US008070108B2

(12) United States Patent
Severson

(10) Patent No.: US 8,070,108 B2
(45) Date of Patent: Dec. 6, 2011

(54) SIGNALING AND REMOTE CONTROL TRAIN OPERATION

(75) Inventor: Frederick E. Severson, Beaverton, OR (US)

(73) Assignee: QS Industries, Inc., Beaverton, OR (US)

( * ) Notice: Subject to any disclaimer, the term of this patent is extended or adjusted under 35 U.S.C. 154(b) by 0 days.

(21) Appl. No.: 12/827,854

(22) Filed: Jun. 30, 2010

(65) Prior Publication Data

US 2010/0330875 A1 Dec. 30, 2010

Related U.S. Application Data

(63) Continuation of application No. 11/505,172, filed on Aug. 15, 2006, now Pat. No. 7,770,847.

(60) Provisional application No. 60/708,864, filed on Aug. 17, 2005.

(51) Int. Cl.
*B61L 23/00* (2006.01)

(52) U.S. Cl. ..... 246/1 R; 246/1 C; 375/238; 375/239; 307/3

(58) Field of Classification Search ..... 246/1 R, 246/2 C, 3, 4, 5, 187 A, 187 R, 34 B, 1 C; 318/280; 104/300, 301, DIG. 1; 340/825.58, 340/825.6, 310.12, 538.11, 825.7; 307/3; 375/238, 239

See application file for complete search history.

(56) References Cited

U.S. PATENT DOCUMENTS

| | | | | |
|---|---|---|---|---|
| 2,349,987 | A * | 5/1944 | Place | 340/825.7 |
| 3,639,755 | A | 2/1972 | Wrege | |
| 4,051,783 | A | 10/1977 | Caliri | |
| 4,293,851 | A | 10/1981 | Beyl | |
| 4,334,221 | A | 6/1982 | Rosenhagen | |
| 4,341,982 | A | 7/1982 | Lahti et al. | 318/51 |
| 4,390,877 | A | 6/1983 | Curran | |
| 4,488,094 | A | 12/1984 | Min et al. | |
| 4,560,909 | A | 12/1985 | Peil | |
| 4,572,996 | A | 2/1986 | Hanschke | |
| 4,584,504 | A | 4/1986 | Lee et al. | |
| 4,591,158 | A | 5/1986 | Samson et al. | |
| 7,210,656 | B2 | 5/2007 | Wolf et al | 246/4 |
| 7,312,590 | B1 * | 12/2007 | Kovach et al. | 318/268 |
| 2006/0100753 | A1 | 5/2006 | Katzer | 701/20 |
| 2006/0284728 | A1 * | 12/2006 | Rubinstein et al. | 340/310.12 |

FOREIGN PATENT DOCUMENTS

WO WO 02/21664 * 3/2002

* cited by examiner

*Primary Examiner* — Mark Le
(74) *Attorney, Agent, or Firm* — Stolowitz Ford Cowger LLP

(57) ABSTRACT

A model train and layout control system based on on-board sound and locomotive modules, new signaling methods, bi-directional communication, environmental sound, turnout control, train location methods, computer interaction and accessory control, by adding components to existing technology. AC power signal waveforms are variously altered to convey digital command words.

11 Claims, 77 Drawing Sheets

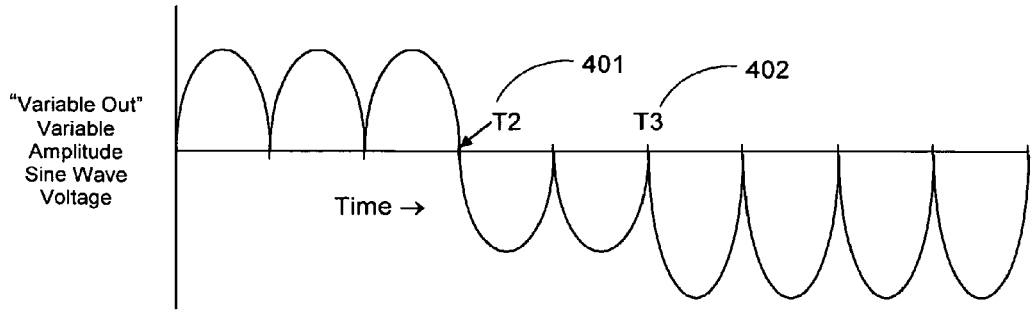
Polarity Reversal "PR"
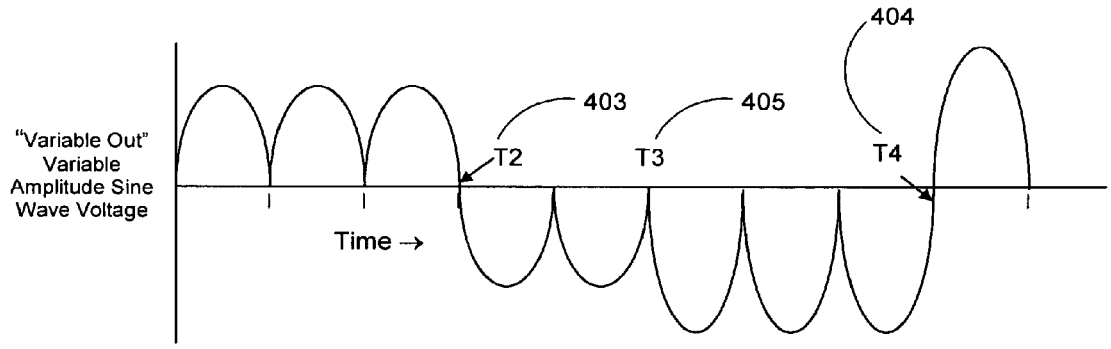
Polarity Reversal Pulse "PRP"
Prior Art
Figure 4

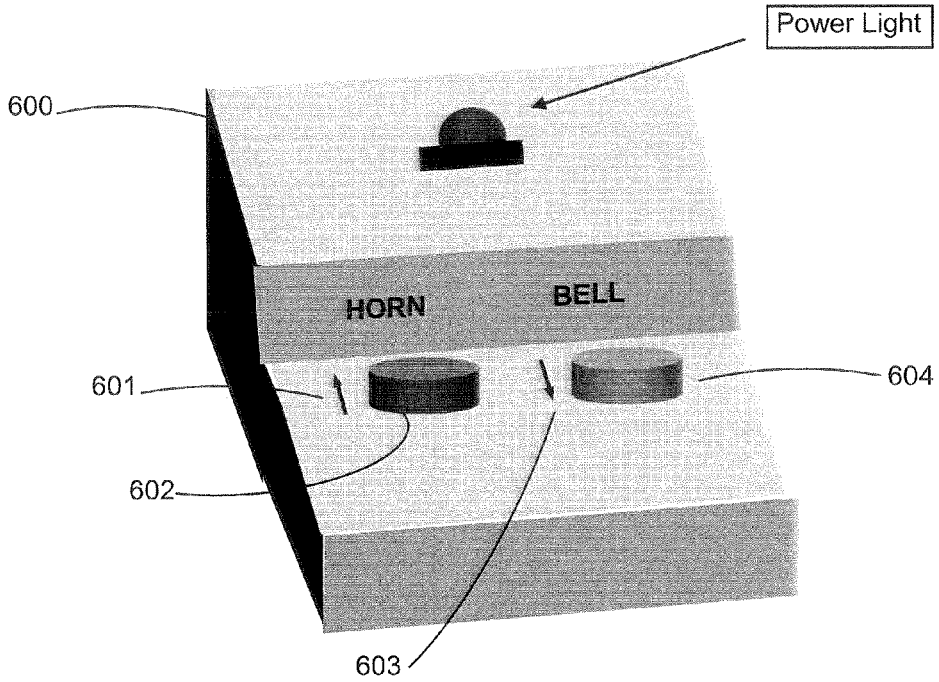
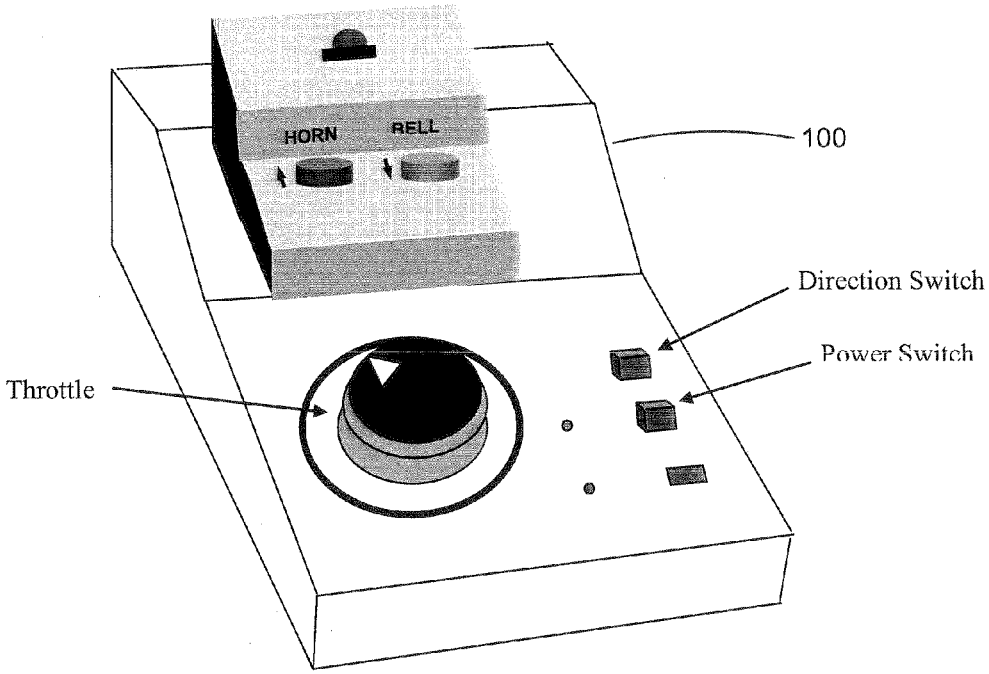
Figure 6

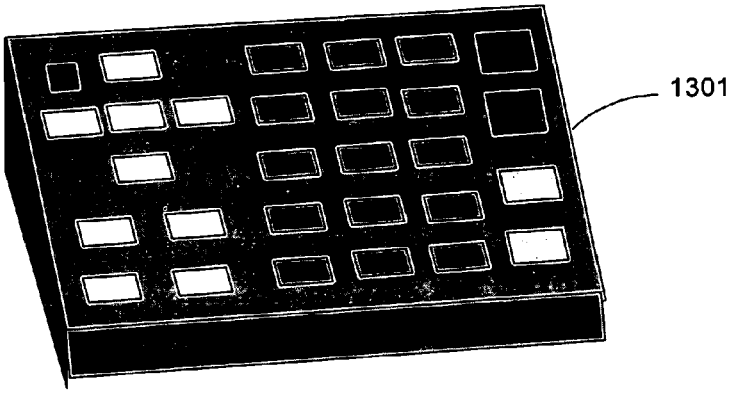
Multi-Button Add-on Controller
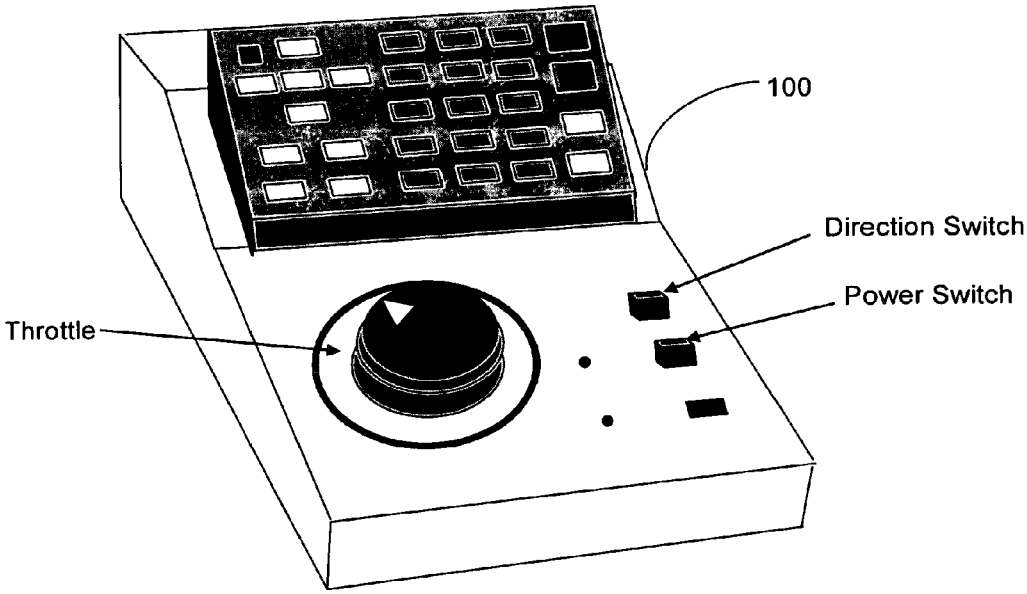
Figure 13

B-B Cross Section

Fig. 16-19 Servo-type feedback throttle

PRIOR ART

Fig. 17-9 Possible complete digital code.

Type 8 Signaling

Type 6 Signaling

Type 7 Signaling

Type 9 Signaling

Type 12 DC Signaling

Type 12 AC Signaling

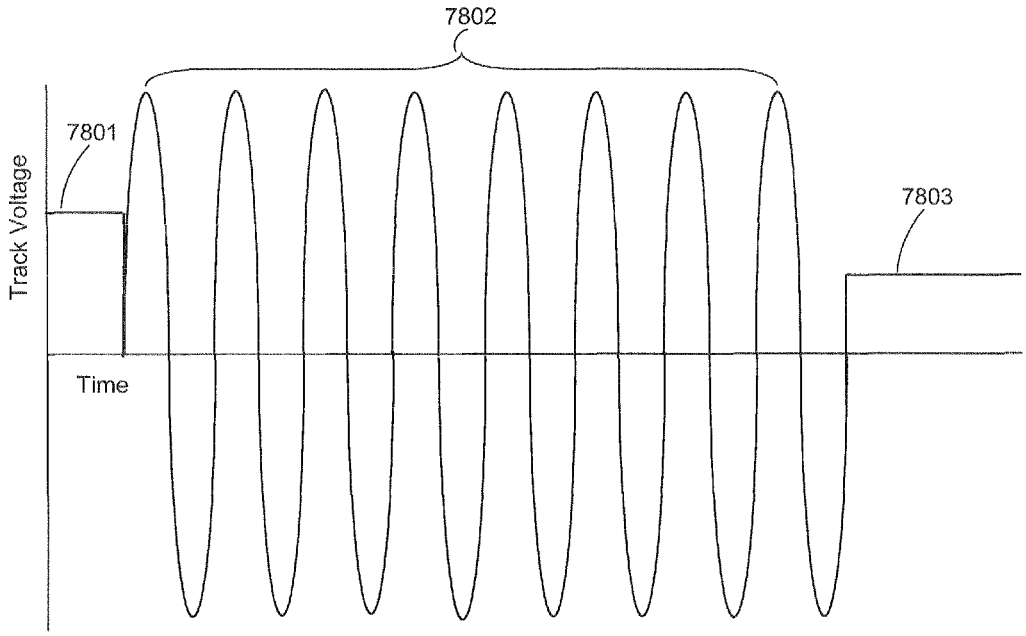
Figure 78
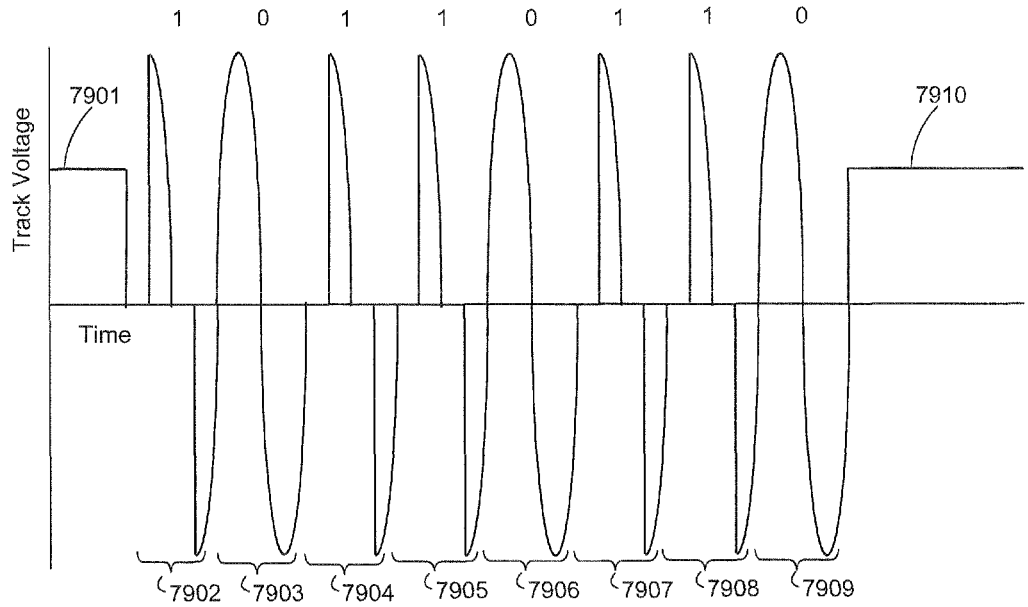
Figure 79 – Type 14 Signaling

Type 11 Signaling

Type 15 Signaling

Type 10 Signaling

Type 13 Signaling

SIGNALING AND REMOTE CONTROL TRAIN OPERATION

RELATED APPLICATIONS

This application is a continuation of U.S. patent application Ser. No. 11/505,172 (U.S. Pat. No. 7,770,847), filed Aug. 15, 2006, which claims priority to U.S. Provisional Application No. 60/708,864, entitled MODEL RAILROAD SOUND AND CONTROL SYSTEM, filed Aug. 17, 2005, both of which are incorporated herein by reference.

BACKGROUND OF THE INVENTION

The model railroading industry is seeing a rapid and almost overwhelming advancement in technology. The introduction of new electronic throttles in the 1960's was the start of tremendous creativity that has touched almost every part of model railroading products including a variety of command control systems, conventional control systems, on-board sound, speed control, accessory operation, lighting effects, computer interaction, website up grades and downloads, bi-directional communication, talking trains, singing trains, on-board cameras, automatic operation, etc. Along with this welcome and exciting creativity, issues regarding compatibility, cost, and obsolescence have appeared. In this rapidly advancing innovative market, the end user can become confused or overwhelmed by the variety and jargon related to these emerging technologies. For many years the motor in all HO locomotives simply connected to track pickup and the power was provided by a variable DC power pack. Making a model locomotive go fast or slow was simply a matter of applying more voltage to the track and changing direction was accomplished by changing the polarity on the track. Today, end users need more than a basic understanding of electricity and electronics. With modern command control systems, they need to understand basic digital technology, signal transmission, programming CV's, trouble shooting motor drives and decoders, ID numbers, etc. Technology has changed so much over that last twenty-five years and has so many contributors that a detailed list of inventions and inventors would take pages. Regarding this invention, a brief description of the relevant subjects and prominent prior art contributors are described below.

Command Control started with Lionel's high frequency electronic set in 1946 to control ten different functions of the locomotive and rolling stock including reversing the direction of the locomotive. There was no real advance in train control until the 1970's when transistor technology opened up new possibilities. A number of viable and commercial command control systems were introduced in the 1980's but serviced a small segment of the market due to its technological complexities and confusion over the variety of methods being sold. In 1994, the NMRA established a preferred method of transmitting digital signals that became the standard for the Digital Command Control in the US.

Command control took a different path for 60 hertz AC powered trains when Lionel introduced their Train Master Command Control (TMCC) system in 1994. This method transmits radio signals to receivers in the locomotives to control speed, direction and features independently for each train. AC powered trains like Lionel three-rail O'Gauge and two-rail American Flyer S'Gauge trains have continued to use the same technology first developed in 1906. Because of their universal AC/DC motors and power pickup methods, AC powered trains require greater power and produce more electrical noise than the more efficient DC powered trains introduced in the 1950's. For this reason, direct transmission of electrical control signals down the track for AC powered trains has been more difficult than for DC powered trains. Although NMRA DCC has been tried with AC three-rail, it has not proved very reliable or popular. The TMCC system avoids the noise problems of AC powered trains by direct radio transmission. QSI has developed a digital transmission method down the track using plus and minus DC superimposed on AC track power to overcome this noisy environment, which is described in U.S. Pat. No. 4,914,431. Later, QSI proposed a command control system using the positive and negative lobes of AC power to transmit digital signals; this method is described in our U.S. Pat. No. 5,773,939. In 2000, MTH introduced their Digital Command System (DCS) with high-speed digital signals superimposed on the AC track.

Speed Control Methods for electric motor control and servo loops to maintain motor speed at a desired setting have been available from the early 1960's. This technology has had many applications both inside and outside model railroading. For instance, this technology was applied to magnetic tape drives by TELIX and Storage Technology Company (STC) in the 70's and 80's and has found popular use for military and computer peripheral applications. A reference book for motor control entitled Electric Motors & Electronic Motor-Control Techniques by Irving M. Gottlieb (1976) describes a number of electronic motor control techniques including servo-based methods. Back EMF and tachometer based feedback servo motor control applications are not new.

The first use I am aware of in model railroading was with servo based Back EMF throttles developed by Paul Mallery in 1983, and also by on Ron Sokol who developed and sold a Back EMF throttle under the trademark: Loggers Supply Company" in the 70's. Mallery in his *Electrical Handbook for Model Railroads*, Vol. 2, described the basic concept of a servo-type feedback control system as follows.

"The most precise method of motor control is to measure speed and compare the voltage representing actual speed with that of the speed control to generate an error signal which then corrects any deviation from the speed desired by the engineer. The essential elements of such a control circuit are shown in block form in FIGS. 16-19. This is a true servo control and requires careful design."

Mallery's FIGS. 16-19 is reproduced here as FIG. 62. Mallery goes on to describe a number of ways that motor speed can be measured including using the motor's back EMF from DC can-type motors. Although Mallery was interested in showing how servo-type speed control can be utilized in a throttle design, the basic concept of motor control can easily be extended to on-board control systems. In this case, the speed reference is set either by an analog remote control signal or by digital transmission of the desired speed reference to the on-board servo system. In particular, the Trix company designed an IC chip for on-board digital control, which included BEMF speed detection and motor speed control in the 1980's. Other companies have produced similar products in the 1990's including Zimo and Lenz Co., which have been selling their Load Compensated DCC on-board controllers since 1996. These decoders allow operators to set any speed they desire for each of the DCC speed steps. Sending data bit sequences down the track to set an on-board speed reference to a desired speed for a servo-type speed control circuit to maintain that desired speed is not new.

Bi-Directional communication: Bi-directional communication is described in Mallery's *Electrical Handbook for Model Railroads, Vol.* 2, for servo-type transistor throttles. FIG. 62 shows Mallory's speedometer feedback of the locomotive's speed to the controller in order to maintain constant speed. Since command control is similar to data transmissions between digital components like between computers and printers and other digital accessories, or between computers and the Internet, etc., it was a natural extension to add digital bi-directional communication to digital command control. In particular, Mallery describes a digital system in his chapter on command control where bi-directional signals are sent from the locomotive back to the cab or throttle. Mallery describes auxiliary commands that might be added to command control as follows.

In FIGS. 17-9, four command pulses are shown as assigned to auxiliary devices such as an on-board sound generator, a unit to turn on, off or dim the headlight and control of uncoupling. The latter would be an enormous benefit on a switching locomotive. Also, as indicated at the right in FIGS. 17-9, spaces can be reserved for pulses generated on the locomotive to send information back to the cab. Among the best uses of such information are the current being drawn, scale speed, an excessive temperature alarm, and cab signals.

Mallery's FIGS. 17-9 is reproduced here as FIG. 63. Mallery makes it clear in his text that the pulses shown in his figures can be binary digital logic pulses.

Bi-directional communication usually means using the same method or type of signaling to send information back to the user or base station. However, other forms of communication can be employed to send back information. This is an important point in model railroading since the track is used for both power and signaling which can create an electrically noisy and low impedance environment that can make signaling from the locomotive more difficult. Therefore different types of signals, other than full voltage DCC type waveforms are often employed to communicate from the remote object (locomotive, rolling stock, turnouts, or accessories) to the base station or user. For instance, the Pacific Fast Mail (PFM) Company in about 1984 used a cam on-board the locomotive to change the impedance of an RF signal transmitted from the base station as the locomotive moved. This information was used to synchronize a chuff sound generated by the PFM sound module to play out through a speaker in the locomotive. In 1988, Lenz DCC decoders used electrical loading by the remote object, as an acknowledgement means where a current increase is detected in response to a query by the base station. In on-board locomotive sound systems developed by QSI in 1991, sound from the remote object was used as a communication medium. In this case, a series of clink or clank sounds were used as a code to indicate the locomotive's status. Later, when more on-board memory was available, recorded verbal messages were used to communicate to the user. Also, in March of 1991, the Trix company was issued a German patent using a motor pulse system to send digital bi-directional communication down the track. In 1993 the NMRA issued a draft Recommended Practice for acknowledgement pulses in operation mode using a 250 Khertz signal to provide acknowledgement on the contents of registers used in DCC decoders in Operation Mode. In 1999, Lionel introduced their Rail Scope™ Video Camera System, which sent back video information from cameras inside the locomotive down the track to a TV monitor at the control center. This provided a view of the layout that would be seen by a miniature engineer in the locomotive. Later Lionel demonstrated their video system with sound as well as video transmitted back from the locomotive. Methods for direct digital bi-communication through the rails has been discussed and documented by the NMRA working group since 1994. QSI's U.S. Pat. No. 4,448,142, column 37, lines 44-60, describes what would be needed to send information back down the track, and in particular mentions the need for "redundant data transmission and error correction techniques". In March of 2000 a frequency based bi-directional system was introduced in Europe. AJ Ireland developed and was issued U.S. patents in 2001 and 2003 on a transponding technique that reports location of locomotives on a layout back to a receiver through a separate network and it does not appear that this information is transmitted back down the track to the base station. On Sep. 16, 2001, Bernd Lenz was issued his first patent on bi-directional communication and received his second patent on bi-directional in February 2005, which was demonstrated recently at the NMRA convention in Seattle in July of 2004 and has been available from the Zimo Company since 2003. The Lenz bi-directional communication current-loop method was formally proposed to the NMRA as a bi-directional DCC standard. Mike's Train House (MTH) introduced their spread-spectrum method of bi-directional communication, using a method long employed in the communication industries. MTH was issued a patent for their method in 2004. To date, no bi-directional communication system has been proposed for analog DC or conventional AC operation other than sending back EMF voltage to the controller.

Down Loadable Software Code and Downloadable Sounds: Downloadable code was available in many embedded system products in the 1980's. In 1985 Microfield Graphics had a graphics card that required the operating code to be downloaded on power up. The development of FLASH memory in 1984 by Toshiba lead to embedded system products in 1988 that could retain downloaded software in system memory. Intel also announced FLASH memory in 1988.

It was a natural extension to employ downloading methods to embedded system within on-board model train electronics. Discussions regarding reprogramming and downloading software began in the late 1980's when microprocessor technologies were beginning to appear in model train products. The Lenz LE130 DCC decoder had pins on the circuit board to allow downloadable code in 1988. The QS-1 on-board sound system by QSI had long term memory that allowed programming through the track of behavioral parameters in 1991. In 1993, QSI filed a patent application (which became U.S. Pat. No. 5,448,142) that discussed downloading via a computer directly to on-board sound systems. In 1994, the NMRA issued a Recommended Practice to download data into DCC decoder equipped locomotives on the track in Service Mode into the decoders Long Term Memory. Also in 1994, North Coast Engineering advertised that their throttles and decoders could be upgraded through programming. As the price of FLASH memory became more affordable, complete downloading of code and sound became possible for model railroad products. In 1984, QSI specified a new Application Specific Integrated Circuit design that had provision for downloading both code and sound into on-board FLASH memory from an external programmer. Since the late 1990's, ESU, a German Company, has provided special programmer products to downloadable code and sounds from a PC directly to their decoders in the locomotive through digital transmission down the rails. Mike's Train House's has a patent on their method of downloading sounds and code directly through the track rails to specially equipped locomotives.

Analog Control: Analog or conventional train control uses variable DC on the track to control the speed of the train for most two-rail model trains or variable 50 or 60 hertz AC to control the speed of most three-rail trains. Power sources for DC are usually described as "power packs" while power sources for AC trains are called "transformers".

The greatest technology advances in model train control have been in the area of digital control to operate remote control features. Different methods were employed for AC powered and DC power trains.

For many years, the only remote control signal for AC powered trains, besides interrupting the power for direction change, was a DC signal superimposed on the AC track power to blow a horn or whistle. In 1984 QSI filed U.S. Pat. No. 4,914,431 which described using the operating state of the locomotive along with applications of positive and/or negative DC voltages superimposed on the AC track voltage as remote control signals to expand the operational capability of conventional AC powered trains.

Lionel had previously used these plus and minus DC remote control signals superimposed on AC track to control only two features, the bell and the horn sounds in the locomotive. QSI introduced an on-board sound and train control product for three-rail AC powered trains called QS-1 in 1991 which also used plus and minus DC signals to operate the horn and bell sounds, but added programming capability, remote coil coupler operation, and a myriad of new remote control features, using the ideas described in QSI's U.S. Pat. No. 4,914,431. The QS-1 system was modified in 1994 for Mike's Train House's ProtoSound system. QSI later added improved versions of their Sound and Train Control system called "QS-2" introduced in 1996, "QS-2±" in 1997, and "QS-3000" in 1999. In 1992, Dallee Electronics designed a Sound and Control add-on unit for AC powered trains and introduced it to AC operators in 1998 as the LocoMatic™. The LocoMatic sends digital information to the train to control the different features under AC conventional control.

Standard DC powered trains were even more limited in operation than AC powered trains. Before the 1990's, the only remote control capability was to change the direction of the locomotive by changing the polarity on the track. In September 1995, QSI was granted a patent (U.S. Pat. No. 5,448,142) for using a Polarity Reversal (PR) and Polarity Reversal Pulses (PRP's) as remote control signals along with the state of the locomotive for feature and train control of DC powered trains. This technique allows us to use standard power packs to control a variety of train control features without requiring the operator to buy additional equipment or learn a complicated new system. The end user could purchase a locomotive equipped with our Quantum electronic sound and train control electronic product, take it home, place it on his layout and be able to control his horn or whistle, bell, direction, Doppler effect, programming of locomotive behavior, etc. all from the throttle and reversing switch on his standard power pack. In addition, these locomotives also had DCC capability for advanced operation using a DCC command station.

The following invention is an extension of this concept of simple control for analog or conventional operation plus related inventions that provide a basis for a complete, simple and inexpensive model train and layout operating environment. This invention provides both backward compatibility as well as forward expandability for the model train industry.

SUMMARY OF THE INVENTION

This invention provides a technology solution to the model railroad environment that allows the user to start with a simple but expanded analog control environment for either DC or AC powered trains and easily advance to full featured operation including computer control and Digital Command Control.

The present invention covers a broad range of model railroading operation with innovative features that allow interaction with locomotives, rolling stock, turnouts, environmental sound, accessories, etc. with simple, easy to understand and inexpensive technology. The focus of this invention is to provide the end user with interactive controls that are a natural part of the model train experience without requiring him to learn complex control systems, while still providing means to expand and use existing and future technologies. This invention also does not require the user to discard equipment he now has.

The first important feature of this invention is a simple yet inexpensive method of sending digital command information from standard DC power packs or AC transformers to model locomotives, rolling stock, accessories, and turnouts for DC analog or AC conventional operation of trains. This is done through simple Multi-Button Add-on (MBA) controllers that modify the power source to send signals rather than add separate signals to the existing power waveform. This provides much more robust signals that will not diminish or loose content over long distances. In addition, our method also minimizes insertion loss to the power waveform and produces very little heat.

Because of the low insertion loss, these analog or conventional MBA controllers can be connected in series, which will allow commands from one controller to pass directly though other controllers to the track and layout. This also allows placing controllers at various places around the layout and also allows for the design of individual controllers for operation of specific accessories, operating cars, turnouts, etc.

In addition, advanced controller designs can include an optional tethered or wireless hand-held throttle with bi-directional communication to allow operation of the different commands at a distance from the power source. This walk around throttle can include an optional display to indicate the different settings and operation parameters of the locomotive or other layout components.

For DC operation, the MBA controllers use mechanical relays to send digital commands through a series of polarity reversals in response to feature control buttons. Relay operation for this FSK method is controlled by a microprocessor (uP) within the Multi-Button Add-on (MBA) controller that easily attaches to most common DC power packs. This method of using Polarity Reversals or Polarity Reversal Pulses of the DC track voltage to send digital commands is called "PRP Encoding".

For AC operation, a similar MBA controller uses a single relay, which can switch the track connection to a pass device and a high-voltage accessory output voltage to produce an AC track waveform that has either a positive or negative DC component. These positive and negative AC voltage periods are used to send digital output commands relying on methods described in our U.S. Pat. No. 4,914,431. This method of adding a DC component to the AC waveform to send digital commands for AC powered trains is called "DC Encoding".

The innovative use of a higher-voltage accessory output when sending DC Encoding commands allows the same throttle power to be applied to the track even though the waveform is being phase-shifted to produce the required DC offsets. This prevents the locomotives from slowing down when commands are sent, which is a common problem with horn and bell controllers for three-rail AC trains under conventional control.

In all models of MBA controllers, buttons are labeled and perform the function indicated. Many controllers for command control use undefined keys that require the operator to program the desired features to operate with the selected buttons. In TMCC, Lionel used an add-on plastic label cover for their Cab-1 buttons to define operation for the different types of locomotives (steam or diesel). We label buttons to operate similar functions for all types of locomotives, with an AUX key in advanced controllers to control special functions that might be specific to certain types of locomotives.

For toggled features, we have also designed our controllers to send different digital codes to turn on the feature or turn off the feature. This ensures that all locomotives in a Consist (a group of locomotives coupled together to provide extra power to pull a train) respond in the same way when a command is sent. We use a single press or double press of a button to send respectively a command to turn on or off a feature. A double-press is performed in a similar manner to a double click with a personal computer mouse. If two single presses occur within some time limit, $\Delta T_1$, then it is decoded as a double-press and a double press code is sent out for that feature. If two single presses require more than $\Delta T_1$, they are decoded as two single presses in a row and two single press codes are sent out for that feature. Having different codes for a double-press and a single-press on a button allows us to design advanced controller cabs that mimic the control panels or consoles of actual locomotives where mechanical toggle switches turn on and off different features. We refer to this type of controller as a Replicab (for replicated cab). Our Replicab would also have more realistic throttles, reversing levers, brake stands, gauges, etc. and may contain the track power supply as well.

In addition we have added a third method to control remote features from the same button besides a double-press and single-press. If the button is held down for over an extended period of time, $\Delta T_2$, and released, a third code is sent out. Since both the single-press and the double-press are done quickly, and since codes are transmitted after the button is released, we can time out how long the button has been pressed. If a single press is over $\Delta T_2$, then a third code is sent out for that feature.

Providing a realistic locomotive console makes the train controller part of the model railroad experience as opposed to standard DC power pack designs that bear little resemblance to the inside of locomotive cabs. Different Replicabs are used for different types of locomotives. Although Replicabs are designed to simulate the inside of prototype locomotives, additional switches and buttons can be discreetly added to perform all the remote control functions on our MBA's or control computer interaction or control of accessories, turn-outs, etc.

Another feature of this invention for DC analog or AC conventional control is a bi-directional feedback technique that transmits from the remote object digital information during AC zero crossings or DC power off periods, where the track impedance is high. This allows useful information to be sent to any of the above controllers from locomotives, accessories, rolling stock and turnouts (all hereafter called remote objects). For instance, information from locomotives regarding their speed, simulated brake line pressure, motor load, remaining simulated fuel or water, etc. could be displayed. In the above-mentioned Replicab controllers, gauges for actual speed, fuel, air pressure, etc. could be on the display console. On future MBA controllers, LCD's or other display means could show different types of information including graphic displays of gauges.

Controller designs can also include a sound system to produce sounds heard inside the locomotive cab such as brake releases, over speed cab whistle, radio orders and crew talk, etc.

These sounds can either be sent directly from the locomotive via bi-directional communication, or respond to information from the locomotive to activate stored sounds in the controllers or direct audio input can be used. This can create a realistic model locomotive cab environment with inputs from scanners, detector reports, dispatcher orders and crew talk. Also prepared verbal orders could be included to increase play value for the train by creating scenarios for picking up and dropping off cars, etc. along with real time communication from other operators. This information could also be transmitted to handheld throttles for audio output through small speakers or headphones. Some of this information could be computer controlled via simple programming by the user using software specific for this kind of operation.

Verbal information can also be used to indicate the status of the locomotive or any remote object. This can also be accomplished by sending status information via bi-directional communication to our sound-based controller to produce verbal cab responses. The status command can be actual verbal information or brief non-verbal digital data sequences. In the latter case, the base unit, hand held with speaker or with headphones could produce appropriate pre-canned verbal responses that can be quite elaborate and realistic simulating radio messages or crew talk. For instance, bi-directional communication or trackside detectors could be a brief non-verbal digital report on the position of the locomotive on the layout. This digital signal would select and play a pre-recorded message at the base unit or hand held describing the locomotive's position as though it were coming from an engineer in the model locomotive cab.

Other canned sounds like passing over turnouts could be simulated at the cab controller since the real sounds on the model railroad would be insufficient or unrealistic even if the sound were transmitted back to the controllers.

With the growing popularity of on-board cameras in the locomotive transmitting back video and audio, video screens can be added to the Replicabs to show the view out the windows of the model train. Pneumatic chairs could also be added to our controllers to simulate the motion of the locomotive. Information regarding motion could be transmitted back via accelerometers, inclinometers, scale speed, and information regarding the track conditions from local trackside transmitters such as going over switches (turn-outs), approaching a grade, etc. Stored parameters or algorithms to produce appropriate pneumatic motion could be stored in memory and applied to the pneumatic chair for different types of terrain such as going over a turn-out. This would be more realistic than reproducing in the pneumatic chair the actual acceleration effects (from sensors like accelerometers) transmitted back to the controllers from the model locomotive or remote object. Models lack the inertia to move like the prototypes.

Many other features can be included in advanced controllers too numerous to list in this summary of the invention which are described more fully in the numerous embodiments.

Advanced MBA controllers could also be designed to do full command control using either DCC, QSI Lobing, or PRP Encoded or DC Encoded transmission. The desired speed would be determined by digitizing the DC power pack or AC transformer analog throttle voltage and sending digital speed commands to the locomotive. In this case, the track voltage would be derived from a constant accessory high voltage output from the power pack rather than the variable output.

This method allows the operator to use advanced MBA's to operate command control locomotives directly from his power pack. In addition, the reverse switch operation on DC power packs could be digitized to perform the same function it had under analog control. The same is true with the Horn and Bell buttons on AC transformers. These could be digitized and a DC offset detected which would then result in a DC Encoded command to be sent out to do these functions.

If the power pack or transformer is insufficient to operate many locomotives in command mode, power boosters can be added to the output of advanced MBA's to provide higher power digital command control outputs to the track. The power pack or transformer could still be used to provide throttle and directional information and the MBA would still provide information on which buttons were pressed. This allows the user to retain his control area design with the power boosters placed out of the way such as under the control area.

The above method of the MBA digitizing the throttle voltage on power packs could also be used to improve analog DC or AC conventional operation. In this case, the MBA would use the AC or DC accessory output voltage from the power pack to generate a different or secondary Analog waveform that would be applied to the track in place of the power pack variable throttle output. This would allow applying a different voltage range in response to the throttle setting. For instance, most on-board electronic motor controllers require a minimum track voltage to be operational. The above secondary waveform would start at this minimum voltage even though the throttle voltage was at zero or at some different value. As the throttle was increased, the secondary Analog voltage would increase in proportion. Digital commands would still be available in this design using PRP encoding for DC power trains or DC encoding for AC powered trains.

Another features of our invention is the use of ID numbers for DC analog or AC conventional control. Our interviews and surveys indicate that the main attraction of command control is the ability to select the desired locomotive without the need for turning on different blocks. This particular feature was favored over independent speed control of different locomotives operating at the same time. Therefore we have included in our advanced MBA's and Relicabs a sophisticated method to select locomotives by their cab numbers and a simple and effective may to make up consists. We have expanded ID numbers past the 10,000 number maximum possibility in DCC to including A, B and C suffixes to correspond to prototype locomotive identification for helpers in a set of locomotives. Also, these A, B and C designators are used to specify types of consists such as "head end", "mid train" and "pushers" to allow these various consist components to be selected and moved around separately.

There are many more features relating to our method of locomotive selection and identification numbers (ID's), which are described in the embodiments.

Another idea central to our invention is Regulated Throttle Control (RTC). Quantum equipped locomotives have two types of throttle control, Standard and Regulated. Both Standard Throttle Control (STC) and Regulated Throttle Control (RTC) will apply more power to the motor as a function of increasing throttle. However, our innovative RTC method includes a motor speed control feature, called Inertial Control, that prevents the locomotive from reacting quickly to minor impediments such as misaligned track joints, tight curves, rough turn-outs, etc. or changes in voltage. A locomotive under STC may come to an unrealistic halt from a raised track joint or a drop in voltage while the same locomotive under RTC, with its Inherent Inertia, will continue at the same speed. RTC operates your locomotive as though it has the mass and inertia of a prototype locomotive; the locomotive will resist changes in speed once it is moving and will resist starting up quickly if at rest. Quantum locomotives operate model locomotives at very slow prototypical speeds without having to adjust your throttle continually to maintain that speed. While small obstacles will not affect the locomotives speed under RTC, a continual opposing force will slow your train down, just like the prototype. For instance, if a Quantum equipped diesel locomotive encounters an upward grade under RTC, it will eventually slow down. Providing more throttle will slowly accelerate it back to speed. The same locomotive under STC would quickly slow down or stop if it encountered an upward grade. The type of throttle control also affects how your locomotive decelerates. Under STC, your locomotive will respond quickly to a reduction in track voltage. Under RTC, your locomotive will decelerate slowly as you bring the throttle down and coast to a long stop just like the prototypes.

RTC in our Quantum on-board sound and train control modules allows us to include a sophisticated braking function in our MBA controllers. Pressing the brakes produces brake sounds and results in the locomotive motor to reduce to idle or the chuff to reduce to a low chuffing sound followed by the locomotive slowing down. Holding the brake button causes more and more braking just like the prototype as more air is released from the brake lines.

Load levels can be increased in either RTC or STC, which results in slower acceleration and slower deceleration and stopping. In addition, RTC is a benefit for our Sound of Power features, which produces more labored sounds as a locomotive accelerates and less labored sounds under deceleration.

The other important component for this invention is that the Quantum on-board train and sound control module can be configured to receive analog PRP Encoding, convention DC Encoding, Lobing, DCC commands and other selected command protocols. Quantum can be designed to operate in analog DC or conventional AC, even at relatively low voltages. Quantum units come in various sizes and power ratings depending on the application and scale of the locomotive. One such configuration is called Quantum Universal Control System or Quantum UCS, which allows for a plug in communication receiver to configure the UCS to any type of popular operating system. For instance, a user could plug in a Lionel TMCC unit or a DCC receiver for radio DCC signals, or any other receiver that can use our connector buss and operating code.

New feature additions to our popular Quantum System will include bi-directional communication for both AC powered and DC powered trains, status response that reports verbally or digitally important operating conditions of the locomotive, steam cylinder cocks for venting steam after a steam locomotive has been idling, drive wheel spin sound effects, on-board calibrated speedometer in scale miles per hour (or scale kilometers per hour) that reports back verbally or digitally for a moving locomotive, rail sanding sound effects, playing the horn or whistle with special ending effects, automatic technique for uncoupling cars over magnets with special sounds, slack action feature with sound effects, variable high chuff rate for shays and other geared locomotives, simple speed curves for analog operation, plus many more features.

Another feature will be a fully playable horn or whistle that will allow the operator to control the amount of simulated air or steam in horn and whistle sound effects in a continuous manner from the controller or hand held throttle. In addition, users will be able to program which chimes they want for their horns to customize the horn to their locomotives or road names.

Other new additions to the Quantum system will include using new smoke generator designs to simulate steam emissions from the steam generator (dynamo), and from or near the decorative whistle while activating the whistle sound effect, or from the steam chests during running, steam cylinder cocks, and steam turret. Cab area smoke would be an occurrence when simulating starting a steam locomotive fire from scratch or when stopping the locomotive without turning on the blowers (steam blowers create a draft to ensure that smoke from the smoke box is vented through the stack).

Also, expanded features will be added by networking other micro-processors in the locomotive to control local features such as an additional uP in the steam locomotive to operate lights, throttle linkage, simulated fire in the fire box, etc. but connected to the Quantum system in the tender to retain control of these additional features.

Yet another feature is our line of Quantum equipped rolling stock where the cars can be operated directly from our MBA controllers or special ancillary controllers that can be added to the MBA's. These automatic cars will each be equipped with power pickups along with speedometers. This will allow the MBA to program the behavior of each car such as volume, ID numbers, operational parameters, etc. The speedometer or motion sensor will allow for a Neutral state with special sound effects (Neutral occurs when the car is not moving), plus automatic or command operated squealing brakes, Clickity-clacks, and Doppler effects. Stock car animal sounds will also respond to the changes in motion from calculations of the progressive derivatives of distance with respect to time (speed, acceleration, jerk and whip) to create more excited or panicked animal sounds.

Many other features are included in the embodiments of this invention that are too numerous to be included here. For instance, the MBA allows for setting ID numbers and selecting turnouts, accessories, trackside detectors, etc. operational windshield wipers, animated rotating fans using LCD displays on the locomotive, automatic moving bell and operating radius rod, reverser and throttle on steam locomotives, reverb and tone control, on-board locomotive operation scenarios, sophisticated lighting control, and a new concept in cruise control.

BRIEF DESCRIPTION OF THE DRAWINGS

FIG. 4 Waveforms for a Polarity Reversal and a Polarity Reversal Pulse remote control signals on variable amplitude analog DC track voltage. (Prior Art)

FIG. 6 SideKick shown attached to a common DC power pack. (Prior Art)

FIG. 13 Multi-Button Add-on (MBA) controller shown attached to a common power pack.

FIG. 78 Waveform from FIG. 82 MBA when relay is connected to the AC accessory output.

FIG. 79 Waveform from FIG. 82 MBA when relay is connected to the AC output where individual lobes of full period AC power are each symmetrically phase shifted by 90°. This is called Type 14 Signaling.

DETAILED DESCRIPTION OF THE PREFERRED EMBODIMENTS

Description of Communication Methods

Signal Types

DC Power Packs and Polarity Reversal Signaling: In our U.S. Pat. No. 5,448,142, Signaling Techniques for DC Track Powered Model Railroads, we describe using two different kinds of remote control signals under DC analog operation: 1) polarity reversals (PR's) where the polarity to the track is changed from its initial condition with a reversing switch, and 2) a polarity reversal pulse (PRP's) where the polarity is first changed and then returned to its initial condition with a Quick or Slow flip and back operation of the reverse switch.

Figure 1:
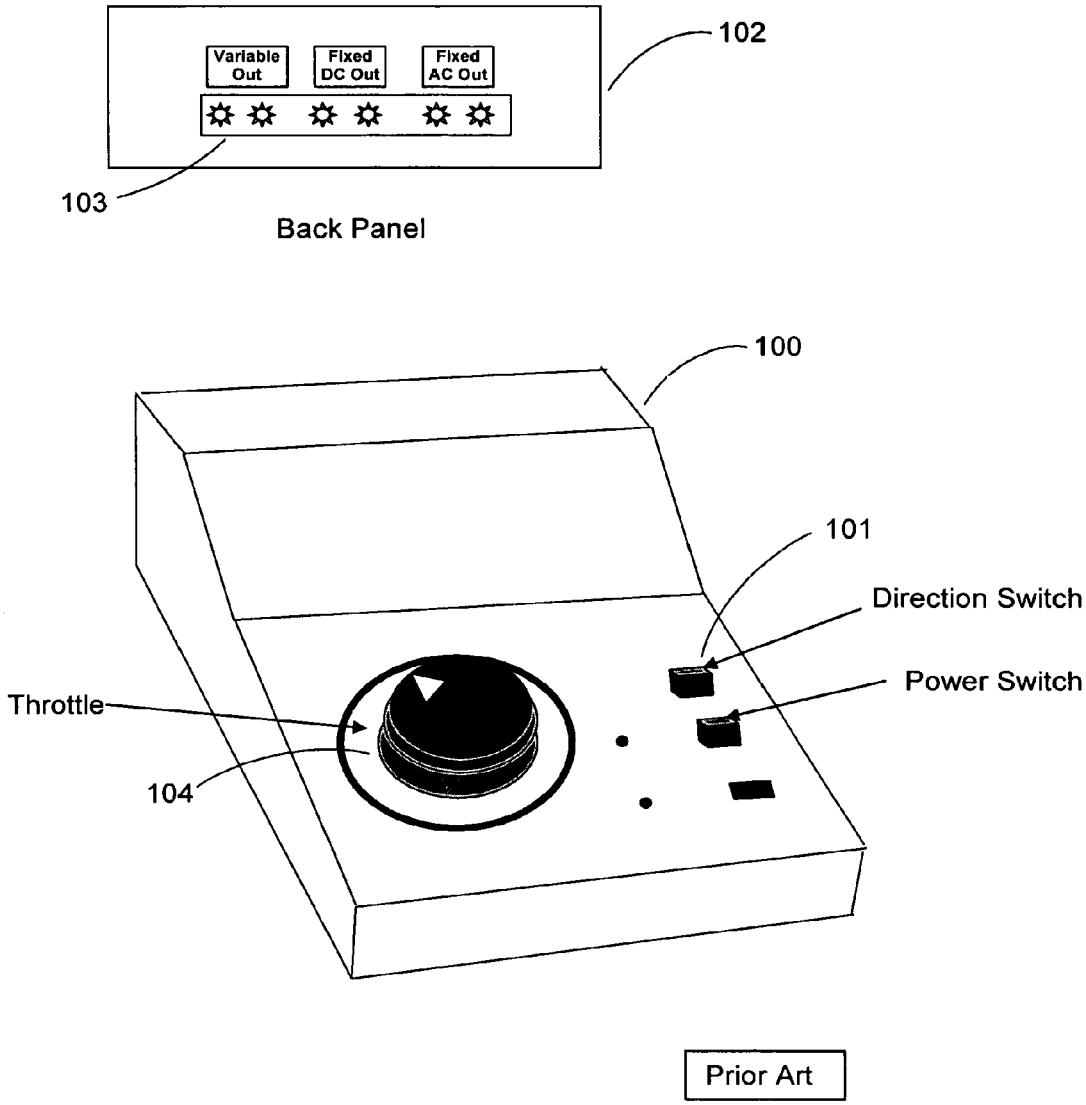
FIG. 1 Common DC power pack (Prior Art).

A typical DC power pack is shown in FIG. 1 with the reversing slide switch, 101. The back panel, 102, shows terminal strip, 103, with three pairs of screw terminals marked, "Variable Out" for the variable throttle output based on the position of throttle knob, 104, and "Fixed DC Out" which produces a fixed DC output voltage for some accessory control, and "Fixed AC Out", which produces a fixed 50/60 hertz AC output, again for powering accessories.

Figure 2:
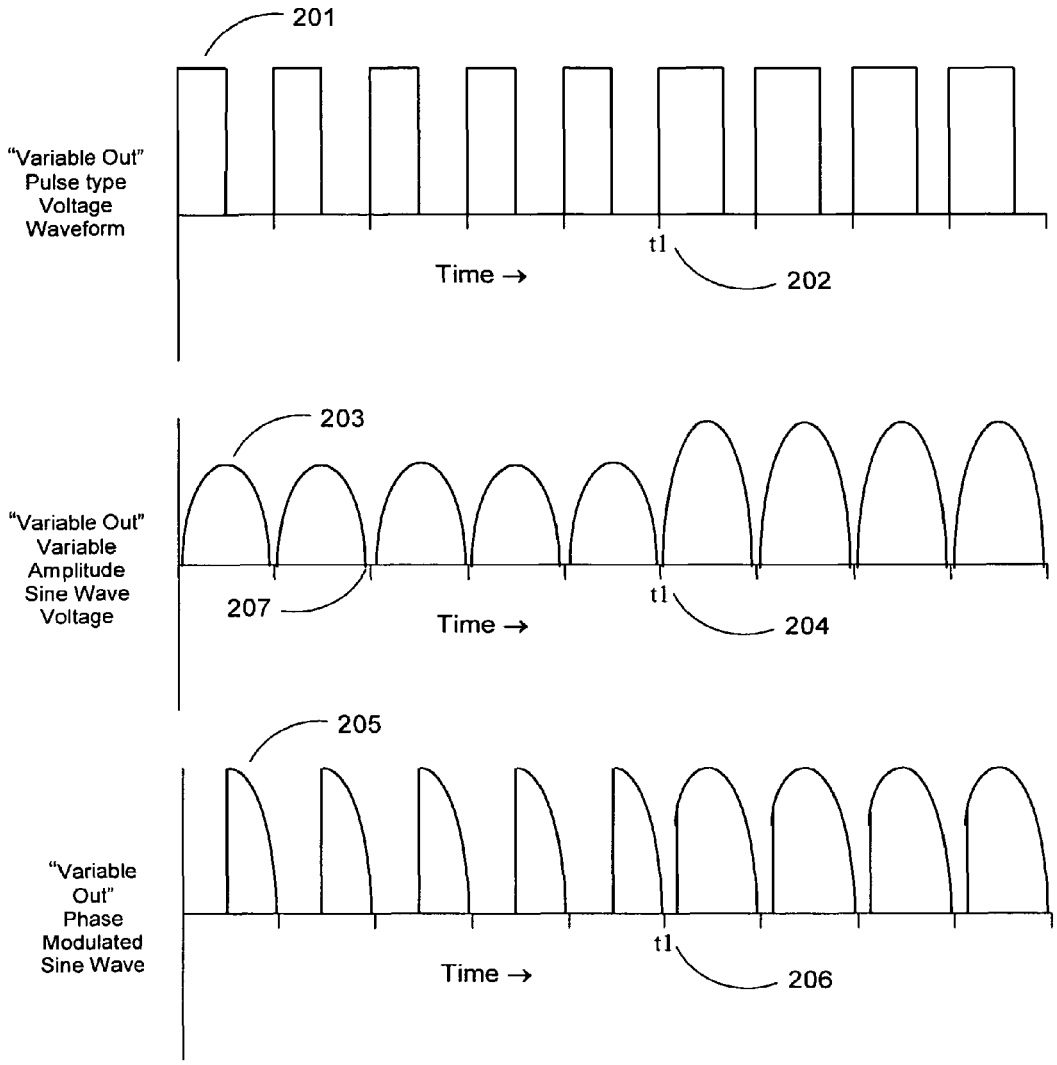
Prior Art Figure 2
FIG. 2 Graphs of different analog waveforms from common DC power packs (Prior Art)

Typical types of Variable Out voltages are shown in FIG. 2. The first waveform, 201, is a pulse type where changing the duty cycle changes the voltage. For instance, the voltage is shown increased at t1, 202, where the duty cycle suddenly increases. The second waveform, 203, is a variable amplitude full-wave rectified sine wave. In this example, the voltage is increased at t1, 204, where the amplitude is suddenly increased. The third typical waveform, 205, is a phase modulated sine wave. In this example, the voltage is shown increasing at t1, 206, where the phase is suddenly increased.

Note that the full wave output for the second waveform has flat regions at zero voltage such as 207. Even though the input sine wave is continuous through the zero crossings, it must reach about ±1.5 to 2 volts to overcome the forward insertion loss of the rectifier diodes before voltage appears on the output of the bridge. The time period for the flat regions also depends on the amplitude of the input sine wave with low amplitude sine waves having a longer period.

Figure 3:
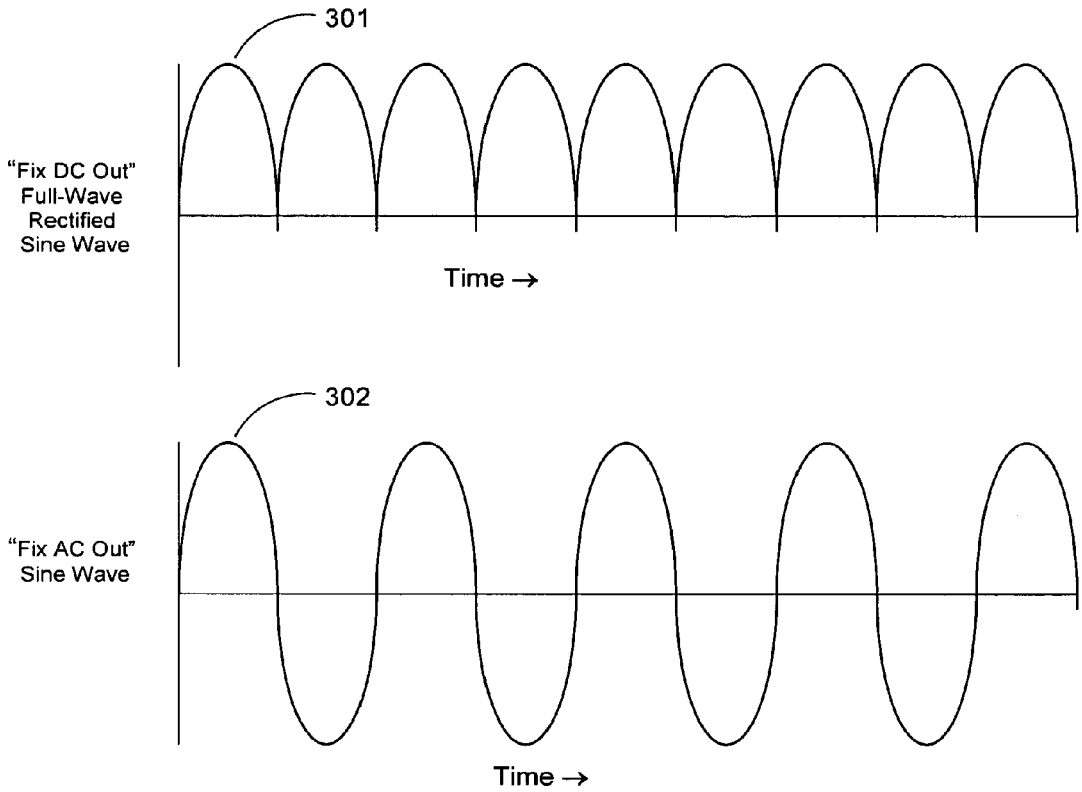
Prior Art Figure 3
FIG. 3 Typical waveforms from fixed voltage accessory outputs on common DC power packs (Prior Art)

Typical waveforms for the fixed voltage outputs are shown in FIG. 3. Fixed DC Out, 301, is a full-wave rectified sine wave while Fixed AC Out, 302, is a fixed amplitude sine wave.

A RP and PRP are shown in FIG. 4, using as an example the "Variable Amplitude Sine Wave" from FIG. 2, 203. In the top waveform in FIG. 4, a Polarity Reversal is performed at time, T2, 401. In this example, the voltage was also increased at T3, 402, which may or may not occur during PR's, since it is dependent on the operator's control of the throttle at the time. In the bottom waveform in FIG. 4, a PRP is performed at time, T2, 403, and terminated at time, T4, 404. Again, in this example, the voltage is shown being arbitrarily increased at time T3, 405, by the operator. PR and PRP can happen at anytime in the waveform. In the examples shown, the PR and PRP are shown beginning and ending at the zero values of the waveform, which is not a necessary condition for a PR or PRP but may be desirable to reduce switching currents.

In order to use PR's and PRP's to control remote control effects, the on-board motor drive is designed to not change the locomotive's direction while it is moving whenever a polarity reversal of any duration is applied. If the operator wanted to change direction, he would turn off the track power, flip the direction switch, and then reapply power, just like HO model railroaders have been doing for years. Whenever power is applied, Quantum equipped locomotives always start in the direction of polarity that is standard for DC powered trains. After power is applied, any PR or PRP will affect some remote control feature depending of the operating state of the locomotive and duration of the PR or PRP.

PR's and PRP's along with the throttle allowed us to operate a surprising number of features using a standard HO DC power pack. In implementing this invention on a Boardway Limited Co. H.O. scale Class A locomotive, we provided the following operating features in our on-board Quantum Sound and Train Control module:

Horn (horn blows while a PR is applied)

Hoot (activates with a long PRP)

Bell (short PRP)

Doppler (PRP for at least 1 second (horn blows and continues blowing for a short time period Δt after polarity is returned to its initial condition), followed by a second PRP within Δt (horn continues to blow after Doppler effect until polarity returned to initial condition)

In addition, we provided the operator with means to program various features:

Enter programming with 3 short PRP's directly after power up (bell turns on, then off, then on again followed by the phase "enter programming" whereupon the bell sound shuts off).

Program Options (POP's) continue to advance whenever a PR is applied with an announcement of each option number. When the desired number is announced, the user returns the polarity to its initial condition (the option name is then announced).

Quick or Slow PRP's are then used to enter and change program options. The user leaves the programming mode by turning off the track voltage and then re-applying track power. If he wants to re-turn to a previous option, he will need to leave programming and start again.

Program Options include:

System volume

Inertia and Regulated Throttle Control (RTC)

Helper Type (Normal locomotive, Lead locomotive, Mid Helper or End Helper)

About Quantum, which describes the software (SW) version, sound set, date, etc.

System Reset

Whistle volume

Bell volume

Chuff volume

Generally, for options that have multiple choices or levels, a Slow PRP will cause the level to increase while a Quick PRP will decrease the level. After the user is finished with changing a programming option, he can advance to higher options by applying a PR and returning the polarity to its initial condition.

The Class A also had a special Neutral state what is entered by reducing the track voltage about 0.5 volts below V-Start. V-Start is defined as the voltage above which the locomotive will leave Neutral. The Neutral state has special sound effects appropriate for a locomotive at rest. PR's and PRP's performed the same functions in Neutral that they did for a moving locomotive with the exception of a Doppler effect.

The idea with Quantum was to provide the analog model train operator with a way to control his locomotive using only the throttle and reverse lever on his DC power pack. This has been very fruitful and most operators are delighted with the possibility of taking their newly acquired locomotive home from the hobby shop and running it with a standard HO power pack without having to add extra components or change their layout in some way.

The Quantum system had the following limitations under analog control as reported by some users:

There are desirable features under DCC that are not available in analog, such as, coupler arm and fire, mute, ID selection, etc. A way needs to be invented that can send simple commands via the power pack to activate remote controlled features.

Although the direction switch on the power pack can be used to send PR's and PRP's, it tends to wear out the switch to do these operations. Also, some users may find it difficult to get the timing correct when using Quick and Slow PRP's.

It is often difficult to know how far to turn the throttle down to enter Neutral, especially if the locomotive inertia is set high. The tendency is to turn it too far down which causes the Quantum system to shut down from low power.

The speed curves for Quantum differ from most standard DC powered locomotives. Because of our derived neutral and the minimum voltage necessary to run the electronics, the Quantum locomotive starts moving at much higher voltage (8-11V) while standard HO locomotives can start out at very low voltages (2-5V).

Even if the speed curves did match up between Quantum locomotives and standard HO locomotives, it is not possible to use PR's and PRP's while the locomotives are moving without the standard locomotive reversing direction and jumping around unrealistically.

Under DCC users report the following limitations:

The in-rush current during start up to charge the filter capacitances can trip circuit breakers in DCC command stations.

The quiescent current is large enough to prevent operation of Quantum equipped locomotives on program t-racks with some brands of DCC command stations.

Bi-directional communication is becoming desired.

There are a number of solutions for the above problems that are part of this invention:

Type 1 Commands: We have previously experimented with using coded horns and bells to provide additional remote control signals. There are two categories for this kind of coding. The first uses horns and bell signals in succession that would make sense on prototype railroads such as — • • • (one long and 3 short whistle blasts) for water refueling on the main for a steam locomotive. This particular whistle signal means "Brakeman protect the end of the train" which makes sense if a train is stopped on the main for water.

— — • — (2 longs, a short and a long) would be used to turn on a crossing bell and produce a clickity-clack sound of wheels over track joints. This particular single is used on prototype railroads to signal automobile drivers and pedestrians that a train is approaching a highway crossing.

Bell with — (Bell on followed by a long whistle blast) is used to arm the station announcement feature. A long whistle or horn is used by some prototype railroads as a signal for approaching a passenger station. Since most locomotives usually have their bell ringing when they come into a station, this particular signal makes sense to enable a passenger announcement feature on a Quantum locomotive.

The signals described above will be called Type 1 Commands.

There are other prototype signals that make sense for other remote controlled features on a model railroad locomotive such as a fuel loading feature, a locomotive maintenance feature, a locomotive shut-down feature and others that can use Type 1 Commands. Using prototype horn and bell signals are easy to do and are part of the play value for the train and provide a method for the model railroader to extend feature control from a standard power pack using only the direction switch. However, there are many other features such as turning on a blower or dynamic brakes, different lights, etc. that would not be associated with prototype horn and bell signals.

Type 2 Commands: Another set of coded horns and bells has nothing to do with prototype operation. For instance, we might use a series of Horn, H, and Bell, B, signals to do the following:

B-B-B opens rear coupler

H-B-H-B turns on dynamic brakes.

B-B-H opens front coupler

B-H sounds squealing brake effect

B-H-B-H turns on blower hiss in a steam locomotive

B-B-B-B mutes the sound system, etc.

where a horn signal is considered a short hoot. In addition, we would limit the allowable time between individual occurrences of bell and horn hoots to prevent normal operation of the train's bell and horn being interpreted as part of the code. This type of signaling is essentially digital codes and are here defined as type 2 commands.

To use type 2 commands, the operator would need a list of codes or he would need to commit them to memory without the mnemonic benefit of having these relate to prototype signals.

Also, because type 2 commands will produce bell and horn hoots that have no prototype meaning for the features that are being activated, they would sound artificial and detract from the model railroading experience. For this reason, we have added the specification that any type 2 code be preceded with a bell signal and we have delayed the bell sound effect from coming on until a long enough period, $\Delta t$, to determine if any other PRP's are generated. If no other signals are forthcoming within this predetermined period, the bell toggles (either ON to OFF, or OFF to ON depending on its current state). If more signals are sent within this time period, $\Delta t$, they are registered and stored as bells or whistles. After a series of bells and whistles have been sent and no further PRP's are sent within a specified time period, the feature corresponding to a set of bells and hoots recorded is executed.

Note that the terminology "whistle" and "horn" mean the same thing. The signal for either is the same but its corresponding sound may be a horn or whistle depending on the type of locomotive (steam locomotive or diesel).

Note: we have arbitrarily assigned the bell to be a logic "1" and a horn to be a logic "0".

The PRP time intervals for a bell or hoot are different with the bell being much quicker. Since some remote control features require close to real-time operation, while others can tolerate longer delays, there are speed priorities for these Type 2 Commands. For instance, a signal for a coupler crash or an activation of squealing brakes should occur quickly to ensure that the event is coincident with the action. On the other hand, turning a smoke generator on or off, engaging locomotive start-up or shut-down effects, or turning on the steam dynamo can tolerate a reasonable delay; in fact, it would be expected on the prototype. Other functions like opening couplers would have intermediate delays. Fast responding functions benefit from more bell signals than hoots.

In addition, Type 2 Commands could be used to select locomotives using individual locomotive ID codes. Locomotive ID's could be set in one of the unused analog programming positions by a series of horn and bell commands. Selecting a locomotive could be done either in programming using another unused option or the ID command could be sent within a certain time interval after power-up. Selecting locomotives could tolerate delays of 2 to 3 seconds as long as transmission of the horn and bell sequences was reliable.

Using Type 1 and Type 2 Commands along with simple PR & PRP's could provide all the necessary operation of a suitable electronically equipped locomotive under conventional analog control, including individual locomotive selection. However, it is expecting a lot for the operator to send Type 2 commands on his power pack, where timing is hard to control; he might miss commands or inadvertently send the wrong command. To take full advantage of Type 2 commands, it is important to add some kind of controller to the power pack to increase command reliability.

The two-button box: To alleviate these problems, we developed a simple two-button controller called the DC SideKick. The top diagram in FIG. 6 shows DC SideKick, 600, with Horn button, 602, and Bell button, 604. The bottom figure shows the DC SideKick, 600, attached to the top of a typical DC power pack, 100. Sidekick connects between the variable DC output of power packs and the track to produce reliable horn or hoots or bell signals of the correct duration.

Besides sending out reliable hoots, horn blasts and bell signals with the correct timing, the DC SideKick product also saves wear and tear on the power packs reversal switch. Also, since the polarity always returns to the power pack normal output polarity when the horn button is released, or after a bell signal is sent, the reversal switch can be used exclusively to do reverse functions and its positions will indicate the direction of travel for the locomotive, as it always has.

Figure 5:
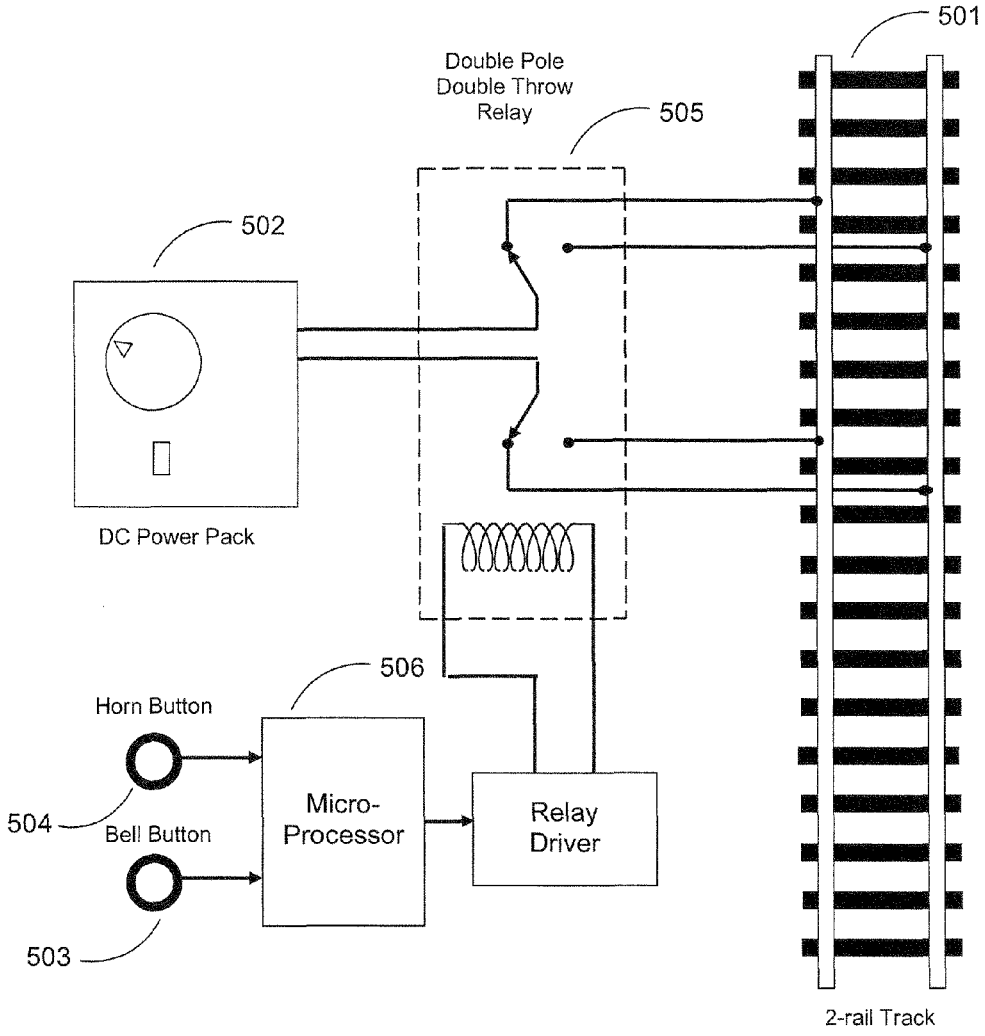
Prior Art Figure 5
FIG. 5 DC SideKick: a two button box for producing Polarity Reversal and Polarity Reversal Pulses. (Prior Art)

The DC SideKick design uses a very simple circuit concept as shown in FIG. 5. Activating the relay, 505, changes the polarity to the two-rail track, 501, to reverse it from that of the DC output from the power pack, 502. Pressing the bell button, 503, will produce a quick PRP suitable for bell operation. A quick tap on the horn button, 504, will produce a PRP suitable for a hoot command. Pressing and holding the horn button will produce a PR for continuous horn or whistle sounds until the horn button is released. In addition, the uP could store in memory a series of user horn and bell operations, and then send out the proper series of PRP's to ensure reliable operation. The user can tap the bell button twice and tap the horn button three times in very rapid succession and wait as the uP sends out bell and hoot signals to produce a 11000 Type 2 Command.

Advanced DC SideKicks could allow simple easy to remember operation of both Type 1 and Type 2 commands. By holding the bell button down while the horn button is tapped a countable number of times and then releasing the bell button would allow selection and transmission of different stored horn or horn-bell sequences.

While everyone can count, this method of sending Type 2 commands could get time consuming for counts exceeding six or seven. This method would probably be reserved for the longer, more complex and difficult to remember sequences of horns and bells that operated popular features. The simple sequences of bells and hoots such as coupler crash sound (2 bells) or brake squeal (bell-hoot) would continue to be coded in by hand.

Programming: The existing SideKick will allow simple programming by pressing either the horn button or the bell button or both and holding it or them down while power is turned on. This sends out a sequence of three bell signals, which starts the program operation in the Quantum Sound and Train Control System. In programming, holding the horn button down allows advancing through the different program options until the desired option is reached and then letting go of the horn button to stop at that option. Pressing the horn or bell button quickly will enter the option where the current setting will be announced by the locomotive. Thereafter, sending bell or horn signals from SideKick will change the option settings. For those options with different levels, the horn button will cause the level to increase while the bell signal will cause the level to decrease. This is shown as the up arrow, 601, next to the Horn button, 602, and the down arrow, 603, next to the Bell button, 604. The up arrow next to the Horn button is consistent with pressing the Horn button to advance through higher POP's in programming. Since the SideKick can remember the number of times either the Horn or Bell button is pressed and released (tapped), it is easy to move through the different levels by a known amount. If the user wants to increase six levels in system volume, he simply taps the Horn button three times while in POP 1.

It would be an improvement in the DC SideKick to add an LED or LCD display to allow the user to select the desired level setting at any POP. However, since SideKick does not know the current setting in the Quantum System, this will not work. However, it maybe possible for SideKick to select a user entered POP number. One method is for the user to press and hold the Horn button while SideKick rapidly counts ups and displays the POP number on the LCD or LED readout. Once the desired number is selected, a continuous PR of the correct duration would be applied until the Quantum locomotive reaches the same POP number and the PR is returned to its initial condition.

This method can work because the Quantum system always starts at POP 1 when programming is entered so it is not difficult for DC SideKick and the Quantum equipped locomotive to start at the same POP number. And, it is always easy to get back in sync by reentering programming with both the SideKick and the Quantum system. However, depending on timing, using a continuous PR to advance POP's may not always result in the same POP for both DC SideKick and the Quantum Locomotive, particularly for large POP values where a PR must be applied for a longer period. In addition, early editions of Quantum locomotives allow the POP's to wrap back to POP 1 once the highest installed POP number was exceeded.

Figure 7:
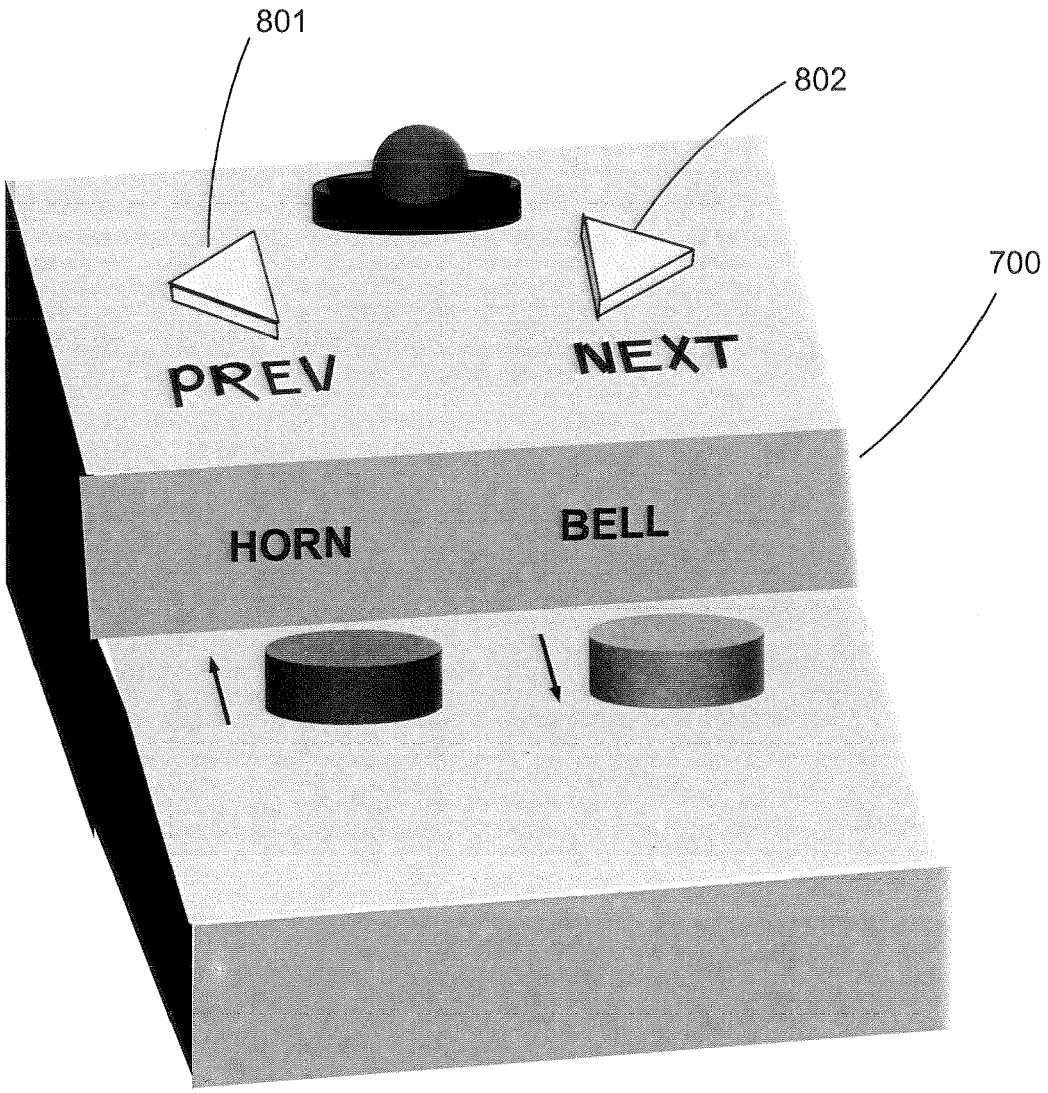
FIG. 7 Advanced SideKick with analog programming buttons added.
Figure 8:
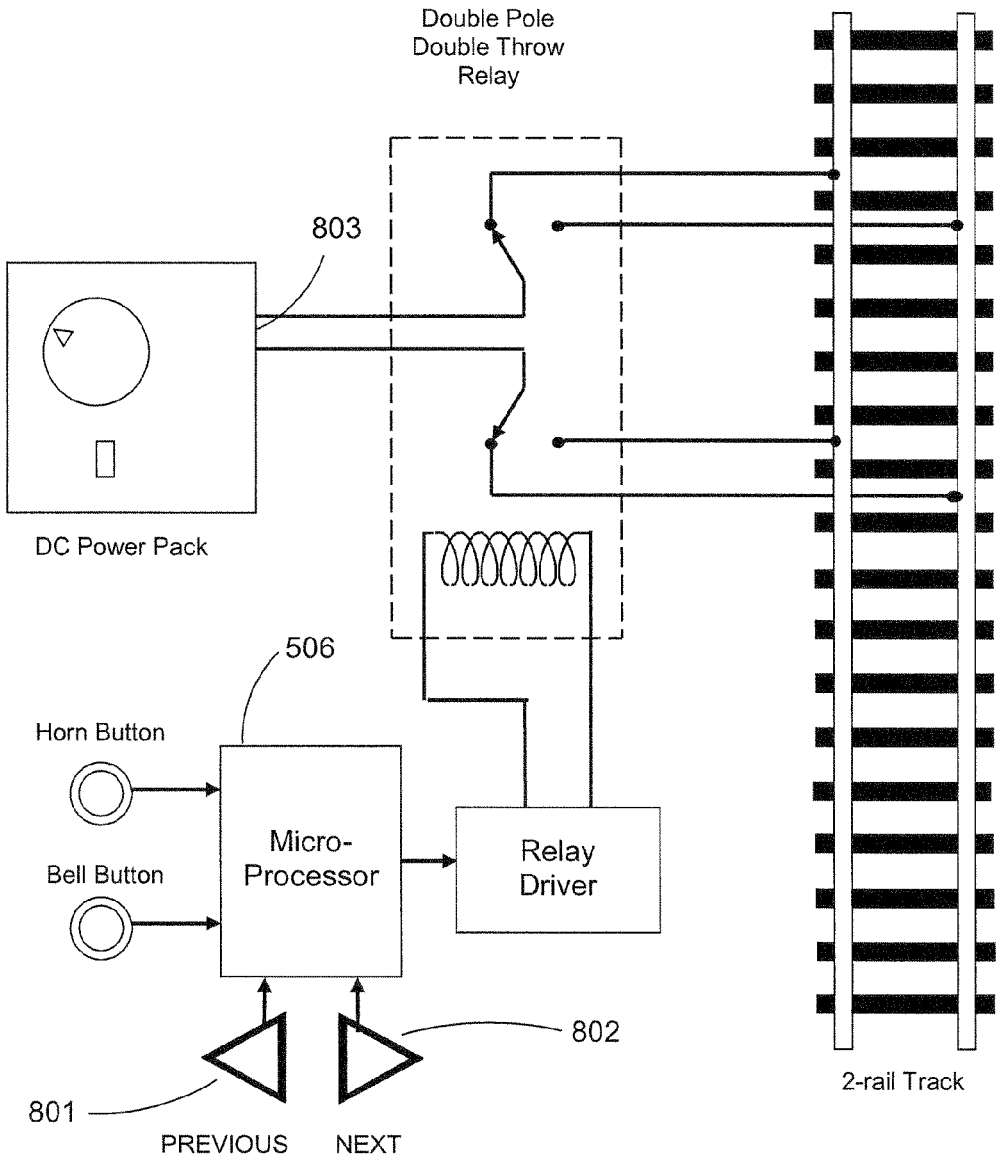
FIG. 8 Block diagram for an advanced SideKick design.

Here Type 2 signaling can be added to SideKick and advanced controllers as programming commands to overcome some of the limitations in the programming method described above. For instance, Type 2 signaling can:

Select between advancing or reversing the direction of moving through Program Options (POPs). A bell-hoot-bell could select going forward and a bell-hoot-hoot might select going backwards. Thereafter a PR would continue to count through the options, whether forward or backward, depending on the forward/backward selection. In addition, the forward/backward selection could be used to move to the next selection or go backward one position. On the advanced DC SideKick controller, two additional buttons could be used to make selecting options very easy. FIG. 8 shows were a "PREVIOUS" button, 801, and a "NEXT" button, 802, have been added with inputs to the microprocessor, 506. These same buttons are shown in FIG. 7 and labeled "PREV" and "NEXT" on advanced Sidekick, 700.

If the "NEXT" button is pressed once, Quantum would advance one POP position. If pressed twice, it would move two positions (POPs) forward. If pressed and held, it would continue to count forward. On the other hand, pressing the "P REV" switch would cause the Quantum system to go back one POP and so on.

An LED or LCD number display could now be added to the DC SideKick or advanced controller to indicate the POP number. The user could use the NEXT and PREV switches to advance or decrease the display numbers quickly and once he let go of either button, DC SideKick would generate a Type 2 command to directly select the indicated POP number automatically. This would extend the required number of Type 2 command codes to include all the POP numbers available.

The use Type 2 codes for a "Next" or "Previous" operation or for each POP number is an advantage when addressing POP's for many locomotives at once such as a consist of locomotives. Because of timing differences in locomotives, a continuous PR may result in a different POP being selected when the PR is stopped, particularly for high POP numbers.

New Quantum Systems can be designed to accept Type 2 signaling but should also accept a PR as a way to advance reset options in order to work with standard power packs and with older SideKicks. We have added two conditions to how new Quantum locomotives will advance POP's to ensure consistent behavior and provide more freedom to design advanced controllers.

Pop's should not loop back to POP 1 if the highest POP is exceeded.

New Quantum Systems can be designed to accept Type 2 signaling but should also accept a PR as a way to advance reset options in order to work with standard power packs and with older SideKicks. We have added two conditions to how new Quantum locomotives will advance POP's to ensure consistent behavior.

Figure 9:
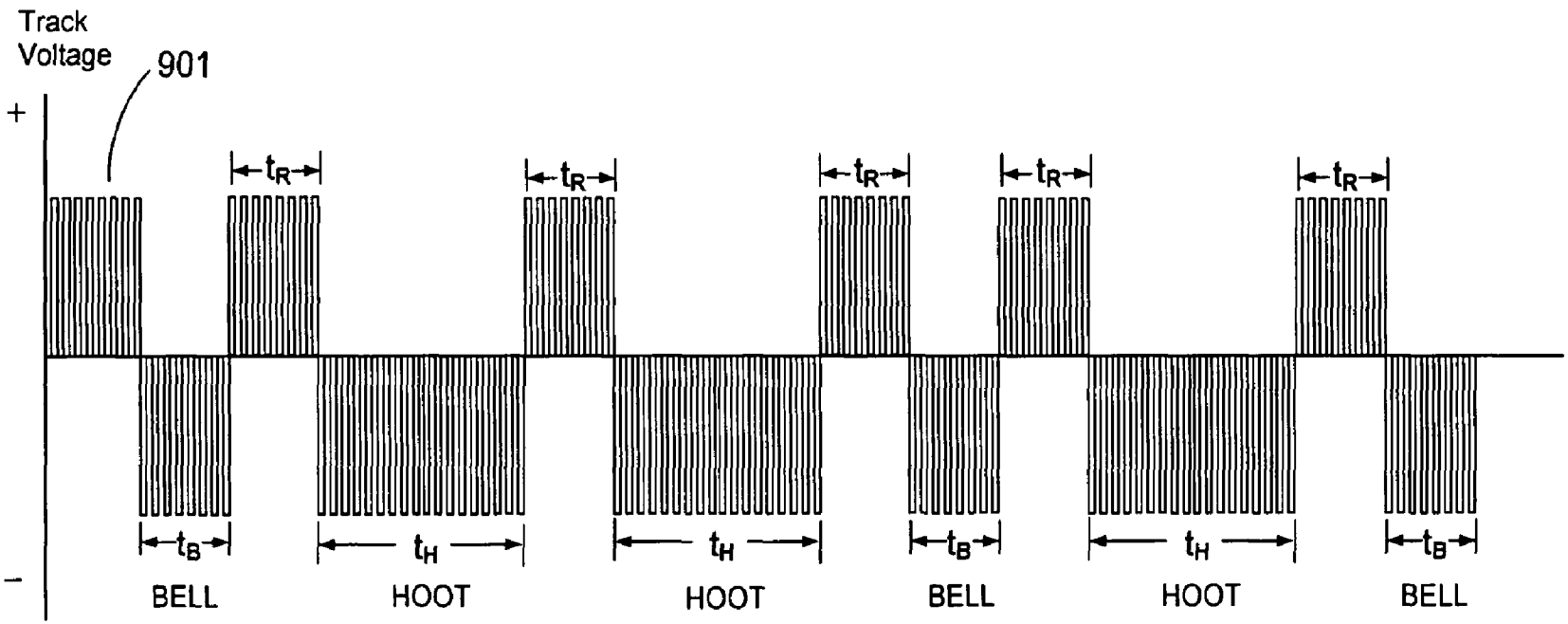
FIG. 9 Waveform of Type 2 signaling.

Improvements in Type II Signaling: We normally do a short PRP for a bell and a slightly longer PRP for a hoot. Type 2 signaling proposes sending a series of bells and hoots as digital signals as illustrated in FIG. 9. In this Fig., for illustrative purposes, the output from the power pack was chosen as the "Pulse Type Voltage Wave Form" shown in the top diagram of FIG. 2 and is represented here as a very dense series of pulses (at 50% duty cycle). However, any type of DC waveform could be used for this discussion. The PR and PRP's are shown as periods where these pulses are going between zero to negative rather than between zero to positive. The first series of pulses, 901, represents the initial polarity condition of the track voltage before any PR or PRP's are applied. The PRP period to toggle the bell is shown as $t_B$, the PRP period to activate a hoot is $t_H$, and the time needed to recover normal operation before another PRP is shown as $t_R$. In the diagram, $t_R$ is shown about the same time as $t_B$, which is equal to or greater than our minimum detection time for a PR. Also, for illustrative purposes, a PR is shown occurring at the end of a power pack output pulse rather than at some intermediate point. However, a PR transition can occur at any time unless there is a good engineering reason to prevent this, such as excessive electrical noise or reliability issues from high switching currents or inductive voltage spikes.

Figure 10:
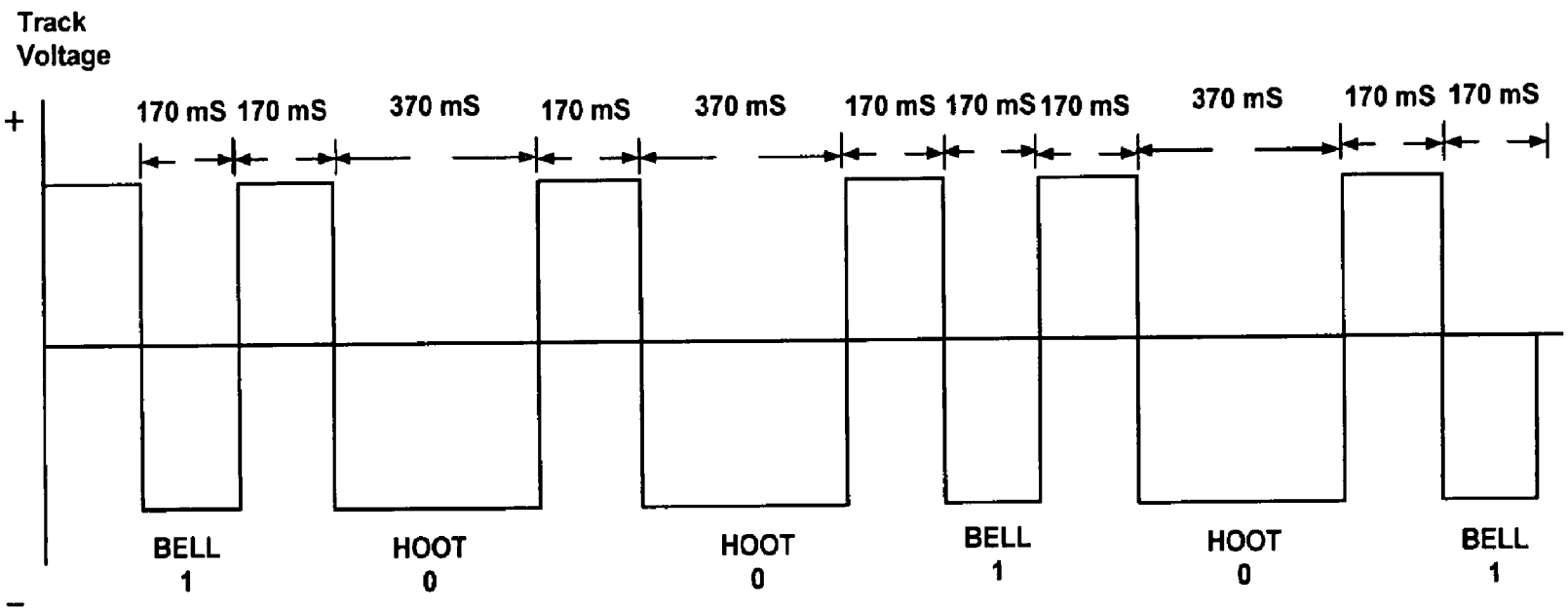
FIG. 10 Envelop of Type 2 signaling waveform.

The diagram in FIG. 10 shows the same series of bells and hoots except the PWM (Pulse Width Modulated) track waveform is left out and replaced by its envelope. Also shown are the PRP times of 170 ms for $t_R$ and $t_B$, and 370 ms for $t_H$ which represents our best engineering choice based on our current hardware and software limitations and it no way represents a limitation on these time periods.

In this example a Bell PRP is considered a logic 1 and a Hoot PRP is a logic 0. For the series of PRPs shown in FIG. 9 and FIG. 10, this command is a binary (1,0,0,1,0,1). However, for Type 2 signals, we use a Bell PRP as a start bit, as described earlier. Therefore, this command is represented by the five bit word (0, 0, 1, 0, 1), not six bits.

Based on the 170 ms and 370 ms PRP time periods, this command would require 2.47 sec to send, plus some timeout period, $t_D$, greater than $t_R$ to know that the data sequence was complete. For a reasonable time period of 200 ms for $t_D$, it would take 2.67 seconds to send this five-bit word. For digital commands that average 8 bits each, the worst case time for all 0's is 4.52 seconds, the best case for all 1's is 2.92 seconds with an average for all possible digital 8-bit words at 3.72 seconds. This would be an unacceptable delay time for the operator to wait for a simple command such as "open the rear coupler".

Figure 11:
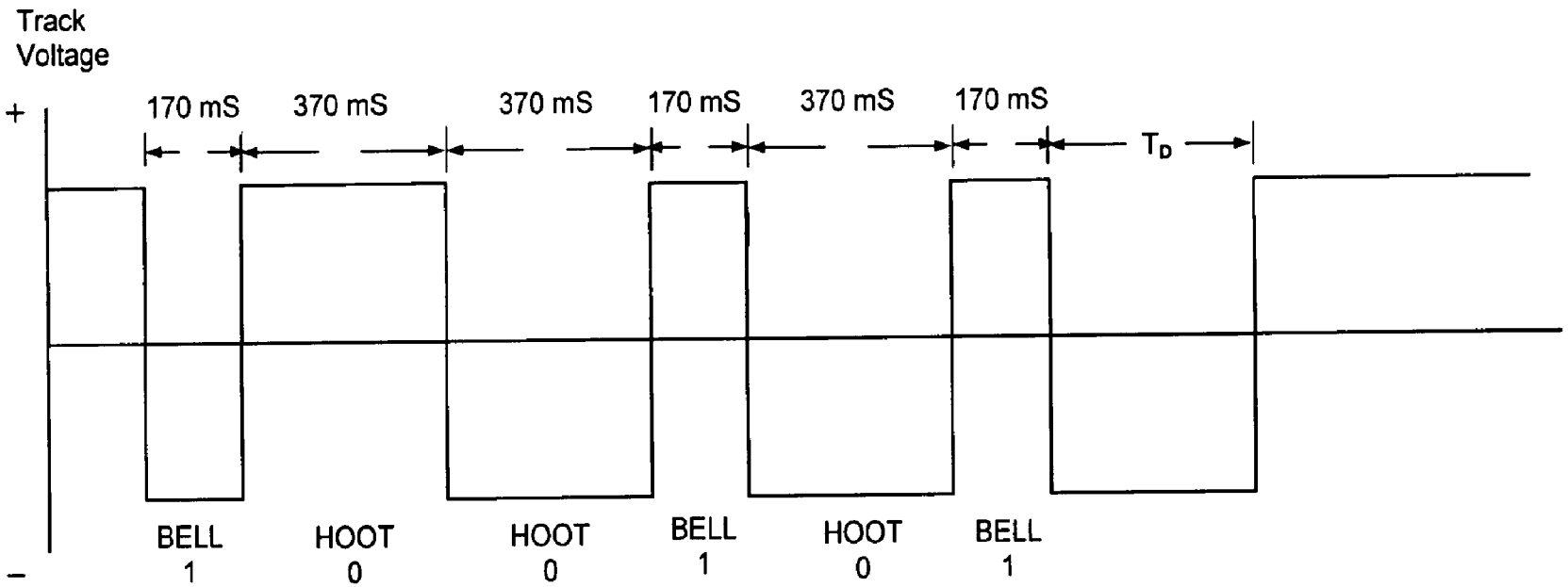
FIG. 11 Envelop showing Type 3 signaling—an improvement over Type 2 signaling.

Type 3 signaling: A better approach would be to avoid the $t_R$ period altogether as shown in FIG. 11. In this case, we time out each PRP to determine if it is a Bell, $t_B$, or hoot, $t_H$, time period. Note that at the end of the sequence, the waveform must remain in its last polarity setting for a time, $t_D$, that is longer than either $t_B$ or $t_H$ in order to not be detected as another bit. This method would reduce the time for the same 5 bits to 1.82 seconds assuming 200 ms for $t_D$. To send 8-bit words, the average would be 2.53 seconds with a worst case of 3.23 sec (all 0's) and a best case of 1.73 (all 1's).

The $t_D$ delay time and the need to return to base line (initial non-polarity reversed condition) can both be eliminated by always sending a word with fixed number of odd bits. This way, it is known that the data sequence is complete when all bits are received and there is no further time delay to return the last date bit to base line.

Figure 12:
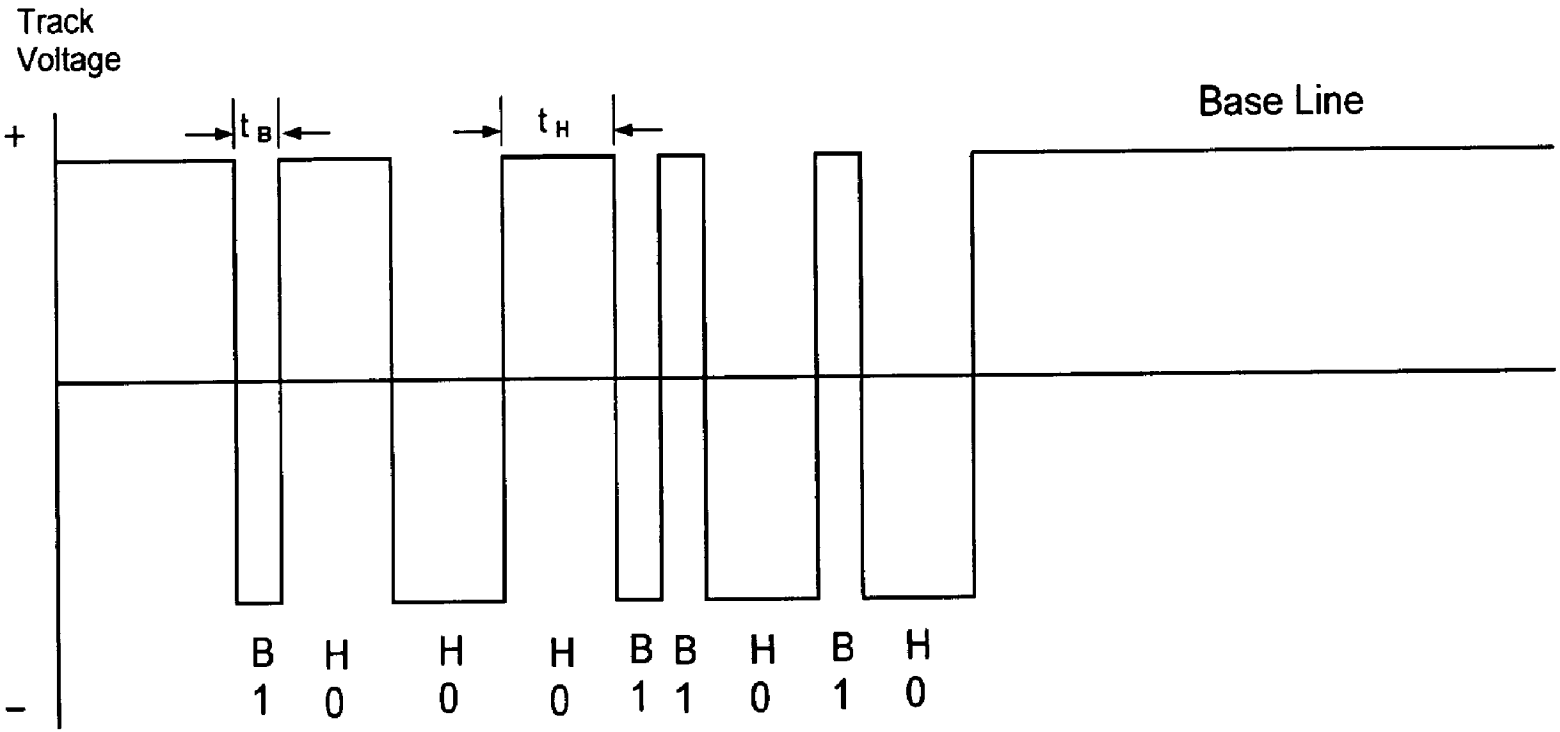
FIG. 12 Envelop showing an improvement in speed for Type 2 signaling by eliminating the end of word time out.

In FIG. 12, we start with a bell or "1" bit followed by the eight bit word (0,0,0,1,1,0,1,0). For an 8-bit word, we save the 200 msec for the end of word time out, $t_D$, which gives us an average transmission time of 2.33 seconds with worst case at 3.03 sec and best case at 1.54 sec. This new Type 3 signaling is almost 40% more efficient than sending a series of bell and hoot signals for an eight bit-word. However, the time required is still too long for an operator to wait for a simple operation.

Controller for Sending Type III Commands: The above Type 3 signaling is not based on our method of sending a series of Bell and Hoots described in QSI U.S. Pat. No. 5,448,142, and could not be easily done by modifying our DC SideKick system, which was only intended to send Type 1 and Type 2 commands. Since Type 3 signaling is different, we are not restricted to maintaining the Bell and Hoot timings used above and can develop hardware that not only increases the data rate but also provides the operator with multiple feature buttons that send specific codes to operate different effects. Our Base Station called "MBA" for Multi-Button Add-on controller that can be attached or used with existing DC power packs in a similar manner to the DC SideKick. Such a controller, 1301, is shown in upper drawing of FIG. 13. The lower drawing shows the controller, 1301, attached to DC power pack, 100. The buttons are not defined in this drawing but will be described in the various embodiments of this invention later in this patent specification.

Figure 14:
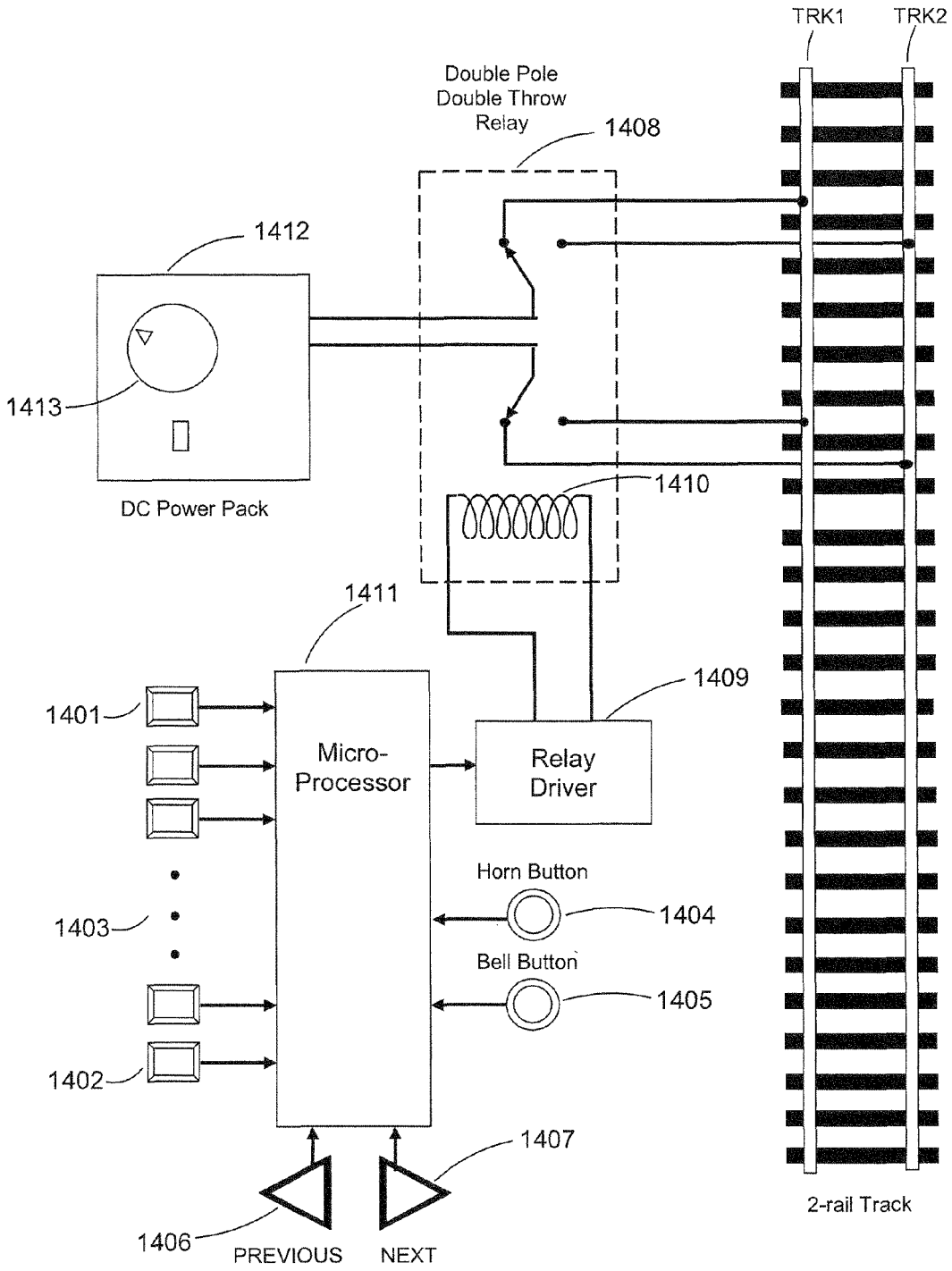
FIG. 14 Block diagram of an MBA.

The basic hardware configuration for the MBA controller is shown in FIG. 14. Here a large array of buttons or switches, 1401, through, 1402, indicates many inputs to the microprocessor for controlling features. The dots, 1403, indicate that the number of buttons is not defined in this diagram. The Horn button, 1404, and Bell button, 1405, and programming buttons, Next, 1407, and Previous, 1406 are retained from the DC SideKick and perform the same functions but may use either Type 1, Type 2 or Type 3 signaling.

We show using a double-pole double-throw relay, 1408, under uP control through relay driver, 1409. The purpose of this relay is the same as the DC SideKick; it is used to produce PR or PRP signals. However, it will operate differently under uP control to send Type 3 signals.

+DC is normally applied to TRK1 and −DC applied to the track second rail, TRK2. When the relay driver (turns on) the relay coil, 1410, the relay activates and changes the double-pole, double-throw switch to apply +DC to TRK2 and −DC to TRK1, thereby affecting a polarity reversal to the track (PR)

Figure 15:
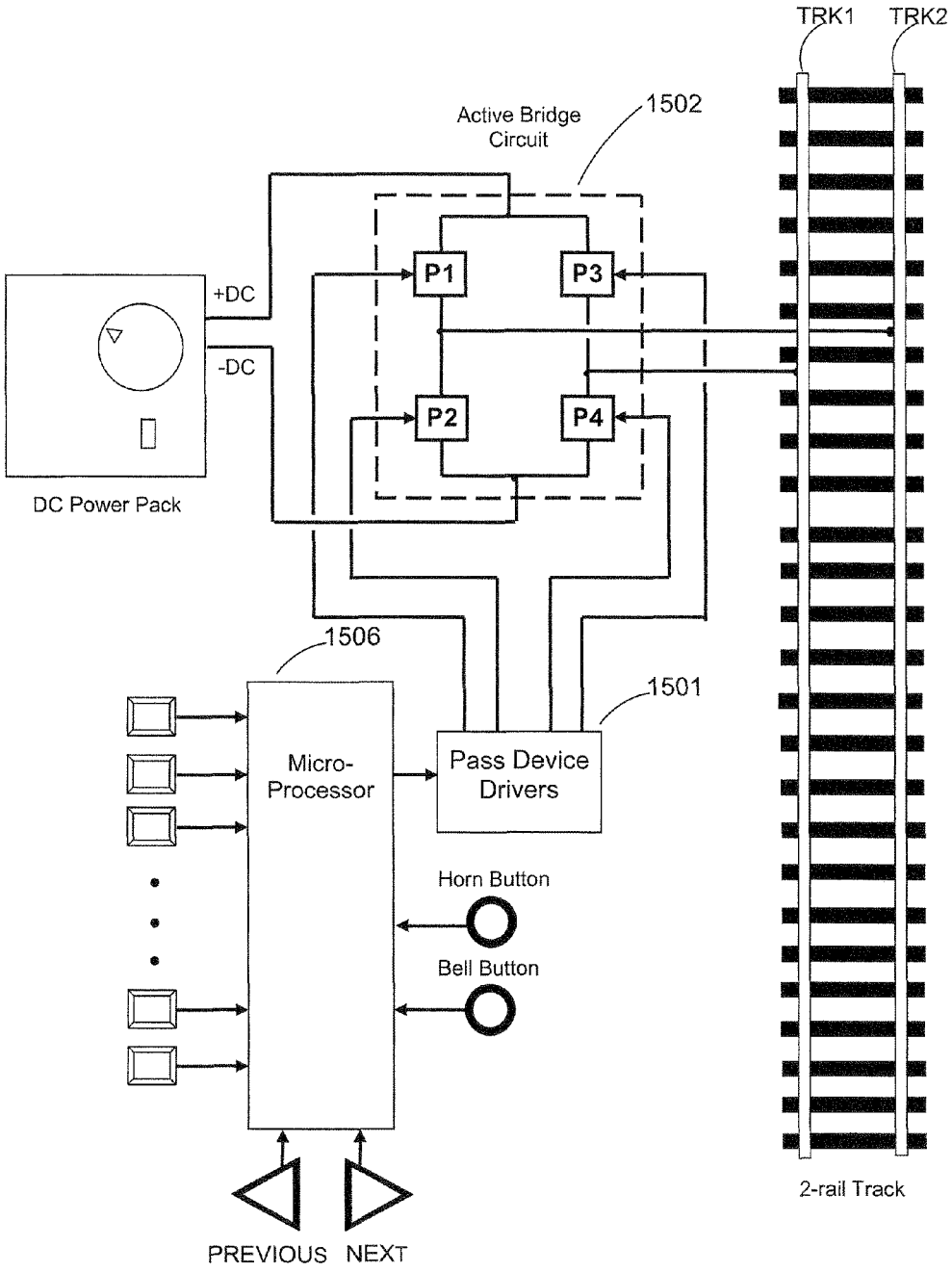
FIG. 15 Block diagram of an alternative MBA design using an active bridge instead of a relay.

We could have used an active bridge circuit, such as 1502, shown in FIG. 15, to produce PR and PRP. Here P1, P2, P3, and P4 represent pass devices that are controlled by the driver circuit, 1501, which in turn is controlled by the microprocessor, 1506. This active bridge circuit is common for motor control and is familiar to anyone skilled in the art. The pass devices can be pnp and npn transistors or power FET's. When P3 and P2 are turned on (conducting) and P1 and P4 are turn off (non-conducting), then +DC is applied to TRK1, and −DC is applied to TRK2. When the microprocessor turns on P1 and P4 and turns off P2 and P3, +DC is applied to TRK2 and −DC applied to TRK1, thereby affecting a polarity reversal to the track (PR)

An active bridge has advantages but for an add-on product like our MBA's, relays are a better choice for the following reasons:

There are no complex biasing circuits for pass devices, P1-P4, that often need to move up and down with the applied input voltage, VPK.

Relays are more immune to damage from spikes and surges in track voltage than electronic pass devices.

Relays can take large currents without overheating.

There is very little voltage insertion loss from relay contacts where electronic devices can have larger insertion loss, which can vary with the input voltage, VPK.

There is no possibility of a short circuit that can happen with bridge circuits made from active pass devices such as the one shown in FIG. 15. For instance, if for some reason, P1 and P2 happen to be on at the same time and/or P3 and P4 happen to be on at the same time, there is a direct short circuit between +DC and −DC. This can happen if pass devices get too hot and continue to conduct even with their gates or bases biased to shut off, or a device gets damaged and becomes a short circuit or the microprocessor (uP) gets confused and turns the wrong devices on. Relays cannot produce a short circuit since the relay moveable contact arm cannot physically be at two throw positions at the same time.

Figure 16:
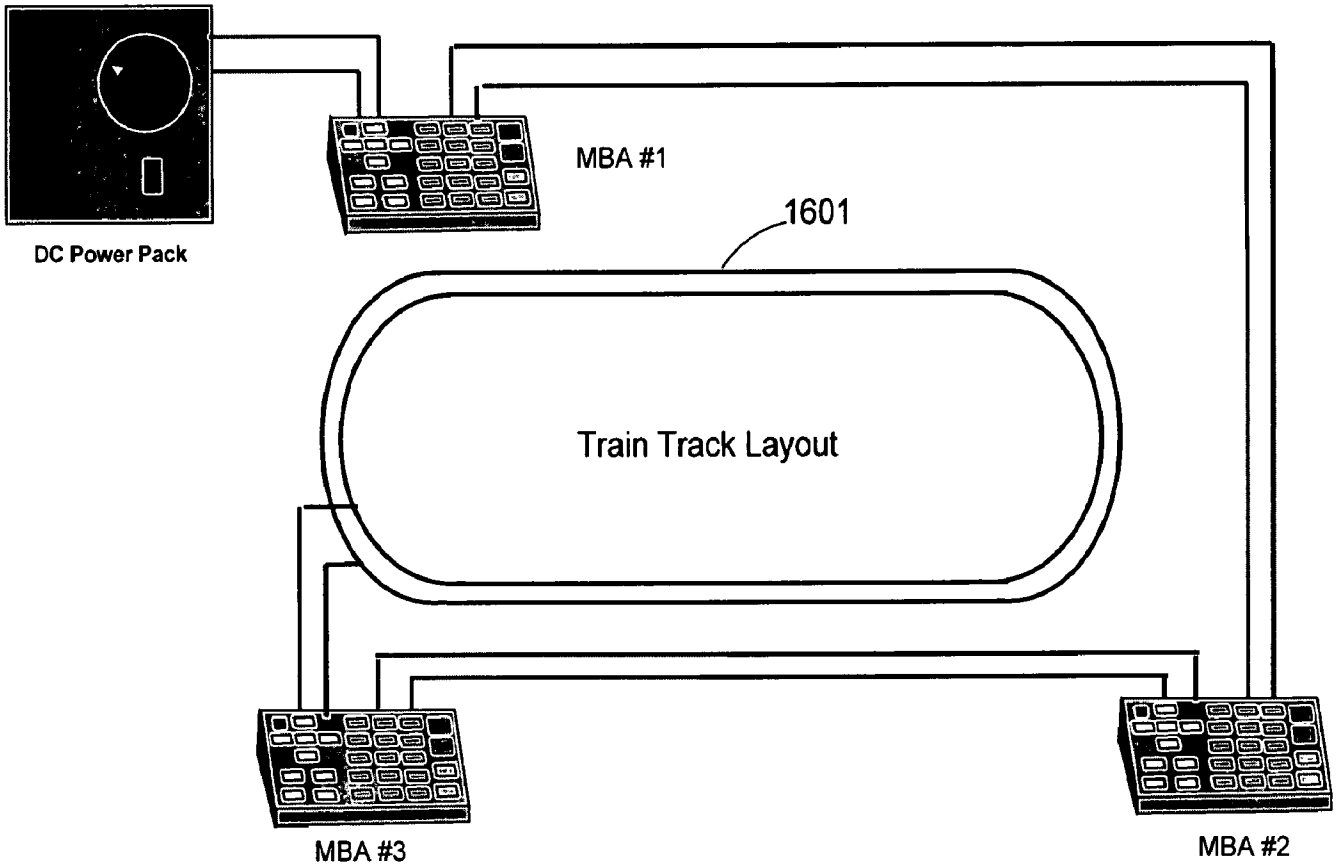
FIG. 16 Diagram shows how a number of MBA using relays can be wired in series to provide control at different parts of a layout without signal loss.

Relays do not care which polarity is connected to the two poles ($+V_{PK}$ or $-V_{PK}$). This is an advantage if this circuit is connected to an existing power pack where the output voltage, $V_{PK}$, can have either polarity depending on how it was wired or what positions the power pack's reverse switch is in Being independent of input polarity of $V_{PK}$ and having very little insertion loss allows MBA's using relays to be connected in series with other units and still allow commands to be sent by any base stations. For instance, consider three MBA's, #1, #2 and #3 in FIG. 16. All three are connected in series and placed at different places around the layout. Any PR or PRP or PRP encoded command can be sent by any of the three MBA's and it will be applied to the layout track. However, if two different operators try to send commands from two different MBA's at the same time, the commands will be corrupted. Using MBA's in series is intended for an operator that has a simple radio linked or tethered walk-around throttle to have access to a local MBA as he moves to different positions on his layout.

Relays cost less than an equivalent electronic bridge circuit for the same current output.

The biggest advantage of an active bridge circuit like, 1502, in FIG. 15 is they can produce a much faster series of PR and PRP's than relays. However, relays are fast enough that they improve PRP timing over the Horn and Bell timing used in Type 2 signaling. Experiments with a variety of relays have shown that it was possible to send a 10 ms PRP and detect it. Speed faster than this had enough variation in PRP pulse width that reliability in timing was starting to become a problem. We got very reliable results with a 30 ms PRP for a Logic 1 and a 60 ms PRP for a Logic 0. At these times an average 8 bit word could be transmitted in 390 ms and worst case (all 0's) would take 510 ms while best case (all 1's) would take 270 ms. This would be very acceptable for the operator, particularly if we use faster codes for those features that need to respond quickly.

Programming Acknowledgements: Besides the verbal acknowledgement used in Quantum we could add a bi-directional system to more advance MBA products or DC power packs to allow signals to be transmitted between locomotive and base station in electronic form in both directions. This would allow querying the Q2 system about which POP it is currently at and the setting for that option.

The simplest method would be to use on/off loading of the power pack in a similar manner to how the NMRA system does their "Service Mode" programming in DCC. In this case, we would turn on the motor for a brief period to load the base station output as feedback to a query. Unlike the NMRA DCC method, we would use a binary search to determine the current POP or POP setting. This works well for most of our POP level settings that have usually 16 levels.

Bi-Directional Communication under Analog Operation (Type IV Signaling): There is also a need for Bi-directional communication under normal operation. In particular, on-board sound systems like Quantum simulate many features of prototype locomotives and as such need to transmit back the state of these features as well as the state of the model locomotive in a form that the controller can interpret, process and/or display, which requires bi-directional communication. For instance, it would be useful to know the following kinds of information from the locomotive:

The speed of the locomotive in scale units (scale miles per hour, scale kilometers per hours, etc.).

The amount of simulated braking applied or the amount of simulated air pressure in the brake lines.

Locomotive's or consist's ID number.

The real current demand and power demand of the locomotive's motor.

Diesel transition setting.

Steam locomotive cut-off setting.

The simulated current demand in the locomotive. This is the simulated current based on notch setting, transition setting, load, etc. that would be appropriate for the prototype under similar operating conditions.

Remaining simulated fuel.

Remaining simulated water.

Remaining simulated boiler pressure.

Amount of time since the locomotive had received it last maintenance.

The total miles the locomotive has been operated since it was new or since its last maintenance.

The name of simulated engineer or fireman, which can be used as a alternative way or alias to identify and/or select a locomotive or train by the control center.

Location of the locomotive based on information from track location identifiers.

Scale distance (scale miles, kilometers, etc.) traveled since last location report.

A turnout command for the next turnout encountered. This would be an additional method to our proximity operated turnout control as described in our two U.S. Patents, Model Railroad Operation Using Proximity Selection (U.S. Pat. No. 5,492,290) and Complex Switch Turn-Out Arrangements Using Proximity Selection and our European Patent.

Off-on state of different lights and appliances.

Video from on-board cameras.

Audio for on-board microphones.

Inclinometer indication of current grade locomotive is on.

Measurement of locomotive's motion, acceleration, etc.

Status of the individual couplers.

Simulated fuel consumption rate.

Time or miles since last steam locomotive blow-down.

Steam locomotive boiler water level.

Time since steam locomotive flues were cleaned; prototype steam locomotives build up soot in the flues over time that needs to be cleaned out. This is usually done while the locomotive is moving by throwing sand into the firebox where it is drawn through the flues. This generally causes the normally white smoke to turn black as the soot is expelled through the smoke stack.

Some of these settings are made at the controller and as such are known by the controller electronics. However, many of these state values are based on automatic operation of the on-board Sound and Train Control system and are continuously changing. In addition, it may not be practical for the controller to maintain the values of all the locomotives settings in memory for layouts with many locomotives; it may be more practical to retrieve this information from the individual locomotives as needed.

Although we supply verbal information from the locomotive on demand, this method is limited and prototypically unrealistic for many operational needs in model railroading. On the other hand, a large electronic data rate may not be needed from the on-board Sound and Train Control system since much of the information is not needed on a continuous basis and can be supplied on demand. Other than speed value, simulated air brake pressure, streaming video and audio, most other data can be updated only when a significant change is made or when queried. Considering that video and audio may be transmitted via a different method (direct RF), the bi-directional system for analog applications may not require a high bandwidth.

Figure 17:
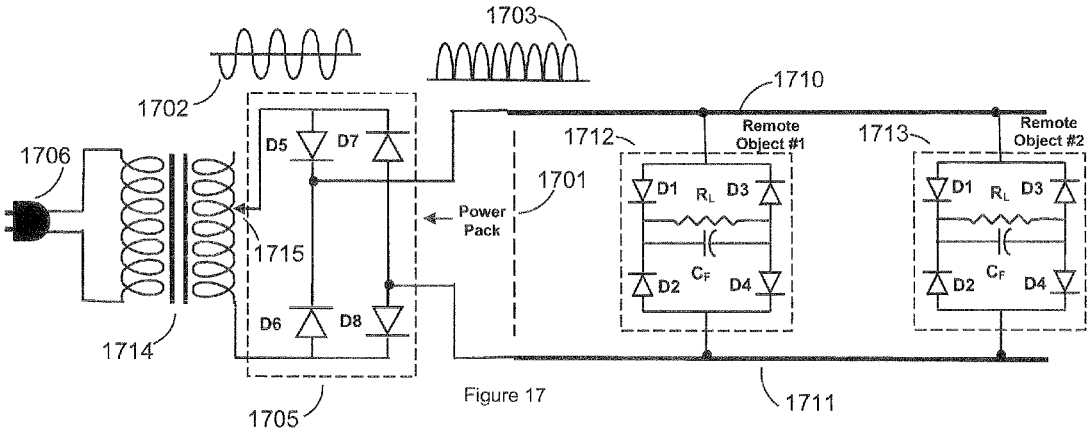
FIG. 17 Basic design of a Variable Amplitude Full Wave HO DC analog power pack design. (Prior Art)
Figure 18:
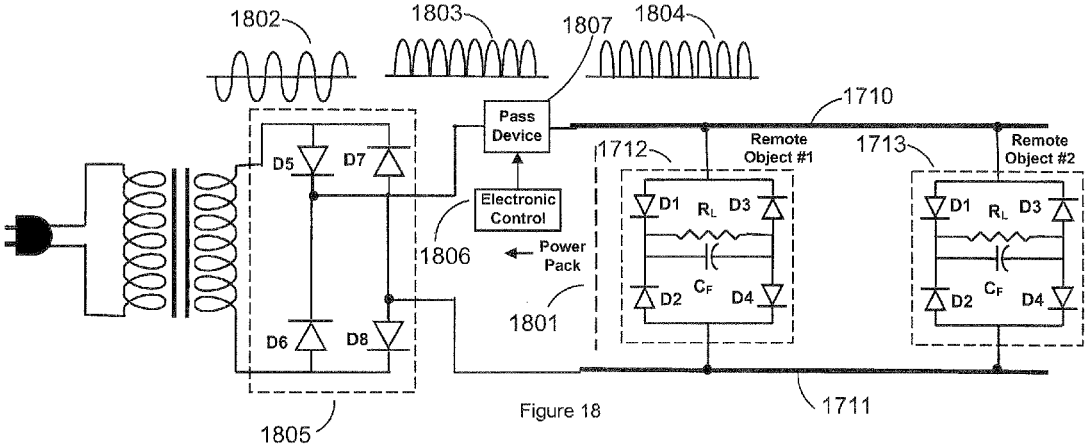
FIG. 18 Basic design of a Phase Modulated Sine Wave HO DC analog power pack design. (Prior Art)
Figure 19:
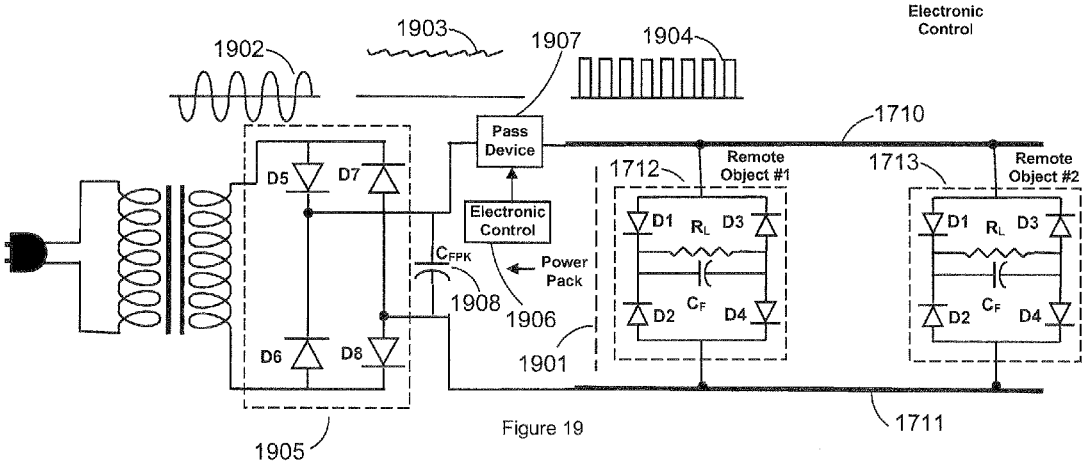
FIG. 19 Basic design of a Pulse Width Modulated (PWM) HO DC analog power pack design. (Prior Art)

The Quantum system design that utilizes a bridge rectifier and filter capacitor can allow for a simple bi-directional communications technique during the normally occurring power off periods of many analog waveform types currently available on DC power packs. Three different power pack design methods are shown in FIGS. 17, 18 and 19. The power packs are shown to the left of the dotted vertical lines, 1701, 1801 and 1901. The layout is represented by the conductive track rails, 1710, and 1711 and by remote objects, 1712 and 1713 that are electrically connected to the track rails. Remote objects can be mobile locomotives and rolling stock or accessories and turnouts that are stationary on the layout. Many modern electronic remote objects, such as 1712 and 1713, use a full-wave rectifier with filter capacitor electronic power supply, represented by D1-D4 and CF. RL represents the internal load on the remote object's electronic power supply.

All power packs are based on 50/60 hertz incoming waveform from the country's power grid and indicated here by the wall power plug, 1706, and connected to variable transformer, 1714.

Note that all power packs produce waveforms what have off periods where the output is at zero volts. This is clearly seen for the Phase Modulated Sine Wave type shown in FIG. 18 where the incoming sine wave, 1802, is first rectified by bridge, 1805 made up of rectifier diodes, D5-D8, and shown as full wave output, 1803, and then phase modulated by electronic control, 1806, that affects pass device, 1807, under the control of the power pack's throttle. The phase-modulated waveform is shown as 1804.

The off period is also obvious for the PWM pulse type design shown in FIG. 19. Here the incoming sine wave, 1902, is rectified by bridge, 1905, and filtered by capacitor, 1908, to produce a near constant DC output 1903. This DC supply is then phase modulated by electronic control, 1906, under the control of the power packs throttle, to affects pass device, 1907, to produce the duty cycle modulated waveform shown in 1904. The off period will of course become vanishingly small if the duty cycle is allowed to approach 100%. Note the ripple voltage shown in waveform 1903; this is the result of loading of $C_{FPK}$ partially discharging due to loading from remote objects such as 1712 and 1713.

The off period is not as obvious in the Variable Amplitude Full Wave power pack design shown in FIG. 17. Here the incoming sine wave, 1702, is amplitude modulated by the variable transformer tap, 1715, which is then full wave rectified by bridge, 1705, which results in full wave output waveform, 1703. This waveform is shown in better detail in the middle drawing of FIG. 2 where the zero voltage gap, 207, is clearly seen. As explained, this gap is the result of the sine wave needing to exceed the forward voltage drop of the rectifier diodes D5-D8 before any output voltage is applied to the layout. Note that some power pack designs use other ways to vary the amplitude of the sine wave but the waveform remains essentially the same. The off time period will decrease with increasing amplitude of the incoming sine wave but will not go completely off.

Another power pack not shown produces variable amplitude filtered DC to the tracks and will not have any periods where the voltage is zero.

The advantage of the three types of output waveforms shown in FIGS. 17-19 is that bi-directional signals can be sent from remote objects while the voltage is off into an electrical environment that has low noise and high impedance. Since all three power pack designs use a bridge rectifier on the incoming sine wave, this voltage source is isolated from the layout if the sine wave is below the forward voltage drops of the bridge diodes. In addition, the remote objects shown all have bridge rectifier inputs which means their electronics are also isolated from the track. If the bi-directional signal does not exceed 1.5-2 volts, this signal can safely be transmitted in the high impedance, low noise environment of the two rail track. In addition, Pass devices, 1807 and 1907 further isolate the track from input sine waves while these devices are off and the charged capacitors, CF, in the remote devices ensure that they are isolated from track signals that are below these capacitors' charge voltage. Quantum System will remain charged enough to keep the on-board Quantum electronics on during the duty cycle off portion of the track voltage waveform.

Under these conditions, the track impedance will remain an open circuit for reasonably large signals as long as these capacitors voltage remains above the desired bi-directional signal peak voltage. This high impedance environment is important since it would allow an on-board transmitter in a remote object to apply a low amplitude voltage on the track without severely loading the on-board power supply during the off period. This is important since the on-board supply usually derives its energy from charged capacitors, $C_F$, which can only supply power for a brief period. In this way, either digital or analog information can be sent from the remote object during off periods of the applied track power voltage. For instance, analog output can be the value of on on-board variable voltage supply (or current supply) or, digital data can be sent as a zero voltage for a logic 0 or some low voltage $V_B$, for a logic "1" such as the sequence shown in FIG. 20 for a PWM pulse type power pack.

The logic output is shown under the graph as a series of 0's and 1's. The first four cycles in this diagram represent the normal output of the power supply. In other words the normal condition from the power pack would indicate a continuous series of zeros during each power off period. In the case of a PWM pulse type power pack, the bi-directional data rate would be equal to the frequency of the applied track voltage (usually twice the county's power grid frequency, 100 hertz or 120 hertz). Logic 1's sent from the remote object are apparent at some points where the DC power pack returns to zero, such as at 2001, 2002, 2003 and other places.

Figure 21:
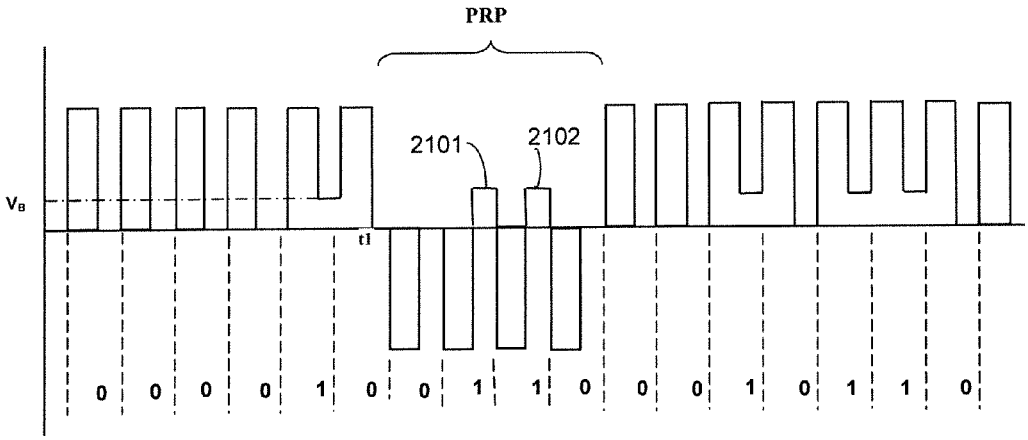
FIG. 21 Waveform of bi-directional communication of the type shown in FIG. 20 combined with PRP Encoding (Polarity Reversal Pulse Encoding).

Note that this method of bi-directional communication can be used in combination with PRP encoding since the polarity of the applied voltage will not affect the offset voltage. This is shown in FIG. 21 where a PRP has been applied at $t_1$, and uninterrupted bi-directional logic is shown being sent as the series (0, 0, 1, 1, 0) during this time. It is also unimportant if PRP occurs during a power pack pulse or in the middle of a bi-directional "1" since it will not affect the magnitude, polarity or period of the bi-directional signal.

Figure 22:
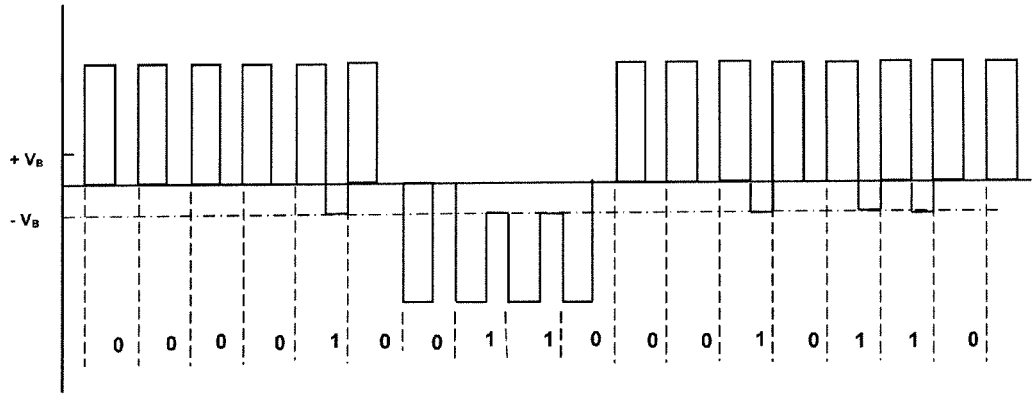
FIG. 22 Waveform showing opposite polarity for bi-directional transmissions with PWM type track voltage.

The polarity of the bi-directional signal is also unimportant as indicated in FIG. 22, where $-V_B$, also represents a logic 1 (i.e., $\pm V_B$=Logic 1). It is a reasonable condition of the design of a bi-directional system to allow either polarity since the locomotive could be placed on the track in the opposite direction and hence could be transmitting data with the opposite polarity. This is actually an advantage since it could be configured to tell the controller the direction the locomotive is facing from the polarity of bi-directional information with respect to the applied voltage.

Figure 23:
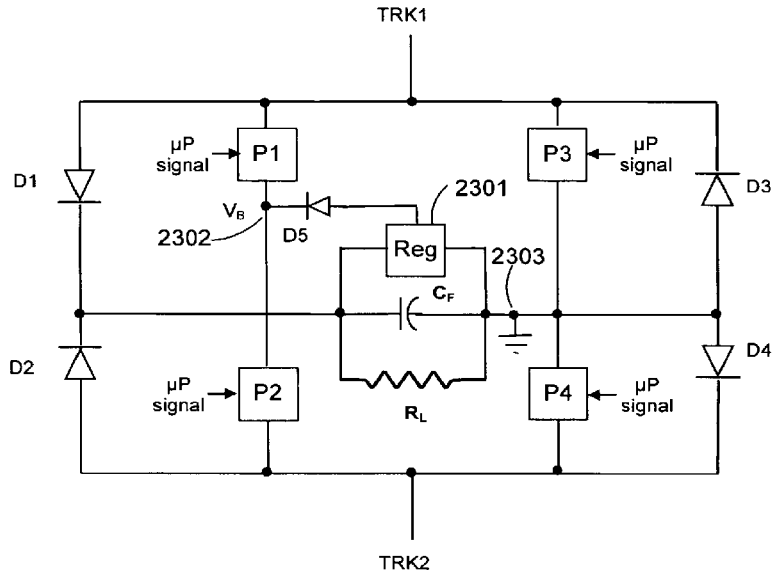
FIG. 23 Schematic of a simple bi-directional transmitter on a remote object using an on-board voltage source for transmission during off periods of the track voltage waveform.

FIG. 23 shows a general case of how an on-board voltage source can be connected to the track. The on-board microprocessor is not shown nor the details of the sound and train control system, motor drive, etc. This diagram simply shows an on-board voltage generator, made up of bridge rectifiers, D1-D4, filter capacitor CF, and linear regulator, 2301 and protection diode D5. This power supply will generate a voltage, $V_B$, at the cathode of D5, 2302, when the circuit is loaded. RL represents the loading on the filter capacitor by internal electronic components such as the on-board uP, lighting circuits, etc. These circuits may be powered by other voltage regulators not shown or may be powered by the $V_B$ generator. In any case, for this discussion, all internal loads receive power from CF and all return current to internal ground, 2303. The pass devices, P1 through P4 represent ideal (zero resistance switches) under microprocessor control. P1 and P2 can apply the output $V_B$ terminal, 2302, to either TRK1 or TRK2. P3 and P4 can apply the internal ground connection, 2303, to TRK1 or TRK2. This will allow the internal $V_B$ generator to connect between TRK1 and TRK2 with either polarity. When track power is applied to either polarity between TRK1 and TRK2, the internal capacitor, CF, will charge to the peak track voltage, less the insertion loss of the bridge rectifier. When track power is removed, the internal $V_B$ generator will continue to operate as long as the internal charge on CF does not fall too close to the $V_B$ output. There are two conditions: 1) if during this time, P1 and P4 are on, and P2 and P3 are off, then the $V_B$ generator will apply positive voltage to TRK1 with respect to TRK2; 2) if P1 and P4 are off, and P2 and P3 are on, then the $V_B$ generator will apply a negative voltage to TRK1 with respect to TRK2.

When designing a circuit for bi-directional feedback, there are three conditions that should be met to ensure reliable operation. 1) if track voltage should reappear when the bi-directional circuit is operating, there should be no temporary dysfunction of the on-board system nor any permanent damage, 2) there should be no unusual current demands from the power supply that can affect the power supply voltage or operation, and 3) a short circuit on the track should not cause temporary dysfunction of the on-board system nor any permanent damage.

Figure 24:
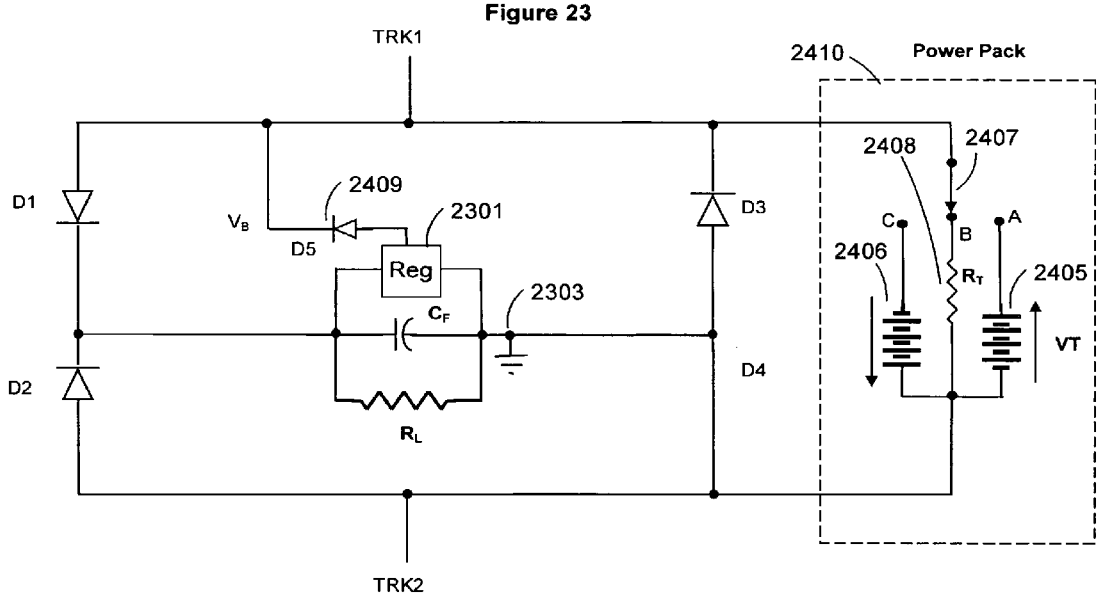
FIG. 24 Schematic of the bi-directional transmitter shown in FIG. 23 with a model of a standard pure DC power pack to illustrate some problems with using this method.

The generalized circuit in FIG. 23 has some of these problems depending on track conditions. Consider the condition where P1 and P4 are on, and P3 and P4 are off, which is intended to apply a positive VB to TRK1 with respect to TRK2 under open circuit track conditions. FIG. 24 shows the resultant schematic where these ideal switches are replaced by opens or shorts (i.e. P2 and P3 are replaced by an open circuit and P1 connects $V_B$ to TRK1 and P4 is replaced by a short to connect the internal ground to TRK2 and also shorting out D4).

To indicate the different track conditions, a simulated power pack, 2410, is constructed as switch, 2407, as batteries 2405 and 2406, and resistor, 2408. The batteries represent track power, VT, during the on period of the track power duty cycle, which is assumed here to be greater than $V_B$. If the switch is in position, A, positive track voltage is applied to TRK1 with respect to TRK2. In position C, a negative track voltage is applied to TRK1 with respect to TRK2. In position B, no track power is applied, and instead the output of the power pack is simply the load resistor, $R_T$. The resistor $R_T$ is likely located in the MBA along with the detection circuitry rather than in the power pack but for this discussion, the MBA and power pack are shown together.

During circuit operation, where CF is fully charged, if switch, 2407, is in position B, a positive $V_B$ is applied to detector resistor, $R_T$, in the power pack. If switch 2407 is in position A, then the positive $V_T$ volts applied to TRK1 with respect to TRK2, will back bias diode D5. No harm comes from this operation. However, if switch 2407 is in position C, then the negative $V_T$ volts applied to TRK1 with respect to TRK2 are also applied directly across diode D3 and can damage this device.

If we examine the circumstance, where a negative $V_B$ voltage is applied between TRK1 and TRK2, (P1 and P4 are off, P3 and P2 are on), we get a similar result except that a positive track voltage (2407 in position A) will damage diode D4.

In addition, if a short circuit occurs in either condition 1 or 2, the $V_B$ generator is loaded which will rapidly discharge the supply capacitor $C_F$. This is seen in FIG. 24. If TRK1 is connected to TRK2 via a short circuit, the cathode of D5, 2409, is drawn down to the internal circuit ground, 2303, which will generate the maximum current allowed by regulator, 2301. This can be sufficiently large to discharge the CF fast enough to power down the on-board uP before the short circuit condition is repaired and may damage the regulator.

Although we are not aware of any previous methods for doing bi-directional communication under analog or conventional train control, Bernd Lenz in U.S. Pat. No. 6,853,312 does address some of these problems for his design for bi-directional communication under the NMRA digital command control (DCC). Instead of an on-board voltage circuit, he connects a current generator between the track rails during a predetermined time period while the applied track voltage is off. If by chance there is a short circuit condition on the track, the current draw from the on-board supply is limited and will not quickly deplete the on-board filter capacitor. It appears that his invention avoids the issue of potential damage during the application of track power by limiting these transmissions of the bi-direction current pulses to times when track power is disconnected.

Figure 25:
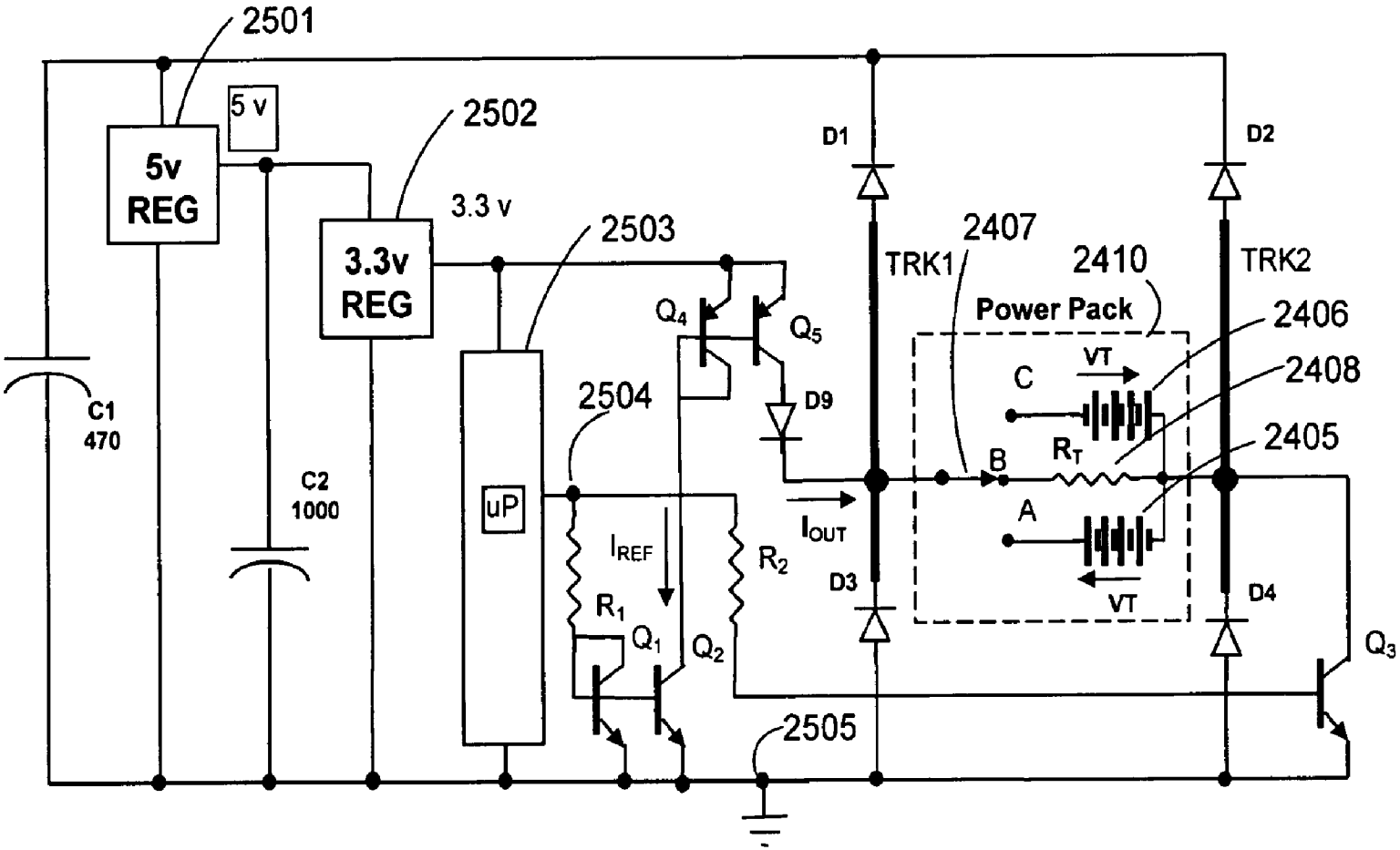
FIG. 25 Schematic of a simple bi-directional transmitter on a remote object using an on-board current source for transmission during off periods of the track voltage waveform.

The circuit in FIG. 25 shows a more complete on-board system where a current source rather than a voltage source is used for bi-direction communication. The bridge rectifier is the same but the power supply is more complex with two regulators to achieve a high storage capacitance for operation at low amplitude power-pack track voltage. The input filter capacitor, C1, is rated at maximum peak track voltage. The 5-volt linear regulator, 2501, serves to lower the voltage to large filter capacitor, C2, with much lower voltage rating. A second regulator, 2502, reduces the voltage to 3.3 volts suitable for the microprocessor, 2503.

The current source generator is made up of two bi-polar current mirrors. The reference current, $I_{REF}$, is set up by a logic high uP output, 2504, through resistor R1 and diode configured npn transistor, Q1, and mirrored by Q2. This current is reflected down by diode configured pnp, Q4, and mirrored through Q5 and connected to the track through protection diode, D5. For this discussion, I am assuming the base current errors are negligible for either the top or bottom mirrors (beta is high).

Although the input bridge and power supply in FIG. 25 is conceptually similar to the generalized circuit in FIG. 23, FIG. 25 is drawn with respect to how the on-board current source is loaded or affected by the power pack, 2410. Hence the rectifier diodes, D1-D4, and track rails TRK1 and TRK2 are shown located at the output of the on-board system. The power pack, 2408, is the same but drawn sideways, to the power pack of FIG. 24. As described, the three position switch, 2407, can connect to either a positive track voltage at position A, a negative track voltage at position B, or a load resistor, $R_T$, 2408, located within the power pack.

Transistor Q3 is used to short out rectifier diode D4 to allow the on-board bi-directional signal current, $I_{OUT}$, to return to the on-board electronic ground, 2505. Q3 performs the same function as pass device, P4, in FIG. 23. Although this circuit has some of the same concerns expressed in our discussion of FIG. 24, the physical limitations of the saturated shorting transistor, Q3, does obviate some of the problems.

Figure 26:
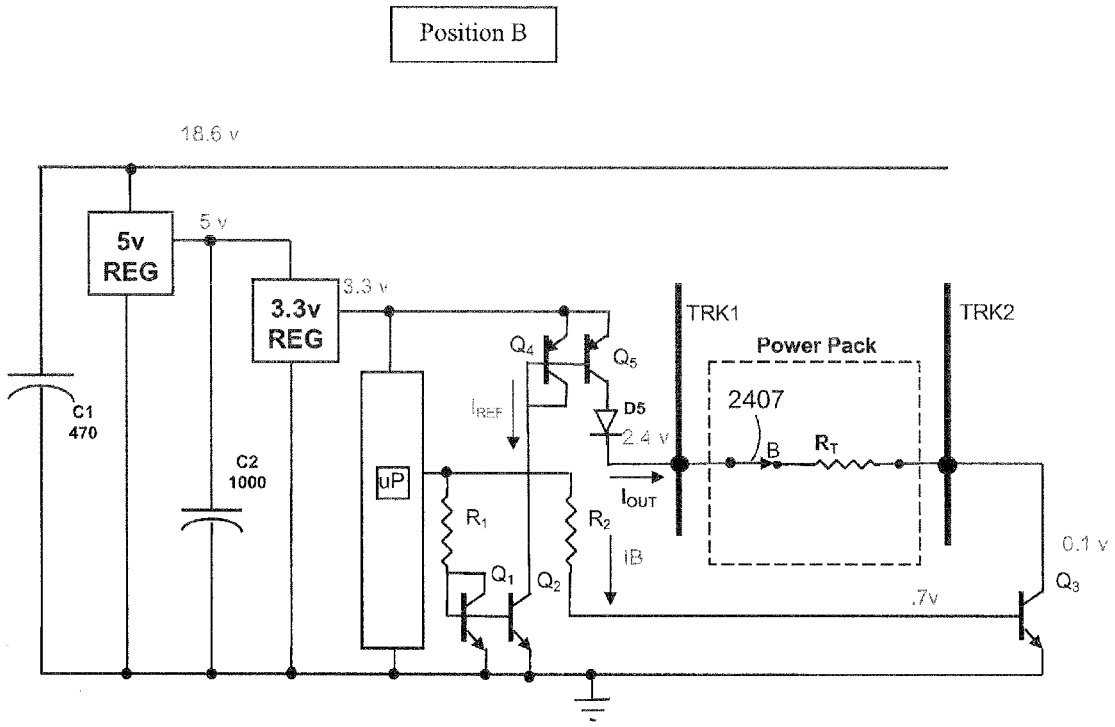
FIG. 26 Schematic of the bi-directional transmitter in FIG. 25 where the track condition is a simple resistive load.
Figure 27:
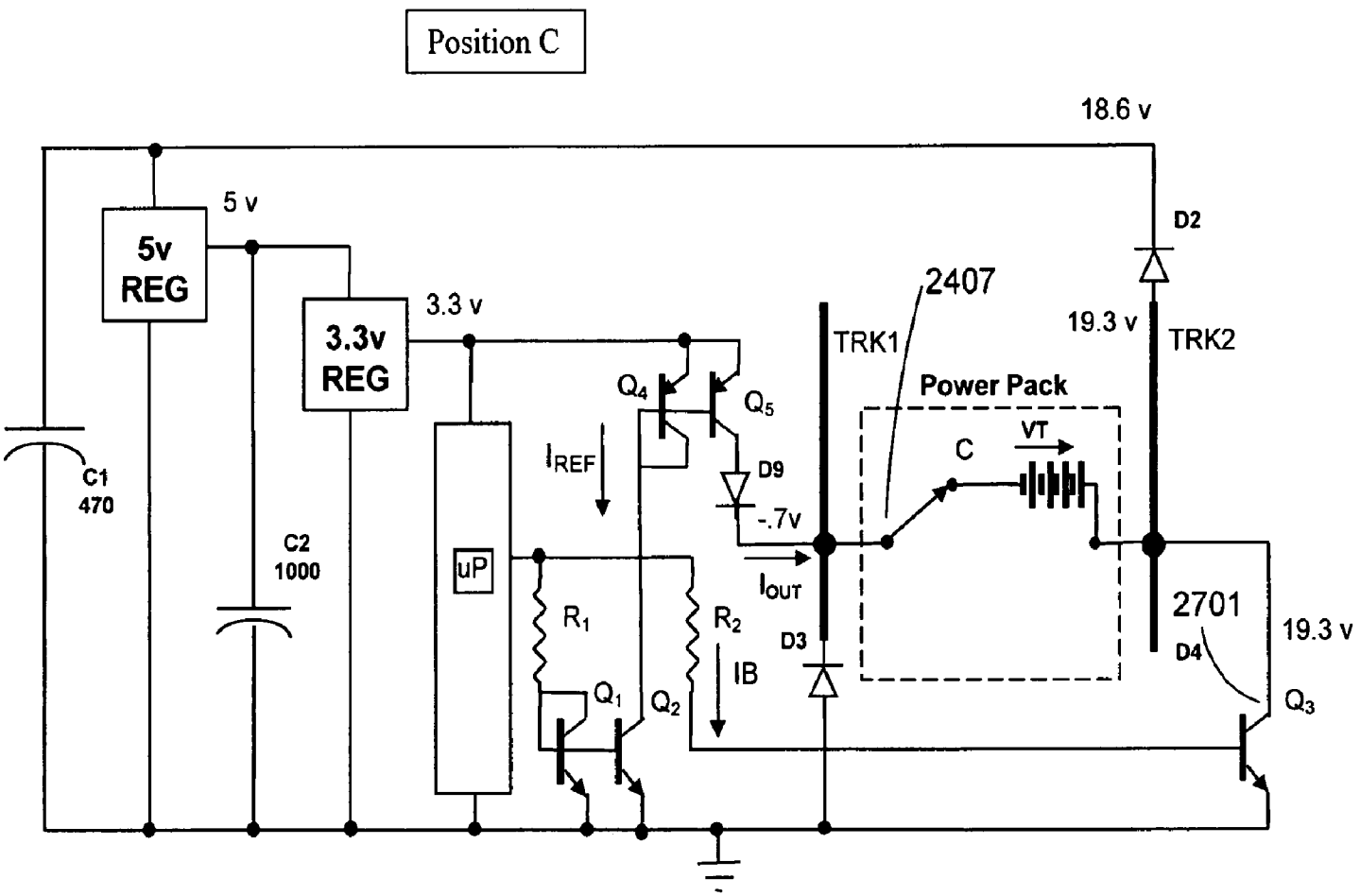
FIG. 27 Schematic of the bi-directional transmitter in FIG. 25 where the track condition is a negative DC voltage to TRK1 with respect to TRK2.
Figure 28:
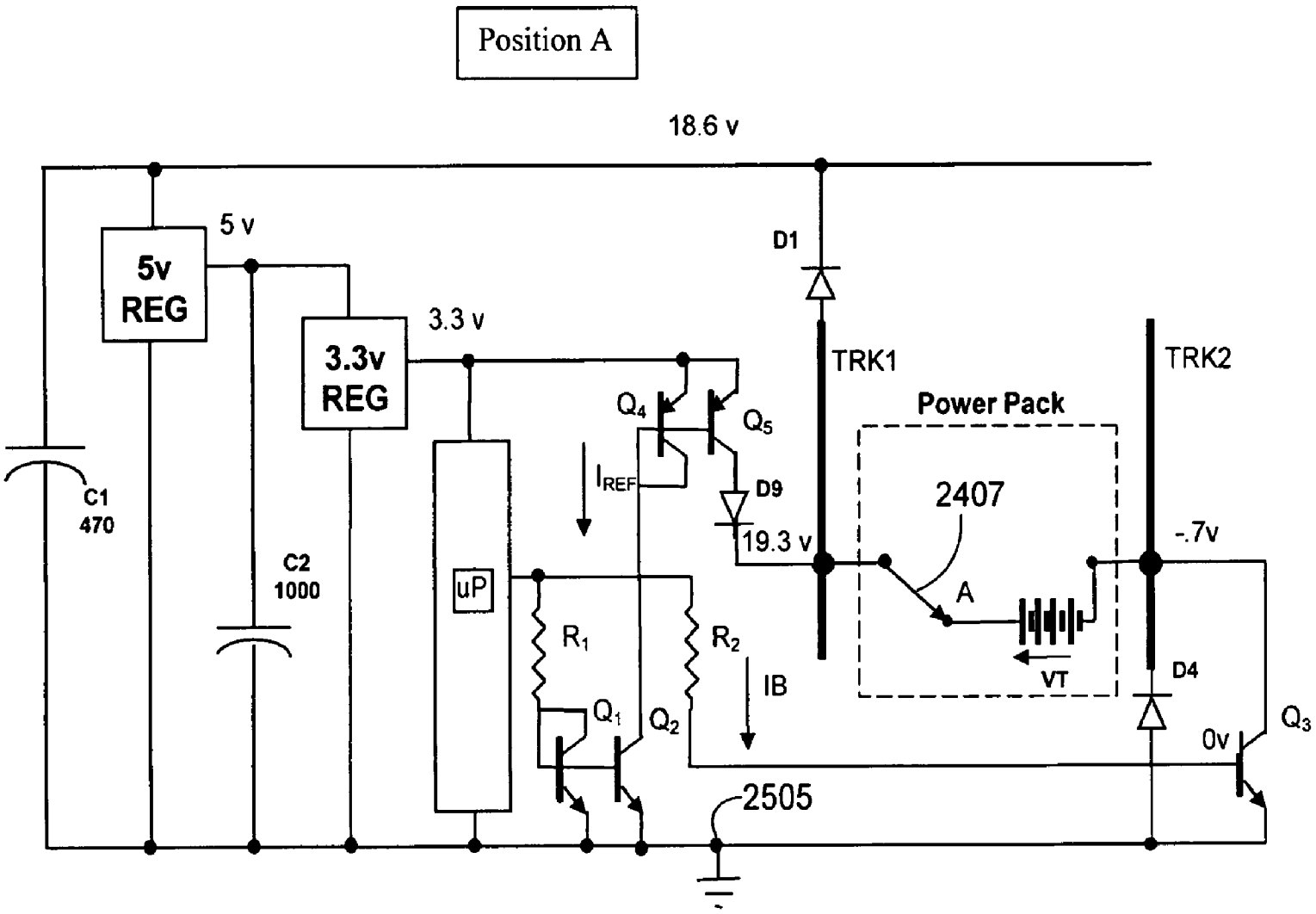
FIG. 28 Schematic of the bi-directional transmitter in FIG. 25 where the track condition is a positive DC voltage to TRK1 with respect to TRK2.

The operation of this circuit under the three power supply conditions is shown in FIG. 26, FIG. 27 and FIG. 28.

FIG. 26 shows the condition with switch, 2407, in position B; the track voltage is disconnected and the track is loaded only with resistor $R_T$. Since the two batteries, 2405 and 2406, in FIG. 25 are not used, they are not shown. In addition, all the rectifier diodes, D1-D4 are back biased and left out of the drawing. This makes it easier to see that the output current, $I_{OUT}$, flows through $R_T$ generating the bi-directional signal at the power pack and returning through saturated transistor, Q3. The bi-directional signal voltage generated at $R_T$ will be $I_{OUT} \times R_T$ but no larger than the voltage compliance of the current source. In this case, it will be no greater than 3.3 volts less the $V_F$ of D5 and the $V_{SAT}$'s of Q5 or about 2.3 volts.

Since Q3 is expected to sink $I_{OUT}$, as a general engineering guide to ensure saturation, we would chose a forced beta of 10 for this device. This would determine the size of R2.

FIG. 28 shows the condition with the switch, 2407, in position A; the power pack is applying a positive voltage to TRK1 with respect to TRK2. The voltages are critical points on this circuit are shown, assuming a typical voltage of 20 volts for VT. Under these conditions, D5 is back biased; Q5 is supplying no current. This presents no problem except that Q5 is saturated which may affect signal transmission speed. Q3 collector is forced low to about 0.7 volts below internal ground, 2505. This also causes no problem but it may affect Q3 switching time.

FIG. 27 shows the condition with switch, 2407, in position C; the power pack is applying a negative voltage, VT, to TRK1 with respect to TRK2. The voltages at critical points on this circuit are shown, assuming a typical voltage of 20 volts for VT. Under these conditions, the cathode of D5 is pulled down to −0.7 volts, which causes no problem since the current is limited by $I_{OUT}$ from the upper current source. The collector of Q3, 2701, is at a high positive voltage, which can be a problem since this device is taking β*IB. This not only presents a problem with excess current and possible heat, but this current is beta dependent which is unpredictable. For instance, if we assume a desired current transmission of 30 mA, then we would want 3 mA of base current. If high beta spec for this npn is 300, we have 900 mA. With 19.3 volts of collector voltage, this is over 17 watts.

Figure 29:
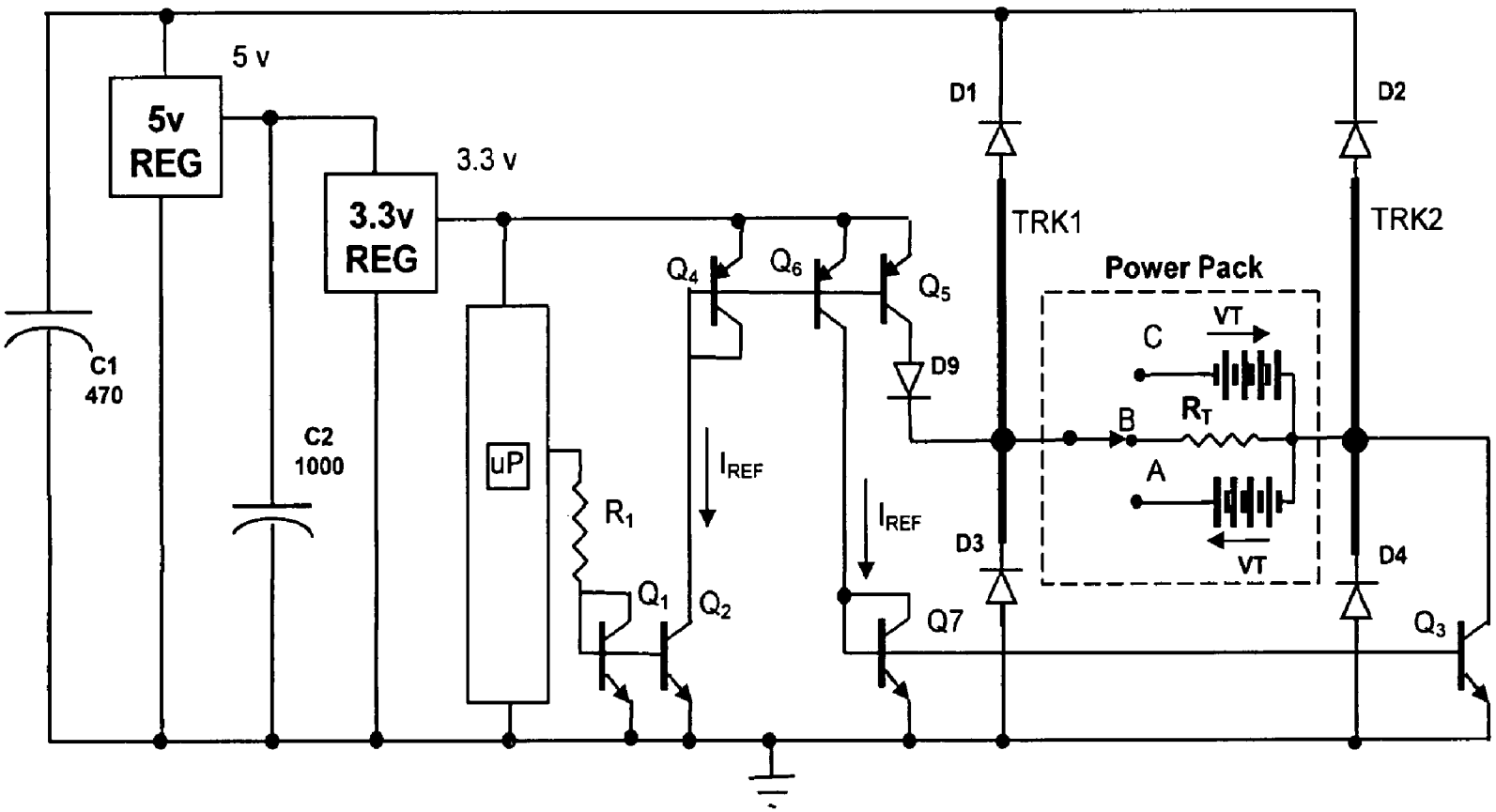
FIG. 29 An improvement in the bi-directional transmitter in FIG. 25 that prevents damage under certain track voltage conditions.

A circuit that may reduce the collector current in Q3 is shown in FIG. 29. Here Q3 is a current source made up of the same reference current, $I_{REF}$, as the upper current source, but Q3 is shown at twice the size, which means it will mirror twice the reference current. Under the condition where the power pack is in position, C, Q3's current will be limited to $2\times I_{REF}$. If $I_{REF}$ is 30 mA, the total power is 0.06×19.3, which is 1.15 watts, which is tolerable.

Under the condition, where the power pack is in position A, Q3 will be saturated.

Under the condition, where the power pack is in position B, D4 is sourcing $I_{REF}$ while Q3 is trying to sink $2\times I_{REF}$; this will saturate Q3.

All of the above circuits showing bi-polar current mirrors are better suited to an integrated circuit design where the devices are much better matched than off-the-shelf parts. However, there are other implementations of current source designs that will accomplish the same goal. This circuit can also be implemented using MOS FET technology, which is a better choice for modern high-density low-voltage logic designs. In any case, the critical issue for analog or DCC bi-direction circuit design is to use current sinks as well as current sources to protect the bi-directional communication circuit if track voltage should be impressed during the transmission period. This is a greater problem with analog then with the NMRA digital command environment where it is much easier to guarantee that track voltage is disconnected before bi-direction transmission takes place. In analog, where there are many different power packs and waveforms to contend with, and where the expense and voltage insertion loss of a pass device to shut down the track voltage may not be practical, it is important to protect the on-board bi-directional circuits from damage.

Another issue that separates the analog environment from the NMRA digital command control environment is that the analog power signal is often being constantly interrupted by its very nature. In the case of a pulse drive or phase modulated sine waves, the applied voltage is off for a certain percentage of the 50/60 hertz time period except for perhaps at the highest setting. Even amplitude-modulated full-wave rectified sine waves are off at the zero crossing of the input sine wave. The issue is to know when the track voltage from the power pack is zero and to provide this information to remote objects and signal detectors to allow transmission and reception of these digital signals.

Figure 30:
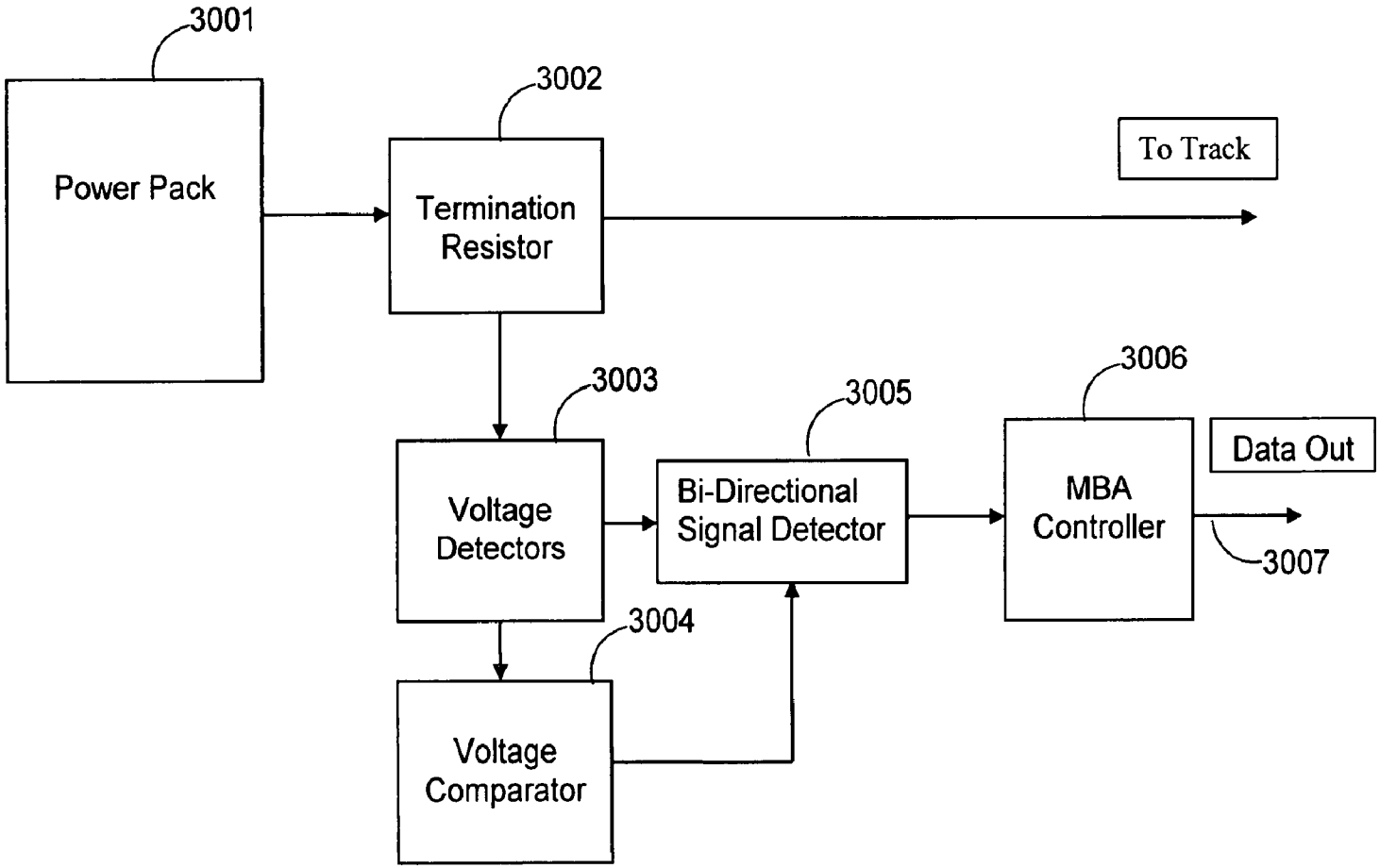
FIG. 30 Block diagram of a bi-directional receiver with DC power pack.

A simple bi-direction data receiver is shown in FIG. 30. DC power pack 3001, variable output DC is connected to termination resistor, 3002. Whenever the track voltage returns to zero during its duty cycle off period or during zero crossing of the input 50/60 sine waves, the termination resistor will register bi-directional current pulses from a remote object connected to the track with voltage pulses that do not exceed the voltage compliance limit of the on-board current generator. The voltage detector will measure all voltage variations on the track including both the applied track voltage and the bi-directional signals across the termination resistor. When the track voltage drops below a predetermined value based on the voltage compliance limit on the bi-directional current source, the voltage comparator, 3004, enables the bi-directional signal detector, 3005, to monitor the voltage pulses across the termination resistor as serial digital data from the remote object. This data is then sent via a serial port to a controller such as an MBA controller, 3006, where its microprocessor can use, analyze, display the data and/or pass data, 3007, to other digital systems such as a personal computer or other digital appliances or accessories on the layout.

Note that if more than one remote object was transmitting, the bi-directional communication data stream would be corrupted. However, if we ensured that each on-board transmitter had the same voltage compliance, then the sum of all the bi-directional signals would not exceed this compliance limit. Even though the data is corrupted, the total track voltage is not statistically changed over the bi-directional transmission of only one remote object.

Figure 31:
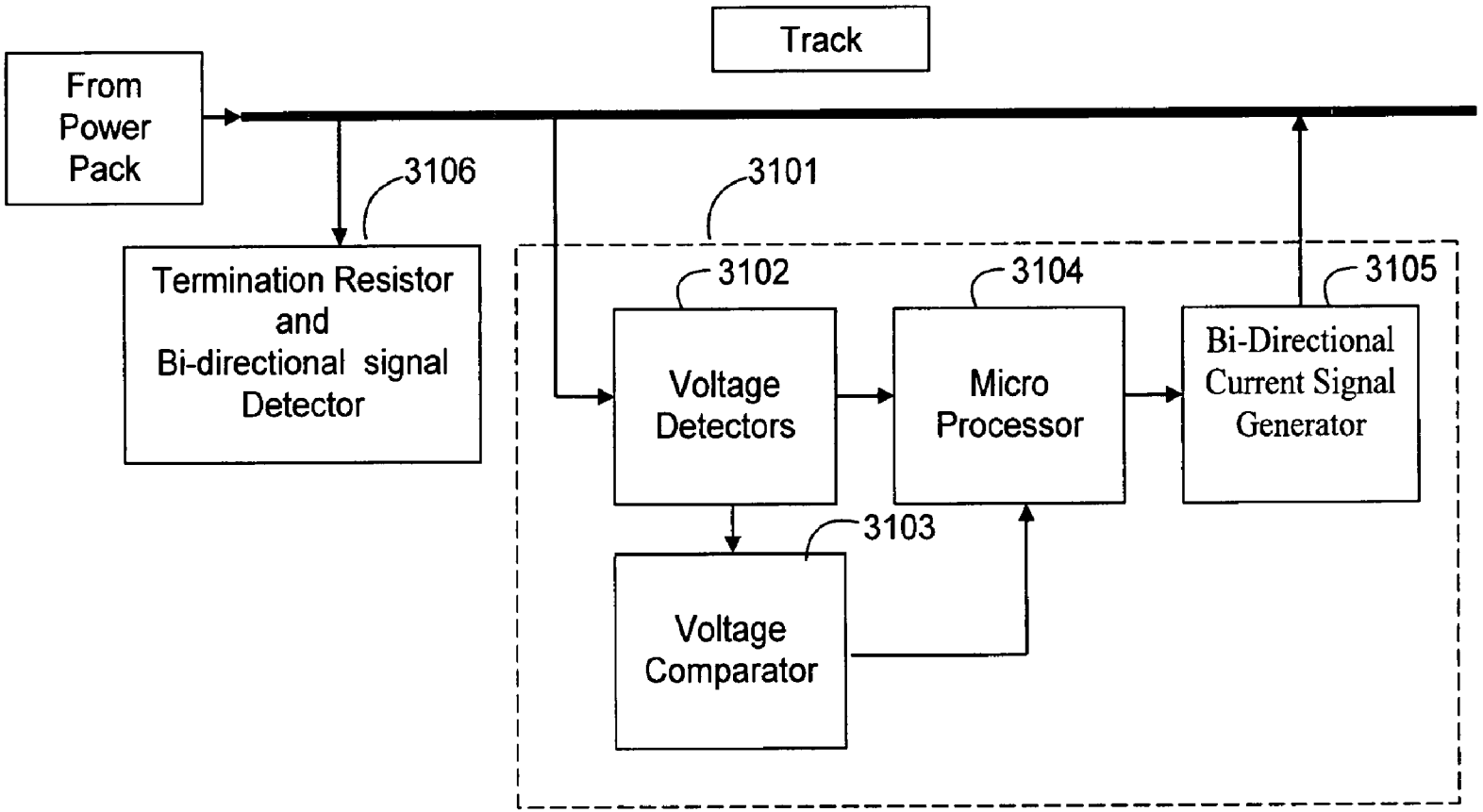
FIG. 31 Block diagram of a bi-directional receiver in a remote object.

In addition, the on-board bi-directional transmitter could also include a bi-directional receiver. This would allow a remote object to listen to another remote object transmitting bi-directional information. A simple on-board system is shown in FIG. 31. Here the remote object, 3101, includes voltage detector, 3102, which communicates digitized voltage values to microprocessor, 3104, voltage comparator, 3103, that also communicates with said microprocessor, 3104, which in turn directs the actions of the bi-directional transmitter, 3105. The receiver operation is similar to the receiver described in FIG. 30. In the case of an on-board receiver in a remote object, a termination resistor is not needed since bi-directional voltage pulses are already being created by the termination resistor within the controller, 3106. Based on the voltage measurements from 3102, the comparator, 3103, determines when the track voltage has dropped close to the preset voltage compliance of current generators in remote objects and enables said microprocessor to analyze said digitized voltage from the voltage detector. The information received may be from another remote object or from the same remote object, 3101. In the latter circumstance, the measurement of bi-directional information on the track verifies that its own bi-directional current transmissions have successfully reached the termination resistor in 3106. When the track voltage exceeds a preset voltage peak value based on the compliance limit of said current generators, the voltage comparator informs said uP and prevents it from further processing of bi-directional digital signals.

In the implementation of this invention, the function of the voltage comparator can easily be included in the uP software and does not need to included as a separate piece of hardware.

It is a worthwhile observation to note that the track voltage is changed by the addition of bi-directional signaling which in turn can affect the setting of the on-board throttle and hence the speed of a locomotive. To obviate this problem, the track voltage should be computed only when the voltage comparator, 3103, has disabled bi-directional detection, or in other words, when bi-directional signals are not being sent, or when the applied track voltage is above the voltage compliance of the bi-directional current sources.

Figure 20:
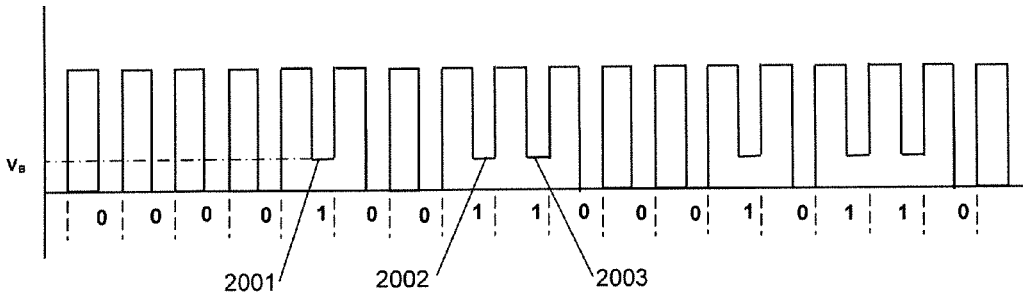
FIG. 20 Waveform for PWM type power pack where Bi-directional digital information is shown transmitted during the off periods of the PWM duty cycle.

In FIGS. 20, 21, and 22 we show bi-directional signals as transmitting one bit per power off period. At 100/120 hertz pulse rate from many DC power packs, the resulting 100/120 baud rate may be sufficient for analog applications. For instance, the on-board system may continually transmit speed and the locomotive's ID number without being prompted. If the locomotive is at rest, perhaps it continually transmits status information such as remaining quantities of simulated fuel and water, load value, type of throttle control, ID number, etc. again without being prompted by a digital signal from the controller. In program mode, where digital information is not required from the controller to select or make changes to program values, the current settings and/or changes could be transmitted back as a consequence of the on-board system's state. This would also allow adding simple inexpensive receivers such as speedometers to the power pack without having the expense or complexity of an MBA.

Indeed, if we limited ourselves to only having speed information transmitted during the off period of the applied track voltage, we could very well transmit a variable analog current from the on-board bi-directional transmitter whose magnitude represented the scale speed of the locomotive. This could be achieved by using a Digital to Analog converter to drive the current reference setting resistor, R1, in FIG. 29, with an output voltage proportional to speed, taking into account the diode drop of Q1.

Figure 32:
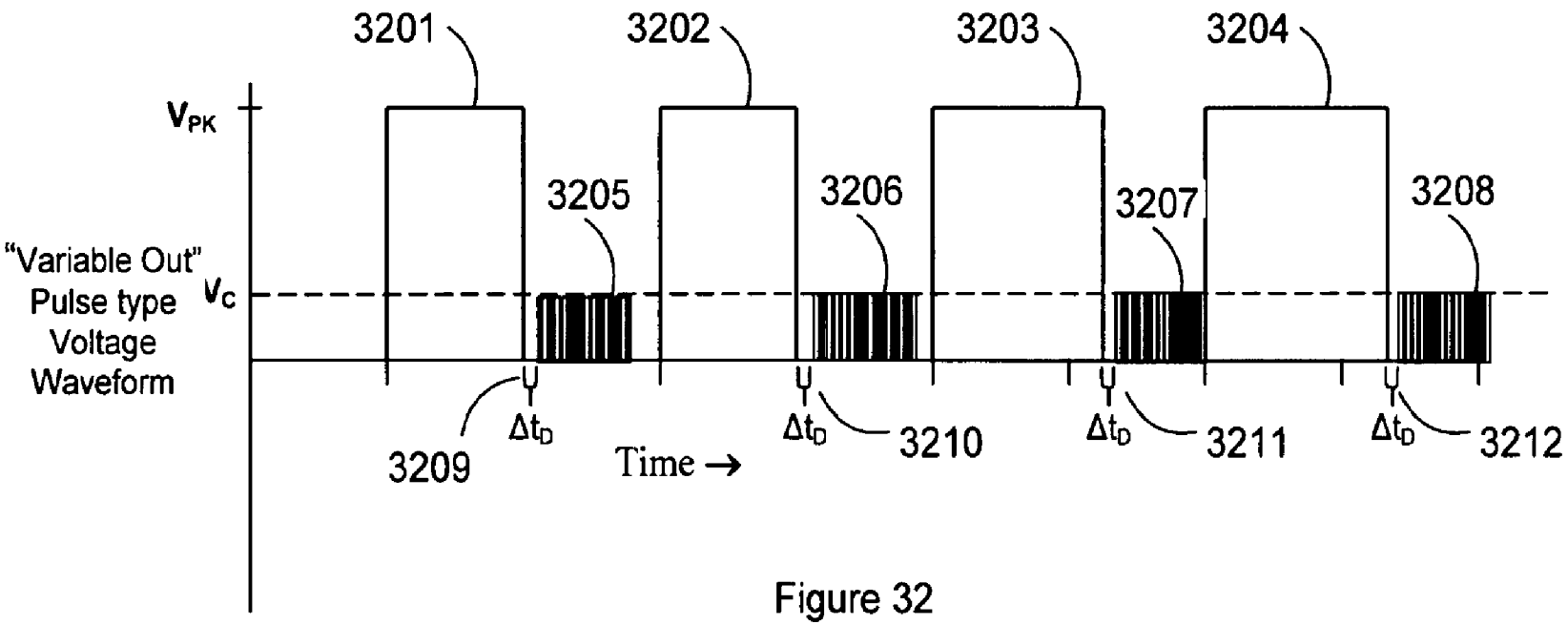
FIG. 32 DC power pack waveform envelop with dense high data rate digital signals shown being transmitted during off periods of the PWM type power pack.

However, if more information is required from the locomotive, digital transmission is our preferred method. The amount of bi-directional data transmitted during each normally off period of track voltage (called the gap) is not limited to one bit. These time periods are long enough and the bi-directional transmitters on remote objects can be fast enough to transmit considerable data. In fact, the on-board transmitter could also function as a DCC bi-directional transmitter when the remote object is operating in DCC mode. It is not unreasonable to design systems with data transfer rates in the k-baud or low mega-baud speeds. FIG. 32 shows dense data bit sequences, 3205, 3206, 3207 and 3208, being transmitted after each track voltage pulse, 3201, 3202, 3203 and 3204, drops to zero volts. Each bi-directional data sequence is shown delayed by a predetermined time, $\Delta t_D$, 3209, 3210, 3211, 3212, to allow the layout track system to settle down from any noise producing elements, such as inductive kicks, motor EMI, etc. The amplitude of each bi-directional data packet is indicated as the compliance voltage, $V_C$, of the bi-directional current generators in the remote objects.

Figure 33:
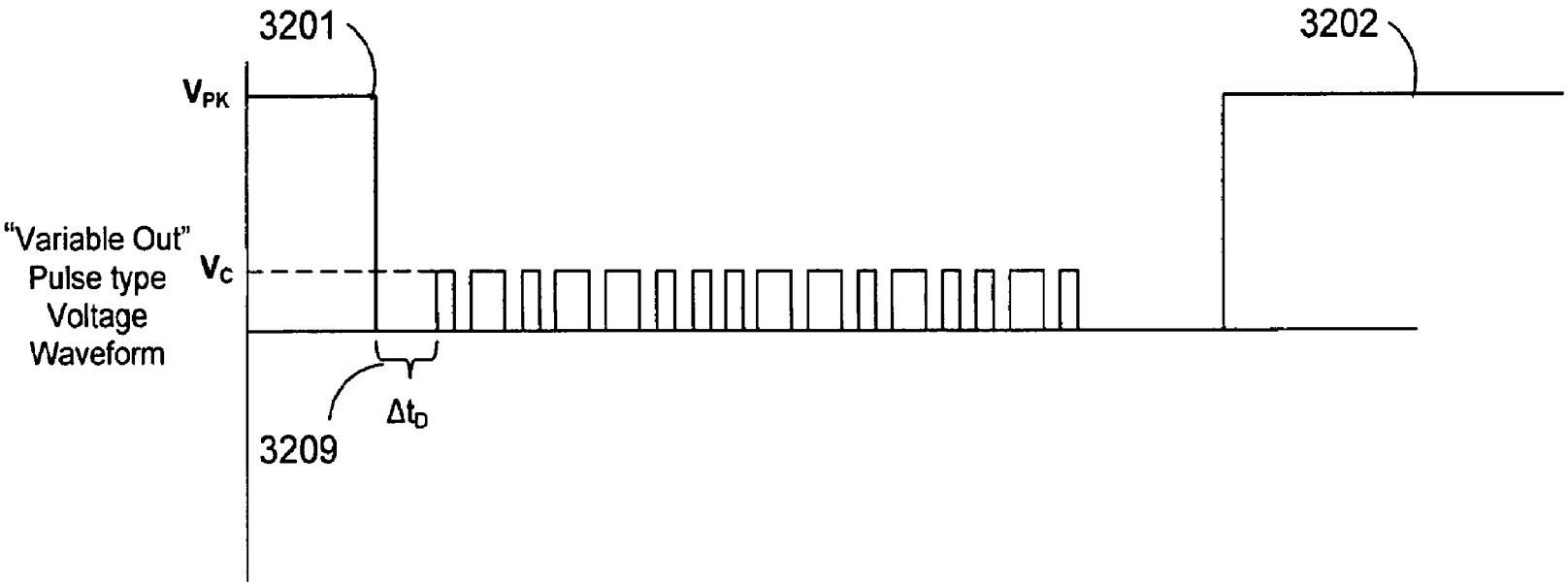
FIG. 33 An expansion of the off period of the track waveform in FIG. 32 showing Frequency Shift Keying (FSK) method being used to transmit digital bi-directional data.

Bi-directional information can be transmitted by any number of ways. However, in lieu of a system clock, data will be transmitted as serial asynchronous bits. An example is FSK-like data transmission shown FIG. 33, which is an expansion of the time interval between DC track pulses, 3201 and 3202. In this case, bits are represented by the different pulse widths, where we have arbitrarily assigned wide pulses to 0's and narrow pulses to 1's. In this case, the bi-directional data transmitted is the sixteen-bit word, 1,0,1,0,0,1,1,1,0,0,1,0,1, 1,0,1.

Figure 34:
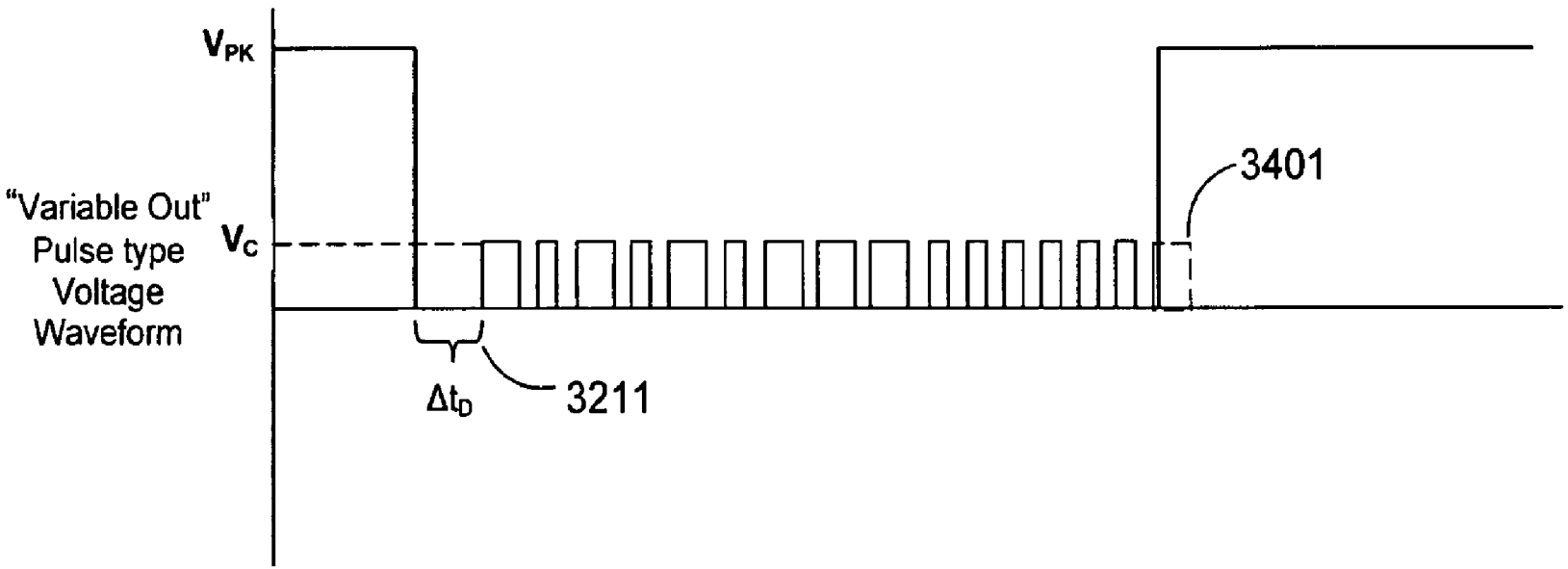
FIG. 34 An example of how the variable off-time of a PWM analog track power signal can interrupt bi-directional digital data transmission.

Bi-directional transmission in an analog environment has a consideration not present under DCC operation, namely that the gap period where the applied track voltage is off is variable depending on the throttle setting. In particular, in FIG. 32 the gap is shorter between pulses 3203 and 3204 due to an increase in duty cycle of the track power. In this example the 16-bit bi-directional data packets, 3205 and 3206 terminate before the next track voltage pulse occurs but data packet, 3207, is still transmitting when the leading edge of pulse 3204 occurs. This is shown in more detail in FIG. 34, which is an expansion of the time interval between DC track pulses, 3203 and 3204. The last zero, 3401, of the 16-bit bi-directional data sequence for this interval, 0,1,0,1,0,1,0,0,0,1,1,1,1,1,1,0 is abruptly terminated before it can finish.

This character of the analog gap shrinking as the duty cycle increases can make it difficult to have a predicable time interval to transmit bi-directional data. Some power packs do not go completely to 100% duty cycle but even so, there is no standard that can be depended on. We could arbitrarily choose some gap time and design for data within this gap. It would certainly work for bi-directional transmission at lower throttle settings. However, it would also limit the amount of bi-directional data transmission that we could achieve at slow and intermediate settings. It would seem that the best gap choice would be the time interval for variable amplitude full-wave rectified sine waves such as the example shown in the middle drawing of FIG. 2 where the gap, 207, is defined by the bridge rectifier insertion loss and the amplitude of the applied sine wave. The formula for this gap period, $\Delta t_G$, is $$\Delta t_G = \frac{2}{\omega}\sin^{-1}[V_F / A]$$

where ω is radian frequency of the applied sine wave (377 for 60 hertz), $V_F$ is the insertion loss of the bridge rectifier, and A is the amplitude of applied sine wave (usually about 18 volts). For these values, $\Delta t_G$ equals about 0.5 ms. Considering that a reasonable delay time, $\Delta t_D$ is about 100 usec, this leaves only about 0.4 ms for data transmission. Even at 100 Kbaud per second, this is about 40 bits. This would be sufficient even with the extra error correction bit for moderate data transmission.

We could also allow the bi-directional data to simply transmit until it is terminated by the raising edge of the next pulse. If we had a bi-directional detector on-board the remote object as well as the bi-directional transmitter, the on-board system would know when the data was being terminated. The on-board uP could simply verify the number of bits or words that were successfully transmitted during the gap, and provide this information to the controller during the next transmission. The transmission would carry on after the last successful bit during the next gap. This would allow full use of the variable gap time interval; more information would be transmitted at low throttle settings for Pulse Type waveforms and Phase Modulated Sine Waves than Variable Amplitude Sine Waves. In all cases, the amount of data transmitted would be higher at low and intermediate throttle settings, which are the most common on model train layouts. This is not an unreasonable approach for bi-directional transmission where the type of DC power pack waveform is not known and where different gaps might be present and vary by different amounts depending on power pack designs.

Another concern is how to chose which remote object would be transmitting. In DCC or analog systems where ID numbers are assigned, the remote object can be addressed and then requested to transmit any desired bi-directional data. However, in analog, we might want to avoid the complexity of selecting locomotives and data type and simply use pre-selected data types for each remote object (such as speed, fuel, etc.). For locomotives, analog does have the advantage of having only one train operating at a time on each block and hence we would only expect one locomotive to be transmitting bi-directional communication per power block. A locomotive could be enabled to send bi-directional information in programming mode using any power pack. In addition, software could be included to prevent helper locomotives selected during analog programming or when making up a consist from transmitting bi-directional information. However, there could be other remote objects connected to the track besides locomotives such as turnouts, accessories, and rolling stock with on-board sound and control systems that have useful data to transmit as well.

A solution to this problem would be to allow sequential data transmission where each operating locomotive or remote object in turn would transmit data during successive gaps. Once the last remote object transmitted, the first remote object would transmit again during the next off period of track voltage, followed by the third and so on in a continuous selection of remote objects in an endless loop. For instance, in FIG. 32, the first packet, 3205 could be for the first remote object followed by packet 3206 for the second remote object followed by 3207 for the third remote object followed by packet 3208 for the first remote object again. Since each remote object could transmit its ID number along with data, an automatic procedure could be easily implemented to sequence the transmission of each remote object in turn that would not require the operator to be involved.

Operating Cars: One area of model railroading where both direct and bi-directional communication are important is in the operation of electronically and mechanically equipped rolling stock. These so called Operating Cars or Automatic Cars have been available in model trains for many years and add considerable fun and variety to the play value of model trains. Generally, operating cars have been more popular in O'Gauge where there is more interior room for mechanical apparatus then in the smaller gauges. The possibilities for operating cars are as varied as the prototype and sometimes the imagination for model train rolling stock goes where no prototype train has ever gone before. In addition, some rolling stock will mimic the operation of the prototype but not perform the exact same function. Some old ideas for operating cars include:

Side dump cars where the contents of an open bin car can be dumped at the side of the track.

Log dump cars where the logs can be rolled off the side of the car.

Milk car where a miniature man moves large milk caldrons from inside a refrigerator car to a platform.

Barrel car where a miniature man pushes barrels from a gondola type car to a loading bin.

Lumber car where a Hyster loader removes lumber from a flat car.

Caboose with a smoke generator for the stove smoke stack.

Etc.

New ideas for operating cars include:

Stock car with animal sound effects. Different cars would have different animal sounds such as cows, pigs, sheep, etc. The animal sounds would respond to the speed or motion of cars to become more alarmed or agitated or become more content if the car was stopped.

Hopper cars where an internal view through the top hatches of the grain or other load would be seen to change as the simulated contents were emptied or filled.

Thomas the Tank passenger cars that can talk and where the simulated eyes can move to specific directions.

Simulated passenger silhouettes moving through passenger cars by animating these actions on LDC displays inside the cars.

Car load on fire, and requiring firefighter simulation to put it out.

Etc.

Some of these ideas have been described in our patents, namely U.S. Pat. No. 5,267,318, Model Railroad Cattle Car Sound Effects and U.S. Pat. No. 5,448,142, Signaling Techniques for DC Track Powered Model Railroads.

Many of these ideas were reserved for the toy train industry and rejected by prototype modelers as being to unrealistic. However, the advent of miniaturized electronics and improved motors can improve on all these designs and in many cases make them acceptable to serious modelers.

Some features are not specific to a particular type of car or load such as a car that has operating coil couplers, or one that produces squealing brake sounds, etc. These are effects that any car can have. If indeed modern design can produce operating cars that are acceptable to serious modelers, a common set of "car features" should be standardized to allow operating of these cars in a more prototypical and predicable way. For instance, each car might be equipped with some special feature like mooing cow sounds but all cars would have affects expected on any piece of rolling stock. We are proposing an on-board electronic system to be installed in rolling stock, hereafter called "Rolling Quantum" or just "RQ" that not only provides features common to all cars, but is expandable to allow customization of special features for specific "operating cars". Rolling Quantum is similar to our Quantum system installed in locomotives, hereafter called 'Loco Quantum" or just "LQ". Both have similar system features such as hardware components, the same types of signaling, similar sound system, motor controllers, lighting operation, etc. The differences are the features and effects that are specific to rolling stock. Currently, we propose that Rolling Quantum have any number of the following generic features and capabilities.

Speed and Motion: All Rolling Quantum will have a speed detector to measure real and scale speed, S, and for calculation of distance, D, traveled ($D=\int S(t)dt$), the progressive derivatives of speed, S, namely acceleration, A, ($A=dS/dt$), jerk, J, ($J=dA/dt$) and whip, W, ($W=dJ/dt$).

Track Voltage Detection: Just like Loco Quantum, Rolling Quantum would have detectors for track voltage to determine the analog throttle setting, Type 1-3 signaling detection, bi-directional transmission and detection, and DCC detectors.

Neutral State and Associated Sound and Mechanical Effects: In analog Quantum equipped locomotives enter a Neutral state when the voltage is below V-Start by a predetermined value and the speed is measured as zero. DCC has a similar condition of the throttle setting being at zero and the speed being measured as zero. Having a speed detector on-board rolling stock allows each car to have a Neutral state based on the same conditions as Quantum equipped locomotives. In Neutral, different car sounds can be activated, such as live stock quieting down, air releases, etc. as well as certain mechanical functions operating or being enabled or disabled. For instance, a dump car could be disabled from dumping its load, even under command, until it is stopped.

Grade and Sway Detection: While we can determine speed and calculate acceleration, jerk and whip, this is only in the direction of motion of the car. Rolling Quantum could include inclinometer to indicate current grade conditions or possible derailment of car, and/or a side-to-side pendulum like detectors to measure lateral car sway and/or accelerometers to measure motion. With a bi-directional system in place, this information could be used to control an operator's pneumatic chair to reproduce the bumps and movements of the model locomotive.

Trip Odometer and Total Mileage: The distance traveled would determine when a car need simulated or real maintenance and the proper time to give it a flat wheel sound or smoking hot box or other maintenance related effects.

Time Log: The time the car has been operating could also be logged. This time could be measured from when the car received fuel or ice or lubrication or other variable that is consumed or changed over time. Total time since the car began operation could also be logged to give an indication of the car's age. This combined with the cars age could also determine when real or simulated overhaul was due or when lubrication was due.

Signal Transmission from Car to Car: Bi-directional communication from the locomotives or the cars, cannot give information about where within a train a particular car is located, or how many cars are in a train, or which way individual cars are aligned. Progressive car detection and identification either from car-to-car transmission or track transceivers could provide each car with a position number and direction and the last position number would indicate the number of cars. Car-to-car communication could be done in a variety of ways: 1) LED transceivers could be located at the end of each car and directed towards each other, preferable out of sight like under the coupler pocket, or directly transmitted and received in the coupler pockets, 2) electrical connection through conductive railroad couplers, air hoses, or car collision dampeners making physical contact with each other, 3) hard wiring from car to car using add-on connecting wires that connect from one to the other.

Power Connections from Car-to-Car: One of the biggest and most persistent problems in model railroading is electrical pickup from the track. Track and wheels can get dirty or an insulating chemical patina can form on metal wheels to interfere with electrical contact. The best contacts tend to be scraping or slipping metal against metal such as a sliding shoe on the track rails since they tend to be self-cleaning. Wheels make poor electrical pickups since they contact only over a small area and there is no self-cleaning action except perhaps on locomotives where there can be some slippage on the rails especially with heavy loads. Rolling stock has no such advantage. In addition rolling stock usually have less wheels in contact with the rails than locomotives that can be used for pickup and less weight pressing down that can help penetrate through the dirt and oil on the rails. In addition, contacts from the wheels to the electronics also have a disadvantage for rolling stock. While these contacts are generally wiper type on an axle or on the wheel, care must be taken to minimize friction since it is important that cars roll easily. Minimizing friction, of course, reduces the ability of these contacts to self-clean or to penetrate dirt and grime. One way to improve electrical contact is to provide electrical connection from car-to-car. This would allow many more electrical connections and for long trains it would virtually ensure reliable power to every car. This certainly applies to the locomotives as well where power can be drawn from other locomotives in the consist of from the rolling stock. Car-to-car connections can be done in a number of ways: 1) through the couplers, 2) through the air-hose, or 3) add-on wires connecting from car to car, etc. The difficulty is to find a way that is not visually non-prototypical or requires an effort on the part of the operator to make the electrical connections. If power connections can be made from car-to-car, then car-to-car communication can also be done using these same connections.

On-Board Electronic Memory: Rolling Quantum should contain read/write Long Term Memory (LTM) means that allow programming behavior parameters such as volume, ID numbers, etc. as well as car related parameters such as the real or simulated contents of the car, its value, its owner, point of departure and destination. Memory means could also record the cars position in the train (if known) or the amount of time since livestock has been watered or the amount of ice remaining in older reefer cars or the amount of fuel remaining in mechanical reefers. Memory means could also be programmed to record the name of the car's owner (UP, SP, N&W, etc. and the build date from the side of the car) and the cars serial number. Memory means could also record the real model railroader's name as the owner of the model; this would be valuable in large club layouts.

Car Transceivers: In model railroading, like prototype railroading, it is important to have information about the cars identity, its contents, value, its owner, and destination and the real or simulated condition of the car and, of course, the location of the car on the layout. Some of this information could be transmitted via bi-directional communication back to the controller but it would need to be queried on a car-by-car basis or the continual flow of such information from all cars could overburden the communication system. In particular, car location is not known directly by the car.

One solution to the this problem is to use "Car Transceivers" located under each car, perhaps at each end, to transmit information to "Track Transceivers" located in the track or at trackside. Information could include the cars status, ID number, etc., which would also locate the car on the layout. Track Transceivers could also communicate to the car information about its location within the train which would be stored in the Rolling Quantum's LTM, each car being given progressive train location ID numbers as they passed the track transceivers. The last car and the trackside detector would both know that is was the last car and how many cars were in the train.

These Track Transceivers could also transmit back to the car its measured real weight. This is a measurement that would be useful to know in a hump yard environment where the cars weight determines how much braking must be applied. An alternative to car transceivers to determine a car's location is to use a bar-code label under the car that could be read by a bar-code reader in a trackside detector. Present LED technology would be favored for the Car Transceivers and Track Transceivers. A modulated IR carrier to transmit information would also be prudent to minimize ambient IR from sending false data.

Trackside Detection Reports: Even if many cars in a train were not equipped with Rolling Quantum, the trackside detector could still maintain a count of the total number of cars. If the last car was Rolling Quantum equipped, it could be told of the total number of cars in the train and any other information about hot-boxes, flat wheels, etc. This information could be sent to the controller directly by the trackside detector or via bi-directional communication by the last car, which would also be received by the locomotives. This information could also be communicated to the locomotive via the controller. This information could be turned into a specific verbal detector message that could be heard from the locomotive, caboose, radio equipped work cars, or at the control center. Detector messages report the problem type (flat wheel, hot box, etc.) and car number, the number of cars in train, etc. Since most verbal components of these messages are the same, prototype detectors use individual recorded message that are combined into a full message depending on the needed content; different verbal numbers, problem types, etc. are substituted into the message as required. This same approach could be done at the controller or at the locomotive to be heard by the operator. In this way, even though detector messages may be long and detailed, only one set of message components need to be stored.

Proximity Transmitters: The on-board car transceivers could also be used for turnout proximity detection. This is important when cars back up through turnouts. A car could be command to change a turnout to the right or left position. This command would be detected by a transceiver located at the lead track into the turnout, which would cause the turnout to respond.

Operating Couplers: A new coupler design could be installed on cars (or locomotives) that would allow a Rolling Quantum car to be uncoupled at either end from other cars under command. In addition, if cars were equipped with car-to-car transceivers that detected when they were within proximity of each other, this could be transmitted via bi-directional transmission down the track to alert the operator to slow down. If the couplers also could provide information to the on-board uP, this could tell the operator when a successful coupling or uncoupling had occurred. Any coupler operation would be accompanied by coupler sound effects such as lift-pin, knuckle opening, knuckle closing, air lines parting, air brake release, etc.

Magnetic Wand Operation: Rolling Quantum could use reed switches, Hall effect devices, etc. that would respond to the presence of a permanent magnet (magnetic wand) placed near predetermined positions on the car to open car couplers, change volume of the sound system, system shut down or start up the car (such as refrigeration motors in mechanical reefers), cause the car to unload its contents, open hatches, etc. Alternately, an LED wand with on-board receiver could be used as well to perform these types of functions. The advantage of magnetic operation is that the receiver can be located inside the car body and out of sight such as under the roof.

Drawbar Tension and Compression: Couplers could have strain gauges or other means to detect tension or compression in the drawbar to indicate if the car is being pushed or pulled and by how much.

Car Load Affects: The total number of cars and perhaps the total simulated weight from car-to-car transmission, track-side detectors, track transceivers, or drawbar tension and compression, could be used to adjust the simulated acceleration and braking (deceleration rates).

Real Braking Action: A method to apply real functional brakes that would act like the prototype. Prototype trains have two pneumatic braking systems, one for the locomotive and a second for the rolling stock. Both use air to activate the brakes. For the model, specific Rolling Quantum equipped cars could have real brakes applied whenever a braking command is sent. This command would be progressive; that is, the longer the command was sent, the more the brakes pressure would be applied. If the command was stopped, the last braking value would continue. To release the brakes a second "release brake" command would be sent which could also be progressive. The longer the command was sent, the more the simulated brake pressure would decrease. Whenever rolling stock brakes were decreased, the locomotive should produce air release sounds.

Squealing Brake Sound Effects: This would be based on a known signal from the operator that car brakes are being applied. The brake sounds could be automatic and speed dependent and stop when the car stops as detected by the on-board speed detection. Squealing brake sounds would be present regardless of whether there are real brakes or not. Squealing brake sounds could also be trigged by a direct command from the controller.

Safety Brakes: A safety design of modern prototype brake systems require that brakes be applied when air pressure is reduced rather than when it is increased. This ensures that if cars became disconnected from the locomotive, the common brake air lines would depressurize and all of the common air brakes would be applied automatically to stop the cars. Model railroading has the same problem that prototypes do on grades where cars can become detected from the rest of the train and start down a long grade, picking up speed along the way until they derail. If no car-to-car communication is available, there is no indication that the cars have become uncoupled from the locomotive. However, each of the Rolling Quantum cars will know what speed they are going. If the locomotives are continually sending speed information, the cars can deduce that their speed is higher than the locomotives and in the opposite direction and can apply brakes to stop the cars. Once the cars are stopped and the locomotives recoupled, a command can be sent to release the car brakes.

Charging the Brake Lines: Prototype trains will need to charge the brake lines and the air reserves in each car before departing. The pressurizing of the brake line makes a definite sound a little like steam sounds in old radiator heaters in homes.

A global command could remove all brakes on all cars within a block or DCC power district. A command could also be used to release brakes on all Rolling Quantum cars that belong to a consist. Brakes could also be released from a command from the locomotive that travels from car to car down the length of the train.

Yard Action: Brakemen can release the brakes on prototype cars using a hand lever under the car to allow movement around the yard such without requiring connecting the brake lines to a the switch locomotive. This lever applies pressure from the air reserve on the car to the brakes. There could also be a similar method to release brakes on a car using a hand-held magnetic wand to activate a reed switch or apply a handheld LED wand to the transceivers under the car. A second action of a wand could reapply the brakes. We could also mimic the prototype operation by limiting the number of times that brakes can be applied before the air reserve is consumed.

In the case where the brakes have been hand released, the automatic method of applying brakes whenever a measurably higher difference in speed between car and locomotive would be disabled. This would allow a switcher locomotive to push cars off to sidings to coast to a stop. These types of movements would be accompanied by coupler crash sounds whenever cars were coupled or uncoupled and would not have the air-line release of parting air hoses.

Light Bulb Operation: Most freight cars did not have lights but some did. This is certainly valuable for passenger cars and cabooses and valuable for special effects.

Curve Detection: On selected cars, Rolling Quantum will have a means to detect that a car is entering or in a curve. Freight cars can make different sounds in curves and have different effects.

Squealing Flanges: This might play continual squealing sounds whenever a curve is detected. The sound would be random sequenced as described in our U.S. Pat. No. 5,832,431, Non-Looped Continuous Sound by Random Sequencing of Digital Sound Records, and be speed dependent. Squealing flanges could also be produced under direct command from the controller.

Smoke Generator: This could be part of the Rolling Quantum system since there are a number of applications where this could be useful.

Hot Box: Prototype bearings on car trucks can become hot if not lubricated properly or if they are defective which will produce a lot of smoke from the bearing box. The smoke generator on the model car could emit smoke in the area around the truck or a particular wheel along with squealing or grinding sounds to simulate this effect. In addition, this action could be timed to the last real or simulated maintenance activity. If a Hot Box were enabled, it would alert any trackside detector that the train passed through.

Hot brake effect. Smoke is emitted near wheels on both trucks to simulate the burning off of brake pads under heavy braking. This could be automatic under the operation of the brakes described above or under direct command by the user. Lighting effects near the hot box could simulate a fire.

Burning Load: Smoke generator could be used to simulate that a load was on fire. On-board lighting could also add to this affect by simulating the flickering and varied light given off from a fire.

Clickity Clack Wheel Sounds. This is such a common occurrence and is often heard after the locomotives have passed by and their dominate sounds fad away in the distance. Clickity clack sounds would be speed dependent. These sounds might be on all the time or perhaps they would be triggered as the locomotive passed over a highway grade crossing. If each car knew its position in the train, these sounds could be progressive such that each car would produce these sounds in turn and then fad away in the distance. In other words, the $n^{th}$ car would know that based on when the command was sent and its value of speed, to wait until it was approaching the grade crossing to make these sounds and then to fad them out after it has passed by. An observer at trackside would experience the sounds. There could also be specific commands to trigger special clickity-clack sound over turnouts or cross over tracks. Alternately, a trackside transmitter or transceiver could communicate to each cars "Status Transceivers" in turn to trigger the Clickity-clack sounds as it approached the grade crossing and a second track side transmitter to turn off the Clickity-clack effect. The turn off or fad out could be timed based on the speed of the car and when the effect was triggered.

Flat wheel: This is the continual thump-thump sound of a defective wheel's flat area hitting the rails over and over. This is special kind of Clickity-clack sound and would be operated in the same way and respond to the same commands. A flat wheel effect might be enabled by a maintenance timeout setting in Rolling Quantum. This would also alert any trackside detector that there was a car with a flat wheel.

Rail Whine: This is an effect that increases in frequency and volume with increased speed. Since this is a continuous sound, it would most likely be created as a Random Sequence Sound, as described in our U.S. Pat. No. 5,832,431, Non-Looped Continuous Sound by Random Sequencing of Digital Sound Records, Doppler Effect. This could be progressive and based on speed. When the Doppler command was pressed to trigger the Doppler effect at a specific location (called the "Doppler Trigger Location" or "DTL"), locomotives in a consist would each display the effect in turn delayed by a certain time based on its known speed to get to the DTL, followed by each car delayed more and more to place it at the same DTL. The observer listening to the train pass the DTL would experience each car passing in front of him going through the Doppler effect individually just like it does for the prototype. If the speed calculation were not exact, the observer might experience the Doppler location with some randomness around the DTL or a movement of the Doppler location gradually in either direction around the DTL. This is based on the same concept as progressive Clickity-clack described above. In fact, these two features would normally be combined. If a trackside transceiver triggered each locomotive and car in turn, then the DTL would be constant and known.

Progressive Slack Action: Slack action that would be progressive from car to car. This could be based on detection of movement, or timed from the car knowing its position in the train or from when the couplers make contact to each other or from measurements of changes in drawbar tension or compression detector. In the latter case, different sounds could be generated depending on whether the cars were being pulled or bunched up. Coupler to coupler signaling through conductive couplers would work well since compressed couplers could be designed to provide no signal or a different type of signal while stretched couplers provide signals that the couplers have been pulled tight.

Car creaking and groan sound effects: Prototype cars respond with all kinds of creaking, clunking, bending, pops, and grinding sounds, that result from its motion on the track. Rolling Quantum could produce these sounds as a function of speed, acceleration, jerk and whip and/or from the output of any on-board accelerometers or motion detectors. These sounds would also change during Doppler and progressive Doppler operations.

Reverb and Echo: These are sound effects that apply to both locomotives and cars. Echo is apparent in area where there are reflecting surfaces a long distance away such as mountains, canyons, etc. while reverb applies more in the city with buildings around or in tunnels and cuts. The same command that applies to these features to Loco Quantum would also apply to Rolling Quantum. However, for a moving train entering a cut, these effects could be progressive so a train entering a tunnel would start to echo one locomotive or car at a time. The same is true regarding turning off echo or reverb when leaving a tunnel.

Car Serial Number Selection: Freight cars have long serial numbers printed on the car side along with the build date, inside and outside dimensions, total allowable load, etc. It might be useful to be able to select cars by their serial numbers either to operate an effect to get a status report of their car specifications or cargo. This is different than their train position ID, or consist ID, or even the car ID setting programmed by the user.

Coupler Operation on Uncoupling Track: On-board transceiver(s) could also allow either coupler to be opened or possibly closed by a transceiver in the track. Uncoupling is normally done with KD type couplers by a magnetic strip in the center of the track that is used to attract the ferromagnetic air hoses that open the coupler knuckles. For legacy issues, the transceiver in the track could be combined with the magnet to allow uncoupling of either KD type or Quantum type couplers. This would also free up the air hose under the Quantum coupler for another purpose other than magnetic uncoupling or at least would allow it to be more decorative and realistic looking than the KD design.

Radio Cab Chatter: Car-to-car transmission or bi-directional transmission could be used to produce simulated radio dialog between the crew in the locomotive and the caboose crew or other cars that may contain crews with radios. Stored messages could be maintained in memory in RQ's and individual appropriate responses to radio communication could be heard in remotely located cars that are logical to the type of communication such as reports from the brakemen or conductor about the condition of the train. For instance, the engineer's voice from the locomotive's radio asking if there was a hot box on the train and the response from the caboose's radio would be the correct answer and so on.

Cargo Damage Estimate: Acceleration, jerk or whip could allow the uP to determine how much damage was done to a simulated load. Sound effects, such as crashing sounds, thumping, bellowing livestock, etc. could be related to these variables.

Smell: optional on-board atomizers to produce smells of different types of loads, such as animals, grains, chemicals, lumber, cooking in the caboose, Christmas trees, fruit, etc.

Local Positioning System receiver. If a Global Positioning Systems (GPS) can be designed for a planet, then a smaller system can be designed for smaller spaces; in particular, for the model train layout. If such a system was installed, then each car or locomotive would know its precise location on the track system. This information can be relayed back to the controller to show a graphic of the train's position and movement on a simulated track layout plan. Even if the cars accidentally broke away, this could also be shown graphically in real time.

On-board Battery Back-up. This would allow the rolling stock Quantum system to remain working even if track power is lost. This is an advantage in three-rail AC powered trains where the track power is interrupted to change the locomotive's directional state. In addition, sound of live stock, escaping air, creaks and groans could continue if the event of a derailment or short circuit on the track. We might also specify high value capacitors to do this job, which sometimes use rechargeable battery technology to make these devices.

State Dependent RC Operation: This allows expanding the number of remote control operations in excess of the limited number of remote control signals or commands available to the system as described in our U.S. Pat. Nos. 4,914,431 and 5,448,142.

Expandable System: This includes motor drives, additional lighting, solenoid drives, UART, serial ports, etc. to remote uP based accessory boards, etc.

Downloadable Sounds and Software: Software and sound records could be downloaded via the systems serial ports, down the track using DCC or other communication standard, or using the Car-Transceivers from a Track-Transceiver unit or some special program apparatus designed to utilize any of the systems communication ports. Special program apparatus may allow increased data transmission rate with less electrical noise than downloading information on the layout.

Take Control: Many features are automatic and occur as dependent state features. That is, the features or sounds may be activated by the state of the locomotive such as directional lighting. Features can also be controlled directly by command. When a feature that is normally automatic is operated by user, and does not revert back to automatic behavior, we call this a "take control feature". For instance, brake squeal may sound automatically when ever RQ or LQ remote objects slowed down. However, if the operator sends a command to produce the squeal effect and if this is designated as a "take control feature", the remote object will no longer make this sound automatically; the user has taken control. There are a number of ways that automatic behavior can be restored. 1) A command could be sent restoring all or individual features back to automatic. 2) The locomotive can enter a state like Neutral that would restore some or all take control features; for instance, the brake squeal might revert to automatic after entering Neutral. 3) Automatic behavior of some or all take control features might be restored when using other commands, such as the locomotive start command where it would make sense that a locomotive begin with all automatic behaviors. 4) Automatic behavior for analog might occur with an interruption of the track power.

The electronics would also help to give the car weight. It might be possible to factory install electronics in flat cars and perhaps the components could be placed and covered with decorative plastic to simulate under-car detail.

Rolling Quantum

Figure 35:
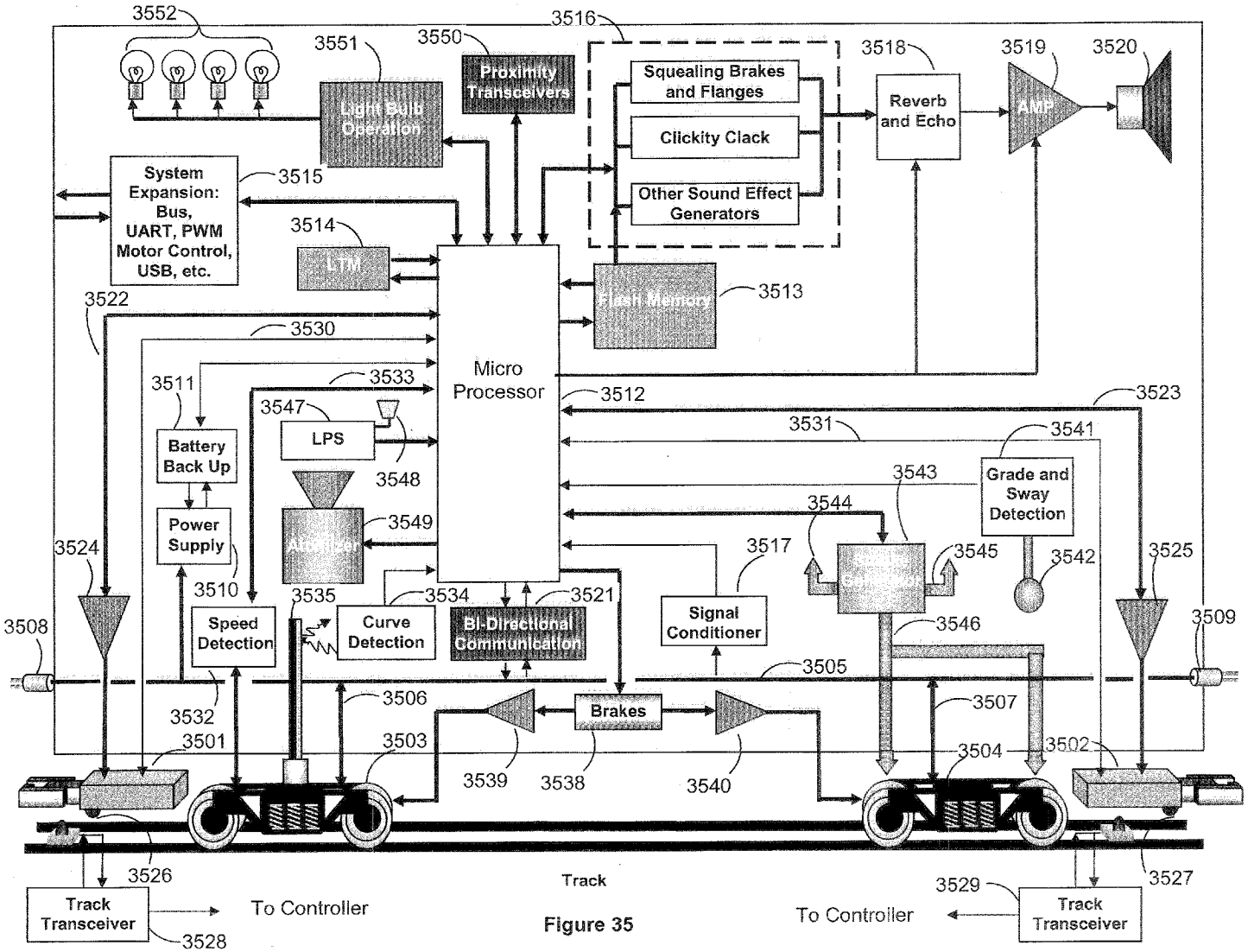
FIG. 35 A block diagram of Rolling Quantum, an on-board feature control and sound system for general application in any remote object on a layout but particularly suitable for rolling stock.

FIG. 35 shows a block diagram of a Rolling Quantum system. The car is represented by it trucks, 3503, and 3504, and the coupler/coupler-pocket assemblies, 3501 and 3502. Heavy connecting lines in this drawing represent multiple signals and arrows on lines represent direction of communication between elements. Connections to the track are shown as double arrows, 3506 and 3507, which represent both power connections and signal transmission from Rolling Quantum to the track, and from the track to Rolling Quantum (here after called "RQ"). Common track power/signal bus from all electrical pickups is shown as line, 3505, which is also applied to car-to-car, connectors, 3508, and 3509. Although these connectors are shown as distinct from other apparatus, they could be combined with the coupler assemblies, 3501, and 3502, which would allow automatic car-to-car power connections when cars are coupled together. Track Power is connected to the power supply, 3510, which supplies stable electronic power to the RQ system. This power supply can be as simple as a linear regulator design or a more efficient switching regulator to save power and provide higher internal voltage at low throttle settings. The optional battery backup, 3511, can provide continuous power through interruptions in track voltage and can provide power to a low power clock IC to provide continuous real or fast time information. To prevent unneeded battery discharge, battery backup, 3511, could contain circuitry to automatically disconnect from the power supply after a predetermined time period after track power has been removed. In addition, Battery Backup, 3511, can also be controlled by microprocessor, 3512. The microprocessor, could also command the battery backup to disconnect from the power supply after a predetermined time after track power has been removed, and could also monitor the battery's charge state and could also affect the charge rate.

Figure 39:
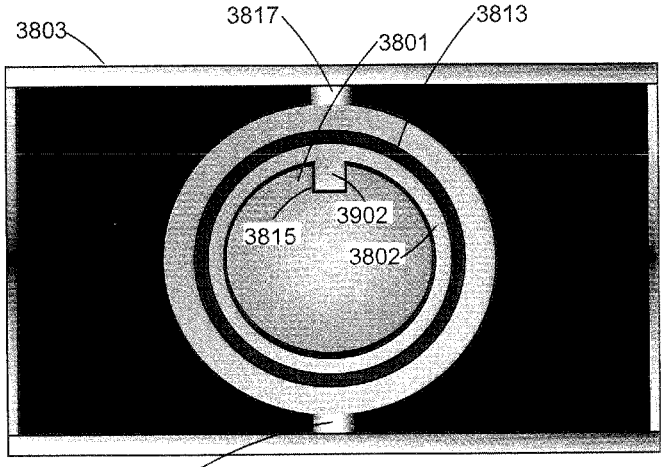
FIG. 39 Cross sectional drawing of coupler in FIG. 38 showing details of moving drawbar shaft.
Figure 40:
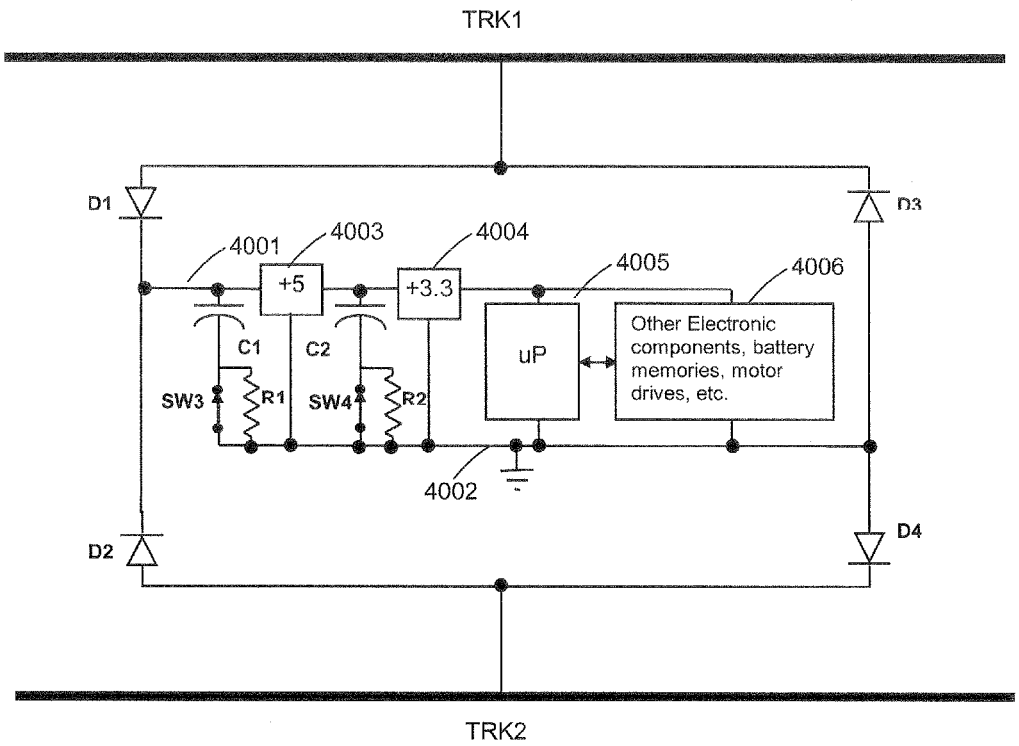
FIG. 40 Schematic of two-stage power supply used in Quantum Loco which can also be used in Rolling Quantum.

A simple two-stage power supply that is being used in Loco Quantum is shown in FIG. 40, which would also be applicable to Rolling Quantum. This is similar to the power supply described in FIG. 25 but is drawn to more clearly see its connection to track power. A full wave bridge made up of diodes, D1 through D4, convert track power supplied on rails TRK1 and TRK2 to positive DC at node 4001, with respect to internal ground at node, 4002. The voltage rating of C must accept the peak operating track voltage between TRK1 and TRK2. The +5 volt regulator, 4003, supplies voltage to the second filter capacitor, C2, and second linear regulator, 4004, which supplies a steady 3.3 volts for the main system microprocessor, 4005, and other electronic components, which includes RAM, ROM, LTM, motor drives, battery back up charging and shut down circuitry, and all other components requiring electronic power in FIG. 39. These components are represented by box 4006.

The two-stage design allows C2 to have a much higher capacitive rating and much lower voltage rating than C1 without requiring large physical space. This provides a robust 3.3 volt supply with reduced ripple for operating at low track voltage and maintains stable power during brief interruptions in power from poor track pickups, or opens or shorts that may occur from faulty track, turnouts, derailments, etc. Because of large currents required to charge capacitors C1 and C2 during initial power up, microprocessor controlled switches, SW3 and SW4, would be opened by default to limit the current through resistors R1 and R2 until near full charge is obtained. SW3 and SW4 can also be independently and rapidly turned on and off via microprocessor to better control the charge rate.

SW3 and SW4 may be simple relays or most likely would be electronic pass devices such as bi-polar transistors or FETS. The latter has the advantage that inrush current can be limited by IDS. SW1 and SW2 can be combined to one switch that connects between ground, 4002, and a common node for the negative terminals of C1 and C2. In this case, the two resistors, R1 and R2 would be combined into one currently limiting resistor connected across this single switch.

The power supply circuit in FIG. 40 is design to provide stable voltage for DCC where the track voltage is constant at a high value (14 to 40 volts depending on scale and power supply) and for Analog where the truck voltage can be reduced to low voltages in the 2-5 volt range, where it is difficult to generate sufficient voltage for on-board electronic circuits. Analog operation benefits from reducing insertion loss for various components to a minimum; diodes D1 through D4 can be schottky types which have forward turn-on voltages that are usually 0.3 volts less than n-p diodes and the +5, and +3.3 volt regulators, 4003 and 4004, can be low drop out (LDO) types. In addition, after power up, the two switches, SW3 and SW4, can short out the R1 and R2 resistors, to maintain the highest charge on C1 and C2 and minimize ripple.

Figure 41:
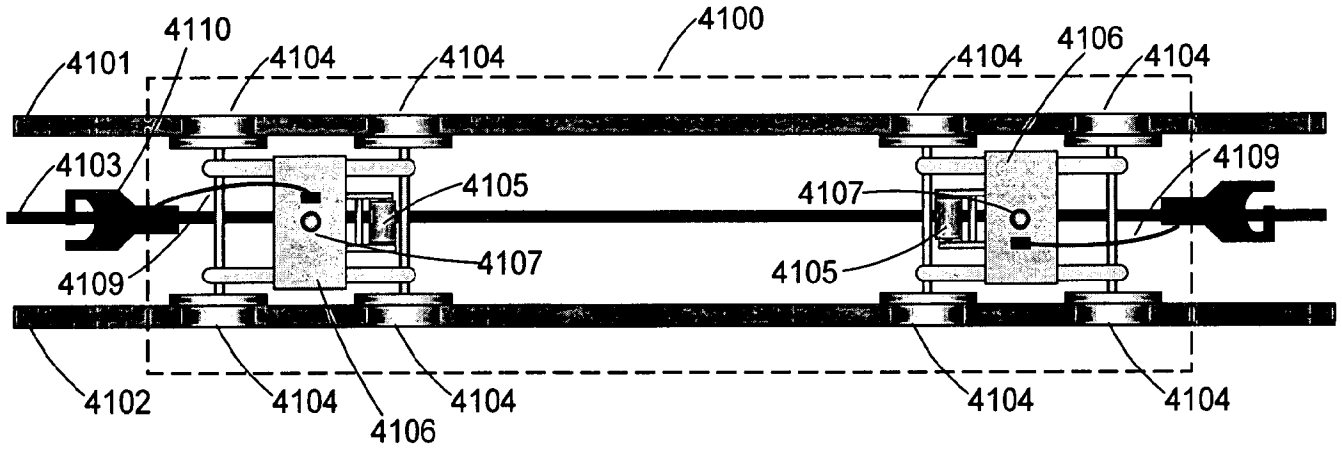
FIG. 41 Diagram showing method of transmitting track power from railcar-to-railcar through the couplers on three-rail track.

A number of issues and methods regarding connecting power from car to car are shown in FIG. 41 through FIG. 53. For railcars that use knuckle couplers it would be advantageous to use the couplers to connect power between cars. FIG. 41 shows the dotted outline of a rail car, 4100, mounted on three-rail consisting of outside rails, 4101, 4102, and center rail, 4103. Three-rail operation usually has both outside rails electrically connected together with power applied between the center rail and these two outside rails. The center rail is shown in red and the two outside rails are shown in green to denote that these conductors are at different electrical potentials. Power pickups for locomotives or rolling stock are done through the wheels, 4104, to connect to the outside rails and through rollers, 4105, to connect to the center rail. Usually the outside rail is connected directly to the railcar chassis through the conductive truck assembly, 4106, and mounting studs, 4107. Because there are usually many wheels making contact to the outside rails (8 in this example) and much less for the center rail (2 in this example), outside rail contact is usually much better than center rail contact. In order to improve power pickup to the center rail when a number of such cars are coupled together, electrical connections, 4109, are shown from the center rail rollers to the conductive couplers, 4110, which are insulated from the outside rails.

Figure 42:
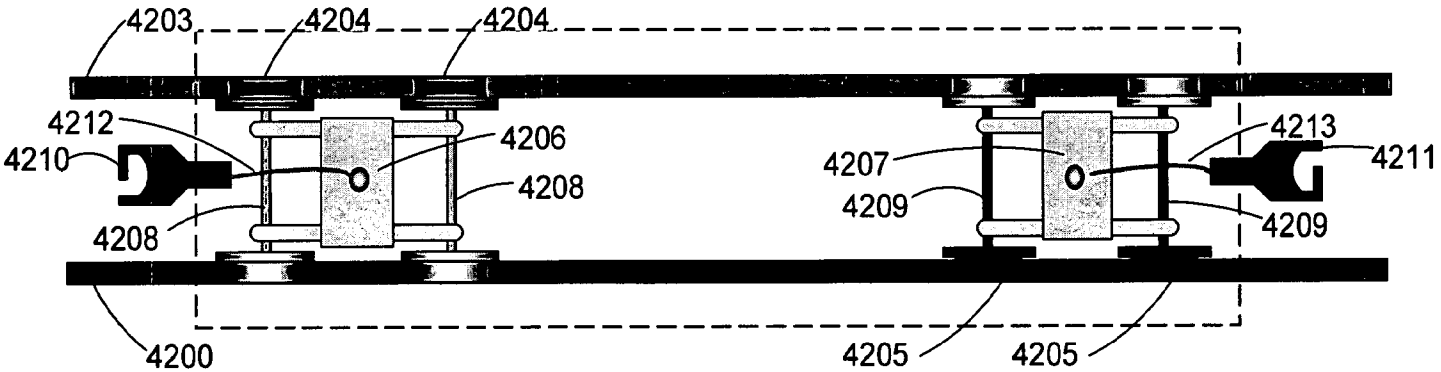
FIG. 42 Diagram showing a similar method of connecting power to railcar couplers for operation on two-rail track.
Figure 43:
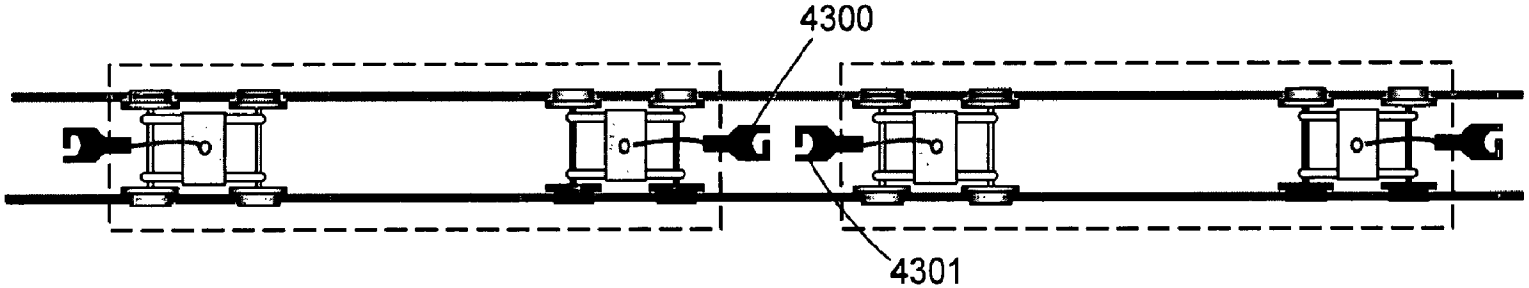
FIG. 43 Diagram showing that a short circuit condition can arise when cars wired as shown in FIG. 42 are coupled together on power two-rail track.
Figure 44:
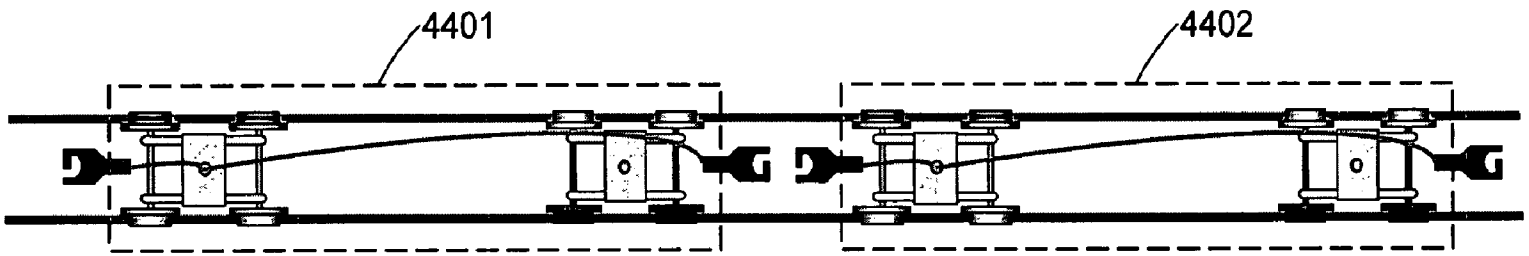
FIG. 44 Diagram showing how the short circuit condition in FIG. 43 can be partially obviated by using only one rail power pickup in each rail car.

Two-rail model train operation applies power between the two rails as indicated in FIG. 42, where one rail, 4200, is shown in red and the other rail, 4203, is shown in green. Two rail trucks, usually use the wheels on one side for pickup while wheels on the other side are insulated. In FIG. 42, the insulated wheels are shown in silver while conductive wheels are shown at the same potential as the rails they contact. Hence wheels, 4204, and axles 4208, are shown in green and wheels 4205 and axles 4209, are shown in red. Power is transferred to pickup assemblies, 4206 and 4207 through conductive fingers that ride on the axles. In an attempt to conduct power from one car to another, wires 4212 and 4213, are shown connecting power line from each truck to adjacent conductive coupler assemblies, 4210 and 4211. In this example, coupler 4210 is at green potential while coupler 4211 is at red potential.

Figure 45:
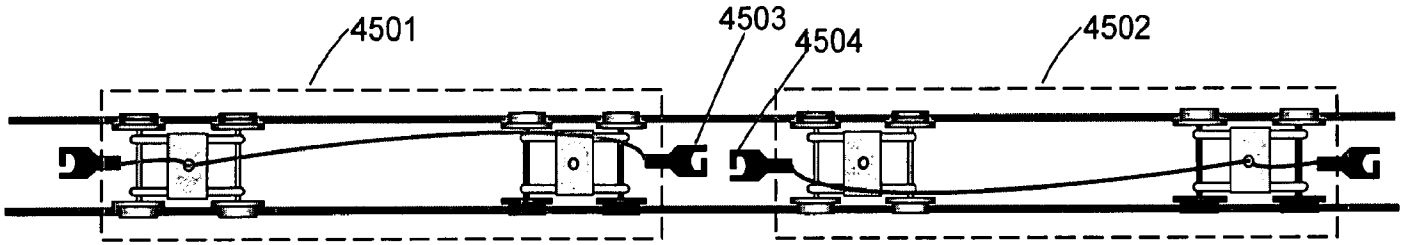
FIG. 45 Diagram showing why the method in FIG. 44 will fail if any car is rotated 180° with respect to other cars on powered two-rail track.

This method will, of course, not work since when cars are coupled together, the potential of each cars connecting coupler will be opposite and a short circuit will occur. This is evident in FIG. 43 where coupler 4300 is at red potential and 4301 is at green potential. It does no good to rotate either car by 180° since the both the pickup position and the couplers change position and there will still be a short circuit. We could simply choose one of the two rail potentials and pass it along from car to car such as the common green potential shown for cars, 4401 and 4402, shown in FIG. 44. This method has two disadvantages. First of all, only one of the two required potentials are conveyed from car to car. Since the power pickups are symmetric, there is no advantage of picking up one side rail pickup over the other. Even if many cars are connected together in this manner, the red pickup in any one car will only be from one side, which is only two wheels in this example. The other disadvantage occurs if one of the cars is rotated by 180° as shown in FIG. 45, where car 4502 is shown rotated from car 4501. Since the pickups also rotate, the polarity is changed from green to red and the adjacent couplers, 4503 and 4504, in the two cars are shown as having opposite polarity which would create a short circuit if they connected.

Figure 46:
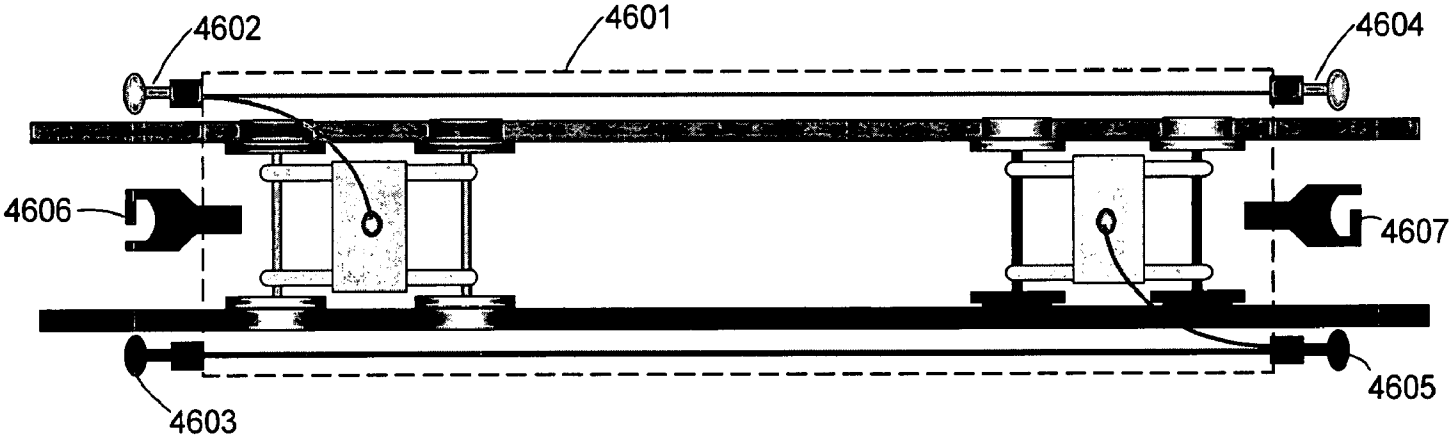
FIG. 46 Diagram showing how coupler dampers used on European railcars can be used to transmit power from railcar-to-railcar.

Connecting both polarities of power from one car to the other may be easier for some European rail cars that have coupler dampers, 4602, 4603, 4604, and 4605 on each side of the couplers as shown in FIG. 46. The dampers provide cushioning during coupling and can also provide smoother and less damaging train startups and braking by minimizing the effects of slack action. Here the green potential is connected to dampers 4602 and 4604 while red potential is shown connected to 4603 and 4605. There is no electrical connection shown for couplers 4606 and 4607.

Figure 47:
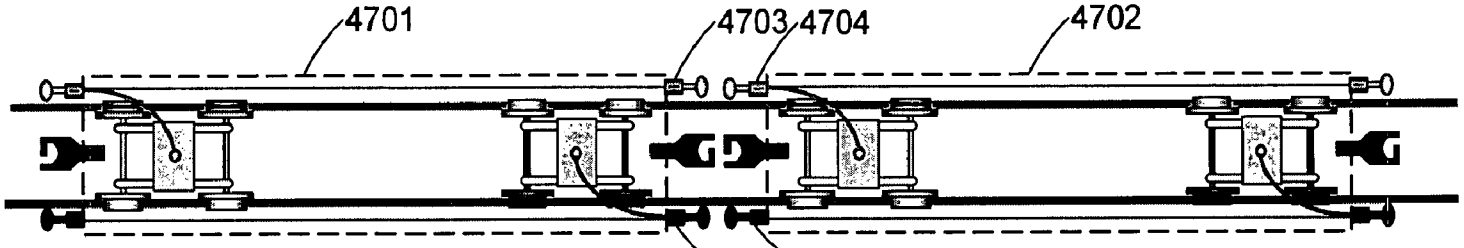
FIG. 47 Diagram showing how cars equipped with electrified dampers can transmit power from railcar-to-railcar without short circuit conditions, irrespective of car orientation.

Two such cars are shown in FIG. 47 where car 4701 and 4702 are shown to have the same potentials for adjacent dampers, 4703 and 4704, and adjacent dampers, 4705 and 4706. If one of the cars is rotated, both the dampers change sides as well as the pickups so the potentials between adjacent car dampers will remain the same. If the car dampers connect with each other and stay connected during operation, this method would work for transferring power from car to car. In addition, since the couplers are not used for power connections, they can perhaps be used to send electrical signals from car to car.

There are other connection methods to send power from car to car. For model passenger cars, the coupler could be used to conduct one polarity while the striker-plate on the passenger diaphragms at the end of each car could conduct a different polarity. On model freight cars, the coupler could conduct one polarity while electrical connection between the decorative air hoses could conduct a second polarity. However, connecting air hoses may require intervention by the model train operator to do this operation by hand. The operator would prefer that simply coupling the cars together would automatically make reliable electrical connections between cars. To do this, we need a coupler that can conduct more than one polarity to a second coupler.

Figure 48:
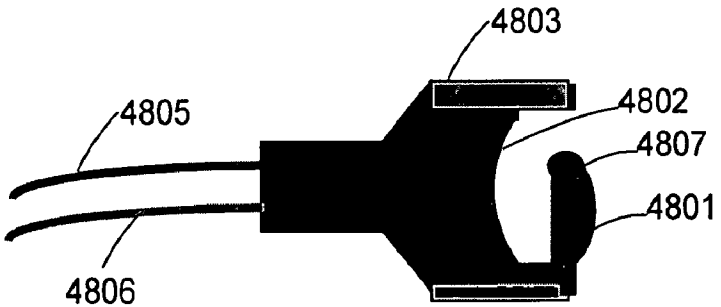
FIG. 48 Coupler design that has two electrical contacts to allow power to be transmitted from railcar-to-railcar.

A new coupler design is shown in FIG. 48. Here the black areas represent non-conducting material while the green and red areas represent conducting materials that are electrically insulated from each other. The knuckle red area, 4801, is connected electrically to pocket red area, 4802, which are both electrically connected to the red conducting wire, 4805. The green area, 4803 is connected electrically to the green area, 4804, which are both connected to green wire, 4806. The small insulating node, 4807, prevents the red and green area from accidentally coming into contact when the knuckle is open and the couplers mate.

Figure 49:
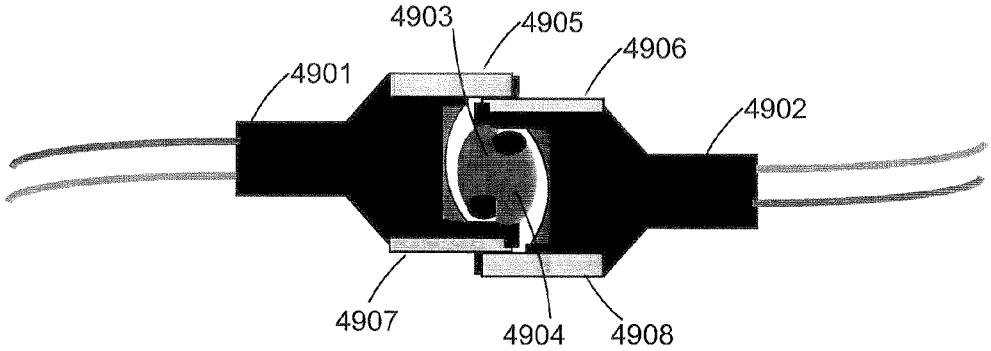
FIG. 49 Coupler design of FIG. 48 showing electrical connections between coupler contacts where the couplers are in tension.

FIG. 49 shows the two couplers connected together while the two couplers are in tension. Here the red areas, 4903 and 4904, will connect between the two couplers and so will the green areas, 4905, and 4906, and the green areas, 4907 and

Figure 50:
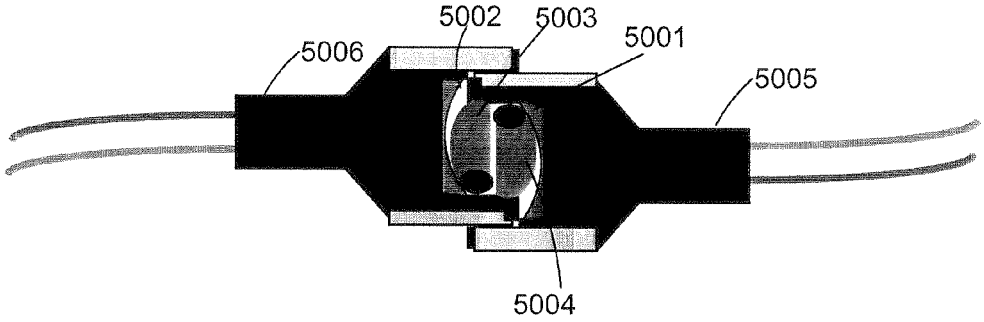
FIG. 50 Coupler design of FIG. 48 showing electrical connections between coupler contacts where the couplers are in compression.

4908. The same pair of couplers connected together while in compression is shown in FIG. 50. Here the red knuckle area, 5003 of coupler 5005 is in electrical contact with the red conductive coupler pocket area, 5002, of coupler 5006. And the red knuckle areas, 5004 of coupler 5006 is in electrical contact with the red conductive coupler pocket area, 5001, of coupler 5005. The green areas remain in contact as described in FIG. 49.

Figure 51:
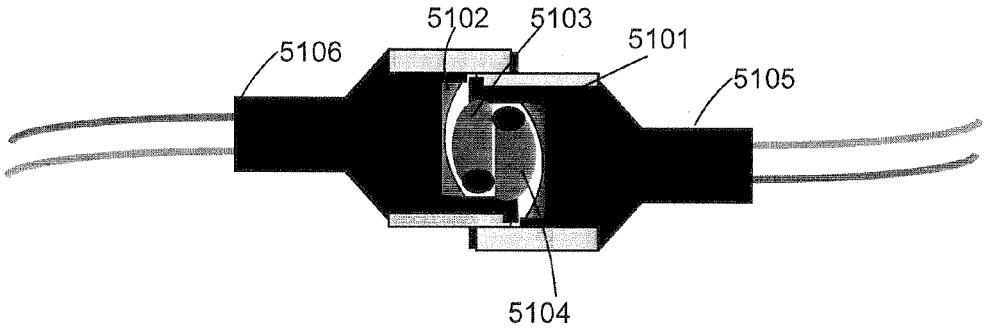
FIG. 51 Coupler design of FIG. 48 showing loss of electrical connections between some of the coupler contacts where there is slack in the couplers.

One problem with this design is that the red areas can loose contact when the couplers are connected but the knuckles are free moving in the coupler pocket; that is when they are neither in tension or compression. This is shown in FIG. 51 where the red areas, 5103 or 5104, are not in contact with each other or with red coupler pocket areas, 5102 or 5101. This condition is not common for model trains but can occur when the locomotives are decelerating slowly and the cars tend to "catch up" with each other leaving slack in some couplers.

Figure 52:
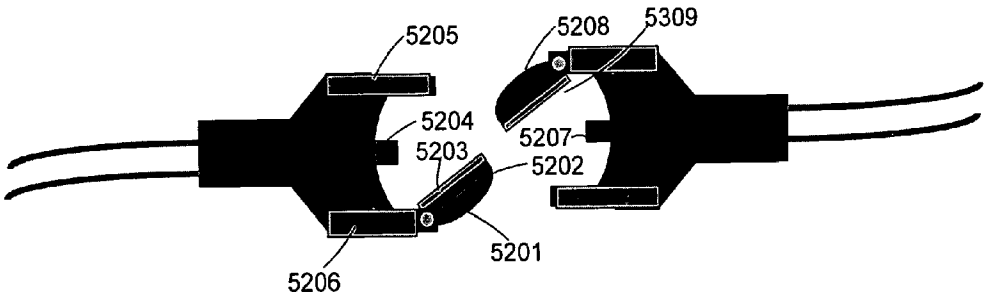
FIG. 52 An improvement in the coupler design in FIG. 48 where a spring loaded pin helps ensure electrical contact between couplers in slack.
Figure 53:
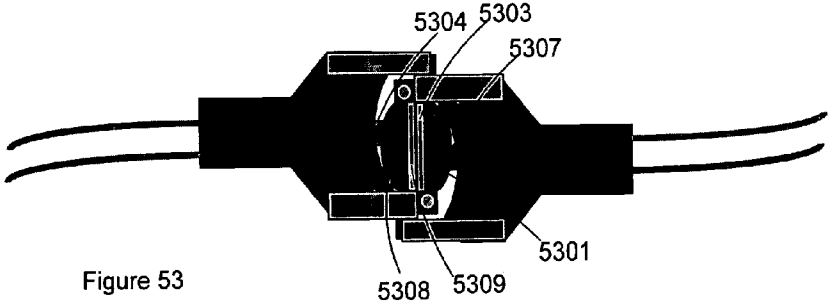
FIG. 53 Drawing showing the electrical connection between a pair of couplers using the design in FIG. 52 where both couplers are in the closed position.

Another coupler design that helps alleviate this problem is shown in FIG. 52. The knuckles are shown in the open positions. The knuckle is made of three elements, red conductor 5201, insulator 5202 and green conductor 5203. The green conductors on the side, 5205 and 5206, remain the same as in FIG. 48. Red conductor plunger, 5204, is designed to press in to the coupler body if pushed but will resist this motion by means of a spring internal to the coupler. When the couplers meet, the plungers, 5204, and 5207, will be pushed into the coupler bodies by means of the closing knuckles of the mating couplers. This will result in the closed couplers shown in FIG. 53. The depressed plungers, 5304 and 5307, are shown pressing against the red conductive areas, 5308 and 5301 of the coupler's knuckles. Also, green areas of the two couplers, 5303 and 5309, are making electrical contact as well as the green area on the sides of two couplers. Now, when the couplers are in tension or compression, the red areas on the knuckles will continue to make contact to the other coupler through the plungers, 5304 and 5307. If the train load is not so great under compression that it overcomes the plunger spring force, the green areas, 5303 and 5309, will continue to make contact even when the train's locomotives are pushing the cars.

Although the plungers, 5204 and 5207 in FIG. 52, are shown extended when the knuckle is open, they could be designed to be part of the coupler latching mechanism and will automatically appear when the couplers lock in the closed position.

One disadvantage of this type of coupler is that there is less opportunity for trains to exhibit slack action. However, the plunger spring does not need to be very strong; it is only needed to ensure electrical contact to the mating coupler's knuckle. If this spring is weak enough, slack action will be preserved. Also, the stress gauge described below and shown in FIG. 38, will provide some longitudinal motion as well. Or the coupler mechanism may be designed to prevent the plungers, 5204 and 5207, from extending until a command signals enable them, leaving slack action effects until the train starts moving. However, the mechanical coupling between cars can become more reliable from the spring-loaded plunger preventing slack action. Rail cars with KD type couplers are more prone to accidentally disconnect when the cars try to "catch up" to the locomotive speed and couplers on various cars are pressed together in compression. This most often occurs while the train is going down a grade at slow speed. Since these types of couplers tend to push the knuckles open in compression, certain cars can disconnect when the locomotives speed up or any other action causes the couplers to change from compression to tension.

Figure 54:
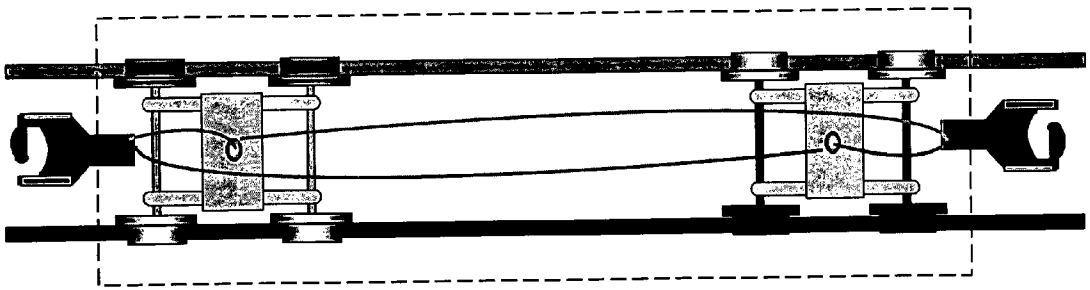
FIG. 54 Diagram of a railcar using the coupler design in FIG. 52 with power connections to both rails on two-rail powered track.
Figure 55:
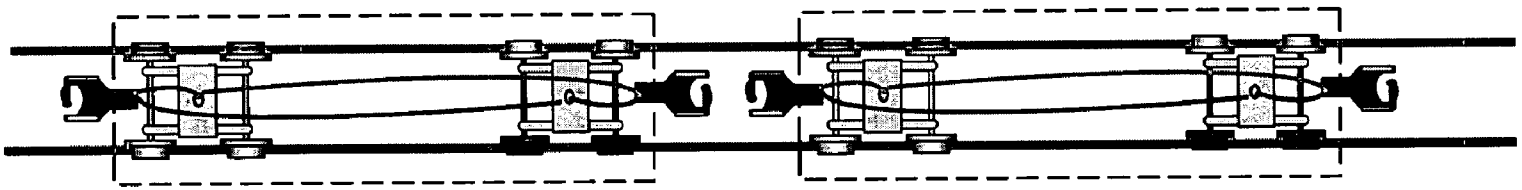
FIG. 55 Diagram of two railcars both oriented in the same direction on two-rail powered track showing that there would be no short circuit condition if both cars were to couple together.
Figure 56:
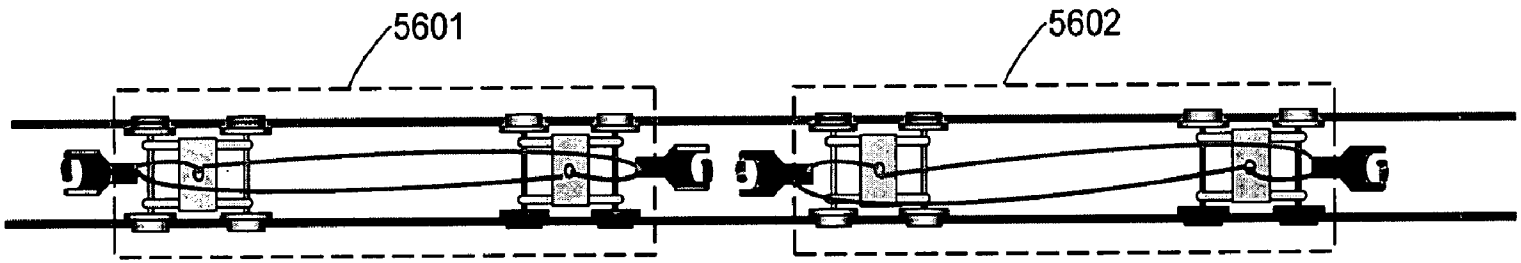
FIG. 56 Diagram of two railcars oriented in opposite direction on two-rail powered track showing that there would be a short circuit condition if the cars were coupled together.

Conductive couplers like those shown in FIG. 48 and FIG. 52 can now be used to conduct power from both car pickups in each rail car to both couplers as shown in FIG. 54. Cars facing the same way can be connected together to provide power from car-to-car as shown in FIG. 55. However, if one car is facing the other direction, the conductive areas on the couplers change polarity and there is a short circuit condition if the cars should couple as shown in FIG. 56. Here it can be seen that the green knuckles of car 5602 will contact the red knuckle of car 5601. While the technique of using a two-conductor coupler design does solve the problem of supplying both polarities, it does not solve the problem of short circuits when cars are not all facing the same direction.

Figure 57:
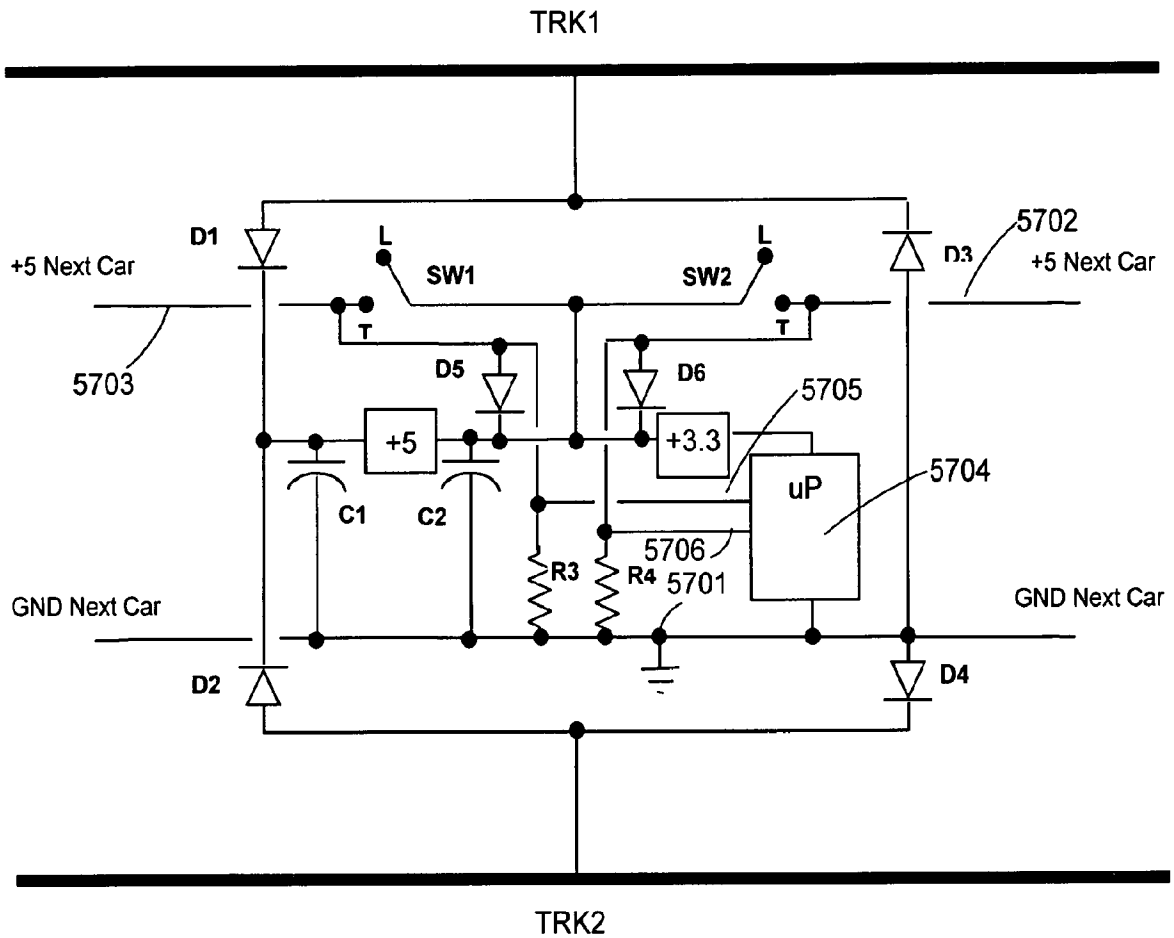
FIG. 57 Schematic of an on-board electronic power supply and transmission system to convey electronic power and data from railcar-to-railcar.

One solution to this problem is to not transfer track power from car-to-car but to use internal electronic power which is immune to track polarity. FIG. 57 shows a simplified Rolling Quantum system plus a means to not only supply power from car to car but also a means to send digital communication from car to car. The internal power supply is a simplified version of the power supply described in FIG. 40, in order to make the discussion easier. The inrush current limiting circuits made up of R1, R2, SW3 and SW4 in FIG. 40 are replaced by short circuits and the ground return lines on the +5 and +3.3 volt regulators have been left out. All electronic components are grouped into the uP box in FIG. 57. The power that is passed on from car to car is the +5 volt supply and internal ground, 5701.

Figure 58:
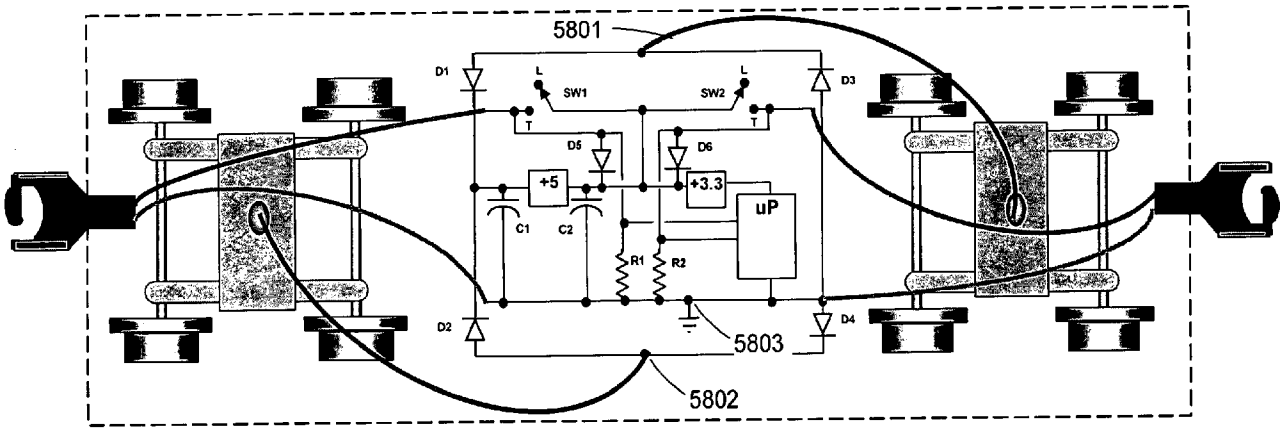
FIG. 58 Diagram and drawing of railcar with on-board electronic power and transmission system from FIG. 57 with both ground and power connections to both truck pickups and to both electrical connections of the coupler design of FIG. 48 of both the front and rear couplers.
Figure 59:
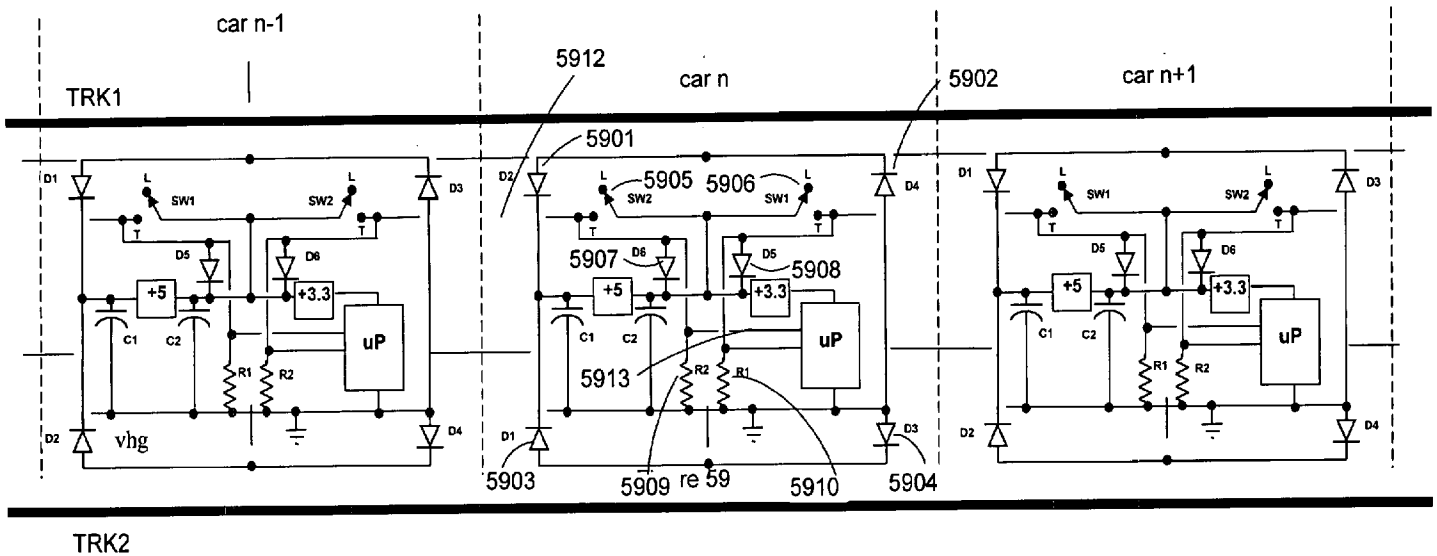
FIG. 59 Diagram showing a series of cars on two-rail powered track connected together to transmit both power and data.

This circuit is shown on-board a model rail car in FIG. 58. In this Figure, the track power from each pickup is connected to the input to the bridge rectifier at 5801 and 5802. In this case, the internal ground, 5803, is connected to the green conductors on both couplers, while the T connection of switch SW1 is connected to one coupler's red conductor and the T connection of switch SW2 is connected to other coupler's red conductor. It would make no difference if this car was turned 180° with respect to other cars other than the SW1 and SW2 switch connections would exchange positions. FIG. 59 represents a three car segment of a train centered at car "n" with car "n−1" to the left and car "n+1" to the right. Car "n" is facing backwards in this figure. The only difference in its schematic is labeling. Diode 5901 is now labeled D2 instead of D1, diode 5902 is now labeled D4 instead of D3, diode 5903 is now labeled D1 instead of D2, diode 5904 is now labeled D3 instead of D4, diode 5907 is now labeled D6 instead of D5, diode 5908 is now labeled D5 instead of D6, switch 5905 is now labeled SW2 instead of SW1, switch 5906 is now labeled SW1 instead of SW2, resistor 5909 is now labeled R2 instead of R1, and resistor 5910 is labeled R1 instead of R2. Otherwise this circuit is functionally the same as the circuit in car "n−1" or car "n+1".

Referring to FIG. 57, when SW1 and SW2 are in the T position, the plus five volt supply is available to any other car that is electrically connected to the +5 lines, 5702 or 5703, and internal ground, 5701. When either switch SW1 or SW2 is in the L position, any data in the form of +5 volts or zero volts can be detected by microprocessor inputs 5705 or 5706. When data is to be transmitted to another car, then microprocessor controlled switches SW1 or SW2 can be switched between the L and T position at predetermined rate and time intervals to send out either PSK or FSK outputs on line 5702 or 5703. Any car that is on an open line that has the appropriate switch SW1 or SW2 in the L position can listen to these transmissions. A line is open through a car if both SW1 and SW2 switches are closed. If all cars have these switches closed except for the last car, then the locomotive would be able to talk to this last car down the entire length of the train.

The switches SW1 and SW2 are shown as simple single-pole single-throw mechanical types but are preferably fast pass devices under microprocessor control to ensure the fastest data rate possible.

Referring to FIG. 59, SW2 of car "n" is open in the listening position, L. If the microprocessor in car "n−1" is turning on and off the SW2, then each time it closes, +5 volts are applied to line 5912 which applies +5 volts to the microprocessor input, 5913, in car "n" and each time it opens, zero voltage is applied to 5913. If we consider +5 volts a logic "1" and zero volts a logic "0", the digital data can be sent from car n−1 to car n at very rapid rate. If car n wishes to talk to car n+m, then it is necessary that all intervening cars, n+1 through m−1, must have both of their switches, SW1 and SW2 in the T position and car M must have the switch connecting to car m−1 in the L position.

It is an interesting task to design car-to-car transmission protocols for trains made up completely of RQ systems. The first task might be to store the position of each car in the train in its own LTM. Until this is accomplished, how would any car know which car is talking to it or whether it is the designated recipient of a message. It is also important for each car to know which way it is facing in order to determine if a message is arriving from up stream (towards the head-end locomotives) or from down stream (toward the caboose or end of the train). Fortunately, each car can sense the track voltage. If during the calibration or identification process, a known voltage polarity was applied to the track, each car could determine its direction with respect to the front of the train. For instance, if an analog track voltage was applied that would make the train move forward, then each car that measured a negative voltage would know it is facing backwards and would know which of the two switches, SW1 or SW2, should be opened to listen to up stream messages or down stream messages. The first command during the calibration and ID protocol would be to send a track command to open all SW1 and SW2 switches to the listen position. The locomotive could then send the first message to the first car announcing that is the locomotive. The first car would give itself an ID of 1, and then close both the up steam and down stream switches and tell the next car it was car 1. This would inform the locomotive that the message was received and that there was a car 1. Car 1 would then open both switches and car 2 would perform the same operation as car 1. The second car would give itself ID 2, and close both up stream and down stream switches and tell both car 1 and car 3 that is was car 2. This would inform car 1 that the message was received and that there was a car 2. It would then open both switches and car 3 would perform the same operation as car 2. This procedure would continue until all cars had given themselves consecutive ID numbers. When the last car did not get a response from the next car with its ID number, the last car would know that the end of the train had been reached and how many cars were in the train. It could then send this message back up stream to the locomotive. At this point all switches would be in the closed position except the first car switch connected to the locomotive. This would allow all cars in the train to have shared internal power supplies to increase the trains pickup and reliability. However, idle packets or a series of digital 1's could be continually sent down stream from one car to the next to keep the channels open. This would mean that every up steam switch was in the L position and every down stream switch was continually sending data. If a car wanted to send a message up stream, it could close its up stream switch. The next up stream car would detect a constant +5 volts on the connecting line and would then change its switch position to L to receive this message which would then continue up stream from car to car.

Once all cars have ID numbers, it would be possible for the locomotive, caboose, or any car to address any other car with a message. It would also be possible to know that a car was unresponsive and maybe has a connection problem. In addition, simple aftermarket conductive coupler kits could be sold to upgrade older cars or locomotives that do not have RQ to all allow messages to be transmitted through these cars. This would only require replacing the existing coupler and have a wire pair connect the couplers together. Coupler kits might also include a small electronics board to allow these older cars to have ID's and to transmit data. This would not require these cars to have powered trucks since power can be supplied from up-stream or down-stream cars that are RQ equipped.

Central to the Rolling Quantum design in FIG. 35 is the microprocessor (uP), 3512, the EEPROM, 3513, the read/write Long Term Memory, 3514, and system expansion, 3515. The uP, is also connected to sound engine, 3516, which digitally processes sound records stored in EEPROM, 3513. The uP, 3512, also contains hardware and/or software to process Analog and Digital Command Control signals. Since these digital or analog signals are combined with the applied track voltage on line 3505, they are first processed by signal conditioner, 3517, to provide signals suitable for uP inputs. Conditioned signals may be in the form of asynchronous digital information, such as FSK or PSK format, or may be analog signals or analog signals with impressed digital information or synchronous data timed to pulses on the track or transmitted by other means. In most cases, the uP's analog-to-digital converters, ADC's, would be used to analyze these signals but could contain hardware to detect DCC or other specific types of digital or analog signaling. For some analog signals, the actual voltage and/or waveforms are important such as determining any polarity reversals for detecting type 1, 2 or 3 signaling, throttle setting, or when a Neutral state would be entered. Microprocessor, 3512, can also contain ROM (such as MROM) for rewriting the system EEPROM, 3513, directly from signals impressed on the track or from data supplied from system expansion, 3515. Without hard coded ROM in the uP to perform this function, instructions must first be loaded into the uP RAM from the system EEPROM, 3513, before the EEPROM is erased and rewritten with new data. Without the advantage of non-volatile on-board ROM, if power is lost during this process, then all programming would be lost including how to load new data.

The system expansion, 3515, allows RQ to be customized for different types of rolling stock and effects. This box is shown with PWM outputs for controlling analog effects as well as motor control outputs for controlling mechanical effects and serial bus to control other uP or digitally controlled appliances or accessories and for receiving information back to uP, 3512, from these items. In addition, the serial ports can allow the EEPROM (such as flash) to be programmed on-board through an external connection to a computer.

The digital sound engine, 3516, provides separate sound channels allowing polyphonic combinations of the independent sound records. These sounds can be individually or collectively processed to add reverb and echo effects, 3518, before being sent to audio amplifier, 3519, and speaker, 3520. The sound engine is shown as a separate piece of hardware but might actually be part of the uP or digital signal processing integrated circuit programming.

RQ includes bi-directional transceiver, 3521, under uP control to impress digital or analog signals on line 3505, to apply bi-directional information directly to the track. Transceiver, 3521, can also receive bi-directional information directly from the track and condition these signals to be applied to uP, 3512, inputs.

The coupler assemblies, 3501 and 3502, are directly under uP control through lines, 3522 and 3523. If coupler assemblies contain means for opening and/or closing the couplers, this function can controlled and monitored directly by the uP as indicated by coupler drivers, 3524 and 3525 and signal lines, 3522 and 3523. Coupler assemblies are shown containing Car Transceivers, 3526 and 3527, which can communicate with stationary Track Transceivers 3528 and 3529, which are connected to main layout control or local stationary accessories, such as turnouts, car loaders/unloaders, trackside detectors and local power control units. As the car containing a car transceiver passes over a track section with track transceivers, bi-directional communication can commence between a track transceiver and the on-board car transceivers whenever these two transceivers are within sufficient proximity of each other. In addition, transceivers like, 3526 and 3527, could communicate from car-to-car, whenever two cars are in sufficient proximity of each other, such as being coupled together. This would allow bi-directional communication from car-to-car down the entire length of the train, including locomotive(s). The car transceivers could also be designed to detect the distance between them and the next car and the speed of approach or withdrawal to help the operator determine the best throttle or speed setting to operate his train when direct vision is impaired or when the train or locomotive(s) are under computer control during switching and yard operation.

A transmitting wand could also be placed under or near car transceivers, 3526 and 3527, to allow selected cars to be uncoupled from each other. The car transceivers do not need to be located on the coupler pockets as shown but do need to be mounted somewhere on the car to allow transmission to track transceivers and the next car. It would be convenient for a number of reasons if the car transceiver could be mounted as part of the coupler assembly. In particular, the coupler body helps shield the Car Transceiver from ambient light.

Car transceivers could also be used as a means to download new sound records and software to RQ either using track transceivers or special program apparatus that would communicate directly to the car transceiver at a higher data rate. Of course, software sounds could also be downloaded via the track using DCC; the bi-directional system would be useful for confirmation of downloaded data. Downloading of data using Type 1, 2 or 3 signaling could also be used but this is generally too slow for large data transfer.

However, any of the communication standards described for RQ and LQ could be used to turn on software features that were disabled at the factory. For instance, features that are protected by copyright or patents or legal agreement, that require a royalty could be turned on by using special codes, which could be short enough that they could be transmitted even by Type 1 signaling. With the number of patents being generated in model railroading, the ability to upgrade the system by the customer after payment of the appropriate fees is becoming more of an issue. The problem with a single codeword to upgrade is that once one person knew it, it could easily be passed on to others without the necessary fee payment. A way to avoid this is to have a special algorithm in the software to generate a random upgrade number and its unlocked codeword whenever the system is queried for this feature. While the random upgrade number would be available to the operator, the unlock codeword would not. The customer would have to submit the upgrade number to the appropriate dealer, who after securing payment, would provide the codeword to the customer to install in his locomotive. Once the system recognizes that the installed codeword matches the codeword generated by the Quantum system, the special upgraded features or sounds or software would be enabled. To prevent the customer from trying a series of code words to try and find the correct one, Quantum could generate a new random upgrade number and codeword each time the system was queried. A six digit random number and codeword would provide 1,000,000 to 1 odds of guessing the correct codeword by chance. Although Type 1 signaling could be used, it would be slow and laborious; either DCC or Type 3 signaling would be preferred or perhaps direct programming from an external computer through a Quantum serial port or special programming apparatus.

Figure 38:
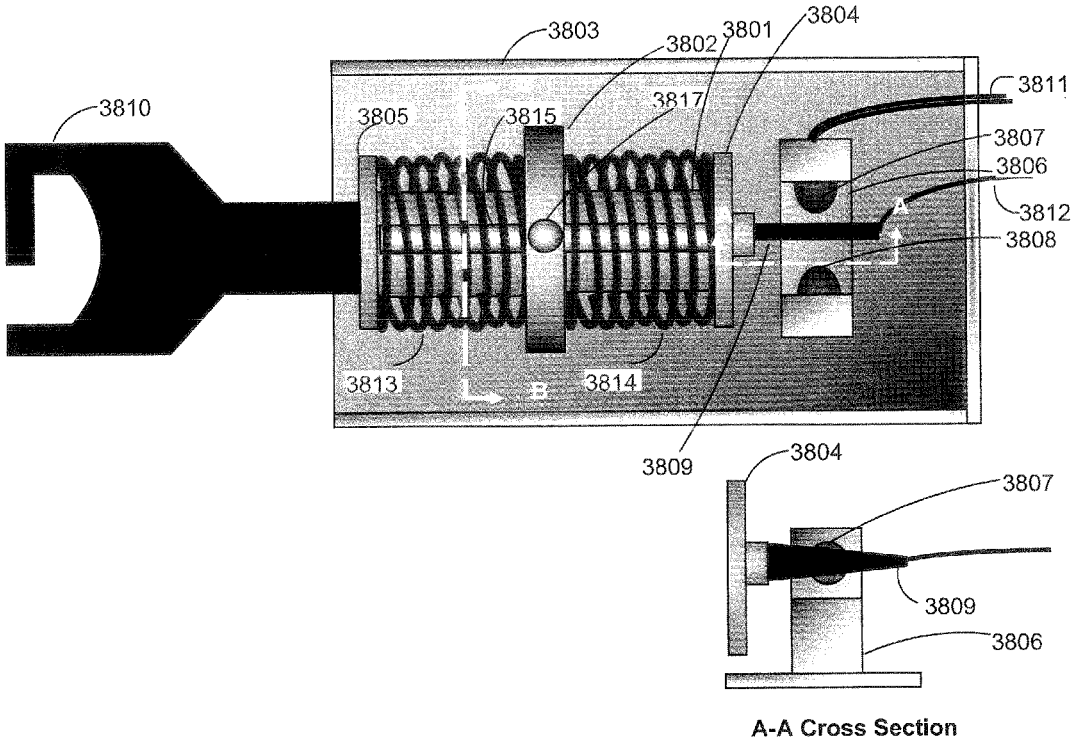
FIG. 38 Coupler design showing method to measure drawbar tension and compression using optical means.

Bi-directional information between the uP to the Car Transceivers, 3526, and 3527, is through control lines 3530 and 3531. Coupler assemblies could also contain measuring apparatus to determine drawbar tension and compression and convey this information directly to the uP through lines 3530 and 3531. There are many ways to design a compression/tension (strain gauge) device. A simple unit using an optical source and detector is shown in FIG. 38. Coupler, 3810, is connected to cylindrical shaft, 3801, with attached spring stops, 3805 and 3804. Coupler shaft support, 3802, is attached to coupler draft box, 3803, which is mounted to the car body. The coupler shaft can move horizontally though a circular hole in keyed coupler shaft support 3802 where groove, 3815, prevents the coupler shaft from turning. This assembly is evident in FIG. 39, where coupler shaft groove, 3815, is clearly seen cut into coupler shaft, 3801. The coupler shaft support, 3802, is shown with projection, 3902, which fits into groove allowing motion down the length of the coupler shaft but prevents it from rotating. Note that FIG. 39 also shows rotating mounting studs, 3817 and 3901, above and below to allow the coupler to pivot from side to side. In FIG. 38, springs, 3813 and 3814, restrain the coupler shaft by providing a return force to a central position if the coupler is moved horizontally front-to-back or back-to-front. The shaft, 3801, will move in or out to varying amounts depending on the horizontal compression or tension force on coupler 3810. Optical source/detector, 3806, is shown mounted to the bottom surface of the draft box. Optical source, 3807, is partially blocked by optical barrier, 3809, which is shown more clearly in the cross section view below. The optical barrier, 3809, is tapered so that more light is occluded when the shaft, 3801, moves to the right and less light is occluded when shaft, 3801, moves to the left. This affects the amount of light detected by optical receiver, 3808, which is a monotonic function of the coupler shaft position. Although optical receivers can be very non-linear, the functional dependence can be calibrated and curve correction factors stored in Quantum memory to linearize the receiver output as function of horizontal position. In addition, the shape of optical barrier, 3809, could be changed to help linearize the response. If the side-to-side pivoting motion is excessive, the optical source/receiver, 3806, might have its source and receiver at a greater distance from each other to allow more lateral motion of optical shield, 3809. Or the optical source/receiver, 3806, could be mounted by bracket to the coupler shaft support, 3802, to allow the optical source/receiver to move from side to side as well and stay centrally positioned between the source and the receiver.

Note that it is possible to use only one spring in the above design. However, this spring would need to be attached at both ends. For instance, if only spring 3814 was used, and spring 3813 was not included, than spring 3814 would need to be attached to spring stop 3804 and coupler shaft support, 3802. In addition, the spring constant for 3814 would need to be doubled to equal the combined force of 3813 and 3814.

The above strain gauge is an example of how one might design a means to detect compression and tension in a model train coupler. It has the advantage of providing a cushioned response whenever cars crash together during the coupling process and helps prevent derailments or damage to the cars or couplers. Under compression the shaft, 3801, would move to the right, which would register that a coupling has occurred (or has been attempted) which could be accompanied by coupler crash sounds. Conversely, if shaft, 3801, moved suddenly to the left under tension, this would be accompanied by a coupler slack action sound. The sound volume for these effects could be proportional to the amount of compression or tension since these sounds might occur for a train that is already coupled but less likely to generate the same degree of motion in shaft 3801. In any case, the tension/compression response would reasonably model the prototype behavior.

Commercial off-the-shelf electronic strain gauges could also be used as long as they were sensitive enough to register the small forces in model railroading and small enough to fit into the coupler draft box, 3803.

Truck, 3503, in FIG. 35, shows supplying speed information to speed detector, 3532, which passes this information on to the uP through line, 3533. Speed information can be obtained through a drum around one of the truck axles with alternating bands of white and black stripes (a timing tape) with optical transmitter/receiver, or a magnet(s) can be attached to a truck axle or wheel and a Hall Effect device can be used to detect the presence of the magnetic field as the wheel turns, or a small stationary generator (or winding) can surround a magnetized axle to read back EMF that is generated when the axle turns, or any number of ways.

Figure 36:
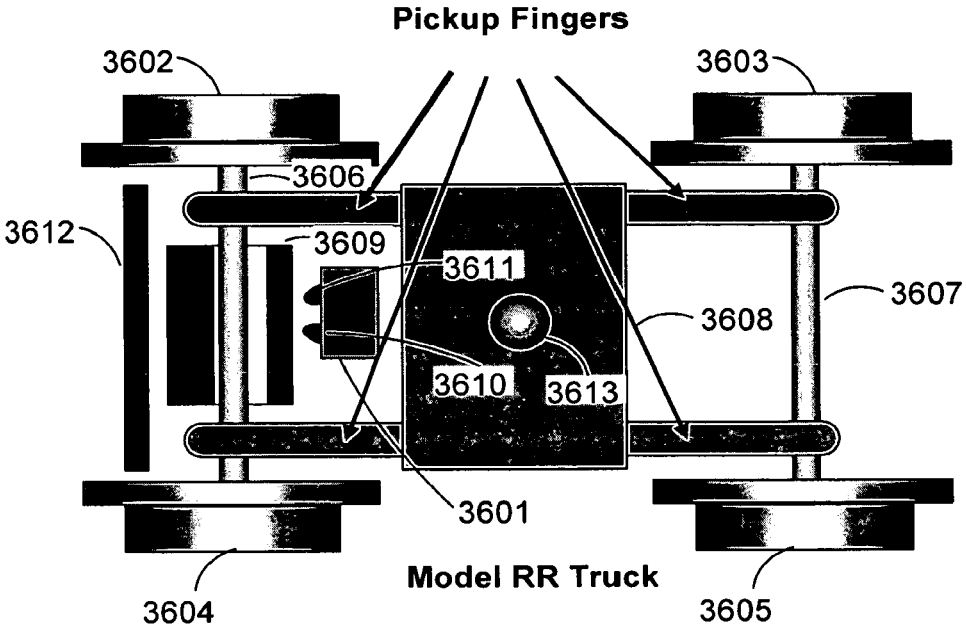
FIG. 36 New truck design for rolling stock to measure speed of car using an optical transceiver and rotating drum with dark and white stripes.
Figure 37:
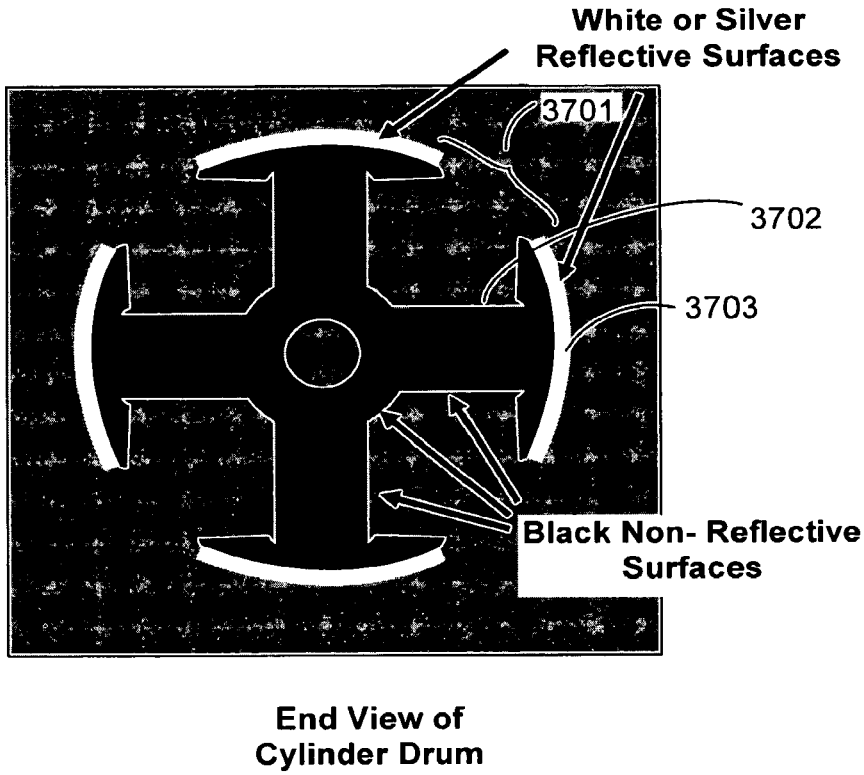
FIG. 37 Side view of rotating drum improvement.

Apparatus for detecting from drum and optical transmitter/receiver is shown in the top down view of a typical model railroad truck in FIG. 36. For clarity, only the wheels, 3602, 3603, 3604, and 3605, axles, 3606, and 3607, pickup assembly, 3608 and truck pivotal mounting stud, 3613, are shown. Other parts such as truck side frames and axle supports or bushings are not shown. The drum, 3609, is mounted on axle, 3606, which turns with wheels, 3602 and 3604, as the car moves. Optical transmitter/receiver, 3601, contains lamp, 3610, which directs light towards the drum, 3609, and detector, 3611, which receives the reflected light from the drum. When the drum rotates, more light is reflected from the lighter stripes than the dark stripes, and this information is sent to uP, 3512, in FIG. 35. The uP can then determine the cars speed by counting the number of incidences of light stripes (or dark stripes) over a predetermined time interval and then calculate the scale speed of the car, based on the number of stripes on the drum and the scale diameter of wheels, 3602 or 3604. Or if the contrast between stripes is high, the uP, 3512, could accurately determine the time it takes for a single stripe to pass and calculate the scale speed. This latter method may not be as accurate but does give faster reports on speed. In order to achieve higher contrast between light and dark areas of the drum, it could be constructed as shown in FIG. 37, which shows an end view of an innovative design. In this case, instead of dark stripes, there are openings in the drum such as, 3701, over internal cavities, such as 3702. The interior of each cavity is colored black to absorb any light that passes through the opening, 3701, in the drum. The outer reflective surfaces, such as 3703 are made of highly reflective surfaces to increase contrast even further. Although only four reflective bands are shown in FIG. 37, there can be any number of bands, depending on the resolution of the optical transmitter/receiver, 3601.

The optical transmitter/receiver, 3601, can either be mounted on the truck or can be mounted under the car body, provided it can still be close enough to make good optical contact with drum, 3609. The advantage of mounting under the car body is that no additional wiring needs to be supplied to the moving truck. The disadvantage is that the light is not always directed at right angles to the surface of the drum as the truck rotates around its center mount, 3613, as car goes around curves.

FIG. 36, also shows light shield, 3612, mounted on the far end the truck. This light shield extends vertically up towards the car chassis and down towards the track. This light shield serves two purposes: 1) it blocks visual eye contract to the drum, 3609, when viewing the car at track level, and 2) it reduces ambient light that can interfere with the detection of reflected light. The light shield would be mounted to the truck to allow it to move with the truck as it pivots on stud, 3613, going around curves.

Truck, 3503, in FIG. 35 also shows curve detector 3534 with an optical transceiver reflecting light from reflecting surface, 3535, attached to the truck central pivot mount. As the truck turns in either direction, the mirror, 3535, also turns causing the light from detector, 3534, to not reflect directly back to the optical receiver. The loss of this signal indicates that the truck has rotated, inferring that the car has entered a curve. The curve detector could also include additional optical receivers to indicate which direction the truck had rotated and by how many degrees. Other detection means besides optical could be used to detect that a truck had rotated.

The second truck, 3504, could be equipped with a similar apparatus. Turning information from the two trucks could allow RQ to determine if the car is in an S-curve or a normal curve and what radius curve it is on. This could change the sound records used for squealing flanges since tighter curves would cause a greater squealing effect. Knowing the degree of truck rotation could also indicate a derailment and RQ could produce appropriate crashing or derailment sound effects.

Brakes, 3538, are shown being controlled by uP, 3512. This is a bi-directional line with information about the braking condition being supplied to the uP, such as how much braking is being applied. Additional information about the amount of braking can also be deduced by the differences in the tension and compression readings from the coupler assemblies, 3501 and 3502. The braking force is applied through drivers, 3539 and 3540, directly to the trucks 3503 and 3504. There are a number of ways that brakes can be applied. One way is to use the same apparatus for detecting speed by back EMF as described above. In this case, a load resistor could be applied to the output of the speed detector, which would allow the speed detector to act as a generator. The amount of the load and the speed of the car would determine the amount of braking. The problem with back EMF braking is that it is only effective at higher speeds. It has much less effect at slow speeds and has no effect when the car is not moving. An improvement to this type of braking would be the addition of applying current to the stationary winding to produce a magnetic force in opposition to the internal magnet on the axles and thus slow the car. This method still has the problem that when the track is unpowered, the brakes are off. Cars sitting on sidings could roll away and possibly derail or cause damage when the layout power was shut off.

Not all cars in a model train need brakes since the amount of weight and momentum do not change directly with the scale of the model and do not require as much braking to stop or slow the train. Therefore, only some cars need to have this optional feature. Brakes also have the advantage of taking the slack out of the couplers, thereby improving the signal and power connection between couplers, if that method is used to transmit information and power from car-to-car.

Other accessories or appliances to RQ include a Grade and Sway Detector, 3541. This part is shown symbolically as a simple pendulum, 3542, but can include other components such as an inclinometer and electronic accelerometer, which together are intended to provide knowledge of tilt and motion of the car. A simple pendulum method was described in our U.S. Pat. No. 5,267,318, Model Railroad Cattle Car Sound Effects. Grade and Sway Detector, 3541, is primarily intended to measure side-to-side motion and grade tilt. Parameters of forward motion are derived from the speed detector, 3532, by the time integral and successive derivatives of speed.

Generally, information from accessories and appliances are applied to uP, 3512, inputs, but the uP may also pole these items for information from their data registers. They may also be on a common bus and each one may be separately controlled by their own uP's.

Another accessory is the Smoke Generator, 3543, which can produce smoke under uP control. A basic uP controlled smoke unit for model locomotives was described in our U.S. Pat. No. 5,448,142, Signaling Techniques for DC Track Powered Model Railroads, where a uP is used to control the amount of smoke and its duration. The smoke generator, 3543, is shown with a variety of outputs, 3544, 3545, and 3546, which can be selected by the uP to control smoke for a number of different effects. For instance, smoke turned on in 3546 could be vented in the vicinity of a truck, such as 3504, to simulate a hot box or the affects of the brakes being applied for extended periods, or output 3544, might be applied to a smoke stack on a caboose, etc. or output 3545 might be vented into the car body to simulate an on-board fire. The smoke effect could also model steam exhaust from passenger cars such as steam heaters, and exhaust smoke from dining cars, etc. Each output could be controlled for smoke volume and duration and puffs of smoke could be created by activating each output. All of these effects are under uP control including the temperature of the heated smoke vaporizer, which is useful to prevent burnout or damage. Information is sent back to uP such as temperature and possibly the amount of smoke reagent (such as oil) remaining in the reservoir. The amount of smoke can be proportional to any state variable including speed, amount of braking, the amount of illumination present, etc.

Another accessory is the Local Positioning System, (LPS) 3547, shown with receiving antenna, 3548. LPS, 3547, works on the same principle as the better-known Global Positioning System, except the transmitters are all stationary and located around or above the layout. Based on phase and time measurements and comparisons between the different transmitters, RQ, could determine its location on the layout. This information could be transmitted back to the central controller, hand held controller, or local accessories for processing and response. Transmission could be RF, IR or through the bi-directional transceiver, 3521, or passed from car-to-car and eventually to the locomotive(s) through transceivers, 3526 and 3527.

Positioning information from LPS, 3547, could be used to track the progress of a train around a layout, or the position of any polled car on the layout or to compile a complete inventory and/or physical location of all cars and locomotives or other remote objects. Knowing the position of each train and/or locomotive could allow easier operation of analog progressive cab control to provide independent speed and operation of different trains on the same track; progressive cab control allows a train to move independently around the model railroad layout where the connection between the cab and the block is automatically switched by relays to the next block, and the present block is released for another train to use. It could also allow easy sorting of rolling stock in hump yards. The LPS could also provide information about the time of day, or "fast time" sometimes used on model trains to speed up the modeled time compared to real time. Time of day information could, of course, be sent by digital means down the track as part of the control signals.

Depending on the bandwidth of the LPS, all train control commands normally sent down the track could be sent by LPS to all remote objects including locomotives, trains, rolling stock, accessories, turnouts, etc. For instance, LPS could also transmit DCC like commands on an RF or IR carrier directly to the remote objects. This would be valuable for some garden railroads and others where the locomotives are battery powered and there is no communication through the track.

Another accessory is the atomizer, 3549. This is used to produce different odors by vaporizing selected chemicals that are design to smell like specific conditions or events. For instance, smells of a hotbox, or a cattle car, or fire would be some possibilities. The atomizer is under processor control to allow this accessory to be operated in concert with specific sounds, lights or the movement of mechanical apparatus.

Another accessory is the proximity detector, 3550, which is used to operate some effects whenever it is in the proximity of some specific transmitting source. This could be an IR, or RF or other transmitting wand placed by the operator near the proximity detector to release or apply the brakes on a particular car, or turn on some lighting effect, or activate a mechanical unloading operation. It could also detect some loading or unloading accessory and react accordingly. This type of detector may be placed near or in the roof of the car. If it were an IR type receiver, it could monitor the ambient light, which would allow certain changes in cars and locomotives. For instance, lighting accessories like locomotive cab lights, marker lights, step lights and truck lights might be turned on under darker conditions or cattle in stock cars may become quieter in the dark, etc. In addition, an IR sensor could also indicate the simulated load level, such as the amount of grain in a hopper or oil or chemical in a tank car. However, this information could also be conveyed by the Car Transceiver to a Track Transceiver or via bi-directional communication down the track.

The last accessory shown is the light controller, 3551, which under uP control can turn on or off any number of light sources shown as 3552. Lamps can be anything from incandescent to multicolored LED types. Lights are used to simulate fire, interior lights and marker lights in cabooses and passenger cars, spot lights or work lights on some operating cars such as crane cars and work cars, etc. Information is shown being sent back the uP as well which could indicate that lights have failed and need to be replaced.

New Operating Cars: The following is a short-list of where the standard RQ system could be expanded and/or customized to specific types of cars.

Stock Cars: Stock cars with reactive animal sounds would not require any additional mechanical parts. In this case, different sound records of animal sounds from very contented sounds to excited sounds with bellowing and kicking or stomping sounds, would be stored in the on-board ROM. For cars at rest, animals would normally be quite with occasional contented sounds being played at random with long periods of silence in between. If the cars were moving at a constant rate, the animals could be slightly more disturbed but in general, the sounds would remain contented. However, if the microprocessor calculated levels of acceleration, jerk or whip from the speed detector, the animal sounds played would be chosen accordingly from records displaying higher levels of excitement or even panic. If a large number of records were available at each of these different levels of excitement, they would be selected randomly using an on-board random number generator to prevent unrealistic repetition. This concept relies heavily on our original concept of random record or voice selection and motion detection described in U.S. Pat. No. 5,267,318, Model Railroad Cattle Car Sound Effects. Additional features include user programmability to change sensitivity to speed, acceleration, jerk and whip or rate of calming down or becoming excited. Other operational features include a command to excite animals when arriving at a watering hole, or unloading or loading sounds of animals at trackside facilities, or increasing the excitement level by sounding the locomotive's horn, which would alarm the animals. The command for stopping at a trackside facility would be a coded horn and or bell (Type 1 signaling), which could be operated from any power pack with a reverse switch. In previous products we used a combination of a bell signal followed by a long horn signal to activate the station stop scenario operation, which for consistency could be used here as well. For stock cars, the optional atomizer in RQ could generate appropriate smells.

Dummy Locomotives: This is considered rolling stock since they are not powered. However, they do contain a Rolling Quantum system to produce all the locomotive sounds normally provided in a fully powered Loco Quantum equipped locomotives. The advantage of having a Rolling Quantum system in dummy locomotives is that they can also respond to speed to produce full labored sounds (called "Sound-of-Power") with simulated loads, smoke output, etc. All types of lighting can be included in addition to programming, dynamic brake sounds, Neutral sounds, coupler operation, simulated or real time radio communications, flange sounds, squealing brakes, ID numbers, etc. These locomotives can receive information from the lead locomotive via bi-directional communication or car-to-car communication such as when the lead locomotive entered Neutral. They could also contain operating mechanical brakes. This is an advantage since the trucks are larger and could accept a more sophisticated braking mechanism than standard freight car trucks. Since these locomotives are un-powered they could be added to powered conventional locomotives, without being concerned about speed matching.

Mechanical Reefer: This would also not require additional mechanical apparatus. It would produce the sound of a diesel motor and generator to provide the simulated cooling of this type of car. This could include starting and stopping sounds and could react to an operator using a portable proximity source to turn on or turn off the diesel/generator. This car could also keep track of the simulated fuel level and automatically shut down when fuel is completely consumed.

Figure 60:
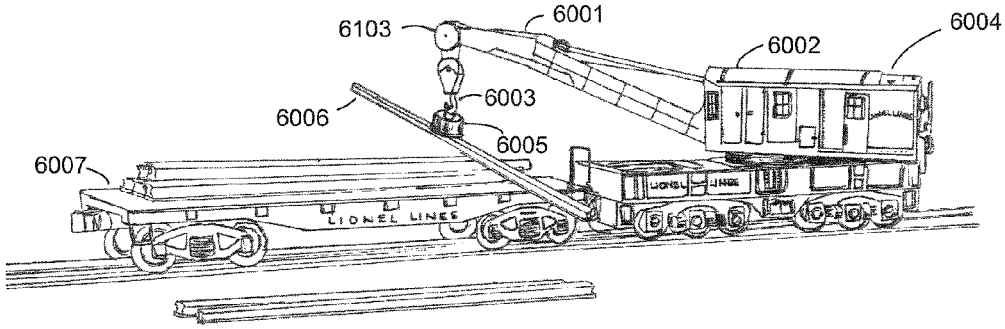
FIG. 60 Drawing of Crane Car as an application for Rolling Quantum.
Figure 61:
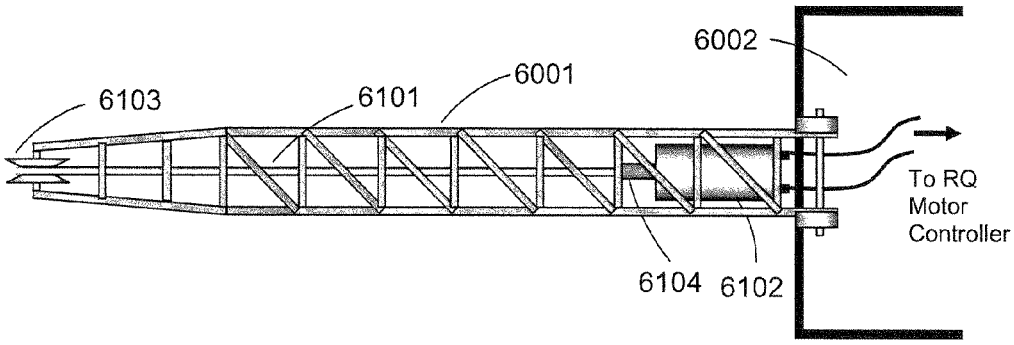
FIG. 61 Drawing of Crane Car boom illustrating method to rotate hook.
Figure 62:
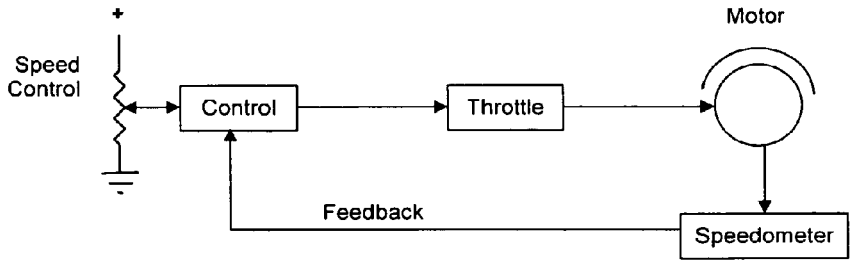
PRIOR ART FIGURE 62
FIG. 62 Block Diagram of Servo Type feedback throttle. (Prior Art)
Figure 63:
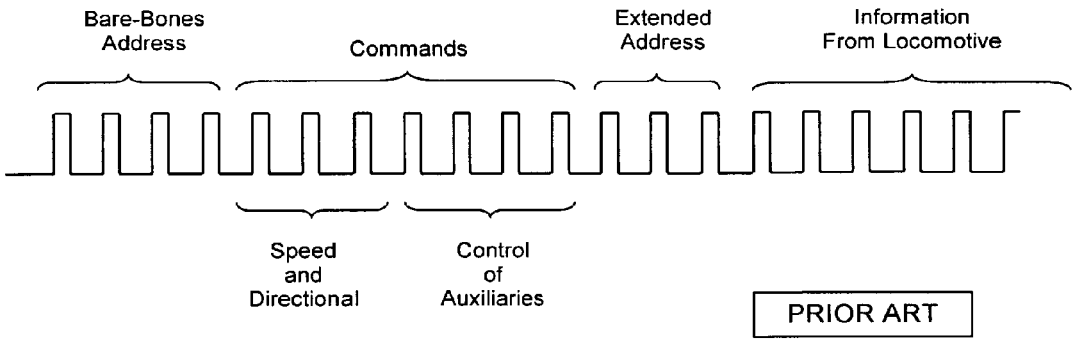
FIG. 63 Timing diagram showing early method for digital command control with digital bi-directional feedback included. (Prior Art)

Crane Car: FIG. 60 is an example of a car that would require additional apparatus, namely motors and motor controllers to move the boom, 6001, up and down, rotate cab, 6002, and boom, 6001, clockwise and counter-clockwise, extend the boom, raise and lower the main hook, 6003, raise and lower an optional auxiliary hook (not shown), extend and lower stabilizers (not shown) plus various lights for work lights and stop lights, smoke generator for steam locomotive or diesel exhaust, 6004, and an electromagnet option, 6005, for picking up ferrous metal parts such as train rail, 6006. Another appliance could be included to rotate either the main or auxiliary hooks, which has no counterpart on prototype cranes. Normally, when a hook is lowered to pick up a heavy load, a worker is available to position and/or rotate the hook by hand to fit in a lifting ring or loop over the load or to position the load over the drop area. In this case, the load is rails, 6006, being picked up from track side and placed on a flat car, 6007. Since the rails at trackside are parallel to the track, the rails will be at an angle when placed over the flat car. In model railroading, the operator would normally have had to rotate the suspended rail by hand to make it parallel with the flatcar body and hold it there while he lowered the hook, which interferes with the illusion of an independent miniature world. One way to accomplish this task of rotating the hook by remote control is shown in FIG. 61. Here a motor, 6102, is mounted at the end of the boom, and connected to the cable, 6101, to provide twisting motion to the cable. The twisting force will extend over the pulley, 6103, causing the suspended hook, 6003, to rotate. Sending a command to turn the motor shaft, 6104, one way will cause the cable and hook to rotate in one direction; sending a command to reverse the motor's direction will cause the hook to rotate in the other direction. The motor shaft could also be extended to the top of the boom just before the pulley, which would transfer rotational twisting force closer to the hook and provide better control of the hook rotation. The motor can also be located within the cab, 6002, along with the other motors and mechanical apparatus and the motor can be geared down to provide a finer adjustment of the twisting action. In this case, an extra pulley would be needed to guide the string from inside the cab to the base of the boom. In all cases, the maximum amount of twisting could be controlled to prevent the hook from rotating more than plus or minus 180 degrees.

Caboose: This car is probably the most interesting of all freight cars and can require additional apparatus to perform some features such as a brakeman that leans out of the back porch with a lantern to signal the engineer, or crewman seen in the cupola that twists his head from side to side and straight ahead to observe the train, a crewman that is seen lifting a coffee cup to his lips at a table by a window, a crewman smoking on the caboose porch using the smoke generator for the smoke effect and a light that glows at the end of the cigar or cigarette, a smoke generator that vents the on-board stove or heater, marker lamps at one or both ends, interior lights, a brakeman turning the hand brakes on the porch. In addition, a number of different sounds could be heard such a crew chatter, radio communications that are either random or generated by real communication from the operator or locomotive or results of a problem as reported by car-to-car communication, or trackside detector reports, or crew chatter coming from a stopped caboose during a simulated emergency.

Dump Cars: These all require a mechanism to unload their contents. In the case of a side dump car, the bin needs to be raised and the side panel needs to open by aid of a motor or solenoid or other mechanical method. Along with the action, sounds could be played to model the operation of mechanical and pneumatic apparatus on the prototype car and to provide sounds of users selected or programmed load types being dumped. Log cars may have a different style of unloading operations and require different mechanisms and sounds but the principle of an unloading automatic car remains the same.

Passenger Cars: We describe a method of moving silhouettes or animated passengers moving within passenger cars in U.S. Pat. No. 5,448,142, Signaling Techniques for DC Track Powered Model Railroads. Car-to-car communication and/or bi-directional could extend some of the scenarios described in this patent to include car-to-car animated activity. For instance, people could be shown getting up to go to the dining car from a coach car and their progress could be seen as they move from car to car until they reach the dining car and sit down. During embarking and disembarking at passenger stations, animated passengers could be shown moving from car to car to finally reach their seats or state rooms. Conductors could be seen moving from car to car checking tickets, turning down beds in state rooms, or filling wood or coal stoves in old style passenger cars, or helping passengers, etc. Also, entire stories could unfold within the length of the train including animated romances, altercations, train robberies, parties, dancing, murder mysteries, etc. Sounds could be provided for each of these activities with an outside-the-car or inside-the-car perspective. Inside-the-car sounds could be transmitted to the operator or observer to fill in communication between passengers or to take on the perspective of one of the protagonists in a scenario to hear what he hears or says. Communication systems, like MTH's DCS, that allow real time sound transmission and/or reception would be useful for this idea. Also, sound for any scenario could be stored at the controller or handheld unit and each animated sequence and lighting effect would then be triggered by a digital or analog command to keep the sound and sight coordinated. These triggers could also include train operation such as a passenger pulling the emergency cord to stop the train or the uncoupling of cars or car or a train wreck, etc.

Other additions to passenger cars include smoke from the diner cars, from old style wood or coal stoves, or vented steam from modern steam heating systems on passenger cars.

These same principles could also be applied to crewmen in a caboose or locomotive or work train and any maintenance equipment. Animation can be accomplished by flat panel displays as described in the —142 patent or can be mechanical animation.

Other advantages of Rolling Quantum are operational:

Progressive Unloading: Entire groups of cars could be unloaded automatically all at once or progressively from car-to-car using the car-to-car or bi-directional communication system. Progressive unloading could occur for stopped trains or while the train is moving. For instance, side dump cars on a stopped train could be unloaded one at a time to simulate an operator moving from car to car to activate the controls on each car. This type of action might be appropriate for dumping ballast at the side of the track or for creating a fill in a ravine. Progressive unloading on a moving train could be appropriate for cars that intend to unload in one place, such as log cars that might be unloading their logs into a pond. In order to have each car unload in the exact same place, each car could calculate it position based on its speed and the length of each car, to know when to dump their load. As each car dumped, it could communicate this condition to the next car using car-to-car communication or bi-directional communication on the track, whereupon the next car would delay its unloading until it calculated that it was in the correct spot. If the speed was determined by a timing tape and optical reader, the number of bands on the timing tape could be counted as a more exact way to determine distance. The train could be made to stop for each car at the unloading place via bi-directional or car-to-car communication for more realistic operation. Of course, a proximity device could be located at the exact unloading place to do progressive unloading but the advantage of the above method is that it does not require a special track device so unloading could occur anywhere desired.

Progressive Loading: Filling any series of freight cars can involve moving the cars in place, waiting for each car to fill and then moving the train to position the next car, etc. However, since the loader is usually stationary at trackside, a track proximity transceiver would be the more efficient and accurate way to do this kind of operation by indicating to the locomotive via car-to-car and/or bi-directional communication when each car is positioned properly.

Cutting Out a Car or Group of Cars: One of the advantages of car-to-car communication and train position ID numbers is that the operator can preprogram which car or group of cars are to be cut from the train. For instance, ID numbers can be assigned to each car or group of cars that are intended for a certain drop location. As the train approaches the drop location, an uncoupler command combined with the group ID number would first result in the last car in the group uncoupling from the trailing cars in the train. The next uncouple command would result in the first car in the group uncoupling from the rest of the train, leaving the group separated from the other cars. This last operation could have been done after the group was pushed onto a siding. Once the locomotives and its trailing cars had recoupled to the trailing cars left during the first uncouple operation, car-to-car communication would confirm that the operation is complete and reassign car position numbers in the train without affecting any other group numbers. The train is now ready to unload the next car or group of cars at the next drop location.

Hump Yard Operation: If cars had their own group ID number, it would be easier to sort them out at hump yards using a track transceiver. As the first car passed the track transceiver, it would report the number of cars in that group and its intended destination. This information would be sent to the central yard controller and turnouts would be activated for that group. As the last car in that group passed the transceiver, its coupler would open to allow that group to move down the hump to the correct siding.

Also, if each car knew its real weight and can monitor its own speed, it would be possible to apply brakes in a way that would allow a car or group of cars to slow the correct amount to coast to the right distance onto the siding.

Loco Quantum:

Note that all the features described for RQ could also be applied to LQ. Except for motor drive capability, the differences are primarily software and appliance operation. All of the features listed above could be applied to LQ were appropriate for a locomotive. The following are additional features that would be suitable for locomotives:

Locomotive ID numbers including A, B and C type: NMRA DCC uses 10,000 ID numbers for locomotives, which is enough for all four digit cab numbers. However, many helper locomotives use the alpha keys, A, B, C, and D along with their cab numbers such as 39A, 69D, etc. This was a common practice with prototype E and F type locomotives where all locomotives in a dedicated Consist were given the same number but different alpha suffixes. For instance, an E unit Consist may consist of a lead locomotive, 39A, and two helpers, 39B, and 39C. Quantum systems will include Alpha suffixes in addition to 10,000 cab numbers to allow giving each locomotive an ID address equal to its designation.

In addition, in model railroading, a user might have three or four locomotives with the same cab numbers because the manufacturing company only printed one type of cab number. Using the alpha suffixes would provide a way to separate these locomotives and still provide a common cab number.

This works well for Quantum Analog where we can include codes for the Alpha suffixes but is not applicable for DCC where the ID protocols are already specified. To extend this feature to DCC, we might need to include a CV to designate the Alpha suffix which would require special ID operations and a specialized DCC command station. These ID's would not be easily accessible to most commercial DCC products.

Figure 80:
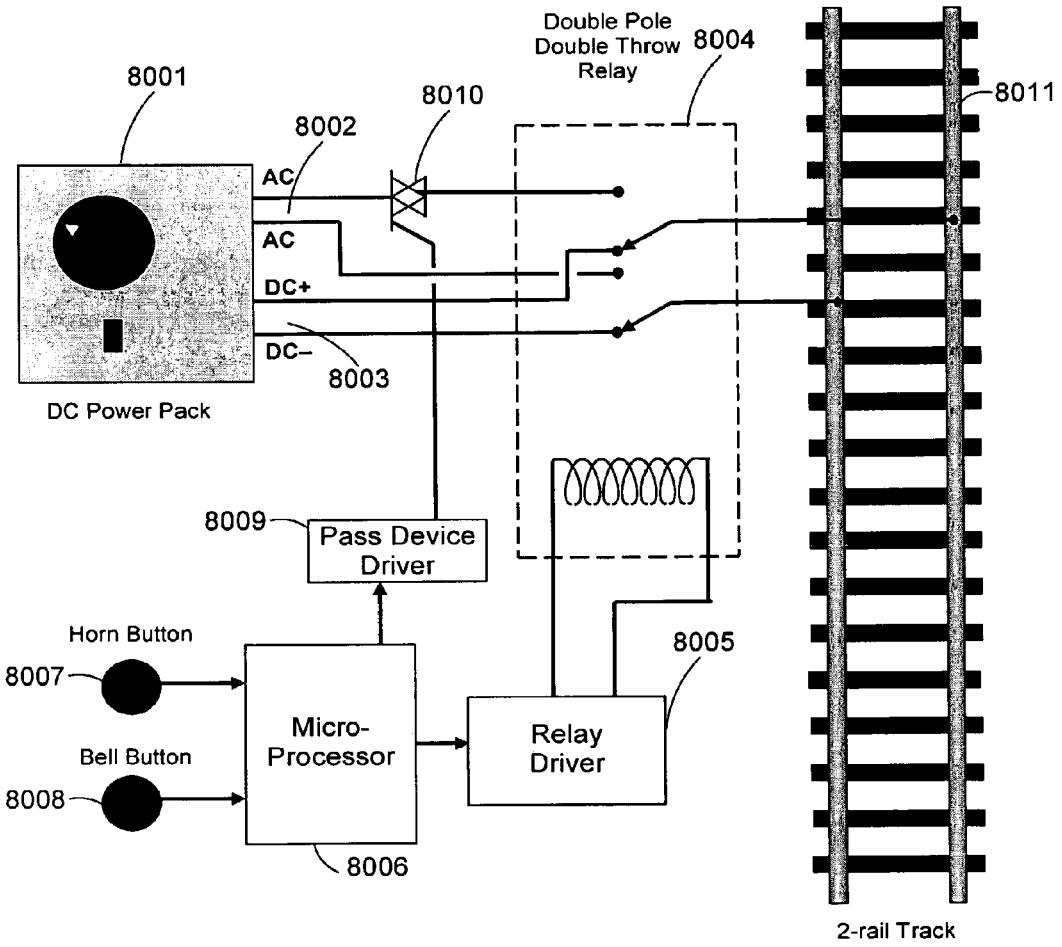
FIG. 80 Schematic and block diagram of two button controller to provide AC remote control signals for DC powered trains.

Selecting a Quantum locomotive on the Quantum Dispatcher Controllers shown in FIG. 80 requires the operator to press the Select Loco button followed by the locomotive number up to 4 digits, followed by the optional Alpha suffix key, A, B or C and followed by the enter key. As an aid to determine how many digits have been selected, the green state light blinks at a progressive rate as each new number key is pressed. Future train controllers will have additional Alpha selections and may allow five digit ID numbers to cover some prototype locomotives that used 5 digit cab numbers.

Entering an ID number into a Quantum System from an Analog Quantum Controller requires the operator to press the Set Loco ID key followed by the locomotive cab number and optional alpha suffix, followed by the enter key. This ID number is retained in on-board non-volatile memory.

Consist ID numbers: NMRA DCC uses 100 ID numbers for train Consists which is usually sufficient for a realistic number of Consists that might be operated on a model train layout. However, there is no reason to restrict the number of Consist ID numbers; considering the lowering cost of memory, and to provide consistency with locomotive ID numbers, this number of Consist numbers should also extend to 10,000. The alpha suffixes can still be used but will have a different purpose.

Types of Consists: Although NMRA DCC allows consisting locomotives but does not provide a simple way to break off groups of locomotives within a consist. There are a number of different Consists used by prototype railroads: 1) Head-end Consists which can contain any number of locomotives usually from two to seven; 2) Mid-Train helper Consists which can include any number of locomotives, usually from one to five, and 3) Pusher Consists. Another type of Consist we will call a Break-Away Consist, which is usually from one to five locomotives which are temporarily used with a Head-end Consist and removed as a group when they are no longer needed. We designate these four Consists as type A, B, C and D respectively and use these alpha suffixes when entering a Consist number.

Each Consist type has its own unique job to do and has its own set of enabled operating parameters. Some of the more important features settings for each Consist type are shown in the table below.

Feature Operation of the Different Consist Types:

| | Head End Consist | Mid Train Consist | Pusher Consist | Break-Away Consist |
|---|---|---|---|---|
| Headlight | Lead Loco only | All disabled | All disabled | All disabled. |
| Reverse Light | Disabled on all locos | All disabled | On all the time in End Loco; all others disabled. | All disabled. |
| Front Coupler | Lead Loco only | All disabled | All disabled. | All disabled. |
| Rear Coupler | End Loco only | All disabled | All disabled. | All disabled. |
| Horn | Lead Loco only | All disabled | All disabled. | All disabled. |
| Bell | Lead Loco only | All disabled | All disabled. | All disabled. |

Other features such as dynamic brakes, squealing brakes, etc. will behave as they do within a Consist type.

However, feature operations change when the Consist types are selected with the Consist ID and their alpha suffix; each consist behaves like a Head-End Consist. That is, the first locomotive acts like a Lead Helper type and subsequent locomotives act like Mid Helper types while the last locomotive acts like an End-Helper type. This allows the Consist types to be moved around in the yard while the train is made up under hostler operation like each is a normal Head-End Consist with the operating front coupler and Headlight and operating rear coupler and Reverse Light. This allows the different Consist types to have lighting to see during yard operation and operating couplers to connect to the train as well as horn and bell sounds for signaling and safety. However, when the train is made up and the Consist is selected with only the Consist ID, then all Consist types operate according to their Consist type specifications as shown in the above table.

The advantage of having different Consist types is that each can be selected and operated separately. For instance, if a train consists of any of these four types of consists, each part can be selected in turn by a common Consist number and by the alpha suffix and each Consist type brought up one by one to make up the train. When the Consist is ready to be operated, the entire train would be selected by its common Consist number (without any alpha suffix) and operated as a whole. When the train needs to be broken up, each part of the Consist can be selected individually and moved to a siding ready for service on the next train or to locomotive yard to be broken up into individual locomotives and serviced and/or stored.

Making Up Consists: A consist can be constructed by selecting each locomotive in turn and giving each locomotive the common consist number followed the optional alpha suffix and then program it for the different helper types which can take a long time. Or a controller can do this automatically by a simple protocol that sets Consist ID numbers and Consist types and locomotive helper types in one expression. For instance, we might key in the following expression on Quantum Controller using the following operations:

"Consist 39A Equals Locomotive 3498A plus locomotive 3498B plus locomotive 5679."

This would first automatically clear any consists on the layout connected to the same controller that had the same intended consist ID. This would prevent any conflict between two trains with the same Consist ID number. Second, it would set 3498A to a Lead Helper type, followed by setting its Consist ID to 39A. Third, it would set 3498B to a Mid Helper type, followed by setting its Consist ID to 39A. Forth, it would set 5679 to an End Helper type, followed by setting its Consist ID to 39A.

Another Consist type within the same Consist might be expressed as:

"Consist 39B Equals locomotive 56 plus locomotive 294."

This would first set locomotive 56 to a Mid Helper, followed by settings its Consist ID to 39B. Second, it would set 294 to a Mid Helper, followed by setting its Consist ID to 39B.

A third Consist type within the same Consist might be expressed as:

"Consist 39C equals locomotive 3498 plus locomotive 4589."

This would first set locomotive 3498 to a Mid Helper followed by setting its Consist ID to 39C. Second, it would set 4589 to a Pusher type followed by setting its Consist ID to 39C.

The command to clear all other consists on the layout will only apply when an A type consist is created. Otherwise, all subsequent Consist types would clear the previous Consists.

A fourth Consist type within the same Consist might be expressed as:

"Consist 39D equals locomotive 45A plus 45C."

This would first set locomotive 45A to a Mid-Helper type followed by settings its Consist ID to 39D. Second, it would set 45C to an End Helper type followed by setting its Consist ID to 39D.

RTC Versus STC

Most scale model trains do not operate well enough to satisfy the critical eye of a real train watcher. The problem is that the prototype locomotives weigh many tons and have a lot of inertia; they are hard to get going and hard to stop. Some model railroad products have been introduced to simulate the massive weight of these locomotives by not allowing the Analog track voltage or internal DCC speed step commands (based on CV3, CV4, etc.) to increase or decrease too rapidly. This works fine under many conditions, but does nothing to correct for the model locomotive slowing down quickly or stopping because it encounters tight curves, or has some gear lash problem. A fifty-ton prototype locomotive that is moving three miles per hour over a turnout does not come to a sudden halt because it hits a bump in the frog or has some minor wheel bind; neither should a properly designed model locomotive stop suddenly over some minor track or locomotive drive-train condition.

Figure 64:
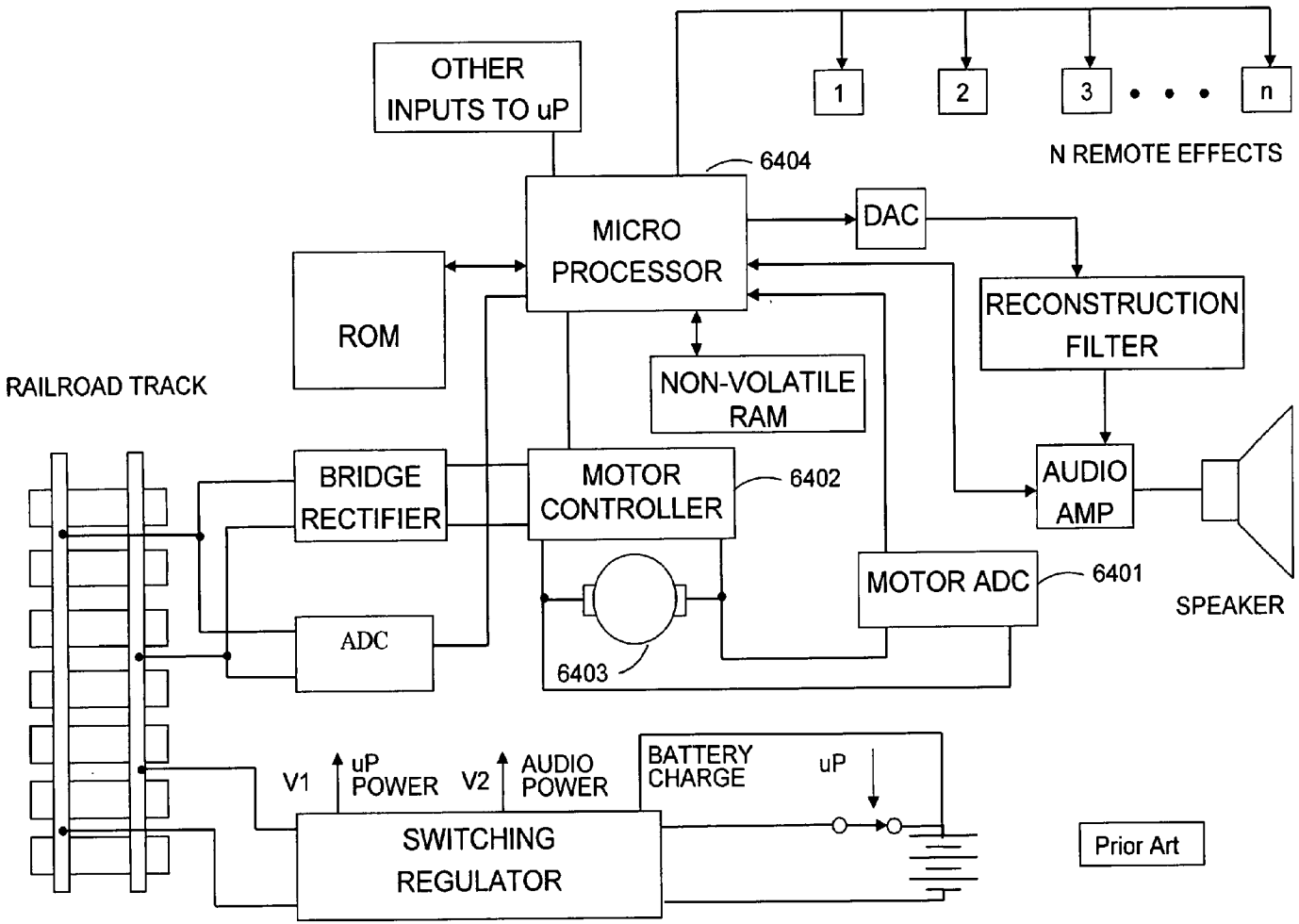
FIG. 64 Block diagram of QSI Train Control and Sound System showing microprocessor implementation of on-board motor control. (Prior Art)

Speed control was introduced into model railroading in the 70's and maybe the sixties to prevent locomotives from changing speed from variations in locomotive loading, track voltage, grades, binding curves, etc. We described the basic concepts of speed control in our discussion of the advantages of knowing the locomotives speed in U.S. Pat. No. 5,448,142 (column 17, lines 4-11) and a microprocessor implementation shown in FIG. 13 of said patent and described in column 22, lines 31-63. FIG. 64 is prior art of FIG. 13 (without the original reference numbers) of U.S. Pat. No. 5,448,142 showing a microprocessor implementation for a sound and train control system. In this drawing, the motor speed is determined by Analog to Digital Converter (ADC), 6401, that senses the Back EMF of the motor, 6403, when the motor controller, 6402, momentarily shuts the power off to the motor. The motor speed from the ADC, 6401, is then applied to the microprocessor, 6404, which in turn directs the power to the motor, 6403, by motor controller, 6402. This is a functional block diagram of a common motor feedback control system. In U.S. Pat. No. 5,448,142, we describe the advantages of knowing the speed of the motor to maintain a constant locomotive speed in column 16, line 17 through column 18, line 18. The pertinent text is as follows:

"Besides new remote control features, the speed of the locomotive can be used for many other purposes. The following is a list of some of the more important applications or uses for motor speed information: . . . 12. To do speed control of the locomotive to set it at some constant speed as it moves around the layout where variations in track voltage or grades or tight curves would normally cause speed changes. Also, knowing the locomotive speed will allow the system designer to provide a number of programmed speeds at different times or gradual start-up or gradual slow-down effects to simulate locomotive momentum."

Figure 65:
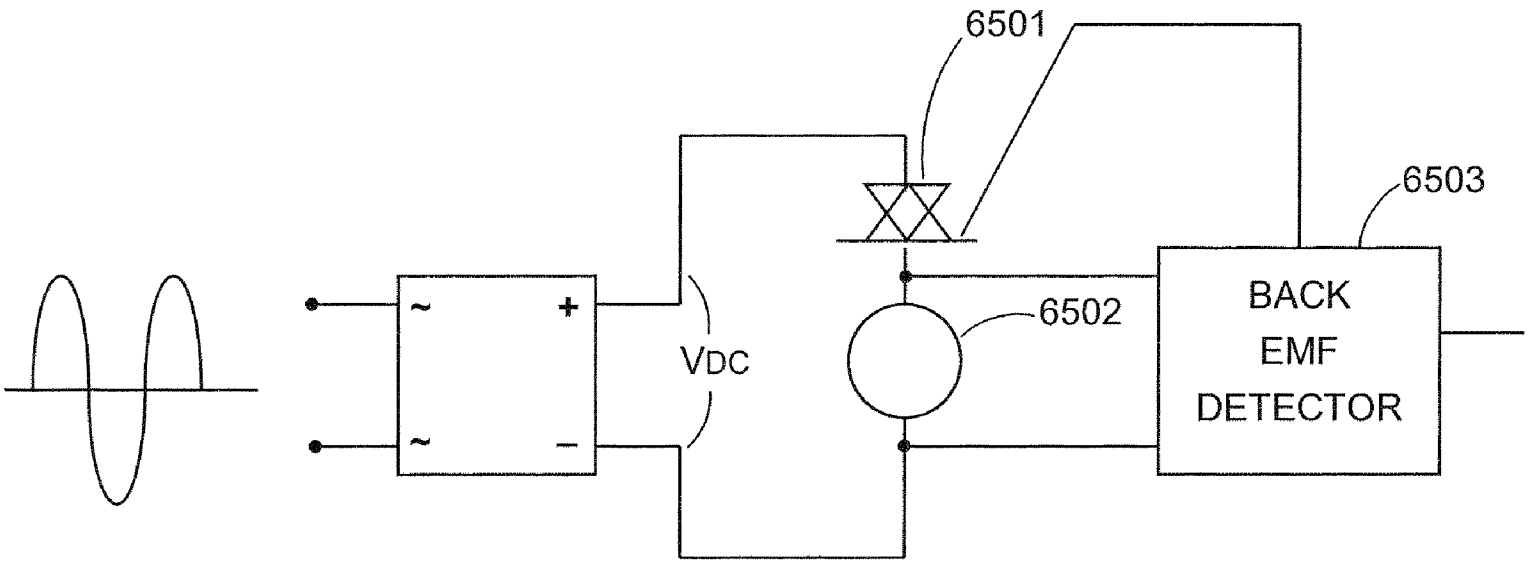
FIG. 65 Block diagram showing motor speed detection using Back EMF and motor control using a Triac pass device. (Prior Art)

Other examples of motor control and speed measurements are shown throughout U.S. Pat. No. 5,448,142. In particular, FIG. 65 is prior art from FIG. 11 of the same patent of the concept of back EMF speed detector on a DC motor using a pass device, 6501, to shut off power to the motor, 6502, to allow detector, 6503, to determine the Back EMF voltage.

Although speed control has been available in model railroading, it does not properly simulate the operation of heavy locomotives. While speed control does prevent a model locomotive from stopping when it encounters a raised track joint or temporary binding in the gears or track, it does not realistically simulate the change in train speed when it encounters a continuous force from grades or coupling up or uncoupling a large number of cars. A prototype train's inertia will resist changes in speed, but if the throttle is not changed, a train climbing a grade or a train encountering any continuous retarding force will slow down over time; the model should behave in the same way.

Under speed control, the model locomotive appears to have infinite inertia. This doesn't seem at first glance to be too disastrous since the operator still has control over his locomotive's throttle. If he wants it to appear to slow down when it starts climbing a hill or when it couples to some cars he can control the locomotives behavior with the throttle or with the throttle momentum features. A problem occurs when he couples a number of his locomotives together in multiple unit consists. All locomotives will try to maintain some speed based on the analog applied track voltage or DCC speed step setting but each locomotive may have a slightly different idea what this speed should be. For instance, a lead locomotive in a consist may try to achieve 29.0 SMPH (Scale Miles Per Hour) while a helper locomotive in the same consist is trying for 29.1 SMPH. The effect is that the helper tries to push the lead locomotive, which will resist the pushing since it is trying to remain at a slower speed. As the helper locomotive draws more and more power from the track (or from an on-board battery), the lead locomotive draws less and less. This condition is unstable and will result in the lead locomotive being completely shut down and the helper running at full power. What is needed to solve this problem is not just simple speed control, but speed control that can be modified by how much individual locomotives are loaded. If the helper locomotive is trying for 29.1 SMPH, but is drawing too much from the track to do so, it should lower its aspirations slightly to say 29.05 SMPH. Similarly, the lead locomotive that is being pushed needs less power than it would normally use for that speed and should understand that a higher speed is more appropriate, say 29.05 SMPH. Now both locomotives are fairly well matched in power demands and will pull well together.

Another problem with speed control is that it is not realistic; many operators prefer throttle control. They want to change the throttle, just like prototype engineers, whenever the locomotive changes speed from grades or coupling up to cars, etc. Operators would also like to use the NMRA's DCC CV's that apply to throttle control (but not speed control) such as V-Start (CV 2), V-High (CV5) and V-Min (CV 6), as well as manufacturer's speed curves and user defined throttle curves (CV67-94), Forward Trim and Reverse Trim (CV 66 and CV 95), etc. This allows users to configure a myriad of locomotive designs that have different performance to respond to the throttle in approximately the same way or to configure locomotives to have more realistic prototype speed ranges.

We have invented a novel method of model train locomotive throttle control called Inertial Control™ and Regulated Throttle Control (RTC)™. These methods combine concepts of speed control with power control to simulate real locomotive inertia. Model locomotives encountering short term forces like a raised track joint, brief binding from turnout or curved portions of track or internal gear binding in the locomotive will maintain their speed; but when encountering persistent forces from entering a grade or coupling up to cars, the locomotive will respond by slowly changing its speed in proportion to these applied forces.

The QSI Inertial Control and Regulated Throttle Control

Figure 66:
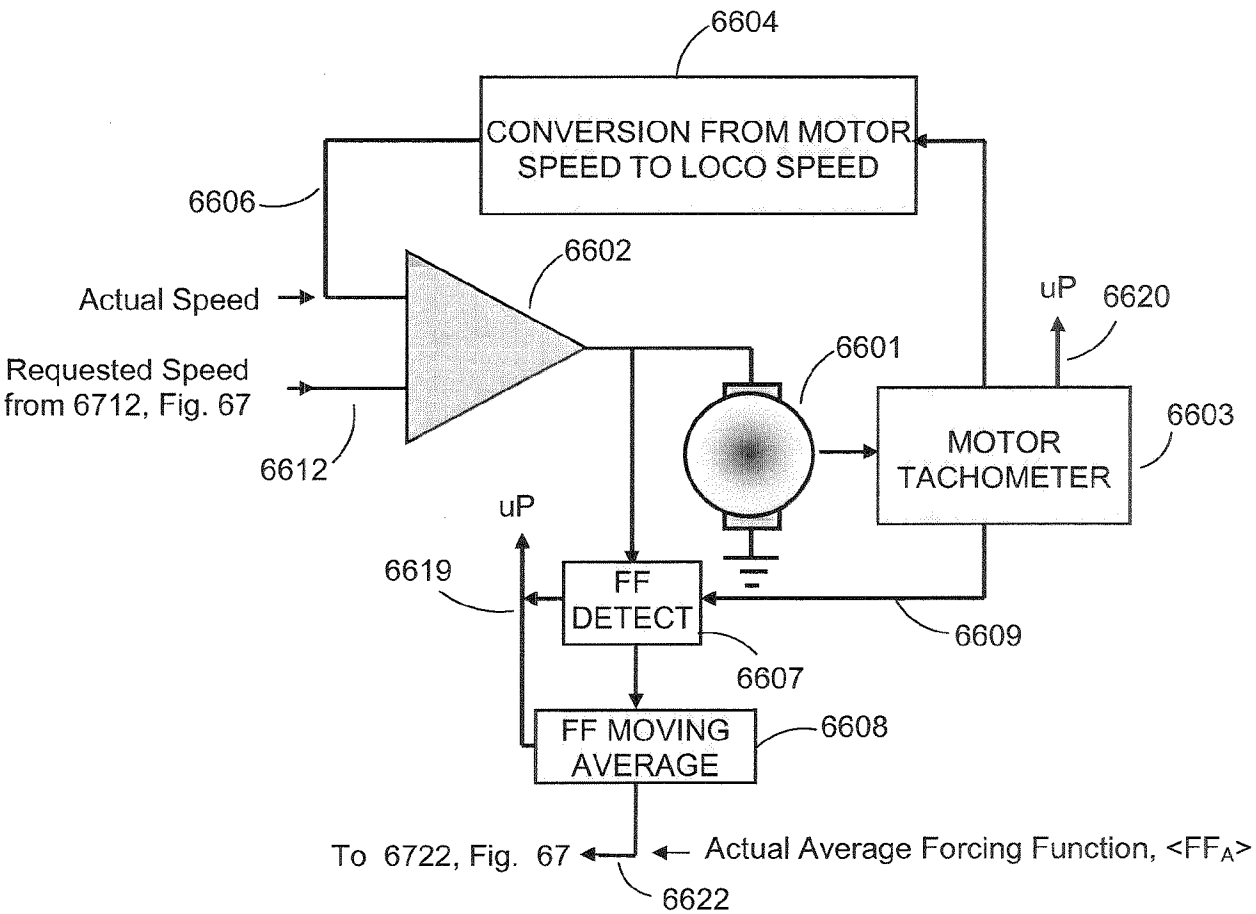
FIG. 66 Partial Block diagram showing a method for motor control called Regulated Throttle Control.
Figure 67:
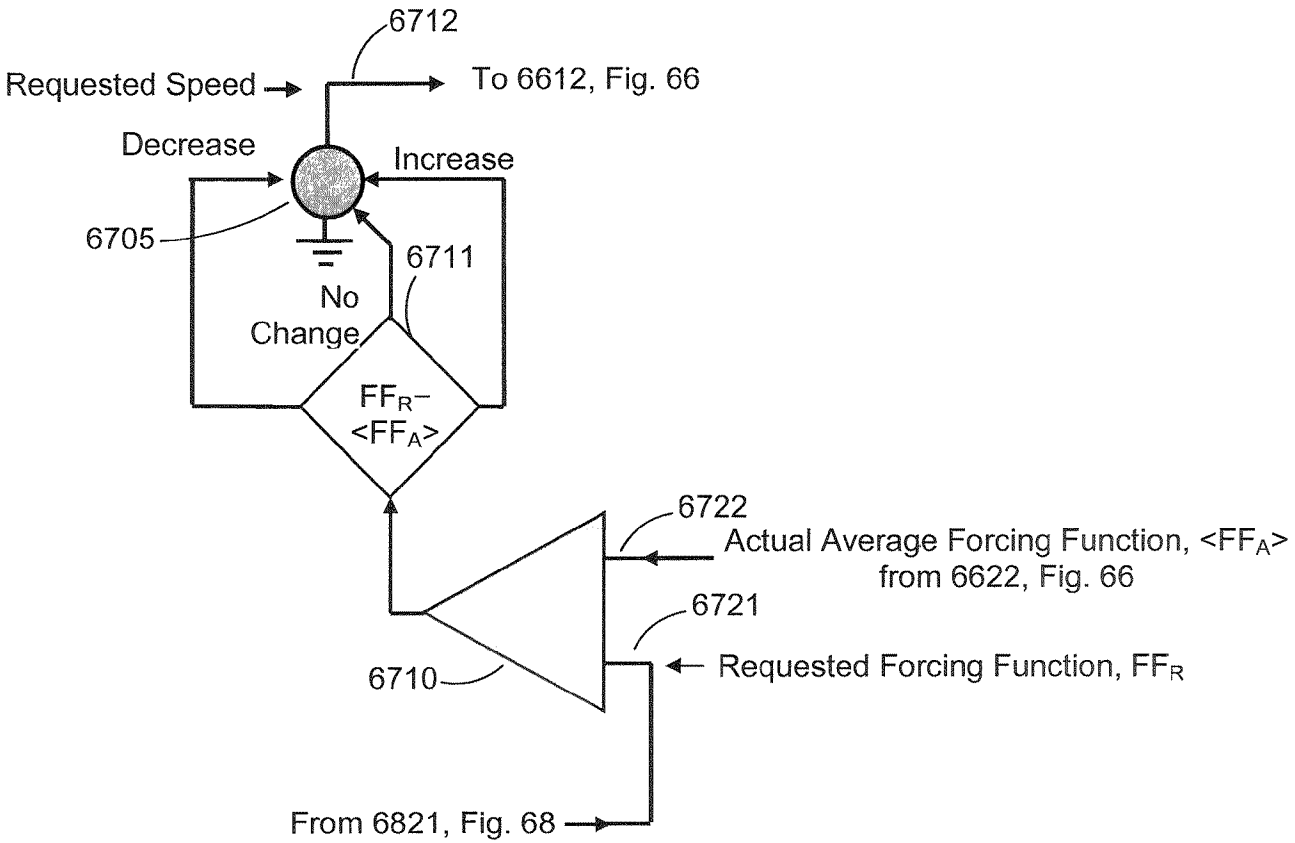
FIG. 67 Partial block diagram showing a method for motor control called Regulated Throttle Control.
Figure 68:
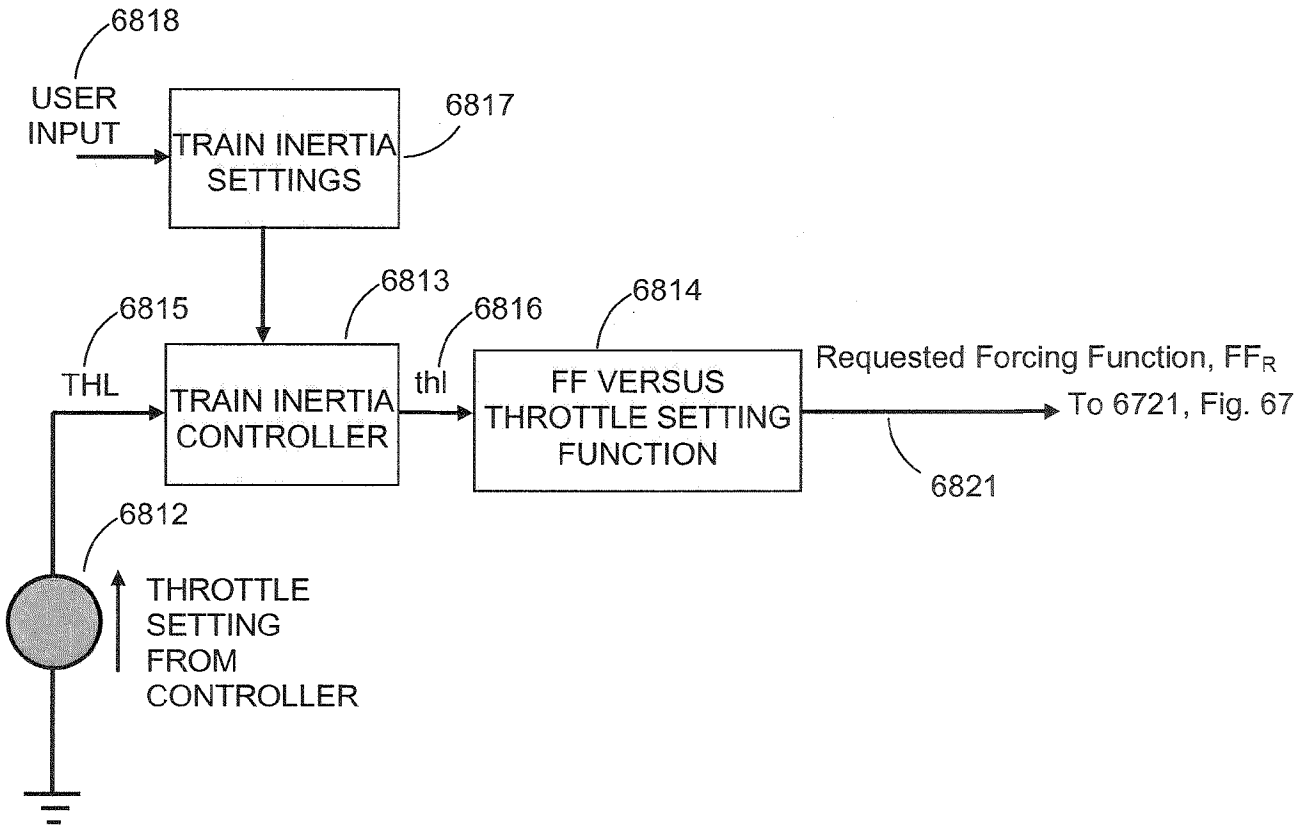
FIG. 68 Partial block diagram showing a method for motor control called Regulated Throttle Control.

This concept is illustrated in FIG. 66, FIG. 67, and FIG. 68. The locomotive electric motor, 6601, is powered by motor controller, 6602. The motor rotational speed is measured by tachometer, 6603. Motor speed is maintained at the requested speed, 6612, by comparing the actual speed, 6606, to this reference and changing the motor's forcing function through motor controller, 6602, to minimize the difference between actual speed and requested speed. Actual scale speed is determined from a conversion of the motor's rotational speed to locomotives linear speed based on the locomotives gear ratio, wheel size, scale of the locomotive, etc. by 6604. The motor control system based on these components is very general. It can represent a standard linear servo feedback system and use PID (Proportional, Integral, Differential) parameters to optimize performance. It can be applied to series or parallel connected universal motors or DC permanent magnet motors, or stepper motors. The motor forcing function applied by motor controller, 6602, can be a fixed high-frequency pulse drive circuit using duty-cycle control with high-rate diodes to maintain motor current during non-powered periods, or the motor may be controlled by applying pulses of different pulse widths and/or magnitude based on other motor control concepts. The motor controller can also control the motor's direction. The tachometer, 6603, can be based on optical measurements from a timing tape applied to the motor shaft or flywheel, or a Hall Effect device that detects the magnetic field from magnets applied to the motor shaft or flywheel, or from detectors that are connected to the locomotive's wheels or drive line or any other apparatus that can derive the locomotive's or motor's speed or direct voltage measurement of the motors Back EMF. Some of the components in the motor control loop may be located at the train's control center instead of on-board the locomotive. There are many different ways to maintain motor speed and many different circuits, which are too numerous to mention here. The point of this illustration is to indicate that the motor's speed is maintained with respect to a speed reference, 6612, by some motor control means. In addition, the motor speed as determined from tachometer, 6603, is shown applied to the microprocessor (uP) to be used in calculations for different effects such as simulated Doppler shift, Clickity-clack sounds and other speed based features.

The magnitude of the motor forcing function is determined by, FF Detect, 6607. This may or may not be a true measurement of the power supplied to the motor but is in general a monotonic function of motor power or torque; in other words, the greater the power or torque applied to the motor from motor controller, 6602, the greater the measured value from FF Detect, 6607 and the lower the power or torque applied to the motor from motor controller, 6602, the lower the measured value from FF Detect, 6607. If the forcing function is a voltage signal, the power to the motor can be determined from the instantaneous applied voltage, $V_A$, and concurrent motor Back EMF value. For instance, a good measure of the motor power is: $\text{Power}=V_A*(V_A-\text{BEMF})/R_M$ where $R_M$ is the motor's armature resistance. The Back EMF could be determined directly by interrupting the applied voltage, $V_A$, and directly measuring the BEMF or it could be computed indirectly based on tachometer, 6603, output 6609 and the motor's generator specifications. The motor's speed and the applied forcing function are also useful for other features and model train control and both outputs are shown supplied to the system's microprocessor through bi-directional bus lines, 6620 and 6619. For instance, using the above example of a voltage forcing function, the instantaneous current, I, in DC type motors can be calculated as: $I=(VA-\text{BEMF})/R_M$. This can be used to maintain safe operating currents for the motor controller and the motor or to act as short circuit protection.

The forcing function from motor controller, 6602, could also be a current source, which would be a useful way of directly controlling DC-type motor torque. In most cases for model railroad control, the controlling forcing function is usually pulse width modulated (PWM) voltage control.

The basic idea of RTC is to compare a forcing function based on the throttle input with the actual forcing function applied to the motor and then change the speed reference slowly in proportion to this difference. FIG. 67 shows difference amplifier, 6710, with inputs for the Actual Average Forcing Function, 6722, and the Requested Forcing Function, 6721. For example, in the case of a DC-type motor control with voltage pulse width modulated forcing function, the FF Detect, 6607, in FIG. 66, could simply detect the current PWM value and the requested FF could be requested PWM.

To provide inertial control, the speed reference, 6705 in FIG. 67, is not allowed to change instantaneously; instead it changes slowly over time. Since the forcing function applied to the motor can be quite variable depending on the motor control circuit, the choice of control parameters and the variations of load on the motor, the detected forcing function can be averaged, filtered, or modified to provide a more steady slower changing evaluation of the actual forcing function. In some cases, this averaging is not necessary. The moving averaging or filtering operation is shown by FF Moving Average, 6608 and the output, 6622 in FIG. 66, from this operation is designated as $<FF_A>$ where "FF" means "Forcing Function", where "A" subscript means "Actual" and the brackets "< >" indicate the result has been averaged or modified.

The output of the difference amplifier, 6710 in FIG. 67, will then cause the speed reference, 6705, to increase, decrease or remain the same in order to change the forcing function to the motor that will result in a smaller difference between the Actual Average Forcing Function $<FF_A>$, and the Requested Forcing Function, $FF_R$. Speed Reference Controller, 6711, controls the direction of change and the rate with which the speed reference is changed. If the Actual Average Forcing Function, $<FF_A>$, 6722, is greater than the Requested Forcing Function, $FF_R$, 6721, then the speed reference, 6705, is decreased. If the Actual Average Forcing Function, $<FF_A>$, is less than the Requested Forcing Function, $FF_R$, then the speed reference, 6705, is increased. And if Actual Forcing Function, $<FF_A>$, is equal to the Requested Forcing Function, $FF_R$, then the speed reference, 6705, is not changed.

If the rate of change to the speed reference, 6705, is slow, the locomotive will accelerate or decelerate slowly to its new steady state speed, which will be the correct speed necessary to minimize the difference between the new Requested Forcing Function and the Actual Average Forcing Function. We call this technique "Inertial Control". If the locomotive encounters a grade, the speed control will quickly react to maintain the speed specified by the speed reference, 6705. If it were an uphill grade, the motor forcing function will quickly increase to apply more power to the motor to maintain the locomotive's current momentum. This would result in the output from, 6711, slowly decreasing the speed reference, 6705, which would in turn decrease the motor forcing function slowly over time to a new steady-state value that again minimizes the difference between the actual and requested forcing function values.

This slow speed change in the speed reference represents the inertia one would expect from heavy locomotives and could be adjusted to simulate the prototype inertia of individual locomotive models. However, we have found it more practical to optimize the averaging of the forcing function, 6608, in FIG. 66 averaging of speed measurements from Tachometer, 6603, motor-control PID parameters and the rate and amount of changes to the speed reference from 6711 in FIG. 67, and gain of difference amplifier, 6710, to achieve the best transient performance of model locomotives during acceleration and deceleration. We call this resulting simulated inertia "Intrinsic Inertia" which should be as small as the fastest prototype locomotive that will be modeled.

The Requested Forcing Function applied to the input of the difference amplifier, 6710 in FIG. 67, is a function of the throttle setting made by the user. In FIG. 68, the output of the throttle, 6815, is the target throttle setting, THL, 6815, which is applied to the Train Inertia Controller, 6813, which delays and modifies changes in the target throttle setting, THL, to generate the effective throttle setting, thl, 6816. Over time, the effective throttle setting approaches the target throttle setting. The amount of delay is dependent on the inertia algorithm or circuitry in the Train Inertia Controller, 6813, and the Inertia Settings, 6817, provided by the user through User Input, 6818. The slower deceleration or acceleration provided by the Train Inertia Controller, could also be implemented in the Speed Reference Controller by adjusting its rate of changing the speed reference. However, as we discussed above, the Speed Reference Controller, 6711 in FIG. 67, is part of a control feedback system; it is sometimes advisable to not interfere with its optimized behavior. In addition, a separate Train Inertia Controller, like 6813 in FIG. 68, can use the same method of controlling momentum specified by the NMRA speed step control through their configuration variables, CV3, 4, 23 and 24.

The throttle setting, 6812, is applied directly to the FF Versus Throttle Setting Function controller, 6814, which can be adjusted to modify the effective throttle value, thl, 6816, to produce a suitable Requested Forcing Function, 6821, that is applied to the difference amplifier, 6710 in FIG. 67. For example, it might be better to provide finer user control over the Requested Forcing Function, 6821 in FIG. 68, by reducing the slope between the effective throttle, 6816, and Requested Forcing Function, 6821, at low throttle settings and increasing the slope between 6816 and output 6821 at mid and high effective throttle settings.

The diagrams in FIGS. 66, 67 and 68 are intended to represent either an analog method or a digital method. Although the use of difference amplifiers, voltage sources representing throttle settings, and the like infer an analog method, this system can be easily implemented in a microprocessor or converted to silicon hardware such as an FPGA or Application Specific Integrated Circuit (ASIC). In a microprocessor implementation, the input to the motor controller, 6602 in FIG. 66, would be digital and the calculation of the difference between the Actual Speed and the Requested Speed would be done digitally. The motor forcing function might be accomplished through an electronic pass device in series with a voltage source or, if directional changes were required, an active bridge circuit or relays could be used. Any pass devices or relays would be under the control of the microprocessor. The Motor Tachometer, 6603, could be an Analog to Digital Converter (ADC) connected directly to the motor to measure Back EMF during motor shut down measurement periods, or it could be a separate digital tachometer with digital output directly to the microprocessor, 6620. The speed reference, 6612, would be a digital value stored in microprocessor memory, which could be incremented, decremented or unchanged by the algorithm representing the Speed Reference Controller, 6711 in FIG. 67. The Forcing Function Detect, 6607 in FIG. 66, may simply use digital information supplied by the motor controller, 6602, or it may use ADC's to measure the actual waveforms applied to the motor and analyze these waveforms in the microprocessor to determine an appropriate FF Detect value or digital information and forcing function waveform analysis can be supplied directly to the microprocessor as shown by 6619. Averaging or modification of the Forcing Function is easily accomplished by a microprocessor or this information can be supplied by separate averaging apparatus, 6608, or raw digital data through bus line, 6619. Other functions such as the Conversion From Motor Speed to Loco Speed, 6604, is easily accomplished within the microprocessor by calculations based on stored motor parameters, gear ratios, model wheel size, etc. and the motor speed input. The throttle setting can be determined by digitizing the track voltage for analog control or decoding the digital speed commands from DCC controllers. With the proliferation of extended feature microprocessors, almost all the functions described in FIG. 66 can be incorporated into the microprocessor.

Labored Sounds

We generate labored sounds under RTC based on how hard the model locomotive appears to be working. Some model train sound systems base their labored sounds on how much power the locomotive is using. However, real loading in a model locomotive presents a problem with our RTC motor control circuit since power to the motor is adjusted by our Inertial Control algorithm or circuitry to maintain momentum. If labored sounds were directly proportional to the real power demands of the model locomotive's electric motor, these sound effects could be inconsistent with the perceived operation of the locomotive by the user. For instance, if the locomotive approaches a grade and the throttle is not changed, the RTC algorithm will slow the locomotive down gradually; the perception by the user is that the train should be using the same power or less power. However, the RTC algorithm is applying more power to the locomotive's motor to maintain the simulated momentum of the train as it decelerates slowly climbing the grade. Without RTC, the model locomotive and train would slow or stop almost immediately as it starts to climb. Thus, the RTC algorithm is actually supplying more power to maintain the train's momentum when it starts climbing the grade. If the labored sound effects produced by the sound system were proportional to the real motor power, then under RTC, the user would hear labored sounds as the locomotive slows down on the grade.

To solve this problem, we generate labored sounds based on simulated loading rather than on real power demands from the motor. One aspect of the simulated labored sounds is simply based on steady-state operation of the locomotive from the throttle setting, 6815 in FIG. 68. The higher the throttle setting, the higher the labored sounds. This is called "Steady State Labored Sound". The other aspect of simulated labored sounds is proportional to the difference between the user throttle setting or target throttle, THL, 6815, and the delayed effective throttle value, thl, 6816, that is applied to the FF Versus Throttle Setting Function controller, 6814. This is called "Transient Labored Sound".

Under steady state conditions, thl and THL are equal and the labored sound is simply a function of their value. However, it the throttle is increased quickly, the target throttle value, THL, is initially much greater than the delayed effective throttle value, thl, which results in higher values of simulated locomotive labor sounds in our Sound-of-Power algorithm. As the thl value approaches the THL value, under the control of the Train Inertia Controller, 6813, and the Train Inertial Settings, 6817, the Sound-of-Power algorithm progressively reduces the labored sounds until finally when thl equals THL, they are consistent with the expected steady-state labored sounds for that throttle setting. On the other hand, if the locomotive is moving at some steady-state throttle setting, and the target throttle value, THL, is suddenly reduced below thl, then the Sound-of-Power algorithm will quickly reduce the labored sounds. As the thl value approaches the THL value, under the control of the Inertia Controller, 6813, and the Train Inertial Settings 6817 the Sound-of-Power algorithm progressively increases the labored sounds until finally when thl equals THL, they are consist with the expected steady-state labored sounds for that throttle setting. Other Sound-of-Power labored sound techniques can be employed as well. For example, we might reduce steam loco chuffing (steam exhaust sounds) to zero or a very low value when THL is suddenly reduced below thl until finally when thl is within some specified range of THL, labored sounds increase to a value consistent with the expected steady-state labored sounds for that throttle setting.

The above Train Inertia and Labored Sound concepts can also be applied to Standard Throttle Control (STC). In this case, the output, 6821, is applied directly to a power amplifier that applies the requested forcing function directly to the motor. In other words, STC, is simple motor power control based on the user throttle input but with the addition of Train Inertia Controller, 6813, and labored sounds effects based on the steady-state value of thl, 6816, and transient values of the difference between thl, 6816, and THL, 6815.

More on Signal Types

Our simple Type 1 commands take advantage of the reverse switch on most common U.S. designed DC power packs to reverse the polarity for simple horn, bell and programming operations. However, many European analog power packs do not use a reverse switch to change track polarity. Instead, the reversing operation is combined with the throttle. These throttles have a center-off position where no power is applied to the track. If the throttle is moved away from this position in one direction, positive DC track voltage is applied in amounts proportional to the throttle position. If the throttle is moved in the opposite direction from the center-off position, negative voltage is applied to the track in amounts proportional to the throttle position. It is impractical to use this type of throttle to do remote control polarity reversals; the on-board sound system can lose power and sound effects if the throttle is moved through the center-off position too slowly and it is problematic to return the throttle to the same setting after a polarity reversal.

In any case, once the operator has graduated to using digital commands for analog feature operation, such as those available with an add-on analog controller like the MBA shown in FIG. 13, there is no need for a reversing switch for remote control operation; either U.S.A. or European DC power packs can be used. Once a commitment has been made to use an add-on controller, or a newly designed analog power pack with digital commands, there are more choices for remote control signaling. Although new power packs have the advantage of fewer limitations in how remote control signals are implemented, most users would prefer to add on a simple controller that provided the extra functions. Type 2 and Type 3 signaling has the advantage of providing advanced analog control for any kind of DC power pack. However, if there is an external source of power available on the power pack such as an AC or DC accessory power output, there are other types of remote control signaling that can be employed, some of which may have advantages over using DC polarity reversals. These alternative methods are discussed below.

Figure 69:
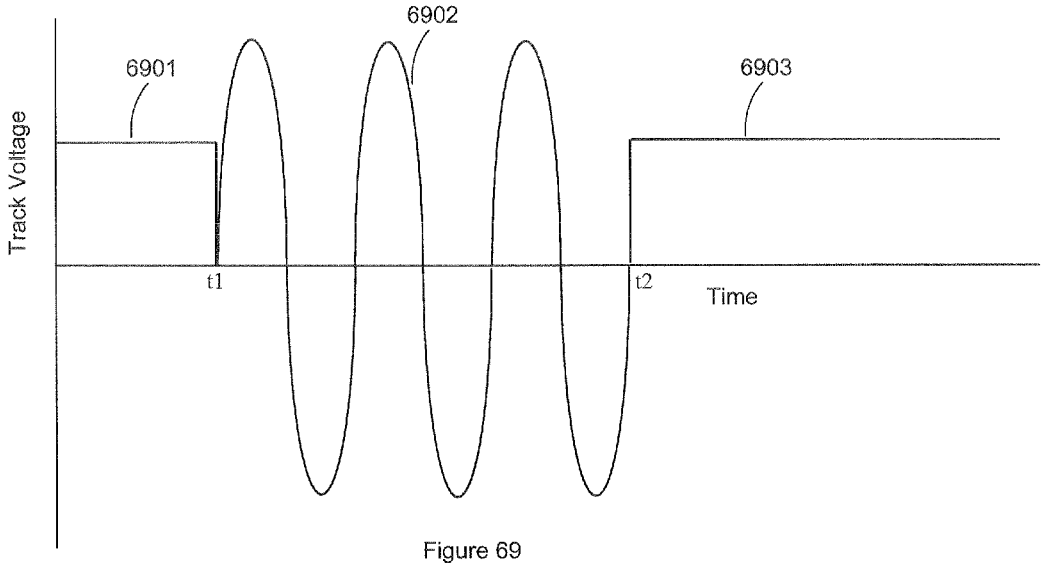
FIG. 69 Waveform showing the use of AC as a remote control signal for DC powered trains called Type 5 Signaling.
Figure 70:
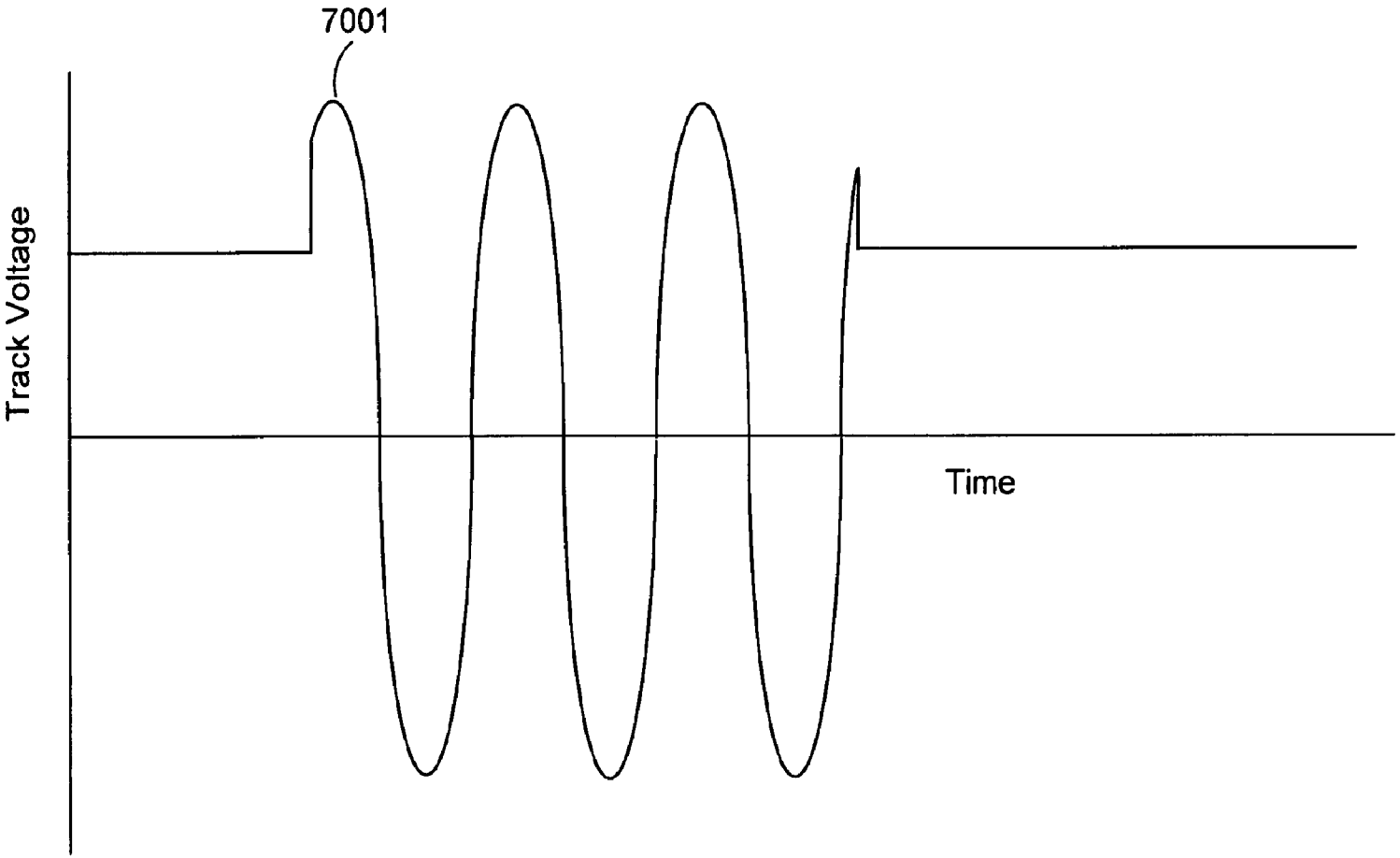
FIG. 70 Waveform showing interrupting the DC track voltage to apply AC at any phase angle for Type 5 Signaling.

Type 5 Signaling: If AC accessory power is available in a power pack, the simplest remote control method would be to interrupt the normal DC track power and replace it with AC accessory power as shown in FIG. 69. Here the normal DC signal track voltage is indicated by line, 6901, which could represent a filtered steady-state pure DC voltage or could represent the envelope of the DC pulse drive output from the power pack or could represent the average voltage of any kind of DC output waveform. At time t1, the AC remote control signal, 6902, replaces the DC track voltage waveform until time t2, where the DC track voltage, 6903, returns. The interruption of the DC track voltage and the start of the AC remote control signal is shown at precisely a zero crossing of the AC waveform. This is not necessary to use AC for simple remote control; the most general case is shown in FIG. 70, where the AC waveform, 7001, is shown starting and ending at arbitrary phase angle positions.

A simple two-button controller using a relay is shown in FIG. 80. The power pack, 8001, is shown with both a variable DC track voltage output, 8003, and a fixed AC accessory output, 8002. The double-pole double-throw relay, 8004, is shown under microprocessor control, 8006, through relay driver, 8005, to select whether fixed AC or variable DC is applied to the track. The horn button, 8007, and bell button, 8008, represent user input switches that affect the application and duration of the applied AC remote control signal.

For most applications, the AC waveform would be standard U.S. 60 hertz or European 50 hertz sine waves (henceforth referred to as "50/60 hertz" meaning either a 50 or a 60 hertz signal). However, this invention is not limited to any specified AC signal; any AC waveform could be used. The remote control concept consists of differentiating the presence of a bi-polar signal on the track from the normal DC track voltage. Another method would be to add AC to the existing DC signal, which would not require AC excursions into the opposite polarity. However, many DC power packs use duty cycle control of waveforms derived from full wave rectified 50/60-hertz power. Adding low-level AC signaling to these waveforms may not be easily detectable. Higher frequency AC modulation of the low frequency 50/60 hertz DC would, in principle, be easier to detect but more expensive to produce.

Figure 71:
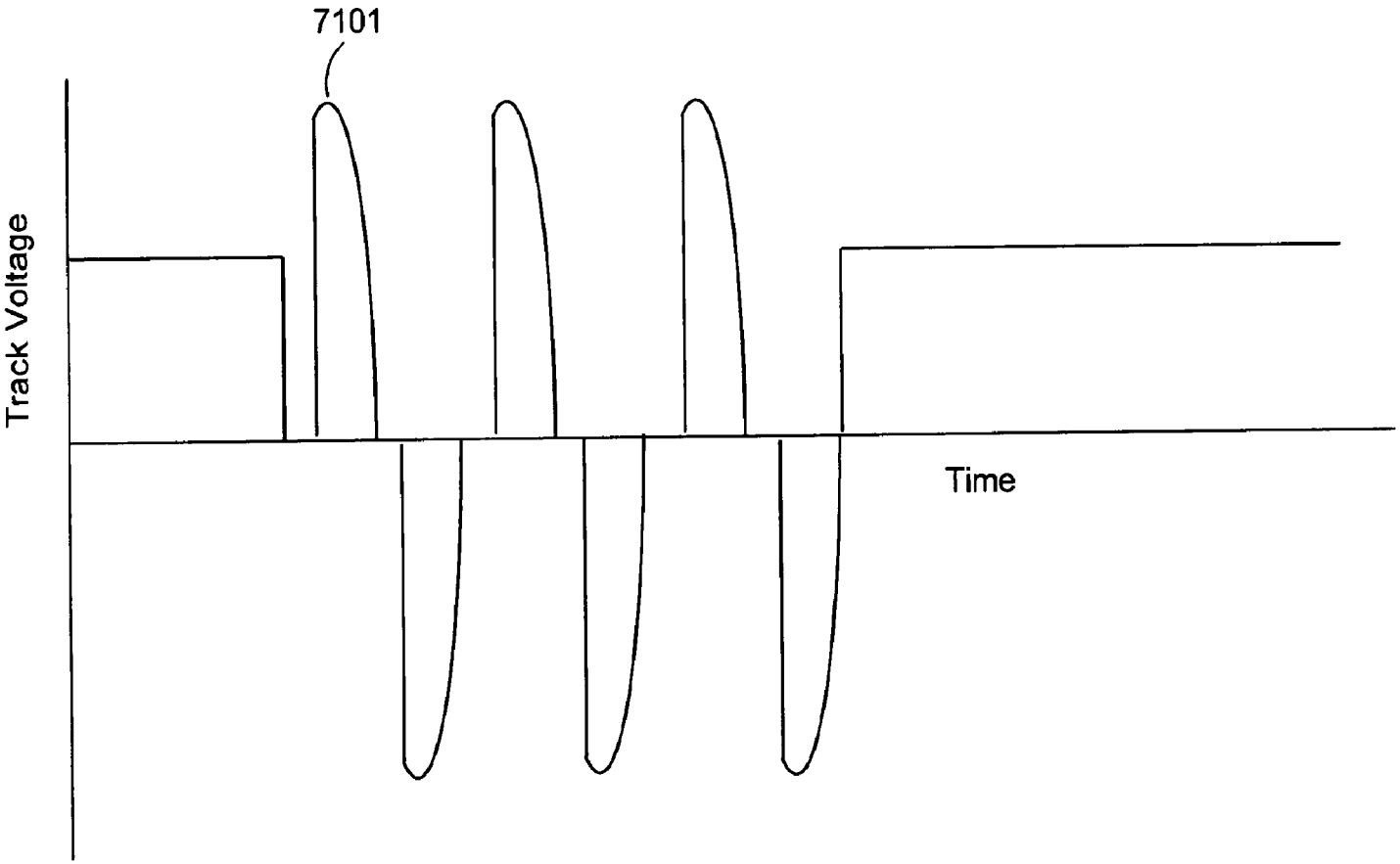
FIG. 71 Waveform showing phase shifting the AC remote control signal to better match the applied DC track voltage to prevent changes in model locomotive power.
Figure 81:
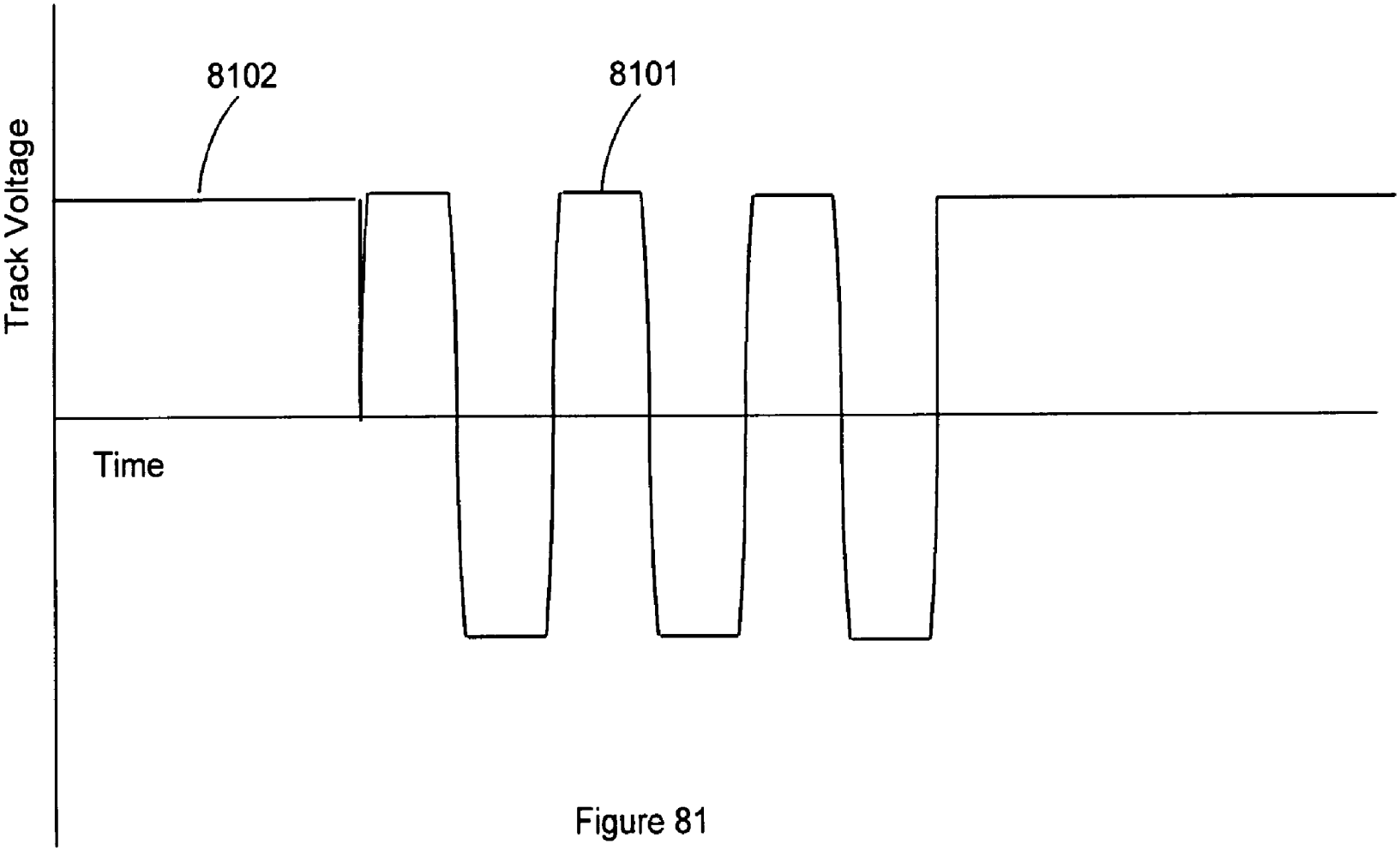
FIG. 81 Waveform showing AC remote control signals clipped to match normal DC track power to prevent changes in power delivered to on-board motor controllers.

One problem with using AC accessory voltage as a remote control signal is that it would likely be higher or at least different than the normal applied track voltage. Type 1, Type 2 and Type 3 signaling have the advantage of producing the exact same voltage on the track when the remote control signal is sent. Since the on-board Quantum system uses a full wave bridge rectifier to produce on-board power, there is no issue that the remote control AC voltage excursions into the opposite polarity will negatively affect on-board power. However, the magnitude will affect the total power available to the motor. One solution is to duty cycle modulate the remote control AC waveform to produce a voltage that is equivalent to the applied DC track voltage. This is shown in FIG. 71 where the AC voltage waveform, 7101, is phase shifted to produce a lower voltage to better match the DC track voltage. This is not completely satisfactory since the on-board available motor power from such an AC remote control voltage is affected by a number of issues. If the peak AC voltage is higher than the peak DC track voltage, any on-board filter capacitor will produce a higher average voltage to the motor, even though the average track voltage remains the same. Also, since the motor current is approximately the difference between the applied voltage and the motor's back EMF divided by the armature resistance, the speed of the train will affect how much the motor power is changed when the AC remote control signal, 7101, is applied to the track. One way to avoid this problem is to use AC square waves of the same magnitude as the applied voltage. Or an alternate method might be to simply clip the applied sine wave at the same peak voltage as the applied track voltage. This is shown in FIG. 81 where the AC waveform, 8101, shows where each AC lobe in FIG. 69, has been limited to the same peak voltage as the applied track voltage, 8102. Note that this method uses the same principles as described for Type 1 signaling except that the polarity reversals are occurring at a 50/60 hertz rate.

Another problem with using AC for remote control is that it changes the analog DC voltage on the track that determines the locomotives throttle setting. If the on-board algorithm determines the throttle speed by the DC value, then AC would be registered as a zero throttle setting. On the other hand, if the voltage detection were polarity independent, then the throttle setting would be changed to whatever the value of the AC voltage, which is probably higher than the DC track voltage but might be less depending on the AC voltage source used for remote control.

Another way to avoid a change in train speed whenever AC remote control signals are sent is to employ on-board speed control. Software or hardware would be used to direct the motor speed control circuitry to maintain the same speed whenever AC remote control signals were detected. Also, if the locomotive had inertia effects such as those described for RTC in this patent, there could be enough time to allow AC signals to be sent without apparent change in the train's speed. Either of these speed control methods seem to be the best and least expensive solution since they do not require adding circuitry to the AC remote control signal generator.

In a similar manner to using polarity reversals of DC power at different time intervals, the duration of the applied AC remote control signal could control different effects. For instance, a very short application of AC could result in toggling the bell, a slightly longer duration could trigger a horn or whistle hoot, while a long duration could continually blow the horn or whistle. A simple two-button controller design to apply an AC remote control signal is shown in FIG. 80. Here the horn button, 8007, and bell button, 8008, could control the time that the AC remote control signal is applied in the same way similar buttons control the duration of polarity reversals in FIG. 5. Double-pole double-throw relay 8004, under control of microprocessor, 8006, through relay driver, 8005, controls whether AC output, 8002, or variable DC output, 8003, from typical power pack, 8001, is applied to track, 8011. The amount of time that these two types of signals are applied are dictated more by the relay operation times than the detect time of the on-board sound system and hence the timing for AC signals to operate a bell or a hoot will be about the same as the time intervals for polarity reversals to do these same functions. These same AC remote control signals could be used to program the on-board sound system in a similar manner to how it was accomplished with polarity reversals. Optional AC pass device, 8010, under control of microprocessor, 8006, through pass device controller, 8009, affects how much AC signal is applied to the track. This device can be used to produce the voltage waveform, 7101, shown in FIG. 71.

A singular application of a short duration AC signal could be reserved for toggling a bell and a singular application of slightly longer duration would trigger a hoot, and any longer duration could cause the horn or whistle to sound continuously as long as AC was present. Under these definitions, Type 5 signaling is similar to using Type 1 signals. It would be natural to extend Type 5 commands in a similar way we extended Type 1 signals to Type 2 digital commands.

Figure 72:
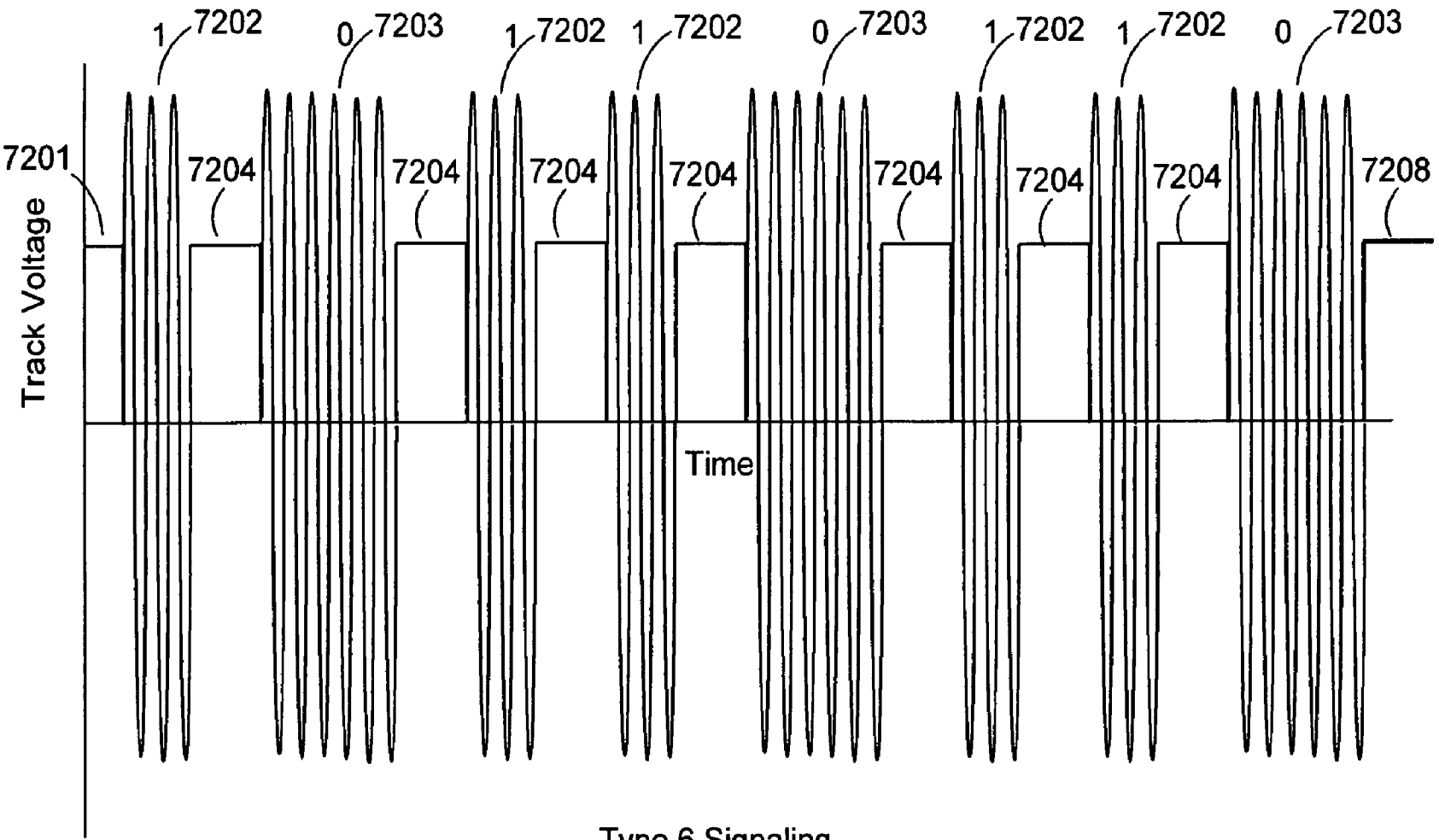
FIG. 72 Waveform showing using long and short durations of applied AC remote control signals with normal DC track voltage in between as a means to send digital information down the track called Type 6 Signaling.

Type 6 Signaling: FIG. 72 shows a series of short applications of AC remote control signals, 7202, interspersed with longer applications of AC remote control signals, 7203, replacing the normal track voltage, 7201. The AC signals are separated by equal duration applications of DC track voltage, 7204. Once the digital command is completed, normal DC track voltage, 7208, is reapplied. We have arbitrarily assigned a logic value of "1" to short duration AC signals and "0" to longer duration AC signals for the purposes of illustration; however, any assignment is possible. This assignment produces the digital word (1, 0, 1, 1, 0, 1, 1, 0). Based on the above definitions of AC signal durations for hoots and bell, this series represents a similar pattern to sending out a series of polarity reversals for hoots and bells in Type 2 signaling. Considering the limitations for relay operation times, this represents about the same transmission time requirements to send out an eight-bit digital word using Type 1 signaling. This type of signaling is called Type 6 signaling.

Figure 82:
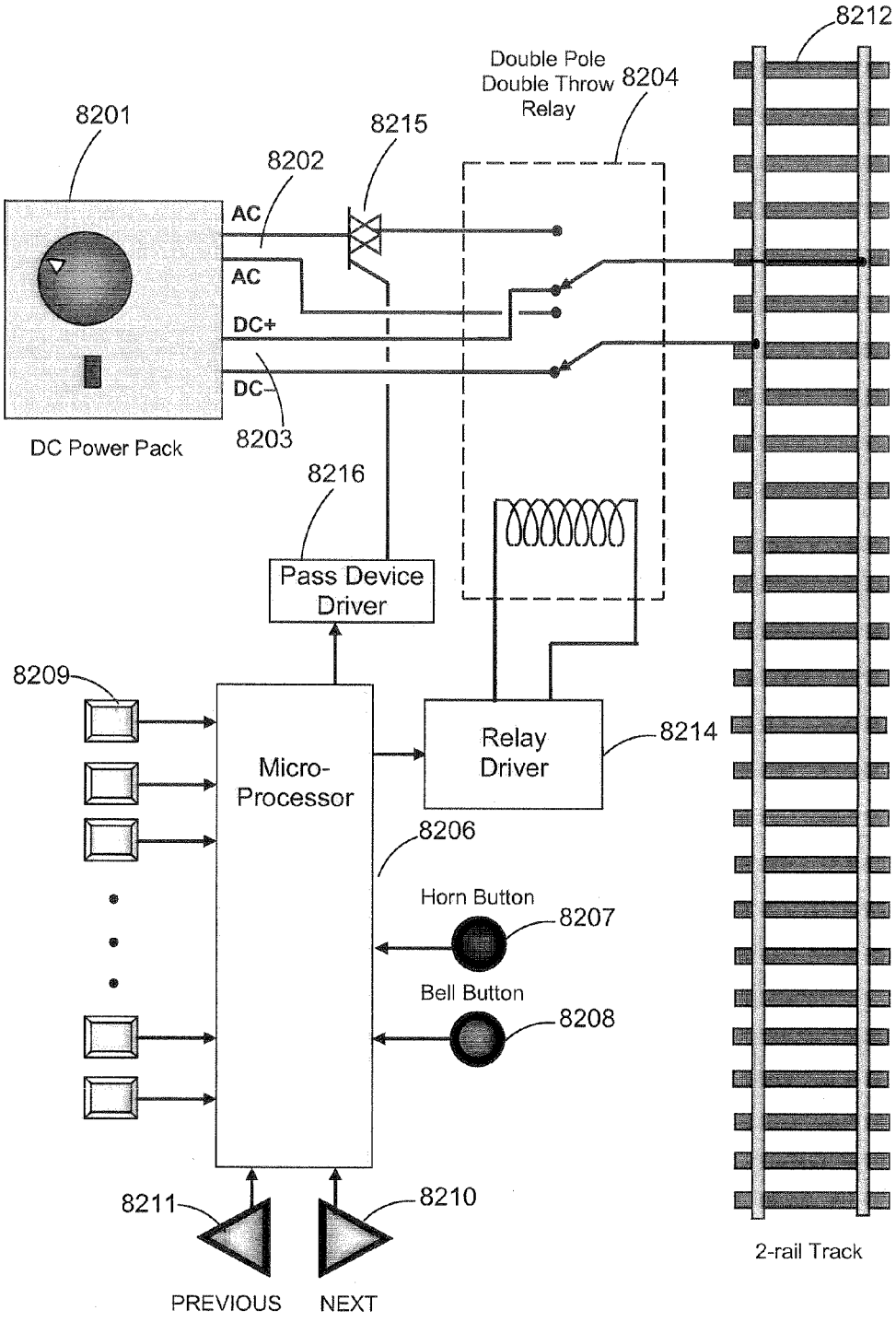
FIG. 82 Block diagram shows extending the two-button controller in FIG. 80 to an MBA type Controller using AC remote control signals.

FIG. 82 shows extending the two-button controller shown in FIG. 80 to an MBA Controller design. Added buttons, 8209, allow the user to control a variety of on-board features besides the horn and bell button inputs, 8207 and 8208. Additional buttons, 8210 and 8211, allow for selecting different on-board programming options. Each time any of the control buttons is pressed, microprocessor, 8206, affects relay 8204 through relay driver, 8214, to send out a series of AC remote control signals of various durations to transmit digital commands to the remote on-board sound and train control system on track, 8212. Optional AC pass device, 8215, under control of microprocessor, 8206, through pass device controller, 8216, affects how much AC signal is applied to the track.

Figure 73:
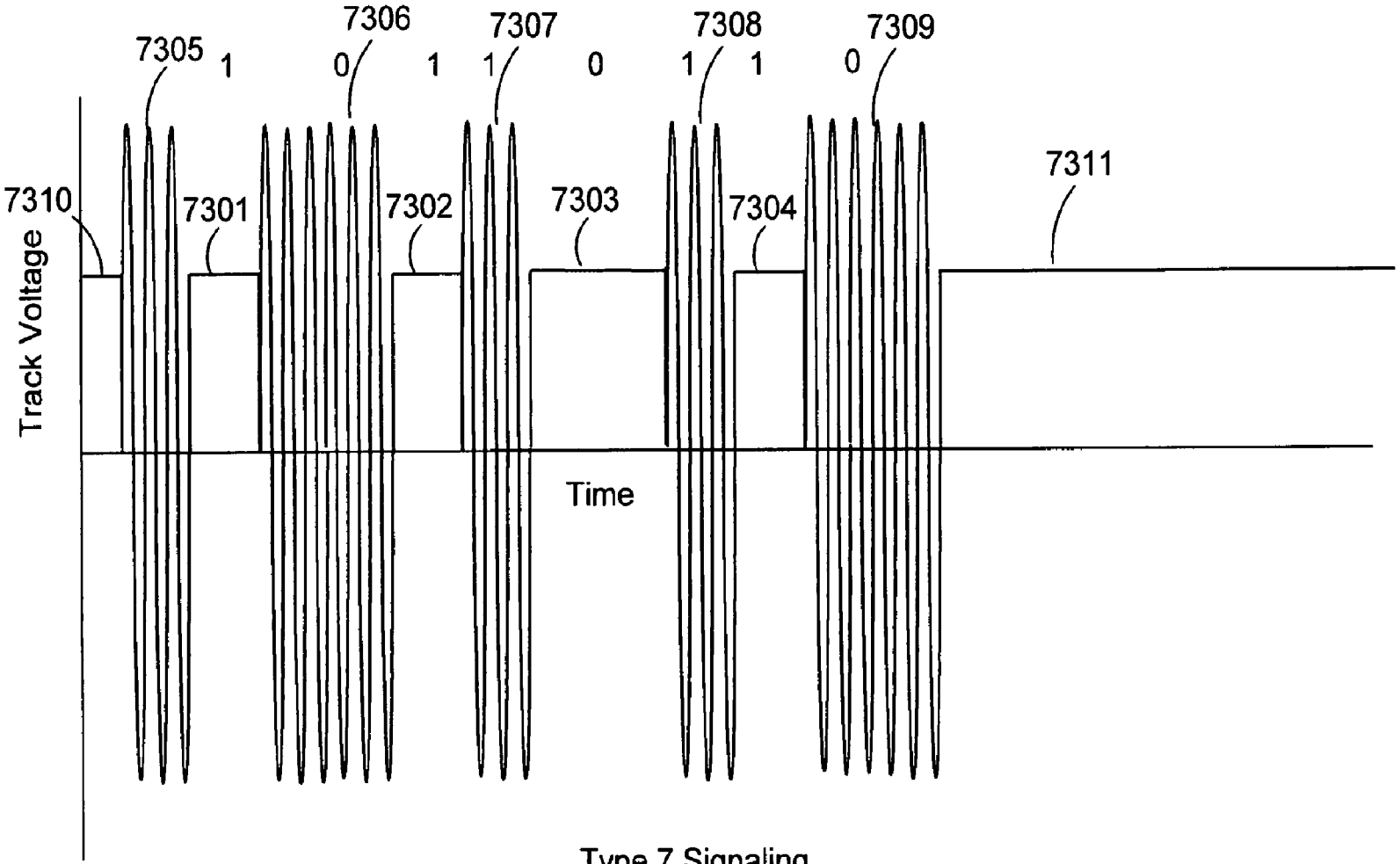
FIG. 73 Waveform showing a method of using long and short durations of applied AC remote control signals interspersed with long and short durations of DC track voltage as an improved means of sending digital information down the track called Type 7 Signaling.

Type 7 Signaling: Type 6 signaling will have the same type of transmission time limitations as Type 2 signaling. Type 6 AC remote control signaling can be improved as shown in FIG. 73. Here varying the time between AC signals is used to generate additional digital data instead of acting as a separator between AC signals such as the equal interval DC track voltage intervals, 7204, shown in FIG. 72. FIG. 73 shows both AC bits represented by AC signals, 7305, 7306, 7307, 7308 and 7309 and DC bits represented by 7301, 7302, 7303, and 7304. For example, we can designate the long duration AC signals a logic "0", and short AC signals as logic "1" and designate the long DC periods a logic "0" and the short DC periods a logic "1". These designations are arbitrary but do illustrate how data transmission can be shortened from Type 6 signaling by such a method. Since we want to return to normal DC track power after sending a digital command, each command must contain an odd number of bits. In this example, nine bits are sent. The first transmission is shown as a "1" start bit for the data packet and is not part of the data transmitted for the following 8-bit word (1, 0, 1, 1, 0, 1, 1, 0) shown above the wave from. However, if necessary, all bits can be used for data transmission. This new type of combining AC and DC signaling is called Type 7

Just like advanced Type 3 signaling, Type 7 signaling can be fast enough for most feature operations for model trains. Type 3 signaling produced very reliable results with a 30 ms PRP for a Logic "1" and a 60 ms PRP for a Logic "0" and we would expect these same times to apply to Type 7 signaling. At these times an average 8-bit word could be transmitted in 390 ms and worst case (all 0's) would take 510 ms while best case (all 1's) would take 270 ms.

Using a logic 1 start bit may have another advantage for either Type 3 or Type 7 signaling. If some feature were normally operated with a short AC pulse in Type 7 or a short PRP in Type 3 signaling, we would prefer that this feature not respond to a digital command using short AC or short DC pulses. In Type 3 signaling, a short PRP and in Type 7 signaling a short AC pulse can be assigned to toggle the Bell effect. If we delay the bell effect from turning on for a specified time period, we can ensure that the bell effect will not respond should other signals follow directly afterwards. This time delay would be perceived as a problem for bell operation, since this feature is not expected to turn on rapidly on the prototype locomotive.

Figure 74:
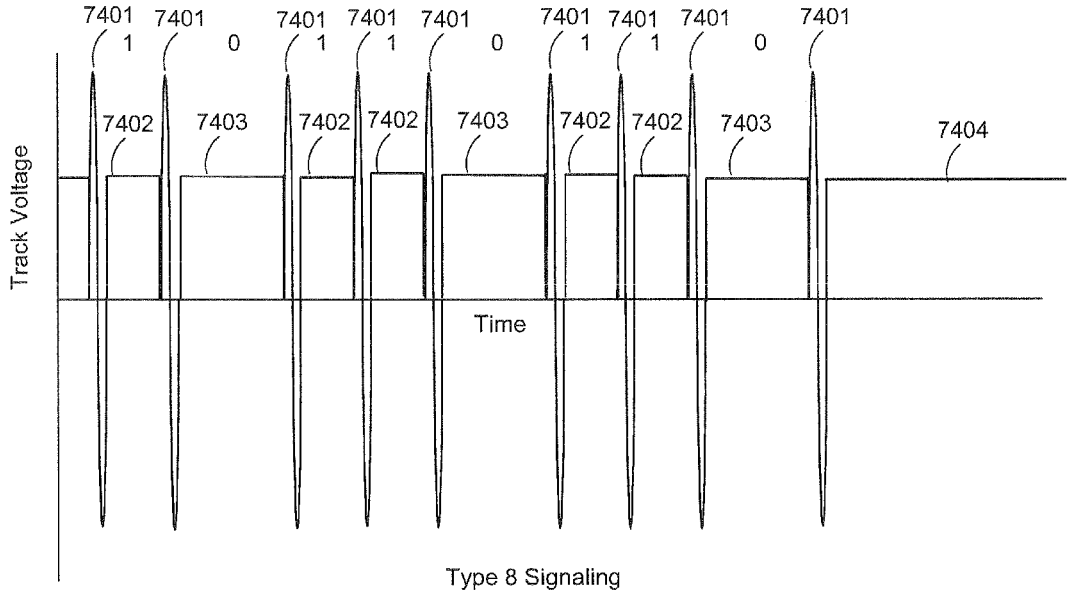
FIG. 74 Waveform showing the use of short bursts of AC as a bit separator between long and short durations of DC track voltage as a means of sending digital information down the track, called Type 8 signaling.

Type 8 Signaling: Another way to use AC signaling is as separator signals for DC track voltage. This is shown in FIG. 74. Here nine short applications of AC signals, 7401, are applied between long and short durations of DC power. In this example, short DC signals, 7402, are designated as a logic "1" while long duration DC signals, 7403, are designated as a logic "0". In this example, the digital word (1, 0, 1, 1, 0, 1, 1, 0) is transmitted. If relays are used to interrupt the DC power to apply AC, the amount of time for the AC applications can be shortened from the 30 ms recommendation discussed above since only the presence of AC need be detected and not its accurate duration. At the end of data transmission, normal track voltage, 7311 in FIG. 73, is reapplied. This is called Type 8 signaling. Type 8 signaling is similar to Type 6 signaling except that the roles of AC and DC are exchanged.

Figure 75:
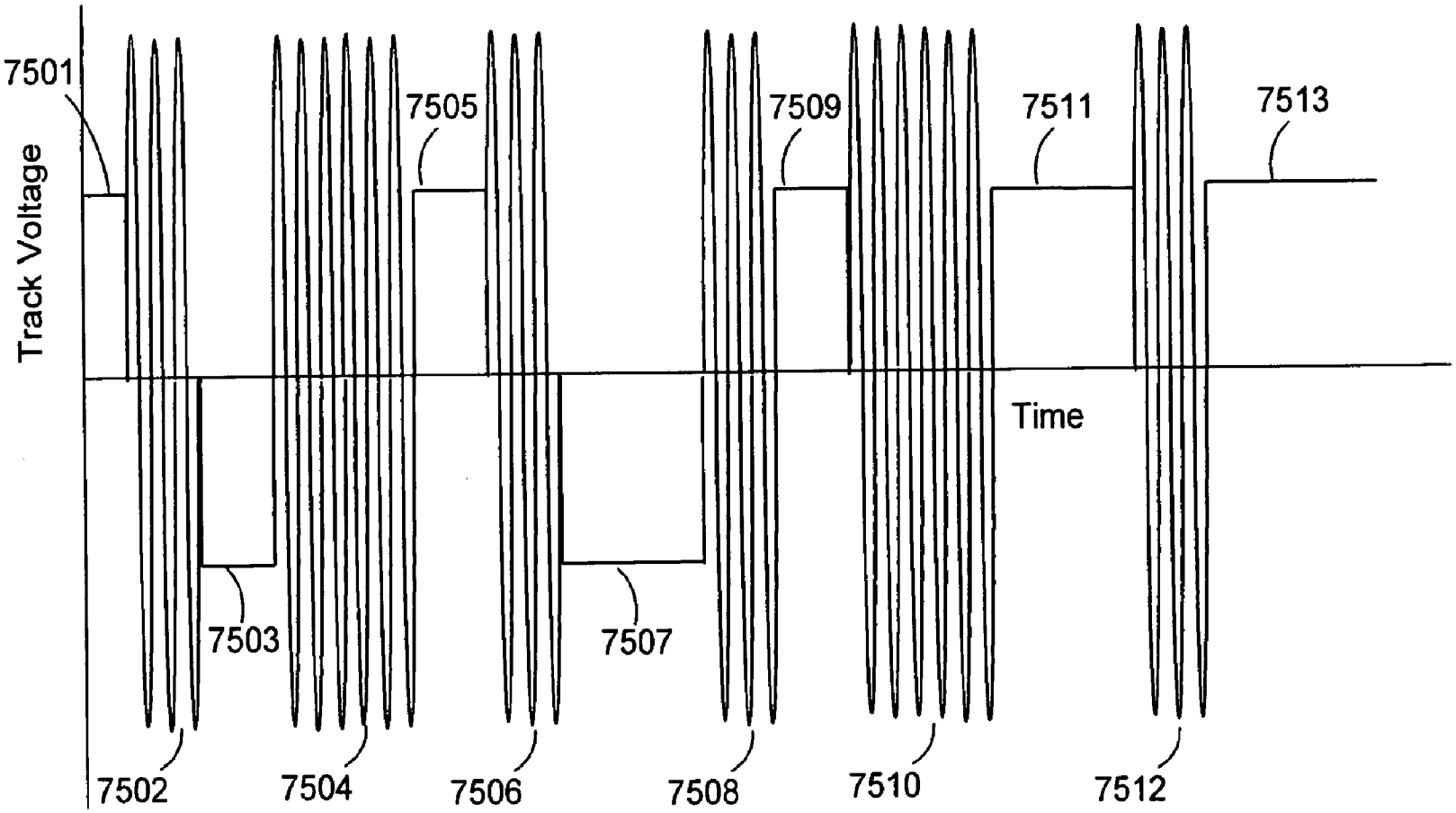
FIG. 75 Waveform that combines Polarity Reversal Signaling and AC signaling to produce a faster data rate called Type 9 signaling.

Type 9 Signaling: FIG. 75 shows combing Polarity Reversal signaling and AC signaling to produce a faster data rate. Each DC signal is separated by each AC signal. Each AC signal can transmit one bit using either a short duration or long duration application of AC power. However, DC signals can transmit two bits since both the duration and the polarity can be changed. The following table is an example of assigning digital values to the two possibilities for AC and four possibilities for DC signaling.

| | Binary Value |
|---|---|
| AC Short Duration Signal | 1 |
| AC Long Duration Signal | 0 |
| DC Long Duration Signal | 00 |
| DC Short Duration Signal | 01 |
| PR DC Long Duration Signal | 10 |
| PR DC Short Duration Signal | 11 |

FIG. 75 shows the original DC track voltage, 7501, being replaced by a series of AC and DC signals. Short duration AC signals, 7502, 7506, 7508, and 7512 represent digital "1's" and long duration AC signals, 7504 and 7510 represent digital "0's". DC signal 7503, represents the two bit binary value, (1,1), since it is a short duration DC signal and it is polarity reversed from the initial track voltage, 7501. The same short duration DC signal, 7505 and 7509, represents a different binary value, (0,1) since it is not polarity reversed from the initial track voltage, 7501. Similarly, the two long DC signals, 7507 and 7511 represent the two different binary values, (1,0) and (0,0) respectively. Once the transmission is terminated, the track voltage, 7513, returns to its initial DC value, 7501. In this example, the binary transmission is the following 16-bit word: (1,1,1,0,0,1,1,1,0,1,0,1,0,0,0,1). This method is called Type 9 Signaling.

Type 10 Signaling: If an additional attribute can be added to AC signaling, than a method similar to Type 9 signaling can be employed where the AC signals represent two or more bits. There are a number of possibilities to add attributes to the AC signal. A polarity reversal could be applied but this might be difficult and/or expensive to control or detect. The idea would be to transmit the first AC lobe as either positive or negative to distinguish it further from long and short duration AC applications. The magnitude of the AC signal could also be changed to add further attributes to the AC signal. This could either be a change in the peak value or in the average AC voltage value.

Figure 86:
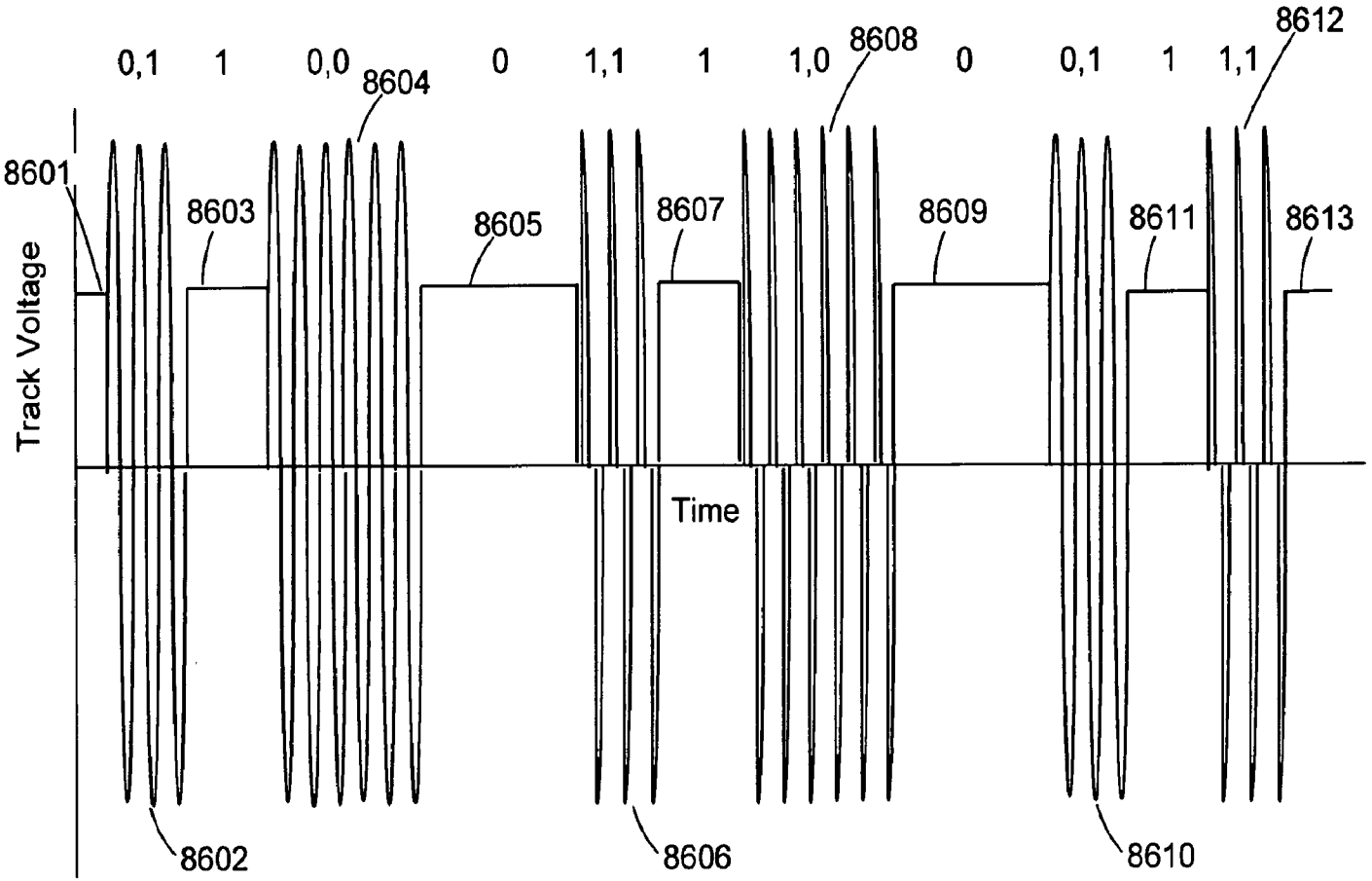
FIG. 86 Waveform combining short and long DC signals interleaved with AC signals of short and long duration and phase shifted and not phase shifted. This allows the AC signals to transmit two bits each. This is called Type 10 signaling.

In FIG. 86, AC voltages can be distinguished by both their duration and their AC voltage value while DC signals remain distinguished only by their duration. For this example, the following digital values were assigned for the AC and DC signal types.

| | Binary Value |
|---|---|
| DC Short Duration Signal | 1 |
| DC Long Duration Signal | 0 |
| AC Long Duration Full-voltage Signal | 00 |
| AC Short Duration Full-voltage Signal | 01 |
| AC Long Duration Reduced-voltage Signal | 10 |
| AC Short Duration Reduced-voltage Signal | 11 |

In this example, AC signals are shown as full voltage sine waves, such as 8602, 8604, and 8610 or by phase modulated sine waves, 8606, 8608 and 8612. DC signals are shown as short duration waveforms, 8603, 8607, and 8611 or long duration waveforms, 8605 and 8609. After transmission is terminated, track voltage 8613 returns to the original track voltage, 8601. For this example, the 17 bit word, (0, 1, 1, 0, 0, 0, 1, 1, 1, 1, 0, 0, 0, 1, 1, 1, 1), is transmitted in the same time interval as the 16 bit word in FIG. 75 under Type 9 Signaling. This new method is called Type 10 signaling.

Note that Reduced voltage AC signals show a reduction to one half by setting phase angle for turn-on half way through each AC lobe. However, any phase angle can be used or any number of phase angles can be used to further increase the number of AC attributes and hence the number of bits, as long as they can be detected.

Figure 83:
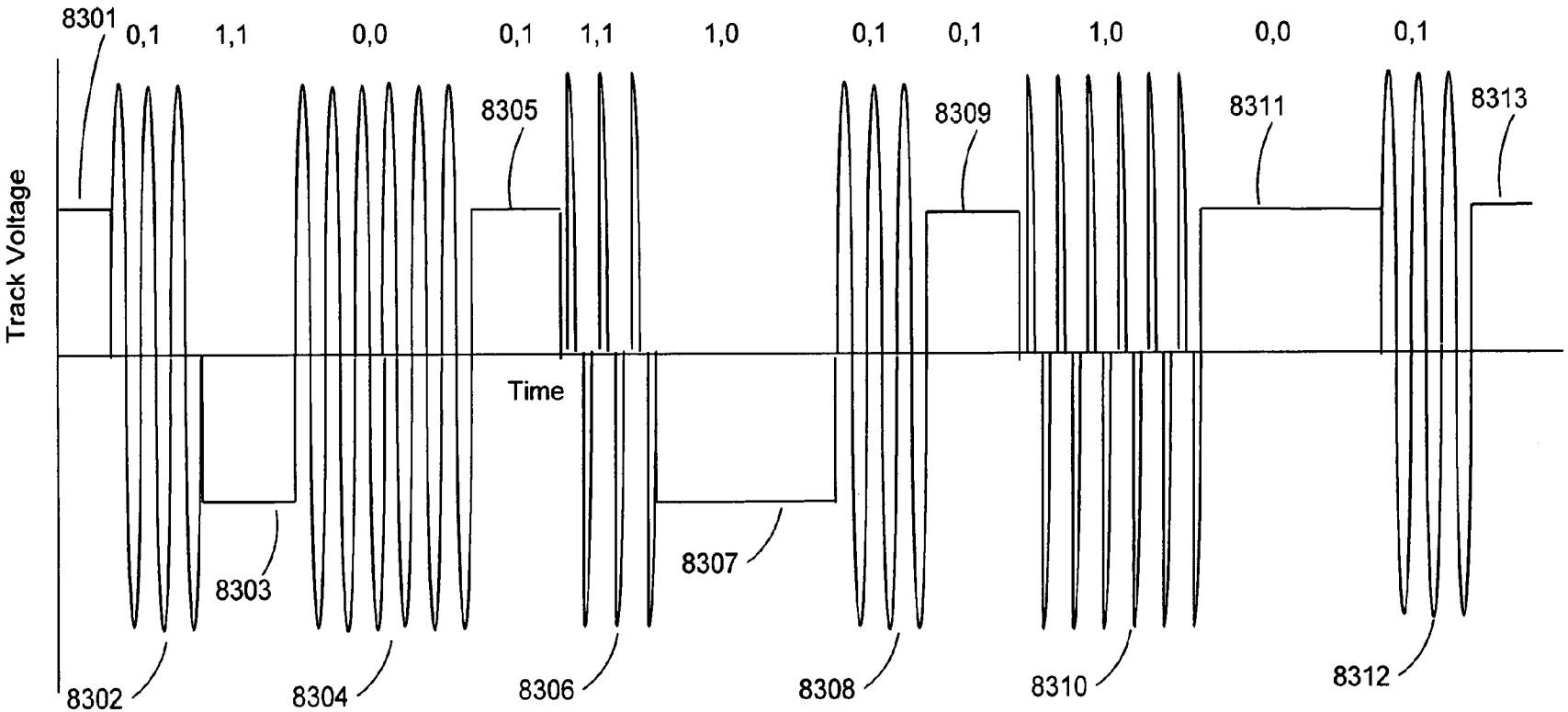
FIG. 83 Waveform showing the combination of Type 9 and Type 10 Signaling to produce a faster method to transmit digital signals called Type 11 Signaling where both the AC the DC signals transmit two bits each.

Type 11 Signaling: Type 9 and Type 10 Signaling can be combined to develop a faster type of signaling. FIG. 83 shows a digital transmission that uses AC and DC signals where both the DC and AC signals can transmit two bits each. The DC transmissions are the same as Type 9 Signaling and the AC signals are the same as Type 10 Signaling.

In FIG. 83, AC signals can be distinguished by both their duration and their AC voltage value and DC signals are distinguished by both their duration and their polarity. For this example, the following digital values were assigned for the AC and DC signal types.

| | Binary Value |
|---|---|
| AC Long Duration Full-voltage Signal | 00 |
| AC Short Duration Full-voltage Signal | 01 |
| AC Long Duration Reduced-voltage Signal | 10 |
| AC Short Duration Reduced-voltage Signal | 11 |
| DC Long Duration Signal | 00 |
| DC Short Duration Signal | 01 |
| DC PR Long Duration Signal | 10 |
| DC PR Short Duration Signal | 11 |

In this example, an AC long-duration full-voltage waveform is shown as 8304, AC short-duration full-voltage waveforms are shown as 8302, 8308 and 8312, an AC long-duration reduced-voltage phase-modulated waveform is shown as 8310, and an AC short-duration reduced voltage phase-modulated waveform is shown as 8306. A DC long-duration waveform is shown as 8311, DC short-duration waveforms are shown as 8305 and 8309, a DC polarity-reversed long-duration waveform is shown as 8307, and a DC polarity-reversed short-duration waveform is shown as 8303. For this example, the 22 bit word, (0, 1, 1, 1, 0, 0, 0, 1, 1, 1, 1, 0, 0, 1, 0, 1, 1, 0, 0, 0, 0, 1), is transmitted in about the same time interval as the 16 bit word in FIG. 75 under Type 9 Signaling for about a 38% data rate improvement. This new method is called Type 11 signaling.

Figure 84:
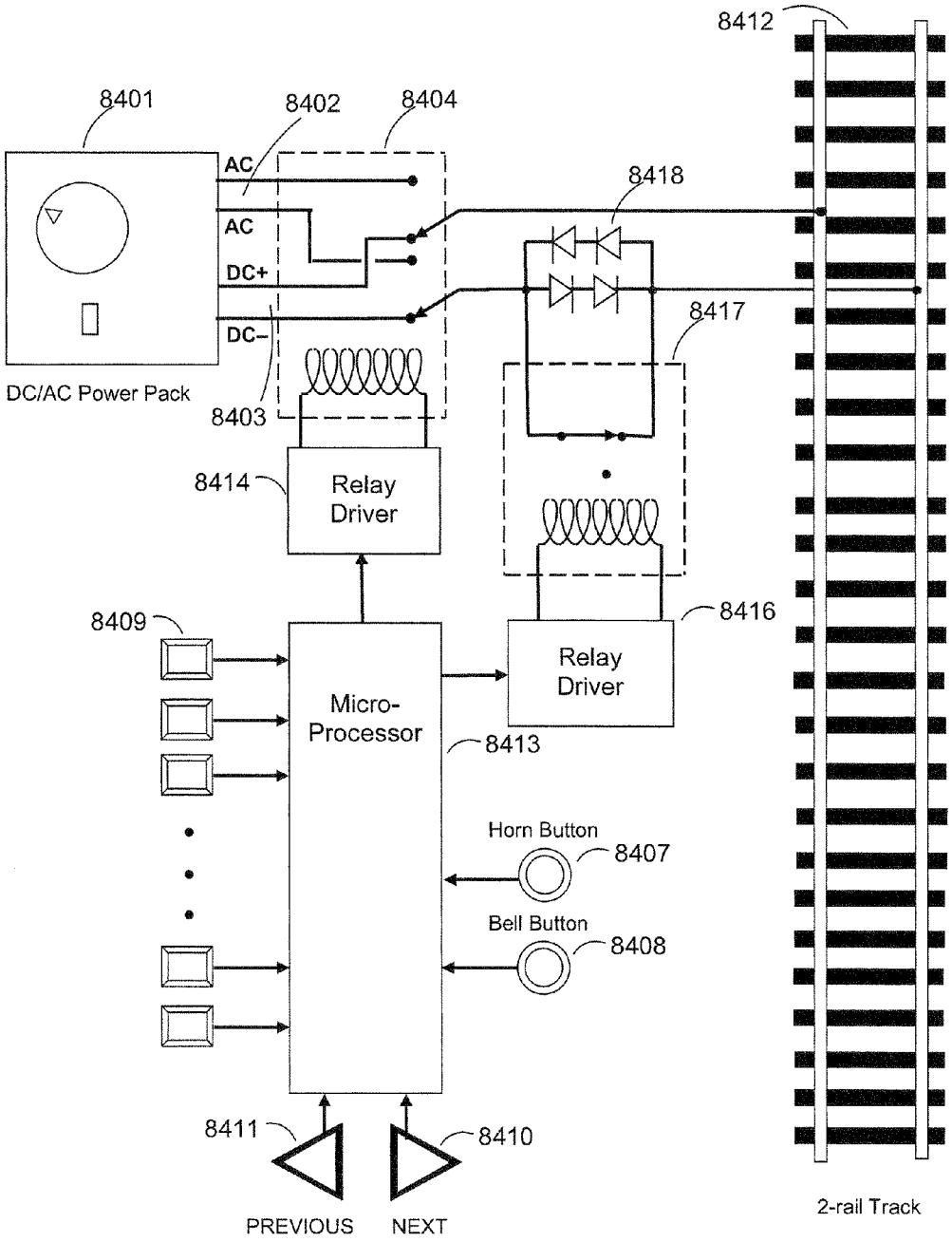
FIG. 84 Block diagram of an MBA that can send DC or AC remote control variable amplitude signals of short and long duration to transmit digital information. Variable amplitude remote control signal transmission is called Type 12 signaling.

Type 12 Signaling: I mentioned changing the peak value of signals as a means to add additional attributes to AC signals in the above discussion of Type 10 signaling. A simple circuit that can be used to affect the peak value of either the applied AC or DC signals is shown in FIG. 84. Relay, 8404, selects either AC or DC signals to be applied to the track. Diode array, 8418, consisting of diodes D1, D2, D3, and D4, can be added in series to either the AC or DC signals, depending on which output is enabled by relay 8404. Single-pole single-throw relay, 8417, is operated through relay driver, 8416, by microprocessor, 8413, to either apply this diode array in series with power pack output or to short this diode array out. If relay, 8417, is closed as shown, the diode array, 8418, is bypassed and has no effect on the track voltage peak value. If relay 8417 is open, the diode array will reduce the applied voltage of either polarity signal by about two diode forward voltage drops (approximately 1.5 volts). Although only four diodes are shown in the array, any number can be added to increase or decrease the voltage insertion lose as long as the remote object on track, 8412, can detect their insertion affect.

Figure 76:
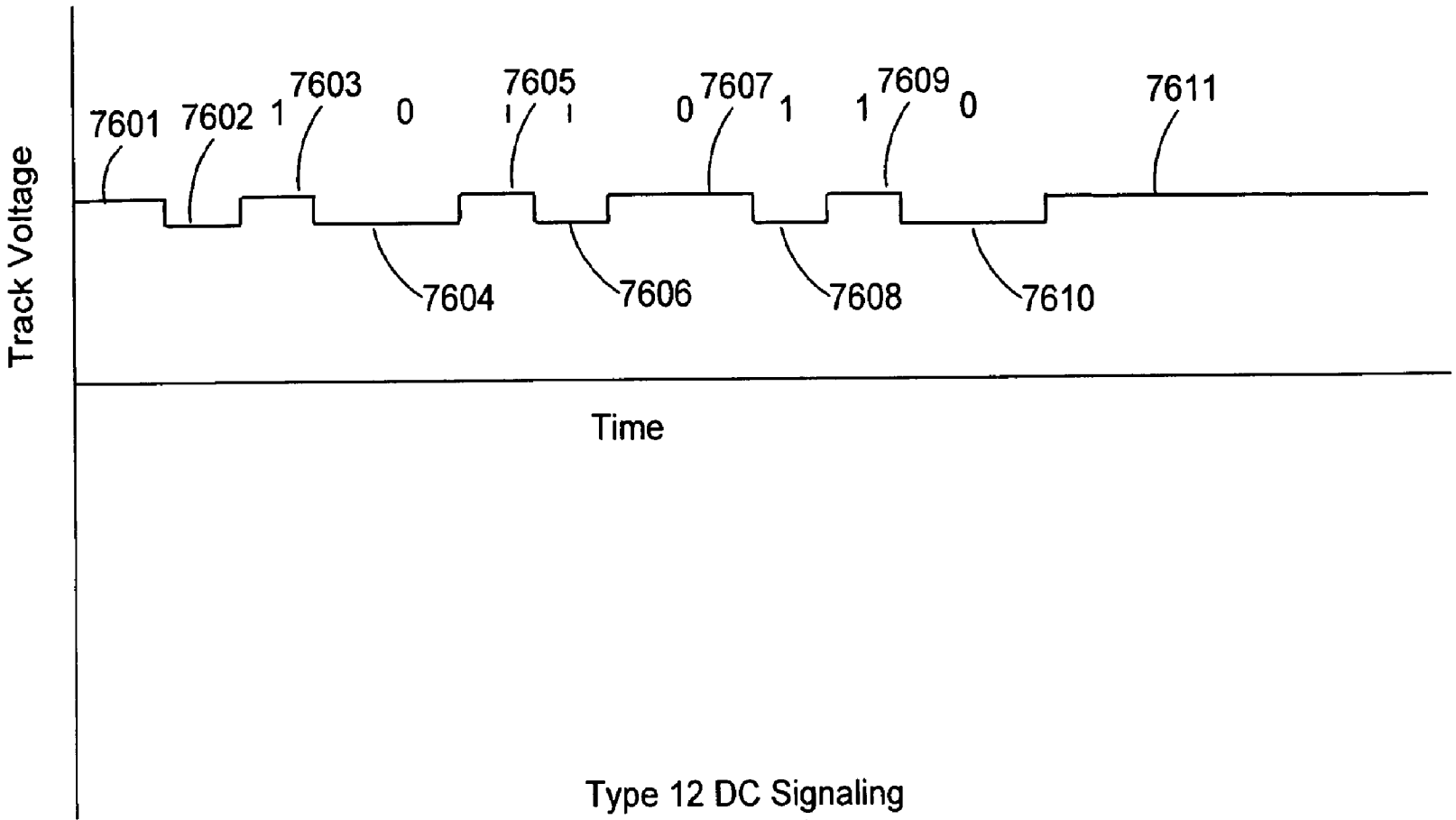
FIG. 76 Waveform showing a method of changing the amplitude of DC track voltage for short and long durations as a means to send digital information down the track.
Figure 77:
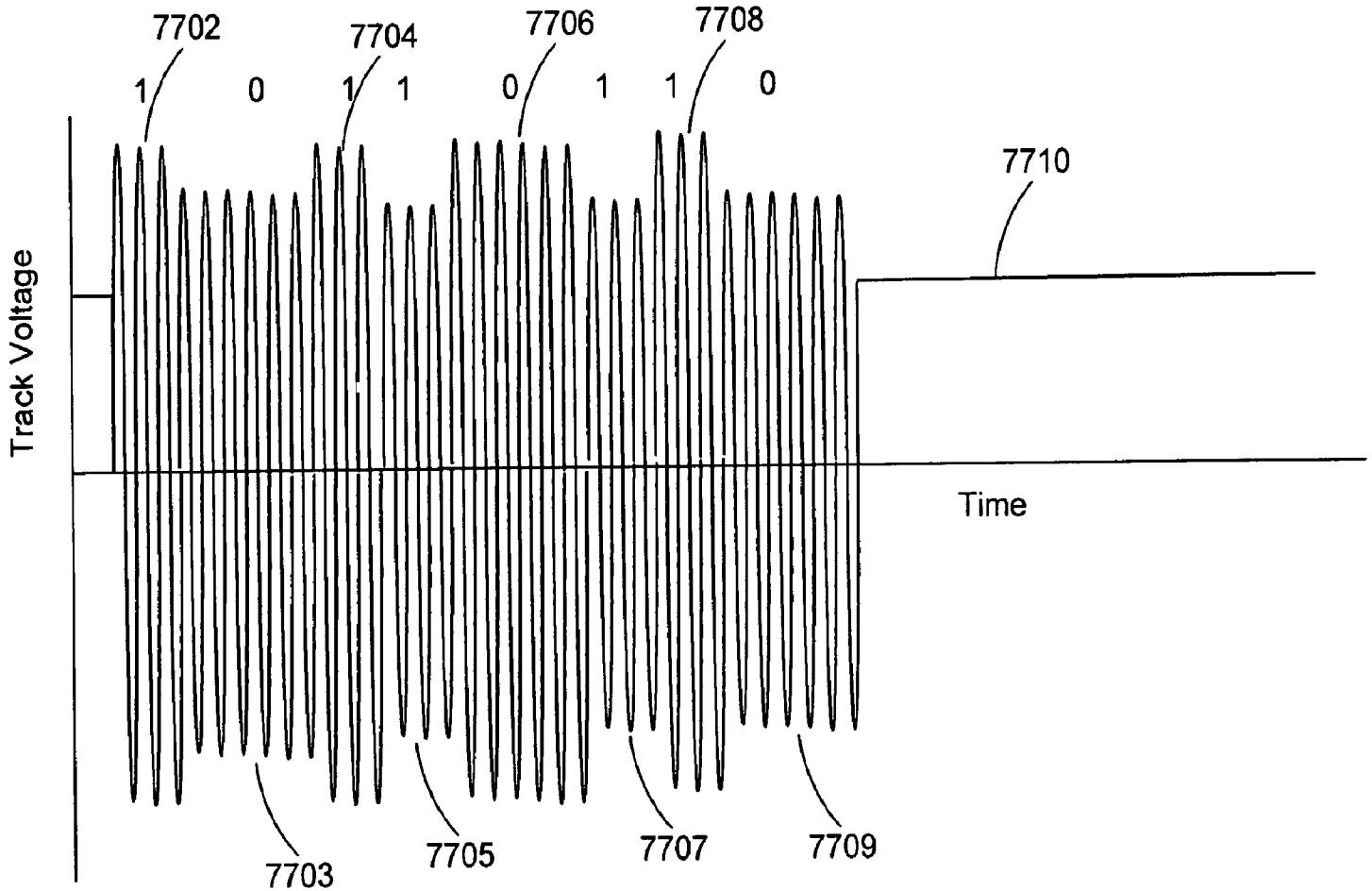
FIG. 77 Waveform showing a method of changing the amplitude of AC remote control signals for short and long durations as a means to send digital information down the track.

The affect on a DC output is shown in FIG. 76. Here the drop in track voltage $V_D$, represents the voltage insertion loss from the diode array, 8418, in FIG. 84 when switch 8404, is selected to apply DC voltage to the track. In this example, long and short applications of full DC voltage and reduced voltage are applied to the track. A long duration of either a full voltage or reduced voltage signal is represent by a logic "0" while a short duration of either a full-voltage or reduced-voltage signal is represent by a logic "1". In this example, we have shown transmission of the digital word, (1, 0, 1, 1, 0, 1, 1, 0) where the long-duration full-voltage signal is shown as 7607, long-duration reduced-voltage signals are shown as 7604 and 7610, short-duration full-voltage signals are shown as 7603, 7605, and 7609 and short-duration reduced-voltage signals are shown as 7602, 7606 and 7608. When transmission of the digital data is finished, normal track voltage, 7710 in FIG. 77, is reapplied to the track. An initial "1" start bit was added to allow a full 8-bit word to be transmitted and have the voltage, 7611, return to its initial value, 7601. The advantage of Type 12 Signaling of DC track power is that standard (not electronically equipped) DC powered locomotives with their motors connected to the track pickups will not change their direction or their speed appreciably by the application of this signal. The problem with this method is that it will more difficult to detect the smaller signals.

Application of Type 12 Signaling to an AC signal is shown in FIG. 77. In this example, we have shown transmission of the same digital word, (1, 0, 1, 1, 0, 1, 1, 0), where a long-duration full-voltage signal is shown as 7706, long-duration reduced-voltage signals are shown as 7703 and 7709, short-duration full-voltage signals are shown as 7702, 7704, and 7708, and short-duration reduced-voltage signals are shown as 7705 and 7707. In this example, we have no need for a start bit since there is no change in the DC voltage, 7710, that had to be returned to normal, when transmission was ended.

Type 13 Signaling: These two types of signaling can be combined as shown in FIG. 88, which shows a digital transmission that uses AC and DC signals where both the DC and AC signals can transmit two bits each.

Figure 88:
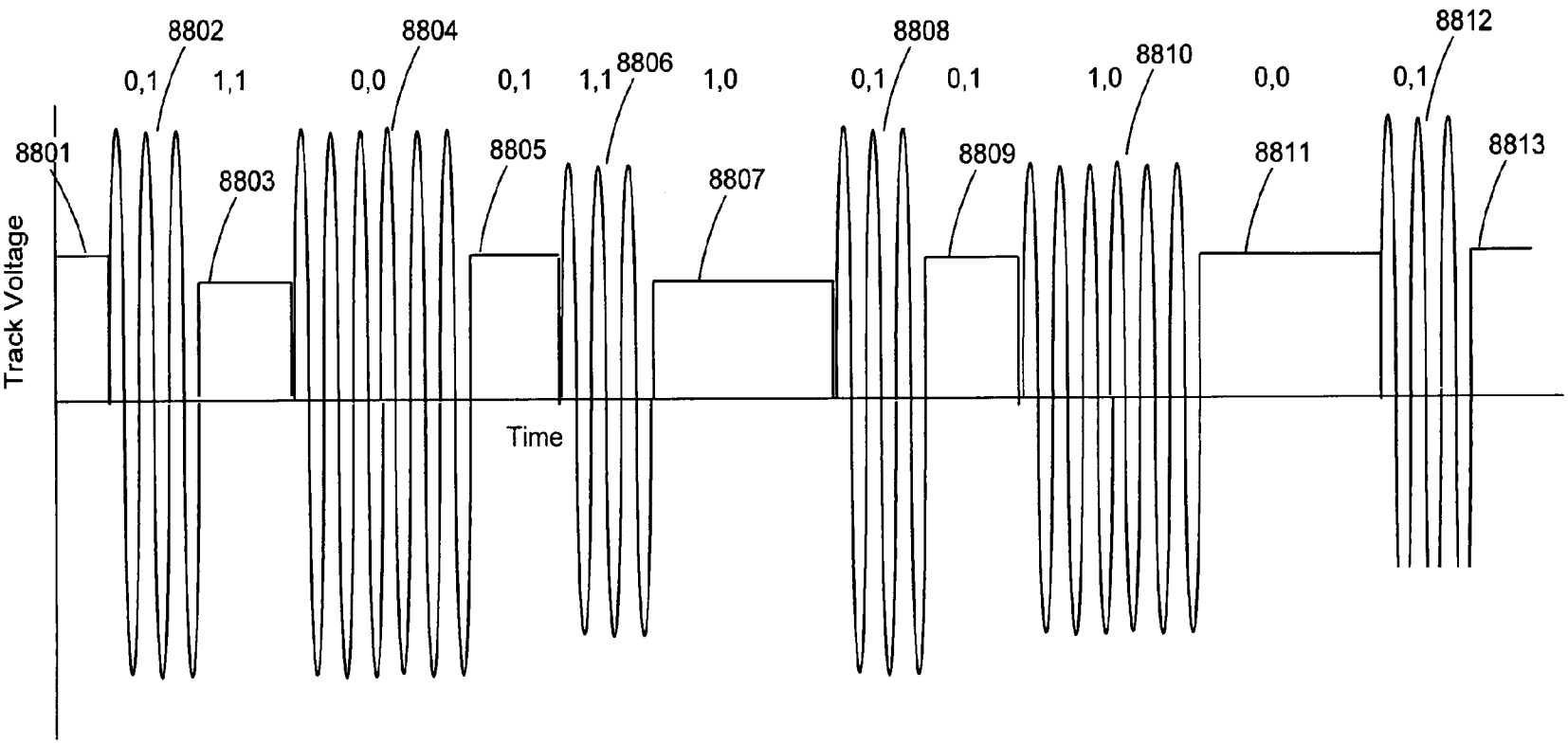
FIG. 88 Waveform of AC remote control signals interleaved with DC remote control signals where the duration and amplitude of each signal can be controlled to provide two bits of transmission for both the AC and DC signals segments. This is called Type 13 Signaling.

In FIG. 88, AC signals can be distinguished by both their duration and their AC voltage peak value and DC signals are distinguished by both their duration and their relative voltage level to the beginning track voltage, 8801. For this example, the following digital values were assigned for the AC and DC signal types.

| | Binary Value |
|---|---|
| AC Long Duration Full-voltage Signal | 00 |
| AC Short Duration Full-voltage Signal | 01 |
| AC Long Duration Reduced Peak-voltage Signal | 10 |
| AC Short Duration Reduced Peak-voltage Signal | 11 |
| DC Long Duration Full-voltage Signal | 00 |
| DC Short Duration Full-voltage Signal | 01 |
| DC Long Duration Reduced Peak-voltage Signal | 10 |
| DC Short Duration Reduced Peak-voltage Signal | 11 |

In this example, an AC voltage long-duration full-voltage waveform is shown as 8804, AC short-duration full-voltage waveforms are shown as 8802, 8808 and 8812, an AC long-duration reduced peak-voltage phase-modulated waveform is shown as 8810, and an AC short-duration reduced peak-voltage waveform is shown as 8806. A DC long-duration full-voltage waveform is shown as 8811, DC short-duration full-voltage waveforms are shown as 8805 and 8809, a DC long-duration reduced peak-voltage waveform is shown as 8807, and a DC short-duration reduced peak-voltage waveform is shown as 8803. For this example, the 22 bit word, (0, 1, 1, 1, 0, 0, 0, 1, 1, 1, 1, 0, 0, 1, 0, 1, 1, 0, 0, 0, 0, 1), is transmitted in about the same time interval as the 16 bit word in FIG. 75 under Type 9 Signaling for about a 38% data rate improvement. This new method is called Type 13 signaling.

Type 14 Signaling: U.S. Pat. No. 5,773,939 describes a method to transmit digital signals at a rate of 100 or 120 bits per second by controlling the polarity of individual AC 50/60 hertz lobes. When using this technique on an AC source, it would be necessary to change the polarity of any lobe on demand, which requires an active bridge circuit of four pass-devices and associated driver circuits. A method of modulating each AC lobe to transmit at 50 or 60 bits per second with only one pass device is shown in FIG. 82. When relay 8204 is switched to the AC position, and the pass device, 8215 is on, the output changes from the DC output, 8203, to the AC output, 8202. The resultant track voltage is shown in FIG. 78 where DC voltage, 7801, is replaced by a series of full-wave sine waves, 7802, before being returned to DC track voltage, 7803, when relay 8204 in FIG. 82 switches back to the DC power pack output. In order to transmit digital information, we phase modulate one full cycle of individual sine-wave periods at various times during the AC transmission as shown in FIG. 79. In this example, a digital "1" is assigned to a phase modulated sine wave period such as 7902, 7904, 7905, 7907 and 7908. A digital zero is assigned to full cycles of non-phase modulated sine waves such as 7903, 7906, and 7909. This will result in the digital word, (1, 0, 1, 1, 0, 1, 1, 0) being transmitted at a data bit rate equal to the AC frequency. For 50/60 hertz AC source, the baud rate would be 50 or 60 bits per second. This is considerably faster than previous transmission techniques described in this patent. This faster rate may require more careful control of the AC source to start at a zero crossing or other methods to ensure proper transmission and detection. The time for an 8-bit word is only 160 ms for 50 hertz AC source and 133 ms for a 60 hertz AC source. This method is called Type 14 Signaling.

One of the disadvantages of the method described in U.S. Pat. No. 5,773,939 was a possible DC offset from digital transmission, which could cause older Lionel three-rail horn detectors to blow the on-board horn or toggle the bell. The above Type 14 Signaling prevents any DC offset from occurring since the both positive and negative AC lobes for each AC cycle are modulated equally and would be a good choice for signaling AC trains. Another concern with two-rail trains is that the polarity can change if a train passes through a reversing loop, which would invert all AC lobes. Type 14 Signaling would not change the waveform for non-phase modulated sine waves but would change the waveform for a phase modulate waveform. However, this may not be problem since each modulated lobe comes in pairs, which could be parsed by looking for successive lobe pairs. One of the advantages of the lobing method described in U.S. Pat. No. 5,773,939, was its faster baud rate.

Figure 85:
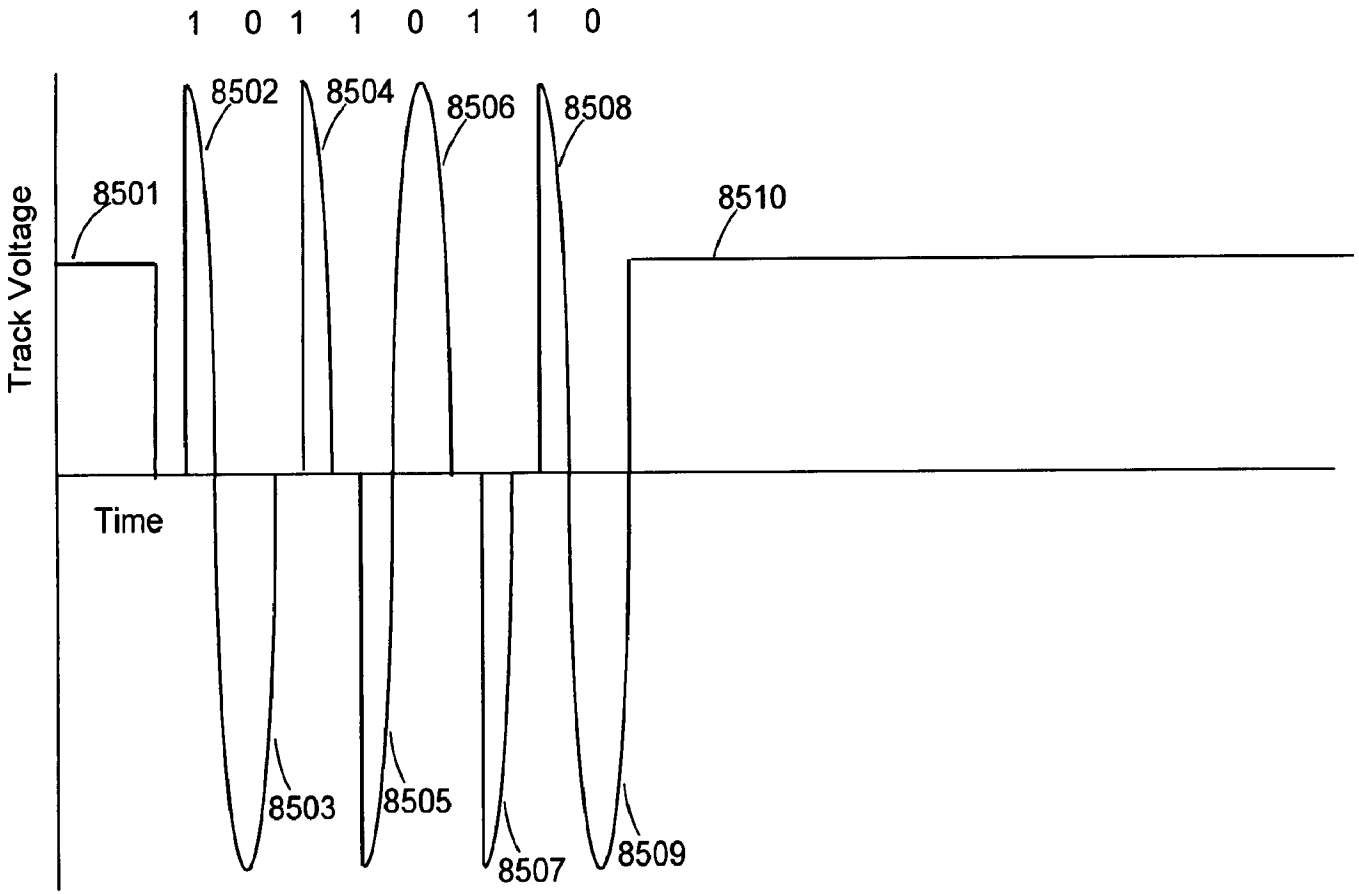
FIG. 85 Waveform of AC remote control signals where the data rate is increased by phase shifting top and bottom AC lobes independently. This speeds up the data rate by two times over Type 14 Signaling. This is called Type 15 Signaling.

Type 15 Signaling: The same circuit shown in FIG. 82, could transmit digital information at a 100 or 120 data rate by only phase modulating each lobe. This is shown in FIG. 85 where a phase modulated lobe is designated as a digital "1" while a full non-phase modulated lobe is designated as a digital "0". In this example, lobes 8502, 8504, 8505, 8507 and 8508 are representative of 1's while lobes 8503, 8506 and 8509 represent digital 0's. This series of lobes shows the transmission of the 8-bit digital word, (1, 0, 1, 1, 0, 1, 1, 0) in only 80 ms for 50 hertz and 66.7 ms for 60 hertz. This method of digital transmission is called Type 15 signaling. Type 15 signaling works well for both DC and AC powered trains but since it is AC signaling, it would be ideal for AC powered two-rail or three-rail model trains. In the latter case, a relay is not required to switch from DC or AC, such as relay, 8204, in FIG. 82; only the pass device, 8215, is necessary to create Type 15 signaling for AC power trains. It is fast enough that Type 15 could be used for command control, particularly for home layouts where there are not many simultaneous operators all trying to operate their trains on the same powered track sections. In addition, there is no limitation in Type 14 and Type 15 signaling to 50/60 hertz nor to any particular type of waveform. Higher frequency AC signals could be used and square waves could be used instead of sine waves, etc.

There is, however, an advantage in Type 14 Signaling over Type 15; it will likely be more reliable. Since model locomotives and other remote objects can loose electrical contract now and then, it can affect the AC lobes. We have concluded on experiments that we have done with AC powered trains on three rail track, the power interruptions of 1 msecond are common; this could affect whether a lobe is detected as a one or a zero. The fact that Type 14 signaling is symetric, allows the microprocessor or other intelligent track voltage detector to determine if one of the two lobes for a full AC cycle has been compromised by intermittent electrical contact. Since both lobes in an AC cycle are not likely to be affected at the same time, the data bit value can be reconstructed in the microprocessor.

Best Choice for Analog Digital Command Signaling Methods

Each of the above signaling methods has advantages and disadvantages. In a competitive market, the best choice is often dictated by which method is the least expensive. The main difficulty with either Type 10 or Type 11 signaling is that they require a means to invert the DC signal as well as supply AC with two different voltage values. This usually requires two double-pole double-throw relays and a pass device or one double-throw double-pole relay and one full-wave active bridge; this results in a more expensive design for the transmitter. As discussed earlier in this patent, relays have a number of advantages over active devices and except for the need of a single pass device needed for phase shifting AC lobes, relays would still be the least expensive choice for a basic MBA such as the Quantum Engineer.

Figure 87:
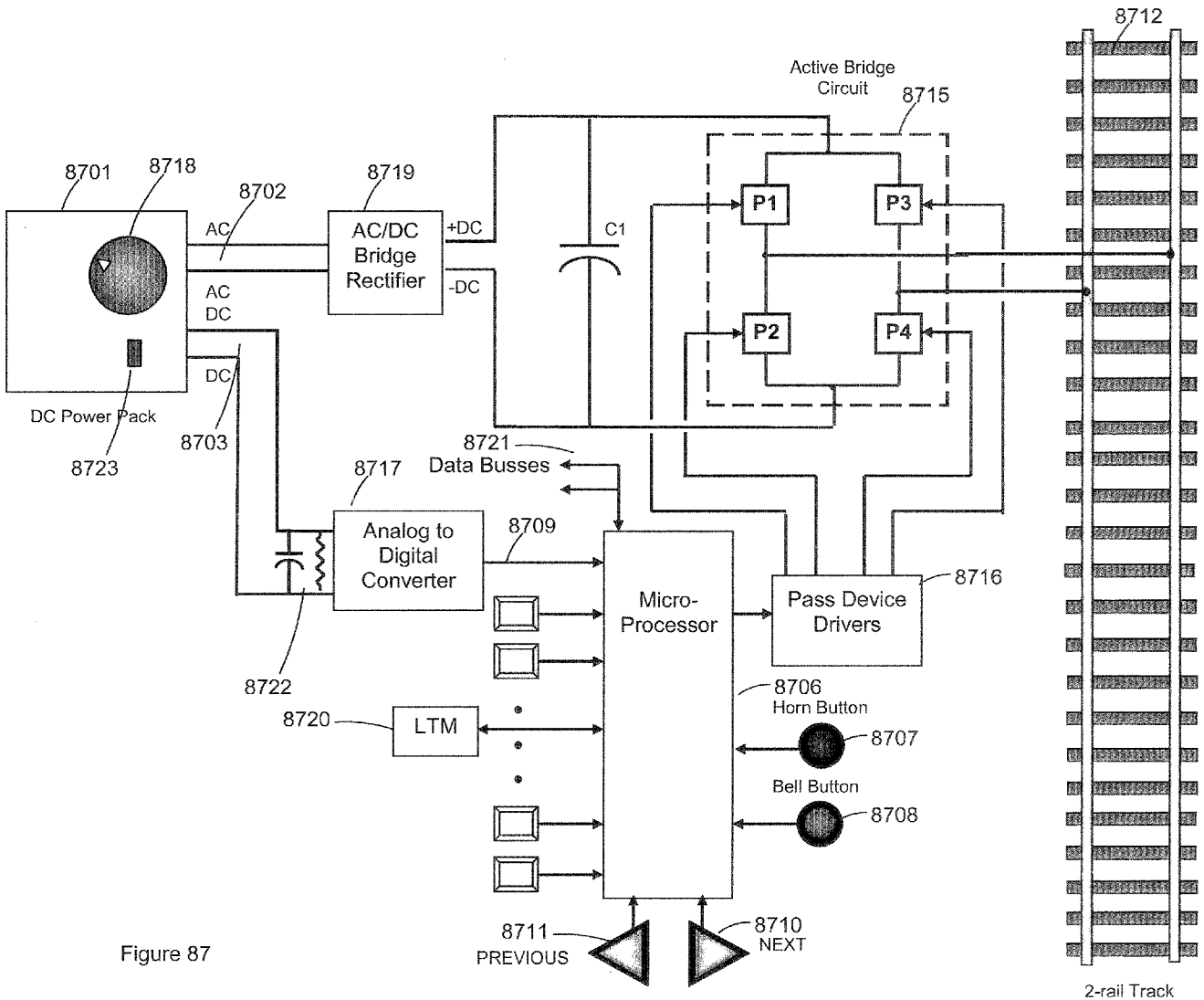
FIG. 87 Block diagram of MBA controller where DC power pack throttle output monitored and functionally remapped to a DC track voltage that is more suitable for operation of electronically equipped locomotives and other remote objects.

However, if there is a need for greater transmission capability, adding a bridge rectifier and a single active bridge circuit like the circuits shown in FIG. 87, provides many advantages. For instance, this circuit allows for DC signaling, AC signaling, and DCC signaling. It can provide both all of the above-described analog transmission techniques as well as high-speed digital command control. It can also provide a minimum track voltage at the lowest throttle setting to maintain power to the remote object in our Neutral state and can operate standard locomotives along with advanced Quantum equipped locomotives.

One problem with our MBA designs shown in FIG. 14 is that when the throttle, 1413, on power pack, 1412, is turned all the way down, the voltage to the track is off and all electronics and sounds in the remote object terminate. We do provide a way for the operator to maintain sound in Quantum equipped locomotives by entering a non-moving Neutral state at two or three volts above the minimum necessary voltage to maintain electronic power. In this special Neutral state, there is opportunity for the operator to change polarity for direction changes or to operate features using Type 1, 2 or 3 Signaling without losing his locomotives electronic power and the sound. However, entering Neutral can sometimes be difficult, especially if a voltmeter is not included on the operator's power pack. Also, with Neutral entered at 8 volts or so, there is much less throttle range for normal locomotive operation. For example, many power packs will produce about 8 volts at mid range, leaving the remaining 50% of the throttle range to operate the locomotive. We have designed the loco's Quantum system to provide full power to the motor at 12 volts and above so there is no loss of locomotive top speed but the physical range of the throttle is nevertheless reduced to about one half.

The circuit in FIG. 87 provides a solution. In this circuit we produce an independent DC source from the AC accessory output on most power packs and use this for track power. We then monitor the voltage from the DC throttle output, 8703, to determine the desired throttle setting and remap these values to our new track power source to allow full range on the throttle with limited output range to the track. When the throttle is turned all the way down, a minimum sustaining voltage is applied to the track to keep the electronics functioning and when the throttle is turned up, more and more voltage is applied to the track until at full throttle, all the available track voltage is applied. The circuit, FIG. 87, is described in detail as follows;

AC to DC rectifier, 8719, produces a raw full wave DC voltage from the power pack's accessory AC output, 8702. This raw DC voltage is filtered by capacitor, C1, to provide low ripple DC power to the active bridge circuit 8715. All of the pass devices, P1, P2, P3 and P4 are under control of the microprocessor, 8706, through pass device drivers, 8716. The output of the active bridge is connected to track, 8712. By selecting and pulse driving the proper pass devices, this circuit can provide DC of either polarity at specified durations for any of the above DC signaling techniques and for controlling the amount of voltage applied to the track through duty cycle regulation to provide variable DC analog voltage to the locomotive. In addition, AC can be created as a continuous series of polarity reversals. If the circuit is designed to switch at NMRA DCC speeds, this circuit can provide NMRA DCC or other fast signaling as well. The power pack DC throttle output, 8703, is digitized by Analog to Digital Converter (ADC), 8717, and supplied to microprocessor, 8706, to monitor the desired throttle setting and polarity. Most throttle settings on HO power packs range in magnitude from a minimum of 0 to 2.5 volts and a maximum of 12 to 21 volts and most AC accessory outputs are at a slightly higher value (about 1.5 volts) than the highest DC throttle output. Once throttle remapped values are programmed into the MBA and stored in Long Term Memory (LTM), 8720, the throttle on the power pack can move from its lowest value to its highest value but the output track voltage from 8715, will range from the minimum sustaining voltage necessary to operate the on-board electronics to the maximum track voltage. This design would also allow users to program the mapping function between the DC throttle and the track voltage. He may prefer a linear mapping or he may want more range at lower voltages or he may want the output to increase rapidly from the sustaining voltage to V-Start (the voltage where the locomotive leaves Neutral), or he may want to correct for an unusual and undesirable output throttle function from his power pack and/or he may want to limit the maximum voltage that area applied to the track. An optional electrical load, 8722, is connected to the output of 8703, to ensure smooth noise reduced voltage suitable for the digitizer, 8717. Open circuit outputs from some power packs are unpredictable and may require a resistive load to ensure correct behavior and may require filter capacitance to reduce electrical noise. An optional ADC can also be connected to the AC accessory output to monitor the zero crossing of the AC signal, AC voltage level and AC peak value. Many of the less expensive power packs will load down under current draw and this will affect the throttle voltage. This loading can be monitored through drops in the AC accessory output and corrections can be applied within the microprocessor to maintain the desired track voltage. When operating under DCC, the throttle settings from the analog DC output, 8703, and digitized by 8717, will be converted by the microprocessor to command control speed step commands that are sent down the track via active bridge, 8715, to remote objects with command control decoders. It will be possible for the operator to program the mapping between the analog output and the DCC speed steps to suit his needs. This information can also be stored in LTM, 8720. In either analog or command control, the desired locomotive direction can still be set by the power pack's reversing switching, 8723. Under analog, this will determine the output polarity from the active bridge, 8715, that is applied to the track, 8712. For command control, the power pack output polarity can determine whether a forward or reverse digital command is sent to a selected locomotive.

The design in FIG. 87 is no longer a Multi-Button Analog (MBA) controller but rather a controller capable of sending NMRA DCC or other command control signals. It is also capable of sending high-speed digital data directly down the track to download new sounds or software into the Quantum System or one of the bi-directional data buses, 8721, can be connected to the Quantum System or other remote objects to directly receive software and sounds downloads. This multi-button universal controller will be called MBU Controller or MBUC.

The communications port data buses, 8721, may be used to link the MBUC to other devices, such as a Personal Computer. Communications protocols may include RS-232, USB, or an Ethernet device to allow the MBUC to connect to other devices through the Internet or other devices using Network Protocols.

One of the data buses, 8721, can be used to link different DCC controllers, DCC boosters, analog block controllers, or other devices, together to allow common DCC or analog DC track signals from all MBU controllers and to prevent data collision from different cabs sending commands at the same time.

Figure 89:
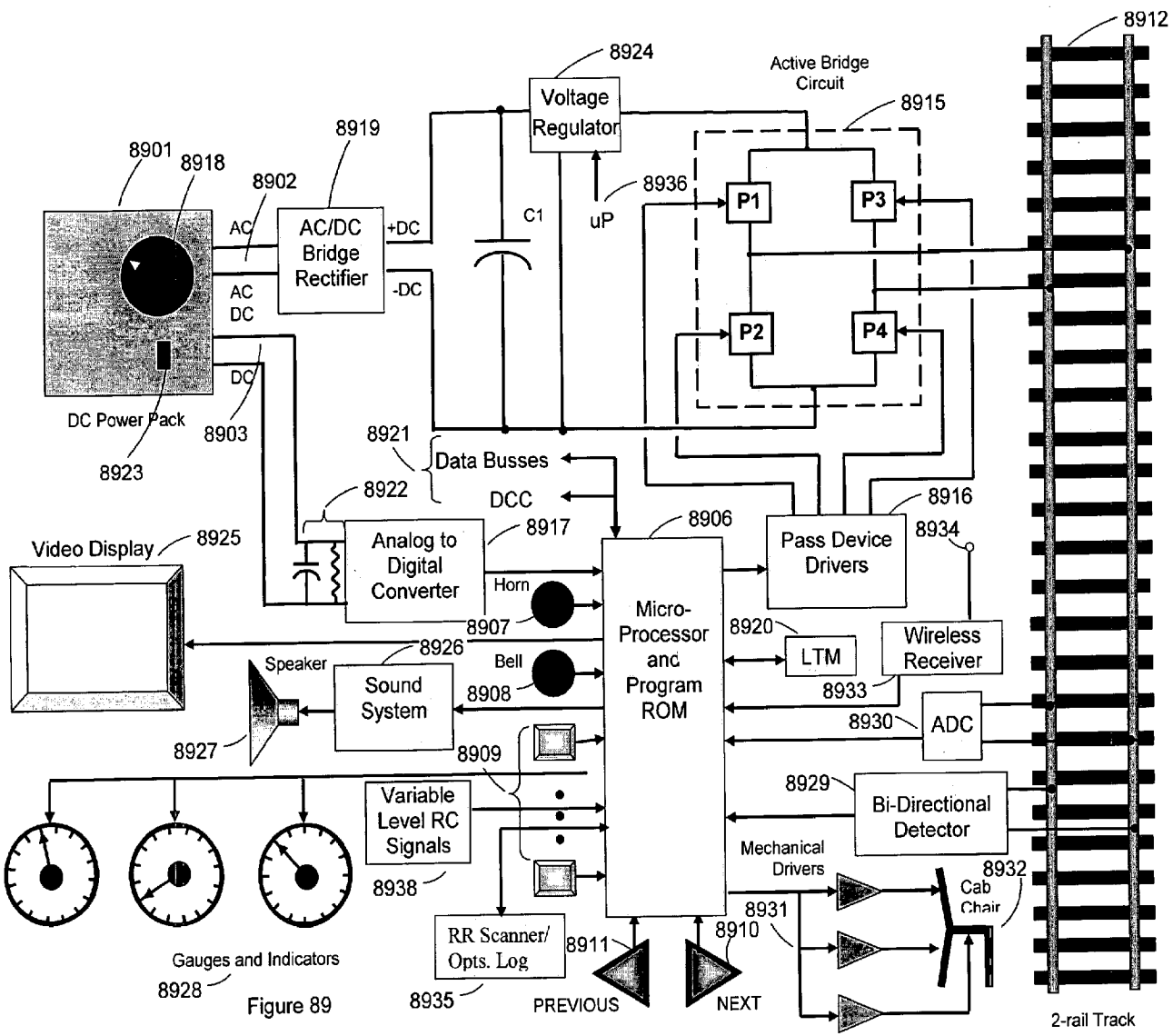
FIG. 89 Block diagram showing extending the MBA controller in FIG. 87 to include many new features. This new controller can produce AC as well as DC power and remote control signals and DCC command control; it is called a Multi-Button Universal Controller or MBAC.

The basic MBU Controller in FIG. 87 can be extended to include many new features, such as those shown in FIG. 89. In FIG. 89, a voltage regulator, 8924 has been included to provide a more stable and controllable DC voltage source from the active bridge circuit, 8915, to the track. Regulator 8924 may be a linear or switching type and is shown under microprocessor control, 8936, to allow programming the output voltage for the different gauge voltage requirements. Regulator 8924 can be used to control the analog output voltage along with or instead of duty cycle modulating the voltage through the active bridge circuit, 8915, and can be used to compensate for DC power pack throttle voltage drops from loading on the power pack transformer. In addition, if the track voltage is monitored by the microprocessor, 8906, through an ADC, 8930, connected to the track or other method, constant track voltage can be maintained over different track electrical loading conditions. This, of course, can also be accomplished by changing the PWM on the active bridge drive, 8915, but there may be good reason to maintain a constant peak voltage value on the track to ensure that all remote object on-board electronic power supplies have reliable and predicable supply voltage.

FIG. 89 shows a bi-directional receiver, 8929, that can be used to receive either the NMRA bi-directional DCC signals, or analog bi-directional signals described in this patent. Bi-directional communication also allows for an innovative concept of pneumatic or mechanical interaction with the operator illustrated by pneumatic drivers, 8931. Here interactions of the locomotive as detected on-board the remote object and sent via the bi-directional system to the microprocessor, 8906, will produce appropriate mechanical movement of the operators chair or cab, 8932, to simulate the movement of the train. This movement can be related to the real motion of the model train through accelerators, inclinometers, or other motion detectors, or the movement of the operator's environment can be simulated to be appropriate to the conditions. For instance, if the locomotive was moving over a model turnout, the actual physical motion may not be significant but knowing that the train is moving at a certain speed over a particular kind of turnout can produce physical motion that would be what is expected from a prototype locomotive moving over a real turnout. Another example would be the jerk or whip that occurs when coupling up to a string of cars or moving out with cars coupled to the locomotive. Model train cars might not be capable of providing the forces necessary for a realistic pull, jerk or whip, but the records could be stored of the type of motion that is appropriate and played through drivers, 8931, when the model train couples up to or starts out with a load of cars. Information about what the model locomotive or train is doing can also be conveyed to the MBU controller through stationary trackside location, proximity and/or motion detectors, that is conveyed through data busses, 8921, that in turn becomes motion played through mechanical drivers, 8931 to the operators cab, 8932.

Similar to the controller shown in FIG. 87, FIG. 89 shows that the power pack DC throttle output, 8903, is digitized by Analog to Digital Converter (ADC), 8917, and supplied to microprocessor, 8906, to monitor the desired throttle setting and polarity. An optional electrical load, 8922, is connected to the output of 8903, to ensure smooth noise reduced voltage suitable for the digitizer, 8917.

If a separate reversing switch is added to our MBA and MBU controllers to do the reversing operation, there is another valuable feature that can be added to our Quantum equipped locomotives under DC Analog control. This reverse switch can be any of the available inputs such as one of inputs, 8909, or could be a slide or toggle switch that provides the two choices, reverse and forward, or the three choices of forward, neutral and reverse. The same switch could be added to any MBA design that is capable of changing track polarity. Whenever this reverse switch is changed, a command code is sent out to change the locomotive's direction state. If the command is to change the locomotives direction, a polarity reversal is established right after the code is sent. The horn is not activated since the locomotive's directional state change had already been made with the direction command. If the locomotive is moving when the direction change command is sent, the locomotive slows down to a stop (based on its Load setting), rests for a moment and then starts up in the opposite direction. If the locomotive is in Neutral, the locomotives directional sense is changed immediately; this is an improvement over making directional changes in the transition state. We call this feature "Analog-Command-Direction-Control" or "ACDC". One of the big advantages of this method is even though the polarity is reversed, PRP commands can be sent during the slow down period. This includes effects such as braking, horn, bell, etc. If the brake commands are sent during the slow down process, the locomotive will come to a complete stop and not move in the opposite direction unless the brakes are released. If the direction switch is set to Neutral, a moving locomotive will come to a gradual stop and enter Neutral even though the track voltage remains above V-Start. If the reverse switch is moved to either forward or reverse and the throttle is not changed, the locomotive will accelerate back to its original speed. Adding a reversing switch to our MBA or MBU units and the ACDC feature to the locomotive to do this special reversing operation is an advantage when using these controllers with power packs that do not have reversing switches.

FIG. 89 shows a sound system, 8926, connected to microprocessor, 8906, and outputting sound through speaker or speakers, 8927. This can be a monophonic or polyphonic speaker system to generate sounds appropriate for the inside of the cab or for information. For instance, if air brakes are applied, the sound of air release could be heard, along with mechanical motion from drivers, 8931, to simulate the drag from applying a certain degree of braking. Also, if scale speed is available from the remote object, an "over speed" cab whistle warning sound could be generated to alert the operator. If the bi-directional system was capable of receiving sounds from the remote object or objects, these sounds could be played in the operators cab. These sounds could be directly from the on-board sound system or may be from on-board microphones. The sounds could also be modified to simulate what an operator would be expected to hear from the inside of the engineers cab as opposed to the sounds he might hear from outside the cab. Another addition to bring realism to the model cab environment is to allow input to the MBU controller microprocessor and sound system from a real railroad scanner, 8935, that is picking up radio chatter between engineers, hostlers, dispatchers and other railroad workers. Other inputs could include pre-canned communication and dispatch messages, shown here as Opts. Log, 8935 that would be played back when appropriate through the MBU sound system. Opts log could trigger dispatch messages from stationary location detectors on the layout, giving orders or asking for information appropriate for the model train operation or schedule or generate fault detector messages. In fact, the Opts. Log, 8935, could be created by the operator or club members to schedule operation on the model train layout before an operating session begins. These would be orders that get played at the appropriate time based on time, scheduled stops and pickups, track conditions, request for information, etc. to simulate prototype railroad operation. This would be a particularly welcome addition to model railroading home layout to provide more interaction and interest when there is only one operator. This could also be part of a computer interactive train control and operations environment with external PC's though communications via data busses, 8921.

Another use of sound in the MBU is to provide verbal messages and confirmations during programming. Our Quantum system responds with verbal sounds during analog and DCC programming which tells the operator which Analog Options or DCC CV's (Configuration Variables) are being programmed and what their values are. If we produce non-sound Quantum DCC and analog DC decoders, we can still provide verbal responses to what is being programmed and with what values directly from the MBU sound system. If the locomotive could provide data feedback, we could use this information to provide verbal responses in a similar manner to what the Quantum locomotive does with its on-board sound system. In the case of non-sound DC and DCC Quantum Decoders, the verbal responses would come from the controller (like an MBU) rather than the locomotive but the responses could be the same type providing continuity with Quantum Sound equipped Locomotives. This communication could come from the DCC program track directly for DCC operation or it could come from the main using the same type of current pulse acknowledgements. Current pulse acknowledgements could also be used for DC programming feedback information. If other feedback or bi-directional methods were available, they could be used as well for this programming operation. Two advantages of verbal responses for programming are that they eliminate the need for an LCD or other display screen for this kind of information, and operations seem to respond well to programming information delivered verbally rather than visually on a small screen. Even if a handheld throttle is used, and there is bi-directional communication with the central controller, verbal responses and other sounds such as cab sounds could be spoken directly through a speaker in the handheld controller.

FIG. 89 shows a general bi-directional wireless receiver, 8933 that can be used for a variety of applications. The radio link can be with a hand held throttle that the operator can carry with him to operate his model trains at a remote location. The desired commands are sent via radio, RF or other transmission to detector or antenna, 8934, which is conveyed to microprocessor, 8906, through receiver, 8933, to generate commands via the active bridge circuit, 8915. The other advantage of a radio or wireless link is communication with other operators or a central dispatch for train orders, track conditions, or other operational information. A radio link can also be used to communicate commands to remote objects that receive control information from wireless receivers. This is particularly relevant for outdoor G'Gauge type layouts where on-board battery power and radio links are often the preferred method of train control.

FIG. 89 shows a series of gauges and indicators, 8928, which monitor conditions of the remote object, the track and the MBU Controller (MBUC). Two of the most obvious uses are locomotive speed and air line pressure. Unless the locomotive is under speed control that is specified via a command from the MBUC, speed information must be supplied directly by the remote object though bi-directional communication down the track or via stationary detectors and local networks in the layout to the MBU via data busses, 8921. Other useful information would be track voltage and current, remote object voltage and current, simulated fuel and water remaining, simulated traction motor current, etc. Each gauge or indicator could perform multiple functions such as measuring voltage and current unless brakes are applied whereupon it registers simulated air-line pressure or locomotive speed.

A video display is shown in FIG. 89 as 8925, which actually may include more than one. Video displays allow information to be displayed such as locomotive ID, consist ID, etc. and could also show a schematic of the layout and the operators train location from information generated via the bi-directional system or via data busses, 8921, from layout detectors. The video screens could also simulate gauges and indicators or write out this information as text. In addition, video information from on-board cameras could be displayed as long as the bi-directional system or wireless system has sufficient bandwidth. Images could be displayed out the front windshield and/or side windows or a view back down the train from the locomotive or videos could be displayed from cameras in the caboose or from trackside locations.

Horn, 8907, bell, 8908, and other control buttons, 8909, are still included on this advanced MBUC, as well as any programming buttons like 8910 and 8911. The major advantage of an MBUC is that all of these advanced features are integrated together to simulate the experience of being in the cab of a real locomotive. The sights, sounds, motion, gauges, communication, interaction and feel of the controls all work together to create an illusion of actually sitting in the model train cab as though it were the real thing.

The circuits in FIG. 87 and FIG. 89 make possible other remote control signals. It would be useful to use the throttle setting to adjust or program some analog or continuous operations such as volume settings. Since it is a variable output controlled from turning a knob, it is a natural means to send down continuous commands or settings under either analog or digital command control. In particular, under programming, where the throttle is not used to control the speed of a train, the throttle output makes an excellent continuous remote control signal. In analog, the throttle output voltage could be used directly as a continuously variable voltage or variable pulse width remote control signal; which would not require any additional control circuitry. Electronics in the remote object could be commanded via Type 1 or Type 2 signaling to accept the throttle input as a remote control signal variable to continually change some feature value or program setting. For instance, a Quantum Loco equipped remote object digitizer could convert this variable track voltage signal to digital signals to change internal settings or control digital features such as sound. One problem with using the analog throttle voltage for remote control operation is that the throttle can be reduced to zero, which can remove power to the remote object. FIG. 87 and FIG. 89 allow re-mapping the throttle setting, 8703 and 8903, to the track voltage which can prevent the track voltage from going below the sustaining voltage for the electronics. This allows the operator to use the throttle over the entire range to make continuous adjustments of variables in the remote object. For instance, if this method were used to adjust the individual volumes in a Quantum Loco equipped locomotive, the throttle could be reduced to zero to turn the selected individual volume off and increased to any setting to make the volume louder without ever reducing the track voltage to the point where Quantum Loco lost on-board electronic power. Once the volume had been selected, Type 1 or Type 2 signaling could be used to command that this volume setting be stored in LTM and move on to the next individual volume setting. Because the throttle may not be in the correct position for the next volume setting, and because the operator may not want the next volume setting to be automatically set to this value, we may change the affect of the variable track voltage remote control signal to prevent any changes in a volume setting until the throttle has been moved to a position that is correct for the current on-board volume setting. In this way, there is no affect on the volume until the throttle hits the right value and from then on, all throttle changes affect the volume; in other words, the operator moves the throttle up or down until he 'catches' the right setting and then can control the feature. This is a very natural operation and automatically lets the operator know what the current setting is by the throttle position when the throttle hits the right spot. We could also indicate the correct throttle setting with an audible signal like a "beep" or bell ding from the remote object or via bi-directional feedback to any kind of indicator such as an LED or LCD output display.

The use of the throttle as a continuous remote control signal could apply to any feature that requires a variable setting. One example is a variable horn or whistle where the sound quality is affected by a continuous remote control signal. This would allow the operator to play the horn or whistle like the prototypes, where the engineer can vary the amount of air or steam in horns or whistles to control the pitch and volume. Since the throttle is normally used in moving locomotives to control the speed, a command would need to be sent to disable or minimize the affect of the throttle on speed and instead use it to control the horn or whistle. Again, it would be an advantage to provide some feedback to the user (such as a beep or ding) that the throttle has been moved back to its previous setting before returning to normal throttle operation of the locomotive. In this case, the feedback can come from the controller since it could have recorded the last throttle position when the variable horn or whistle feature was activated. This procedure might occur as follows: the user enables the variable horn or whistle feature with its feature button that sends out the command to the remote object. The horn or whistle sound remains off and is not affected by the throttle until the throttle is moved to its lowest setting. Now when the throttle is increased or decreased, the horn or whistle produces sounds in proportion to the throttle setting. A higher throttle setting represents higher air pressure or steam pressure. The horn or whistle shuts off whenever the throttle is reduced to its lowest setting. The variable horn or whistle feature is disabled by pressing its feature button a second time, whereupon the throttle regains control over the trains speed. Since the throttle is probably in a different position after playing the horn or whistle, the throttle would need to return to its original position with a beep or ding feedback to indicate that it has caught the old position and now has control over the locomotive's speed. In addition, a standard horn or whistle button could be included to control a non-variable horn or whistle sound independent of this feature.

Separate levers or buttons, 8938, in FIG. 89, could be added to the MBU controller input to the microprocessor to apply variable level remote control signal inputs, which could produce variable analog voltage to the track independent of the throttle to control the variable horn or whistle operation described above. When these control buttons or levers are returned to their original off positions, separate commands are sent to deactivate these variable feature(s) on the controller and/or the remote object, whereupon the throttle would automatically regain control of the locomotive at its current throttle setting. In the case of DCC operation, these separate controller inputs, 8938, might send completely separate digital commands independent of the throttle.

Continuous remote control via the throttle setting can also be accomplished digitally by mapping the throttle setting to digital commands sent down the track. This is already described for sending DCC speed step commands based on the throttle setting. These same speed steps or other digital signals based on the throttle could be sent to the remote object to control variable features such as volume or playing the horn or whistle. Although there is more latitude in doing this operation with digital signals, the basic idea of using the variable throttle settings for variable operation of features is the same.

Since the active bridge circuit, 8715 or 8915, can supply AC power, this controller can be a suitable AC power supply for American Flyer S'Gauge and Lionel AC systems. Although the track, 8712 and 8912 is shown as two-rail, this system can be equally applied to three-rail track, such as Lionel O-Gauge, Standard Gauge, Lionel OO'Gauge, and Marklin three-rail HO or any other kind of conductive track system using AC or DC power. Although AC trains could be controlled with the circuits shown in FIG. 87 and FIG. 89 using DC power packs, the AC accessory outputs from most power packs do not have sufficient power output from the AC accessory lines to control the higher power demands of O'Gauge and Lionel's Standard Gauge trains. However, the DC power packs, 8701 and 8702, can be replaced with AC transformers like the Lionel ZW. In these cases, the ADC, 8717 and 8917, would be digitizing the AC throttle voltage instead of a DC throttle voltage and it would be this AC throttle voltage that was remapped into the AC track voltage from bridges, 8715 and 8915. Many AC power trains like Lionel use plus or minus DC superimposed on AC track for remote control of features such as horn and bell operation, and use power interruptions to affect directional control and for resetting the electronics in remote objects. Many of these transformers have become old and the remote control signals have become weak and undependable in addition to causing locomotives to speed up or slow down unrealistically. However, most signals from AC transformers, no matter how erratic or weak, can be detected from waveforms supplied to the microprocessor through ADC's, 8917 and 8717, which can be remapped into more reliable signals to the track from active bridges 8715 and 8915. All other features of the MBU controller would remain the same as DC powered trains except that different choices might be made for the Type of remote control signaling used for analog or command control.

In FIG. 89 and in FIG. 87, a single power pack is shown with a single MBU controller. However, a single MBU can be used with two or more controllers with additional ADC's to monitor the throttle output of each power pack or transformer. A switch could be included on the MBU to select which transformer or power pack to monitor or the operation could be automatic where any change in a throttle setting or operation on a power pack or transformer would cause that power pack or transformer to be selected. This is not beneficial for analog control for the MBU shown in FIG. 89 and FIG. 87, since there is only one track output, but does have an advantage for command control where only one output is required for the entire layout. In this way, an operator could move from throttle to throttle which would automatically result in selecting the locomotive, consist or accessory associated with that throttle, and have control of its feature through the one MBU controller. This concept could be extended to analog but the MBU would need multiple track outputs, each controlled by separate active bridge circuits like 8915 and 8715.

Although the circuits in FIG. 87 and FIG. 89 are shown as add-on's to existing power packs, the MBU controller can be combined with a simple step-down transformer to replace the power supply function of the external power pack to develop a new universal integrated power pack and train control system for either analog or command control operation of either AC or DC powered trains using two-rail or three-rail track. For an integrated power pack, additional buttons for locomotive direction and levers or knobs for throttle setting would be added to replace those functions normally provided by the DC power pack or toy train transformer.

Quantum Loco Features Related to Locomotive Speed Control, Motor Control, and RTC Once speed control and features like RTC have been implemented, there are a number of features that can be included on model trains to enhance prototype like performance.

Braking and Brake Release

Because of the inertia of a heavy prototype locomotive, speed is controlled mostly through braking. There is less need to make fine adjustments in speed using the throttle since the high inertia of prototype locomotives ensures that speed remains fairly constant for a long period of time. In a yard or switching environment, the engineer will start the locomotive moving by increasing the throttle and then back it off to allow the locomotive to coast and use the locomotives independent brakes to make fine adjustments in speed.

There are actually two different braking methods used on trains. One is the independent brakes that control the braking function on the locomotive only. The other is the automatic braking system that applies braking to the cars or rolling stock in the train. Both systems use compressed air to activate the brakes but in different ways. The independent brakes apply air pressure directly to the locomotive brake cylinders, which directly uses air from the locomotive's air reserves. For the automatic braking system, the brakes are disengaged by releasing air pressure from the brake pipe (air brake lines) that run the length of the train, including the locomotive brakes. Air reserve tanks on each car apply the air pressure to the car brakes directly in response to the drop in the train's main air brake lines.

RTC allows us to incorporate prototype-braking operation in the model locomotive or train. Under analog control, a digital code is sent to the locomotive to reduce the on-board throttle sound to its lowest or reduced setting while the speed of the locomotive is allowed to slow gradually. This simulates the coasting of the locomotive or train. Since RTC is a throttle control, and not a speed control, when a coasting locomotive couples up to a series of cars, or encounters an upward grade, it will slow down more quickly from the increased retarding force.

To simulate operation of the automatic braking systems, the controller sends out braking codes to reduce the simulated brake-line air pressure, which causes the locomotive to slow down more quickly. The longer the brakes are applied at the controller, the more simulated brake-line air pressure is reduced and the more the locomotive or train decelerates. It is not necessary to continually reduce the air-line pressure to cause braking. Discontinuing sending brake commands will result in the locomotive continuing to slow down at the last brake setting.

To release brakes, a command is sent to restore the simulated air-line pressure to its normal high setting, whereupon the locomotive returns to its coasting slow-down deceleration. Another command can be sent to restore the locomotive to its previous power operating state where the locomotive accelerates to a speed commensurate to its original throttle setting and locomotive sounds return to their normal powered levels. Whenever a brake release command is sent, the locomotive air pumps start up to return the locomotives air reserve to its nominal pressure.

The braking commands can be structured any number of ways. Each command sent could cause the simulated air-line pressure to decrease and deceleration to increase by a specified amount, or a command could be sent that caused the simulated air-line pressure to decrease and deceleration to increase continually over time until a second command was sent to stop further braking action or a number of different commands could be sent where each one specified the amount of braking to be applied. The latter method has the advantage of the controller knowing precisely how much braking is being applied in the locomotive. Otherwise, unless the controller maintains a log of how much simulated air pressure was released in a locomotive, bi-directional communication would be required for the controller to know the status of the brakes in the remote object.

Braking functions on a prototype locomotive allow for either increasing or decreasing the air line pressure by any amount using a brake lever along with an air pressure meter to indicate the amount of braking. The same method can be applied to model trains where commands can be sent to increase or decrease braking. A meter would be used to indicate the simulated pressure where the meter setting is maintained by bi-directional feedback or by a log of what braking commands were sent to the locomotive.

Other braking functions include braking for the rolling stock as described in Rolling Quantum and emergency braking action where flashing lights accompany the rapid deceleration rate of maximum braking. Since most model cars have little momentum, braking action in the locomotive can simulate rolling stock braking when these cars are connected to a locomotive. While there may be two levers or brake buttons on the controller, one for the locomotive and one for the rolling stock, only the locomotive is responding to the commands but with different sound effects and deceleration rates depending on the type of braking applied.

An additional sound effect can be added when the brakes are released and the brake pipe is being recharged. This sounds a bit like steam hiss in old apartment steam heaters—a sort of contained steam venting sound. This recharge process can take a few minutes for a train that is sitting in Neutral with full brakes applied. It also depends on the length of the train and the remaining pressure in the reserve tanks on each car. Although this sound is also present when brakes are released on a moving train, it is difficult to hear over the other train sounds. However, in either case, air is being drawn from the locomotive's air reserve and being applied to the brake pipe, which automatically results in the air compressor turning on until the air reserve is restored to full pressure.

Independent braking can also be simulated in essentially the same way as automatic braking. Unless there are true brakes in each car, the two differences noticed by the user applying the locomotive independent brakes are that: 1) the locomotive air pump sound effects come on whenever independent brakes are applied rather than when they are released and 2) there is no recharging sound of the brake pipe when brakes are released.

DCC braking is easier to simulate then analog since there is always sufficient power applied to the track to maintain the motor control functions. Under DCC, the operator could turn the throttle all the way down to its lowest setting, which would not affect the track voltage allowing the locomotive to slow gradually from its current speed. However, under analog operation, this might not be possible. If the throttle is turned down to a low setting, available power to the track is reduced as well, often causing the speed of the locomotive to reduce rapidly and unprototypically to lower speed than can be maintained by the available track voltage. However, using the method described above, where a braking command is sent independent of the throttle setting, the locomotive can slow gradually using the higher available track power. If controller and on-board power supplies are designed to maintain sufficient power in the remote object, then analog voltage can be reduced to lower values (but not completely off) without affecting the speed of the locomotive. Such designs might use controllers with high frequency PWM with constant peak voltage and on-board capacitors in the remote object that could maintain motor power during the PWM off periods.

Load Settings: Under RTC or STC, acceleration and deceleration can be independently specified in the motor control algorithms as described in the "The QSI Inertial Control and Regulated Throttle Control" section above. In DCC load settings are specified by CV3, CV23 for acceleration and CV4 and CV 24 for deceleration. These CV's specify how the internal throttle speed step values change over time. In analog, Quantum Loco currently has 15 levels of load setting that result in the locomotive taking from 30 seconds at level 0 to accelerate to full speed to over fifteen minutes at level 15 to accelerate to full speed. Although these level settings currently apply to both the acceleration and deceleration in analog, acceleration and deceleration can, of course, be specified separately in DCC. There is nothing that limits making both of these settings in DC analog as well.

It would be a novel idea to calibrate the load settings based on the locomotive type, horsepower, and tractive effort specifications and the number of cars that are being pulled. Load levels would be replaced with the number of cars in the train, or perhaps the total tonnage being moved. In addition, the inertia of the locomotive by itself could be an independent load parameter, here called "Loco Inertia"; prototype locomotives have different maximum acceleration and braking depending on their weight or inertia and horsepower. Customizing the locomotive inertia and selecting the trainload, here called "Train Load" based on the number of cars or tonnage, would allow more realistic operation of model trains and a more meaningful way to specify loading. Model trains with the same number of cars or tonnage and different locomotive type would accelerate or decelerate at different rates depending on the horse power and tractive effort of the locomotive and the quality of the braking system.

There are three issues with specifying load levels for locomotives within consists: 1) Unless all locomotives in the consist were the same type, locomotives would try and accelerate or decelerate at different rates based on their custom speed curves, Loco Inertia settings, horse power and tractive effort. 2) Different Train Inertia settings for locomotives in a consist would result in locomotives fighting each other during acceleration and braking. 3) If the same number of cars in the train were specified in all the locomotives, the consist would not act any differently than a single locomotive pulling the entire train. A consist of five similar locomotives should be able to accelerate the same number of cars five times faster than a single locomotive.

The first problem would be reduced if large Train Loads were programmed into all locomotives since the individual differences in Loco Inertia values would tend to be overshadowed. In addition, the problem is alleviated by the RTC algorithm, which results in power sharing between locomotives. Even so, performance would probably be compromised while the locomotives attempted to adjust their power requirements. To eliminate the problem, entirely, each locomotive model would first need to be calibrated for speed versus throttle settings and no-train-load acceleration and deceleration under RTC. The no-load acceleration/deceleration values would be based on the Intrinsic Inertia of the RTC algorithm and some factory or user setting stored in flash ROM or L™ such as the Inertia Settings in 6817, in FIG. 68. We call these no-load acceleration/deceleration values and common speed curves "Standard Loco Inertia" and "Standard Speed Curves" respectively. The Standard Speed Curves and Standard Loco Inertia would apply only when the locomotive was addressed by its consist ID ensuring that all locomotives would respond the same for transient acceleration and deceleration and steady state speed. If locomotives were each addressed by their locomotive ID numbers, the inertia would revert back to the Loco Inertia setting and their original Speed Curves that was dependent on the locomotive's horse power, tractive effort, top speed, etc.

If locomotives are too diverse, the above method may not be practical for operating in consists. In such cases locomotives may need to be grouped into types such as Passenger, Fright, and Yard, where Passenger types are high maximum speed, Fright are moderate maximum speed, and Yard is low geared for low speed operation. Within these groups locomotives could be calibrated to have the same speed and inertia characteristics.

The second problem would be solved by specifying the Train Load for the consist independently of any Train Load settings that individual locomotives might have or by overwriting any Train Load setting when the consist is made up. In this way, when a consist is made up and addressed by its consist number in either analog or command control, not only would Standard Speed Curves and Standard Loco Inertia apply to all locomotives but so would the common "Consist Train Load" setting, ensuring that the consist would act as a consistent whole. When the consist is disassembled and the locomotives addressed by their locomotive ID numbers, the Train Load level for each locomotive would apply.

The third problem could be mitigated when the consist is made up, particularly if the central train controller had a means to automatically make up consists as described above in Making Up Consists. Here the number of locomotives is known by the controller and the controller could adjust the Consist Train Load level. For instance, if the consist was made up of five identical locomotives, the original number of cars or tonnage setting would be divided by five for all locomotives in the consist. If the consist was made up of a number of diverse locomotives with different horsepower and tractive effort, and the controller had this information, then a more complicated calculation could be made for a load level for the consist, based perhaps on the sum of the individual locomotive's tractive effort, horse power, etc. In any case, a reduced load level would apply to the consist for the same number of cars and tonnage, which would result in more realistic operation of the model train.

In addition, the steady-state labored sounds could be modified by the load setting. If the load setting is increased, the steady state labored sounds would increase. On the other hand, if locomotives are added to a consist for the same amount of rolling stock, the load setting for each locomotive would be less and the steady-state labored sound settings would also be reduced. This would produce more realistic locomotive and consist operation when pulling a loaded train.

Load On/Off

This feature allows the operator to enable the Train Load or Consist Train Load level he has programmed into his locomotives or return to the locomotive's Loco Inertia (or the Standard Loco Inertia if in a consist). The Train Load or Consist Train Load would be enabled after the operator had coupled up to the cars he intends to pull. The Load Off command allows the operator to move his unloaded locomotive or unloaded consist around the yard quickly and realistically and to send the Load On command to increase the train load to the Train Load level he had previously selected when he couples up to his train.

The Load On/Off command could also automatically select whether the "apply brakes" and "release brakes" command at the controller operates the automatic or independent braking system. In DCC, any non-zero value in CV 23 and CV 24 could be considered a Load On condition. If the Load is On, it is assumed that the locomotive is pulling a train and hence the automatic brake system would be more appropriate. If the Load is Off, the locomotive is probably operating without a train, and the independent brake system would be more appropriate. A command could be designed to allow selection of either automatic or independent brakes. This would have some advantages. Independent brake operation could be selected for doing car switching in the yard where automatic brakes are seldom used to move small groups of cars around. Of course, if there were enough function keys in DCC or control keys in Analog, both types of braking systems could be available and not dependent on the Load On/Off condition.

Heavy Load

Heavy Load allows the operator to increase his load level dramatically in a moving locomotive to a level that would require over 15 minutes or more for locomotives to reach maximum speed or slow down to a stop. The advantage of Heavy Load is that once it is engaged, the locomotive will maintain near constant momentum over grades, around curves and though changing conditions on most average size layouts without appreciable or noticeable changes in speed. It has the same benefit of cruise control but without its limitations. Cruise Control has been available in model railroading since the 1980's but has the same limitations as speed control discussed earlier. The idea behind cruise control is to lock the locomotive at its current speed, which is maintained under a variety of loading conditions and variations in track voltage on the layout. In consists, it can result in fighting between locomotives. However, Heavy Load uses RTC, which allows the locomotives to power share and prevent fighting.

An additional advantage from Heavy Load is that the throttle can be turned up or down without appreciable or noticeable speed changes. This is another and unique use of the throttle as a remote control signal. The most appropriate use of the throttle under Heavy Load is to increase or decrease Sound-of-Power™ settings and to rev the diesel motor up or down. For instance, if the train approaches an upward grade and Heavy Load is engaged, the operator can increase the throttle to a high value as the locomotive starts to climb. If it is a steam locomotive, the steam exhaust sounds would become louder and more labored. If it is a diesel, the diesel motor could rev up to a higher notch and motor sounds would become louder and more labored. On the other hand, if the locomotive approaches a descending grade, the throttle can be turned down to create lighter non-labored chuffs, or no chuffs at all in a steam locomotive or lower motor notches with non-labored sounds in diesels.

Slack Action and Coupler Crash

Having the load level preset in a locomotive or consist can result in more accurate coupling sounds when connecting to cars or pulling away with a load of cars. One set of coupler sounds, called coupler crash, is related to couplers and cars being pushed together and another coupler sound, called slack action, is when couplers are being pulled tight. Both kinds of sounds result because of the slack in the coupler knuckles. If load setting is specified by the approximate number of cars, then slack action sound effects can be produced in Quantum Loco that is made up of a series of single car coupler sounds where each is delayed based on the speed of the locomotive or locomotive consist. In addition the volume of each coupler slack action sound in the locomotive could be reduced in succession, which would give the illusion that the sounds are coming from progressively remote cars in the train. Reverb and echo effects for each individual car coupler sound could add ambience to the effect. If coupling sounds are the result of a consist coupling to or pulling rail cars, then it might be appropriate that only the last locomotive in the consist have the coupler sounds enabled.

Car Load On/Off

If Train Load or Consist Train Load is specified by the approximate number of cars, then an additional setting would be whether the cars are loaded or not. This could conceivably be done on a car-by-car basis but for a quicker and easier designation, the locomotive or consist could be programmed to change the loading based on whether the train is running empty or full of cargo. This would apply less to passenger cars since the passengers do not contribute appreciably to the cars weight. Since the number of cars stays the same, the coupler sounds would remain accurate. However the acceleration and deceleration and Sound-of-Power effects of the locomotive or consist would be affected by the extra weight of loaded cars.

Wheel Spin (Real or Simulated)

Prototype locomotives can loose traction under load and spin their wheels. This produces a dramatic effect with steam locomotives where the steam exhaust or chuff rate speeds up quickly and then decreases back to the normal chuff rate as the engineer pulls back on the throttle or increases cut off to reduce power to the drive wheels. Visually, because of the inertia of the locomotive and the train, when wheel slip occurs, the locomotive does not appear to slow down. However, the wheels can be seen rotating rapidly on a steam locomotive until the engineer regains control. On diesels or electrics, wheel spin is visually less obvious since the wheels are not as visible, often hidden behind trucks, brakes, and other apparatus. However, the sounds of wheels grinding against the steel rails can be clearly heard. It can be heard in steam engines as well but these sounds are often overshadowed by the rapid chuffing.

Modeling wheel spin is difficult in model locomotives since models have very little real inertia. If the wheels do actually slip the locomotive and train visually looses speed quickly. However, it would be possible to produce only the sound effects. Simulated wheel spin on diesel and electric locomotives would be easier since the wheels are not as obvious as they are on steam locomotives. However the effect could be quite dramatic and realistic on steam locomotives if the engines were not viewed from the side where the wheels are obvious. In either case, the wheel spin itself does not happen which allows the speed control circuitry on the model to maintain speed and realistic inertia. If the model was accelerating, the speed control could suspend any acceleration during the wheel spin effect to enhance the effect and perhaps include a slight slowing down as well.

The simulated wheel spin sounds and drop in acceleration could be operated under a digital command or it could be automatic. If it is automatic, it could be controlled by the throttle setting, Train Load, Loco Inertia, tractive force, cutoff setting in steam locomotives, diesel notch setting, diesel transition setting, grade conditions, simulated weather conditions, etc. so the effect is coupled directly to the simulated loading conditions and traction on the locomotive, which would properly model the prototype conditions that cause wheel slip. Once wheel slip effect occurs, it could be automatically and realistically terminated or it could continue until the operator reduces the throttle or applies simulated sand to the track. The operator could also produce wheel slip on demand by increasing the throttle at any time when the train is heavily loaded. Automatic wheel slip would be less likely to occur if the locomotive was hauling very few cars. Automatic wheel slip that depends on loading and other conditions would require that the operator handle the throttle, cutoff and transition more carefully, especially under heavy load, just like a prototype engineer.

If real wheel spin does occur on the model, the chuff in steam engines would of course speed up. If this did occur, grinding sounds and other sound effects could be added to improve the effect. However, if the locomotive is under speed control or RTC, the wheels would not spin faster; instead the locomotive would slow down. If it were possible to detect that the model wheels were slipping, it would also be possible to speed the wheels up under motor control to produce a more realistic visual effect plus add sound effects.

Sanding Operation

Prototype engineers can release sand from the sand reservoir to the track to increase traction. This is not practical on model train locomotives but the sound effects could be added to simulate the effect. In addition, if simulated wheel spin is occurring, simulated sanding effect could stop or reduce the wheel slipping effect to produce more realistic operation.

Dynamic Brakes

Dynamic Brakes can be included on prototype locomotives that have electric traction motors such as modern diesels and electric type locomotives. Electric motors can act as motors or generators depending on whether they are using power or generating power. When used as generators, the traction motors are disconnected from taking power from the locomotive's prime mover, and instead are connected to large resistor grids in the roof. By increasing the resistive load on the traction motors, the traction motors become harder to turn and act as brakes for the locomotive. The electric power generated by turning the traction motors is dissipated as heat by the resistor grid. These resistor arrays get quite hot and require cooling. Dynamic brakes are usually operated during long descents on down grades to maintain the train at a steady speed. Dynamic brakes are relatively ineffective at slow speeds and are not used to bring the locomotive to a complete stop.

To Model Dynamic Brakes Under Diesel Operation, the Diesel Motor Sound drops to notch 1 and the Dynamic Brake Cooling Fan sounds come on. Since these brakes are usually employed to keep the train at a constant speed during down grades, there is no simulated braking action to slow the locomotive down. In fact, we could lock the speed at its present value using techniques similar to Heavy Load described above; this would help prevent the actual weight of a long model train causing speed up.

Although Dynamic Brakes are not available on Steam locomotives and some early diesels, we include a dynamic brake feature to maintain consistency when these locomotives are used in consists. If a dynamic brake command is sent to a consist, all diesel locomotives with or without dynamic brakes will lower their motor notch, and all locomotives will disable or reduce their labored sounds (Sound of Power™). Otherwise it would be unrealistic for a diesel in a consist to apply dynamic brakes while a steam locomotive in the same consist maintains full labored Sound-of-Power chuffs.

Prototype diesel locomotives can use dynamic brakes to test their diesel motor and generators by applying their output power to dynamic brake resistor grids instead of the traction motors. This is usually done while the locomotive is stopped and the traction motor disconnected. We also model this on Quantum Loco by first sending a command to put the locomotive into a special state called Disconnect where the power pack or transformer can be increased without the locomotive moving. For diesels, moving the throttle under Disconnect will cause the diesel motor sounds to rev up or down. If dynamic brakes are also turned on in Disconnect, the diesel motor sounds have full Sound-of-Power effects to model the testing of the prime mover under load. Dynamic Brake fans will also be turned on since this models the cooling of the resistor grid.

Fuel Consumption

Since we can model all variables that cause fuel consumptions such as train load, locomotive horse power, tractive effort, speed, acceleration, braking, dynamic braking, when the locomotive was last serviced, we can calculate and log the amount of simulated fuel used by a model train. Based on the capacity of the fuel tank, the amount of fuel loaded before a trip, we can continually update the amount of remaining simulated fuel. This can be transmitted back to the operator by any bi-directional feedback technique or verbally from the locomotives sound system. The remaining fuel can also be stored in LTM to maintain continuity from operating session to operating session where power is shut off between sessions.

Water Consumption

All locomotives use water. Steam locomotives use water to produce steam for propulsion and for heating passenger cars. Diesel and electric type locomotive create steam for steam heated passenger cars. Just like our calculation for fuel, we can calculate the rate of water consumption and continually update the amount of remaining simulated water. This can be transmitted back to the operator by any bi-directional feedback technique or verbally from the locomotives sound system. The remaining water can also be stored in LTM to maintain continuity from operating session to operating session where power is shut off in between sessions.

Smoke and Labored Sound:

Quantum Loco can have a number of different features based on simulated steam and smoke as described for the smoke generator, 3543, in FIG. 35. For instance, we can use smoke generators to model a) steam emission when whistles are operated on steam locomotives, b) steam emission from the dynamo, c) steam exhaust around the steam chest of a moving or stationary steam locomotive, d) steam exhaust from open steam cocks used to clear out condensed water in the steam locomotive steam chests, e) smoke and steam exhaust from steam locomotive blowers, f) steam exhaust from a working steam locomotive out the main stack, g) smoke from idling or working diesel locomotives, h) smoke from steam water heaters in diesels and electric type locomotives, i) steam from coal auger steam engines on steam locomotives, j) smoke in a steam locomotive cab from poorly vented fire in the firebox, k) smoke from the vents of a locomotive that has a motor failure or fire. Each of the effects can be controlled separately in Quantum Loco although some may use the same smoke generator.

Smoke units have been designed for years in model trains to simulate the smoking of both steam and diesel locomotives. Early units were usually designed to respond to the amount of voltage on the track, which also directly controlled the power to the motors. Most early smoke units were used to simulate puffing smoke from steam locomotives. The puffing rate was usually controlled by a plunger connected directly to the drive system that vented air over a heated wick soaked in oil; the amount of heat was proportional to the track voltage. The amount of smoke and puffing rate were coupled to both speed and throttle setting which produced a reasonable simulation of the prototype where the amount of smoke is also roughly proportional to the throttle setting and speed.

Smoke from diesel motors and steam exhaust from working prototype locomotives depends on how hard a locomotive is working. This will be modeled in Quantum Loco by microprocessor control of the smoke generator as described in U.S. Pat. No. 5,448,142 (column 29, line 57 through column 31, line 13). Again, we have all the necessary variables to model the amount of steam and smoke emitted from the main stack and steam chest. The on-board microprocessor can calculate the amount of smoke based on simulated Train Load, horse power, type of fuel, throttle setting, acceleration, speed, and Cutoff for steam locomotives (described below) and Transition setting for diesels, and simulated ambient temperature.

Some smoke generator designs use information from the motor control circuits to vary the amount of smoke generated based on the real power in the electric motor. However, if the motor is in a control loop to maintain constant speed or to maintain momentum (such as our RTC method described earlier), the smoke output can appear to be inconsistent with the locomotive's behavior just like we described labored sounds being inconsistent with the locomotive's behavior. Since smoke output and labored sounds go together, a better choice would be to produce smoke based on the simulated load described under Regulated Throttle Control and Standard Throttle Control rather than the actual power demands of the electric motor. Thus, smoke intensity could be very high for an accelerating locomotive along with heavy labored sound effects and smoke could be very low or off under deceleration with very low labored sounds. At steady state operation, the amount of smoke would be proportional to the throttle setting and load settings.

The amount of smoke generated by model train smoke generators can also be a problem. Prototype steam locomotives and diesels produce a great deal of smoke and steam which if modeled correctly could easily fill the model train layout room with an over abundance of noxious fumes. On the other hand, a reduced smoke output looks toy like and is hardly worth the effort. Another approach which provides the best of both methods is to have the on-board microprocessor controlled smoke generator provide heavy smoking under acceleration while the locomotive is working hard but to reduce it to very low levels when the train is moving at constant speed or when it is stopped. Here again, it might be best to provide more smoke when a locomotive has just entered neutral and then shut it down to a low level or completely off after a minute or so, when the attention in not focused on the locomotive as much. In particular, when a prototype steam locomotive stops, the engineer usually turns on the steam blower to vent steam out the stack. This draws air through the firebox and maintains the fire and also prevents smoke from entering the cab. So on the model steam locomotive, after it stops in neutral, it would have very little smoke until the blower is heard to automatically start up after a minute or so whereupon smoke would be seen venting from the smoke stack. If the blower feature were not automatic, it could provide interesting operation for the engineer or fireman who forgets to turn on the blower before or directly after the model steam locomotive actually stops. In this case, the following scenario would be observed: the smoke generator would vent smoke into the cab from the smoke generator with verbal complaints heard from the locomotive crew about the excess smoke with coughing here and there and shouts to turn on the blower. Smoke would stop being vented into the cab as soon as the blower turned on and instead smoke would be seen from the smoke stack. In either case, it would be prudent to turn off or reduce the smoke from the stack after a few seconds or so to prevent excess smoke in the layout room. This is reasonable since there would initially be an excess of smoke that had gathered in the firebox and the flues and once ejected, smoke output would be reduced.

Note: Most model railroads are indoors and operated at a fairly constant temperature. The amount of visual steam or smoke produced from prototype locomotives is dependent on the both the environment temperature and the relative humidity. Both of these variables can be simulated and programmed into the locomotive to calculated temperature and humidity dependent effects. These variables can be programmed into the locomotive and retained in LTM at the beginning of an operating session or they can be read by the locomotive at different physical locations, at different simulated or real time of day and at different simulated or real seasons where the simulated temperature and humidity might be modeled differently. For instance, high mountain areas might have lower temperatures and lower humidity while daytime in the lowlands in summer would have higher temperatures. These values could be read into Quantum Loco via local track signals or stationary track-side optical transceivers that communicate with transceivers located under or on the locomotive or tender.

In some cases, real temperature and humidity may be preferred over simulated values such as with outdoor layouts. In this case, thermometers and humidity sensors would be required either in the remote object or on the layout where this information can be transmitted to the remote object via local track signals or stationary track-side optical transceivers that communicate with transceivers located under or on the locomotive or tender.

What is unique in this patent is the control of smoke for different appliances from the same smoke generator, modeling whistle steam exhaust in steam locomotives using microprocessor controlled smoke that was synchronized to the whistle sound, and a method to control the average volume of smoke to a small amount but provide dramatic smoking under certain conditions such as loading where it is likely to be observed.

Although the improved smoke generators described above are part of a sound system, an independent smoke generator could be designed and retain much of the features described above. Inputs to the smoke generator would be measured locomotive speed and throttle setting. The independent smoke generator could also contain DCC and Analog PRP decoders to respond directly to commands. An integrated digital decoder also allows the input of loading variables such as DCC's CV3, CV4 and others to provide variable smoking dependent on simulated loading. If a DCC decoder is added to the locomotive to control the motor, both this and the smoke decoder could receive identical information regarding simulated loading and other parameters to allow coordinated operation of the two independent decoders.

Cylinder Cocks:

One special area where simulated steam would be particularly dramatic is the action of steam cylinder cocks. When a prototype steam locomotive sits idle for an extended period of time, water condenses and collects in the steam chest. Since water is not compressible and can damage the cylinder valves during operation, the engineer must open special cocks on the steam cylinders to allow the water to be ejected as the piston moves. As the locomotive moves out, clouds of steam and water are propelled out on either side of the locomotive in such a flurry that it sometimes obscures the wheels and valve gear of the locomotive.

A smoke generator could be timed to eject high-pressure smoke out either side of the locomotive as it starts out. Even though the smoke output is high, this effect only lasts for a short period and will not vent a large total volume of smoke into the layout room.

The cylinder cocks smoke would also be combined with the unique sounds of water and steam being ejected as the locomotive starts out. This sound is essentially dominated by the steam hiss and could be modeled using a hiss sound generator in the sound system. This can be done with analog circuitry or simulated using a digital algorithm. The easiest way is to use the sound systems microprocessor to do this job. This allows varying the volume and frequency components of the hiss to give character and realism to the simulated steam sound that is common in the prototype cylinder cock operation. This also allows us to produce realistic start and stop effects and to vary the character of each individual steam emission to provide variety to the effect.

Both the sound effects and the smoke generator emissions would be timed to the motion of the steam locomotive wheels. In either analog or command control, special commands could be sent to activate and shut off the steam cocks. Or it could be automatic. Since the engineer only opens the cylinder cocks after the prototype locomotive has been idle for some time, we could time how long the model has been idle and arm the cylinder cocks effect after a certain period of time has passed. Once armed, the cylinder cocks effect would automatically begin when the locomotive started out without requiring any special command to be sent. In addition, since the prototype cylinder cocks are only on for a short time, we could automatically terminate the feature in the model after some countable number of steam emissions or after the locomotive had reached a certain speed.

Coupling and Uncoupling:

It is possible to make special use of the reversing command in either analog or DCC to do KD coupler type uncoupling over uncoupling magnets. Because it is important to do reversing precisely over uncoupling magnets, uncoupling has usually been done without inertia of load effects. An additional reversing feature for uncoupling would be to ignore the load or inertia setting if the locomotive is moving at some slow speed such as below 5 smph. When the desired coupler is directly over the uncoupling magnet, the reverse command is sent which causes the locomotive to stop and change direction quickly to avoid overrunning the magnet area.

This would allow normal uncoupling. However, one problem with uncoupling is that the slack between locomotive and cars or between cars must be compressed to allow the knuckles to open from the magnetic force. A rapid reversal may not allow compression. To improve this effect, the locomotive would rapidly decelerate to some minimum slow speed such as about 1 smph and stay at that speed for a short period to ensure that the coupler slack is compressed before the locomotive reverses.

If uncoupling is done in Analog with a standard DC power pack, the reversing switch operation could have a different effect than blowing the horn when the locomotive is moving less than 5 smph. Instead, the above operation of slowing down to minimum speed to compress the couplers followed by stopping and reversing direction would be performed. Note that method could also be used to do standard reversing of a moving train or locomotive without having to return to Neutral or without the intent of doing an uncouple.

If the locomotive had the Analog-Command-Direction-Control feature, the same operation would occur if the locomotive was below 5 smph except the horn would not need to be disabled.

If the locomotive is operating over 5 smph and a reversal command is sent in DCC or Analog using ACDC, the locomotive will decelerate slowly according to its load setting, come to a stop for a moment (which may be programmable) and then accelerate according its load setting in the opposite direction.

If an ACDC command to change direction to Neutral is received by a locomotive that is moving below 5 smph, the same process of slowing down to minimum quickly over the magnet area is done except that the locomotive will come to a complete stop. The operator will then need to change direction before pulling away from the cars or rolling stock.

This method does have a problem in Analog since it eliminates standard horn operation if the locomotive is moving below 5 smph, which seems like an unacceptable penalty to pay for this feature. Instead of relying on only the reverse function to do this operation, a specific uncouple command could be sent to accomplish the same effect either directly or in concert with the direction command. In fact, this allows for a greater choice of uncoupling operations along with appropriate sound effects.

There are three types of uncoupling over uncoupling magnets using KD type couplers. These are:

Uncoupling by pushing the desired cars such that their connected couplers are over a flat magnet between the track rails. This allows the ferromagnetic air hose detail part to be pulled away from each coupler to open the coupler knuckles while the couplers are compressed. The locomotive is then stopped and direction changed to pull away from the uncoupled cars.

Uncoupling while pulling cars by stopping the desired cars such that their connected couplers are over the magnet and stopping. The train is then reversed to push the cars slightly to compress the couplers without overrunning the magnet. This allows the ferromagnetic air hose detail part to be pulled away from each coupler to open the coupler knuckles. The locomotive is then returned to its original direction and to pull away from the uncoupled cars.

Pushing cars onto a siding by first stopping the desired cars over a magnet, compressing the couplers to allow the magnet to open the knuckles, pulling away slightly while still over the magnet so the couplers have parted, then changing direction to allow the couplers to press against each other without connecting to allow the cars to be pushed onto a siding and dropped off. This method works because when KD couplers part, they pull away from each other over the magnet such that when they meet again, they are misaligned and the couplers do not mate and hold. This allows the operator to push the cars at a reasonable speed and decelerate quickly to permit the unmated cars to coast onto the siding in prototypical style.

With speed control and unique coupler commands, each of these operations can be automated to perform better than the user can do with individual stopping, starting and reversal operations. We would propose the following:

Uncoupling KD type couplers over a magnet while pushing cars: Press the compression-coupler command just before the desired cars enter the magnet area. This slows the cars to some minimum speed to allow the user to better judge when to do the uncouple operation and to ensure that the cars couplers remain in compression. A second command is sent to stop the cars smoothly over the magnet, which after a brief period causes the locomotive to change direction and start out smoothly for a short distance until the couplers part. As the cars part, there is the hissing sound of the air hoses parting between the cars. At this point another command is sent which stops the train, hopefully still over the magnet area. If the uncouple was unsuccessful, the compression-coupler command can be sent again to repeat the operation. The locomotive returns to pushing the cars until the different coupler commands are again sent. Once the uncoupling is successful, the throttle can be increased to perform a pushing operation with non-mating couplers to drop cars off on a siding. This is accompanied by crashing sounds of cars being compressed. Or the direction of the locomotive is changed and the throttle turned up to leave the cars behind.

Uncoupling KD type couplers over a magnet while pulling cars: Press the tension-coupler command just before the desired cars enter the magnet area. This slows the cars to some minimum speed to allow the user to better judge when to do the uncouple operation. A second command is sent to stop the cars over the magnet. After a brief period, the locomotive backs the cars up a short distance without overrunning the magnet area. Crashing sounds will be played of cars couplers changing from tension to compression. Another command is sent to stop the train followed automatically by the locomotive then changing back to its original direction and moving for a short distance leaving the cars uncoupled. As the cars part, there is the hissing sound of the air hoses parting between the cars. Another command stops the train. If the uncouple was unsuccessful, the tension-coupler command can be sent again to repeat the operation. The locomotive backs up putting the cars in compression until the different coupler commands are again sent. Once the uncoupling is successful, the throttle can be turned up to moving in the original direction or the direction can be changed to perform a pushing operation with non-mating couplers to drop cars off on a siding. This is accompanied by crashing sounds of cars being compressed.

Analog Example:

The following is a description of one of many techniques we might use in Analog to do the above uncoupling procedures with only one button. Our current Quantum Engineer already has a single button for coupler sound effects. We can use our method of expanding the remote control options of a single button described earlier in this patent specification of a single-press, double-press and press and hold operation to provide three different types of coupler remote control command signals.

For cars in compression from a pushing locomotive moving below some specified low speed, a single-press causes the locomotive to reduce speed to minimum along with brake squeal effect and enables the "pushing cars" coupler operation. When the desired couplers are over the magnet area, the next single press causes the train to stop with some additional brake and car crash sounds followed by the locomotive moving in the opposite direction at minimum speed along with optional continual slack action sounds. When the cars part, the next single press causes the train to stop. If the uncouple was unsuccessful, the coupler button is pressed and held until the locomotive again backs up at minimum speed along with crashing sounds of cars being compressed. This rearms the above uncouple operation allowing all of the above single press operations to be repeated. Once the uncoupling is successful, the throttle can be increased to perform a pushing operation with non-mating couplers to drop cars off on a siding. This is accompanied by crashing sounds of cars being compressed. Or the direction of the locomotive is changed and the throttle turned up to leave the cars behind.

For cars in tension from a pulling locomotive moving below some specified low speed, a double-press causes the locomotive to reduce speed to minimum along with brake squeal effect and enables the "pulling cars" coupler operation. When the desired couplers are over the magnet area, the next single press causes the train to stop with some additional brake followed by the locomotive moving in the opposite direction at minimum speed along with crashing sounds of cars being compressed. When the couplers over the magnet area become depressed, the next single press causes the locomotive to stop and move in the opposite direction until the next single-press of the coupler button. If the uncouple was unsuccessful, the coupler button is pressed and held until the locomotive again backs up at minimum speed along with crashing sounds of cars being compressed. This rearms the above uncouple operation allowing all of the above single press operation to be repeated. Once the uncoupling is successful, the throttle can be increased to leave the cars behind or the direction can be changed to perform a pushing operation with non-mating couplers to drop cars off on a siding. This is accompanied by crashing sounds of cars being compressed. Or the direction of the locomotive is changed and the throttle turned up to leave the cars behind.

A coupler effect is coupling up to cars. With KD couplers this does not require a magnet; cars can be coupled to anywhere on the layout. However, the sounds of the coupler hitting and the cars moving into compression or tension when the locomotive moves out are value additions to our feature set.

A similar method can be designed for NMRA DCC operation. Other types of button scenarios could be designed for either DCC or Analog depending on the style of the operator and whether he is uncoupling cars from the locomotive or cars from cars. What is unique is to combine these operations with speed or regulated throttle control. What is also unique is the repeat operation, which is often very necessary with these types of couplers. Another unique aspect of this method is the means to allow the coupler compression or tension to propagate down the train to the desired couplers before the next coupler operation is activated. Also, it is a great benefit that once armed, only single-presses are necessary to do each coupler operation rather than more complicated operations or the use of other buttons or keys. The operator must have his eyes keenly on the uncouple operation and cannot afford to try and remember complicated keystrokes or divert his eyes to scan for another command key.

Besides the above uncoupling methods, AC trains such as Lionel, have a coupler design that can be operated remotely at any location. This allows cars to be uncoupled from the locomotive while the train is moving. Since this type of coupler will eventually be available for smaller scales, we must reserve commands and methods for this type of uncoupling operation as well.

Rough Start Up:

If the locomotive starts roughly from a stopped position, we could detect this via speed control and apply coupler crash sounds and feature this effect. Normally, we would want a smooth start effect if the throttle is eased up slowly. However, we may want to cause a rough start by detecting a quick increase in the throttle and then have the motor controller produce an artificial jerk start. We could also prevent the locomotive starting out if the simulated load is too high requiring that the operator back up to compress the slack in the couplers with appropriate slack action compression sound effects and then produce a slack action expansion sound effects when the locomotive does start out.

Maximum Speed

Prototype trains are limited in their top speed by the trainload and the available horsepower in locomotives or consists. Model locomotives are seldom limited in power but are sometimes limited in tractive effort, which can limit their top speed. However, most model trains can go faster than the number of cars should allow. Since Speed Control and Regulated Throttle Control can limit top speed by limiting the internal speed reference, such as the speed reference, 6605, in FIG. 66, we can constrain the locomotives speed to a maximum value. This maximum would be determined by calculations based on simulated trainload, tractive effort, horse power, type of locomotive, or consist composition, etc.

Steam Locomotive Cutoff

Cutoff is a term used in steam locomotives to describe where in the piston stroke additional steam is cutoff from entering the cylinder. With no cutoff, steam enters the cylinder during the entire stroke and is vented to the outside at the end of the stroke. This provides the most power to the cylinder and also uses most of the steam. Since the steam is at full pressure when vented at the end of the stoke, the steam exhaust sound is loud and has more of a bark than a gentle steam release. The no-cutoff position is used when starting a steam locomotive with a large trainload. After the locomotive gains speed, the cutoff is increased to improve efficiency and the steam exhaust sound becomes less sharp. At steady state, the cutoff is increased further and just enough to maintain speed. When slowing down, the cutoff may be increased again and the chuff becomes quieter and much more mushy or soft or wet sounding. Generally, steam locomotives are run with the throttle wide open and all power control is done by changing the cutoff level. If the locomotive has too much power for its tractive effort, the actual throttle can be backed off to a more appropriate value. Even so, cutoff would likely still be used for power control.

Cutoff can be modeled by sending cutoff level setting commands to the locomotive, which will set the simulated power demand for the locomotive. However, it might be more appropriate to send throttle setting level commands to the locomotive and use the throttle knob on the power pack or transformer to set the cutoff. In this way, the cutoff sound effects would automatically change as the operator changed the controller's throttle knob.

There are a number of ways to simulate cutoff. Since chuff is basically white noise with an envelope that determines its attack, sustained period and decay, which determines its chuff duration, we could simulate different cutoffs by changing the profile on white noise generated in the sound system. No cut-off would have a chuff record that was essentially flat with short attack and decay portions while full cutoff would not have any sustained period, only an attack and slow decay. Or we could play different chuff records for each cutoff position. Since cutoff is a continuous variable, the former method would be more attractive. Also, this technique allows direct microprocessor control of chuff duration, which makes it easy to change chuff rate as the locomotive moves faster. However, chuff is not entirely white noise; there is character to the chuff's noise content, which makes the second technique attractive. Perhaps, we could use records of real chuffs and manipulate the envelope to produce the different chuff rates and cutoff. This would give us the best of both techniques.

Once we have the optimal way of generating chuff sounds, there are a number of ways to use the throttle knob and cutoff effects to control a model train:

Changing the throttle knob on the power pack or transformer directly changes the cutoff value, which directly determines the labored Sound-of-Power effect. Our Sound-of-Power is almost completely independent of Train Load settings. The difference in behavior is that a lightly loaded train will accelerate faster and reach a higher speed at a higher chuff rate than a heavily loaded train but the laboring sounds will be the same. However, if there is power to spare, and the maximum speed is higher than intended, the operator will reduce the throttle, which will increase the cutoff resulting in less labored sounds. When the throttle knob is reduced to lower the speed, the cutoff increases more, which results in a slower decay in each chuff to produce the softer, mushier sound. The volume of the chuff stays the same over this entire process and is determined by the throttle setting command. If air brakes or a dynamic brake command is sent, the cutoff increases to it highest value and the simulated on-board throttle setting may also be reduced to lower the chuff sound volume.

Changing the throttle knob results in an automatic cutoff control where the locomotive starts out with minimum cutoff, which is increased periodically as the locomotive speeds up until it reaches its maximum speed with reduced cutoff. Turing the throttle down causes the cutoff to increase periodically as the locomotive decelerates until the cutoff is maximum as the locomotive slows to a stop.

The first method places the operator in the position of a steam locomotive engineer who directly controls the steam cutoff level. The second method simply lets the operator turn the throttle up to the final value he wants and lets an imaginary engineer in the on-board Quantum Loco continuously adjust the cutoff level. With the first method, the operator needs to back off the throttle knob during acceleration to increase the cutoff level with its concurrent sound effects. The first method is a bit like controlling an automobile throttle entering a freeway where a driver might press down hard on the gas at first to get up to freeway speeds but starts to back off a little at a time as he approaches the correct speed. Perhaps both methods are equally desirable and an analog programming option and/or a DCC CV will be available for the operator to select which method he likes the best; it kind of depends on whether the operator wants to be an engineer or an observer.

Note that changing cutoff versus changing throttle does not affect the basic operation of RTC since in either case, we are requesting a forcing function and comparing it to the detected forcing function. It might affect the "FF Versus Throttle Setting Function", 6814, in FIG. 68.

Stopping a Train Over a Specified Distance

Stopping locomotives in a predicable way has always been a problem in model railroading, particularly under computer control. It would be desirable to have a train stop appropriately in front of a station or at a water tower or at block signals without having to do it with hands on throttle manipulation. Having the locomotive and train stop at a specified distance will allow for automatic signal controls and collision avoidance, etc. without complicated locomotive sensing and speed updating data in an external control center computer based algorithm.

The technique is simple but may take some serious software implementation to produce. Commands can be sent to stop the train at some prescribed set of distances, say at 1000 scale ft, 750 feet, 500 feet, 250 feet, 100 feet and 50 feet or if on-board computation is not a problem, the prescribed distances can be much finer, perhaps in one foot divisions. Once a command is received by the locomotive, and based on its current speed, the speed is reduced in a mathematically correct way to slow the locomotive at a prescribed deceleration. Since we know the speed, we can incrementally change the speed over time at the proper deceleration rate necessary to stop the train where we want it. Based on the initial velocity $V_o$ and the requested stopping distanced, d, the deceleration is $V_0^2/2d$ and the time to stop is $2d/V_0$. An example of the different deceleration (braking) and stopping times for a distance of 1000 feet is shown in the table below as a function of the initial velocity.

Deceleration or Braking and Time to Stop as a Function of Distance and Initial Velocity.

| Distance (Feet) | Initial Velocity (scale feet/sec) | Scale miles/hour | Braking (scale feet/sec$^2$) | Time to stop Seconds |
|---|---|---|---|---|
| 1000 | 176 | 120 | 15.4887 | 11.4 |
| | 161 | 110 | 13.01481 | 12.4 |
| | 147 | 100 | 10.75604 | 13.6 |
| | 132 | 90 | 8.712396 | 15.2 |
| | 117 | 80 | 6.883868 | 17.0 |
| | 103 | 70 | 5.270462 | 19.5 |
| | 88 | 60 | 3.872176 | 22.7 |
| | 73 | 50 | 2.689011 | 27.3 |
| | 59 | 40 | 1.720967 | 34.1 |
| | 44 | 30 | 0.968044 | 45.5 |
| | 29 | 20 | 0.430242 | 68.2 |
| | 15 | 10 | 0.10756 | 136.4 |
| | 0 | 0 | 0 | N/A |

Conversion factor from mph to feet/sec. = 1.467

This table shows a linear deceleration for each initial velocity but the deceleration may vary over the distance to make the stopping appear more realistic.

It would be possible to automate this process to insure that trains stop appropriately in front of stations, block signals etc. by isolating track areas (local command track section) where the stopping commands can be transmitted locally. In this way, as the locomotive passes over the local transmission area, it will begin its deceleration based on its speed to stop in the prescribed distance. If bi-directional communication were available in the locomotive, the local command track section could receive the ID number of the locomotive as it passed and selectively transmit stopping commands. In this way, some trains would stop at a station stops while others would continue past.

Other Features for Quantum Loco

Diesel Idle Sounds using RSS: Most prototype diesel sounds range over eight notches with different RPM settings. When the model locomotive is powered up and moving, the looped digital sound record usually does not get too monotonous or boring since Sound of Power labored sounds are being generated along with other locomotive sounds and the notch position is often being changed. However, at the lowest notch at idle, where there are not a lot of changes occurring, a looped record can become too repetitive, unrealistic and actually irritating. One solution is to use our concept of random sequence sound for the idle (see U.S. Pat. No. 5,832,431) to constantly generate unpredictable sounds. These could simply be different regions of a recorded idle record or more discernable events such as random piston misfires. If on-board memory allowed, it would also be possible to add slight changes in RPM since no prototype diesel motor maintains a precise idle speed.

Lighting Operation: Lighting is a dramatic part of model trains. With the advent of Light Emitting Diode lamps that are very bright and require little current, it is now possible to provide many different kinds of lights even with HO and N Gauge trains. In particular, the following kinds of lights can be operated under microprocessor control in Quantum Engineer: 1) Headlight, 2) Reverse Light. 3) Hazard Light (including Over Head Blinking Lights, Mars Lights, Ditch Lights, Emergency Lights), 4) Interior Cab Light(s), 5) Front and Rear Number Board Lights. 6) Truck Lights, 7) Engine Room Lights, 8) Step or Porch Lights, 9) Firebox Lights, and 10) Instrument Panel and Gauge Lights. Each of these could be controlled separately through DCC or Analog commands.

Signaling for Ac Powered Trains

Many of the different types of remote control signaling described for DC powered trains can be applied to AC powered trains. For instance, the MBA shown in FIG. 82 is shown connected to a typical Lionel-like AC transformer in FIG. 101 for transmitting Type 14 and Type 15 remote control signaling. AC transformers like the transformer, 10101 in FIG. 101, usually have two levers for train control. Throttle lever or knob, 10143, is used to vary the output voltage at track terminals 10103. This is generally 50/60 hertz sine waves with either variable amplitude or phase modulation control. Voltage ranges from a typical minimum of 5 vac to a maximum of 16 to 21.5 vac.

The second lever, 10142, has two functions. If this lever is rotated to position, 10140, track power is interrupted. This function is used to change the direction of Lionel-like locomotives. Each brief power interruption will change the directional state from "Forward" (F) to "Neutral Before Reverse" (NBR) to "Reverse" (R) to "Neutral Before Forward" (NBF) to "Forward", etc. Some locomotives will "Reset" to a known directional state after power has been off for an extended period, usually in excess of 3 seconds.

If lever, 10142, is moved to position 10141, a DC offset is applied to the AC throttle voltage as a remote control signal. With AC powered trains, DC offset signals can be positive or negative. New transformer designs use the positive DC offset to activate a horn or whistle effect while a negative DC offset is used to operate a bell feature. Older transformers had only one DC offset and operated only the horn or whistle features.

Most transformers have a fixed AC accessory voltage output shown here at output terminals 10102. This was usually selectable by which terminals were connected or in some cases it could be adjusted by a knob. All transformers that I am aware of use unmodulated stepped down commercial power grid waveforms for their fixed AC voltage accessory outputs. These are usually sine waves with some distortion due to industrial and home appliance loading and other power factor issues. For purposes of this discussion, the fixed AC accessory voltage output, 10102, is assumed to be pure sine waves and equal to or set at the highest possible throttle voltage. However, the inventions described are not limited to any specific setting for the "fixed AC accessory voltage"; any voltage may be used but lower voltages may affect train performance.

Figure 90:
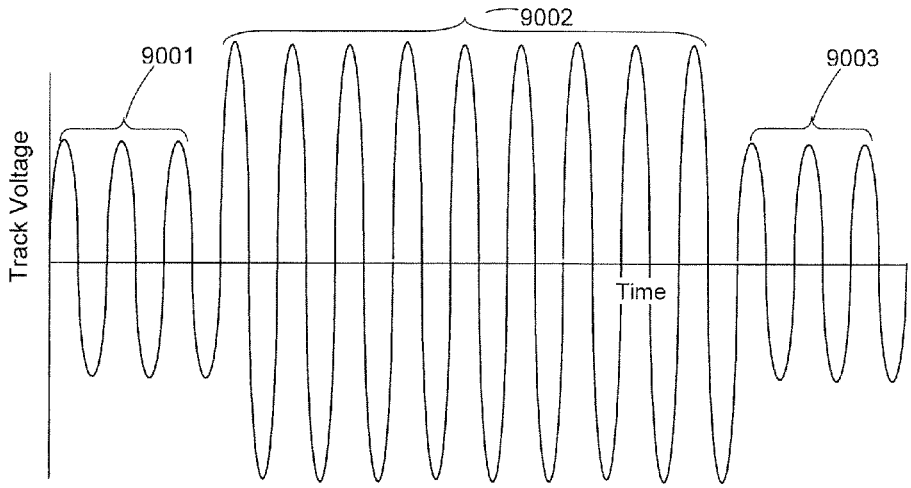
FIG. 90 Waveform of higher voltage AC interleaved with throttle AC as a remote control signal, where the higher amplitude of each remote signal can be detected as separate from the throttle voltage.

Pass device, 10115, is used to phase modulate this fixed accessory voltage. Although this is shown as a Triac, we will assume that this is a general-purpose pass device that can turn on or interrupt the waveform at any phase angle. If this pass device is turned on and the relay is suddenly switched to fix AC voltage accessory output, the waveform shown in FIG. 90 would result. Here the normal track voltage, 9001, is disconnected and the output from the fixed AC accessory voltage, 9002, is applied until at such time, the relay is returned to the throttle output voltage, 9003. For instructional purposes, we are showing the throttle voltage about one half the fixed AC accessory voltage. Note that this remote signal, 9002, could be used for a remote control signal except when the throttle voltage was equal to the fixed AC accessory voltage output.

Figure 91:
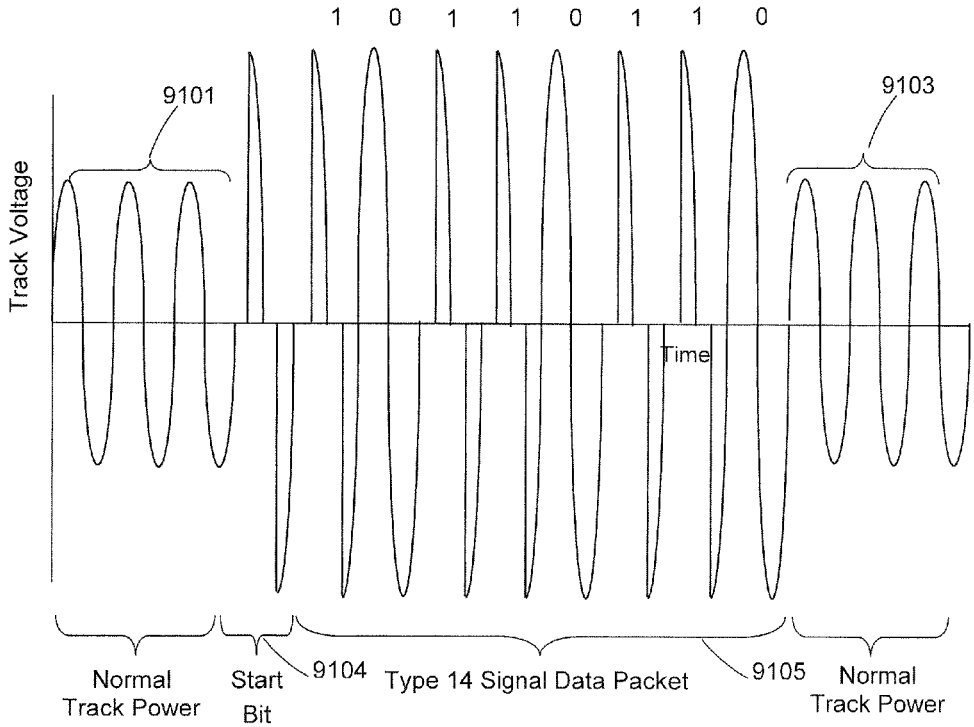
FIG. 91 Full sine wave throttle output replaced by higher voltage phase modulated AC sine waves as remote control signals where each full cycle can be phase modulated or not phase modulated to provide two bits of transmission. This is called Type 14 Signaling.

FIG. 91 shows Type 14 signaling being used for the remote control signal. Here pass device, 10104, in FIG. 101 can be used to phase modulate each full cycle sine wave at 90° and 270° to produce symmetrical full sine waves or symmetrical phase modulated sine waves. In this case, we have assigned a modulated sine wave as a logic "1" and a full period sine wave as a logic "0" although this assignment is arbitrary. In this example, after normal throttle voltage, 9101, is replaced by Type 14 signaling from the fixed AC accessory voltage output, we first send a "1" start bit, 9104, followed by the phase modulated signal, 9105, representing the eight bit word, (1, 0, 1, 1, 0, 1, 1, 0), before returning to the original throttle voltage, 9103.

Figure 92:
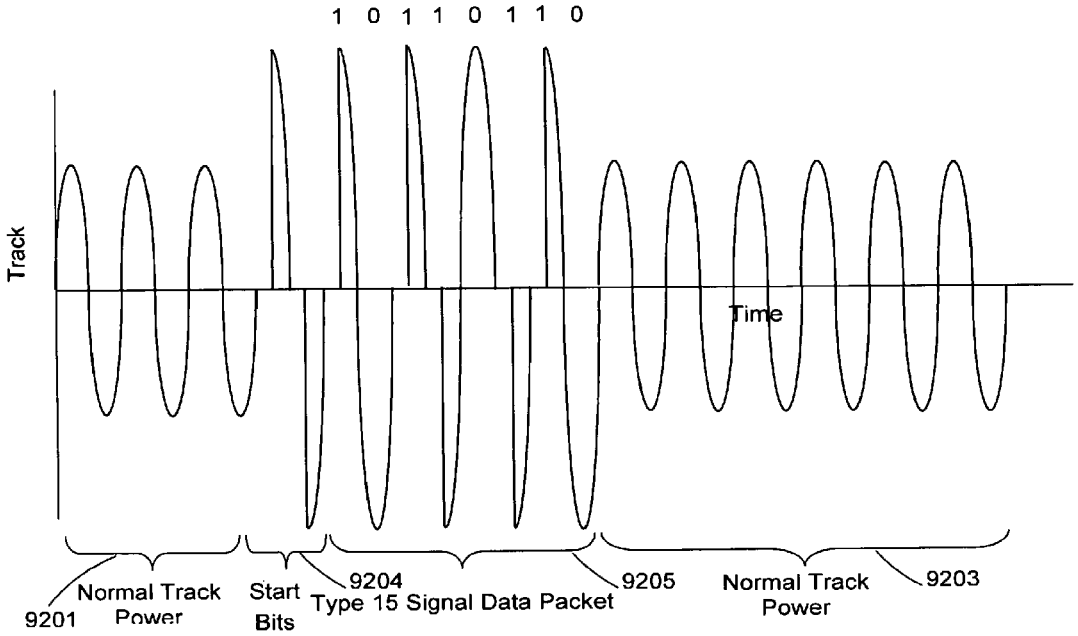
FIG. 92 Full sine wave throttle output replaced by higher voltage phase modulated AC sine waves as remote control signals where each half cycle (AC lobe) can be phase modulated or not phase modulated to provide two bits of transmission. This is called Type 15 Signaling.

Type 15 Signaling is shown in FIG. 92, where each AC lobe can be individually phase modulated at 90° to double the data rate from Type 14 Signaling. In this example, after the throttle voltage, 9201, is replaced with the fixed AC accessory voltage source, we first send double 1's start bits, 9204, followed by the phase modulated Type 15 Signal, 9205, representing the eight bit word, (1, 0, 1, 1, 0, 1, 1, 0), before returning to the original throttle voltage, 9203.

Figure 93:
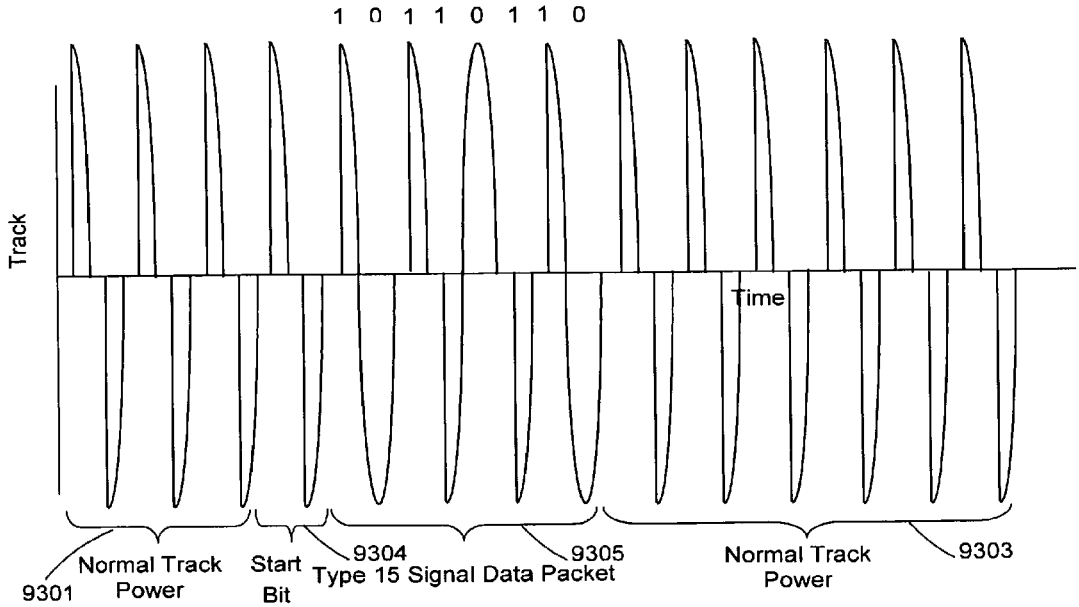
FIG. 93 Type 15 signaling where throttle is also a phase modulated sine wave at same voltage making it difficult to discriminate data from the normal throttle waveform.
Figure 95:
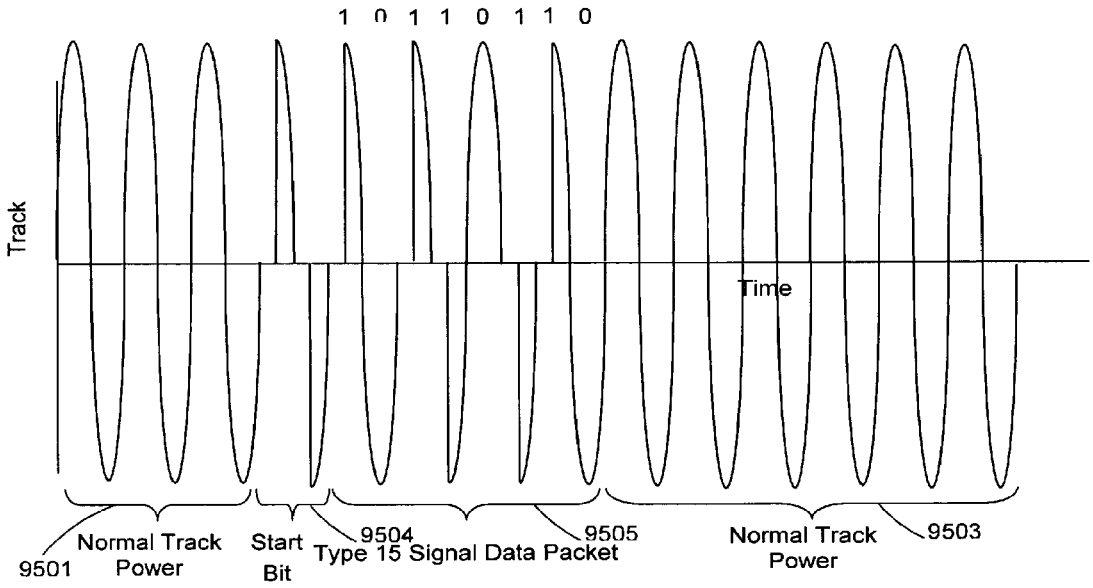
FIG. 95 Type 15 signaling with full sine wave throttle where a data start indicator is provided by a full period of a modulated sine wave at the same peak voltage as the throttle voltage.

All of the older Lionel transformers use variable amplitude non-phased modulated sine waves for their throttle voltage. Even if the throttle voltage was turned up to equal the fixed AC accessory voltage source, it would be easy to distinguish when data was being transmitted from detection of the phase modulated start bit or bits from Type 14 or Type 15 signaling. This is shown in FIG. 95 where it is quite clear when the normal track power, 9501, is replaced by digital signaling with the detection of start bits, 9504, and the following digital word, 9505. It is not as clear where the transmission ends without a stop bit but if we know the length of digital transmission, this is not a problem. However, modern transformers often use fixed-amplitude variable phase-modulated throttle voltage, which makes it difficult to detect Type 14 or Type 15 remote control signals. This is illustrated in FIG. 93 where the phase controlled throttle voltage is set at half, which means that each AC lobe looks like lobes used during digital transmission. In this example, it is not possible to distinguish the normal track power, 9301, for the start bit, 9304 or the first transmitted bit in the data packet, 9305, of this Type 15 transmission. In fact, if the digital word were all ones, it would be indistinguishable from the track power.

Figure 94:
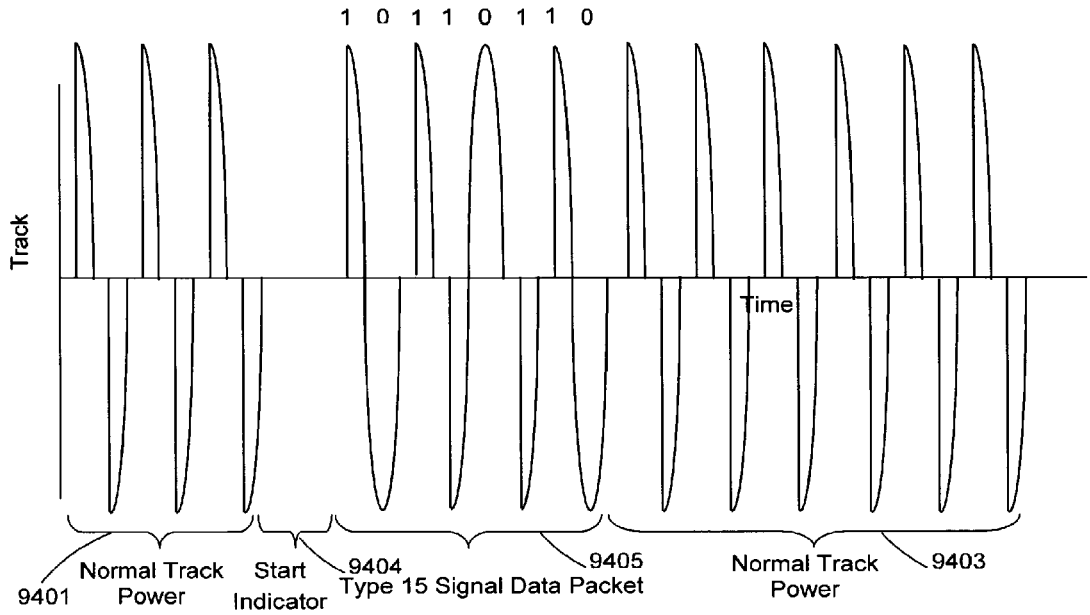
FIG. 94 Type 15 signaling with phase modulated throttle where a data start indicator is provided by a track power interruption of one full sine wave period.

One way to prevent this problem is to make the start of the digital word obvious. FIG. 94 illustrates a method where track power, 9401, is interrupted for one full sine wave period as a start indicator before digital transmission, 9405, is started (Type 15 Signaling in this example). This also allows a clean start for digital transmission. In FIGS. 90 through 95, we show transferring from normal track power to the fixed AC accessory voltage occurring at zero crossings. In reality, unless we took care to switch only at zero crossings, this transfer could take place at anytime in the waveform. In addition, there is switching time of the relay, which would cause a brief no-power period or perhaps some switching noise voltage if inductive loads were present. If the pass device, 10104, in FIG. 104 were off when the transfer was made, then there would be time for all noise to settle and for the fixed AC accessory voltage source to be established before digital transmission occurred.

I am inferring that both Type 14 or Type 15 signaling can be used for AC powered trains under analog operation and the obvious choice would be the faster Type 15 signaling. However, Type 15 signaling can produce a DC offset depending on the data content of the digital signal transmission, which can blow horns or trigger on-board bells for standard AC operated trains under conventional analog control. Type 14 signaling has the advantage of no DC offsets and will not result in unwanted horn or bell operation on older Lionel-like locomotives. DC offset is also an issue for the start indicator, 9404, in FIG. 94, where we show a full period timeout when a half period timeout might be sufficient. A full period timeout has the advantage of no DC offset.

Under command control such as Lionel's TMCC, a DC offset is not important since the horn and bell response to DC is disabled under command operation. In this case, a complimentary command control system can be developed using the faster Type 15 Signaling that can operate at the same time as TMCC.

There is a power concern with both Type 14 and Type 15 signaling. During digital transmission, on the average one half of the lobes or cycles will be at half voltage, which reduces the power available to the motor drive, which may slow the locomotive down. This is not much of a problem for conventional analog operation of AC trains since the analog commands are short. At high locomotive speeds, the natural momentum of the train should maintain speed during these brief command transmissions. At low speeds, the throttle voltage is quite low and the digital transmission is at full AC accessory power. This might cause a speed up of the train but not a slow down. If the locomotive has speed control, there would be plenty of available power to maintain speed at these low throttle settings.

However, under command control, where full track voltage is maintained at all times, continuous digital transmission of data could reduce the average track voltage by 25% to 50%. This would not be tolerable for command control since it would lower the top speed of locomotives considerably. This could be ameliorated by increasing the peak track voltage but this puts a strain on the remote object's electronic power supply design and will likely increase its manufacturing cost.

Figure 96:
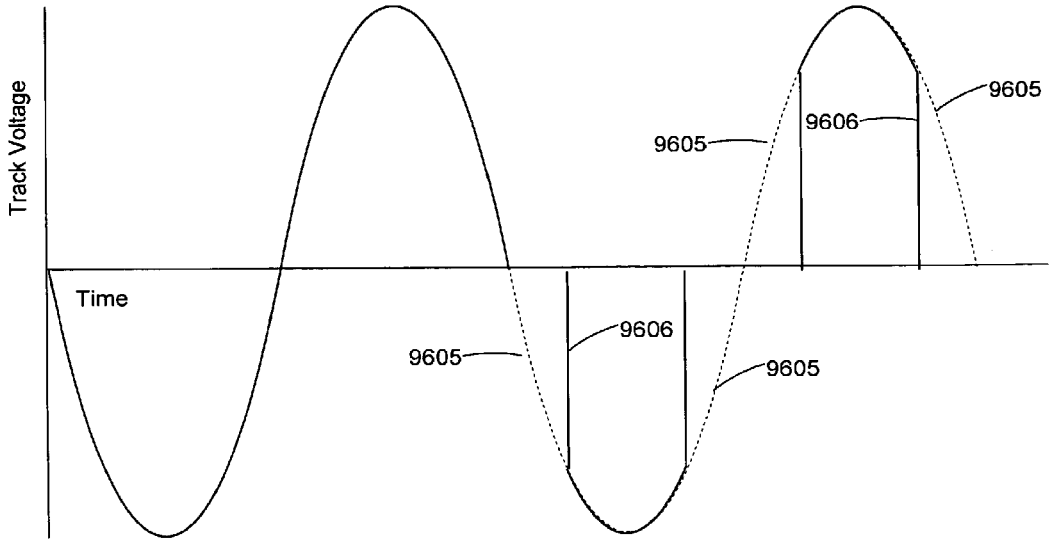
FIG. 96 A Twice-Phase Modulated waveform as a way to transmit data on sine waves at the same peak voltage as the normal throttle without loosing significant motor power during data transmission.
Figure 97:
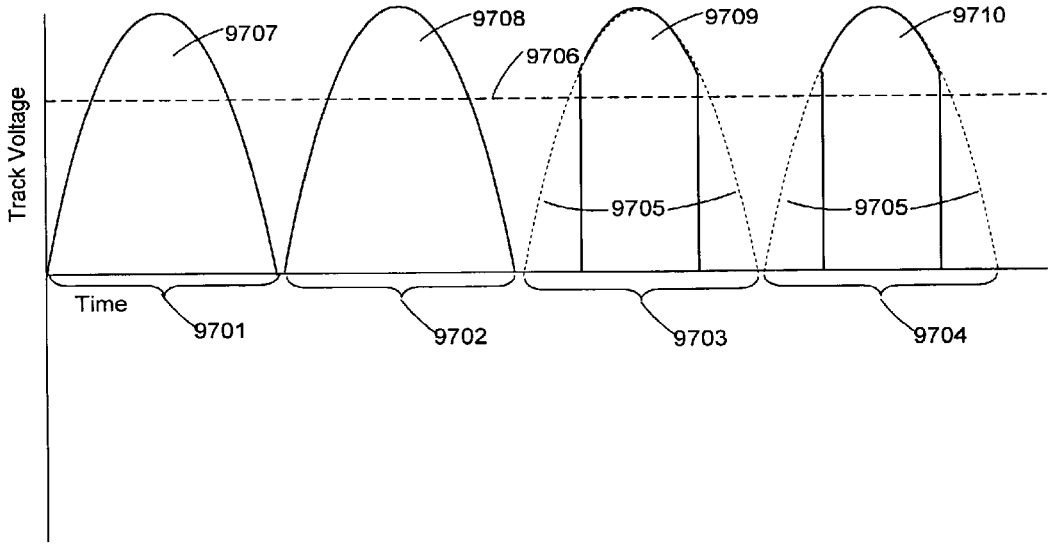
FIG. 97 Full sine wave throttle voltage followed by a Twice-Phase Modulated (TPM) waveform after passing through a full wave rectifier bridge and applied to the motor to show how very little power is lost from the TPM waveform on a rotating motor compared to the power from the non-modulated throttle voltage.

An alternative method is shown in FIG. 96. In this waveform we see two cycles of AC power where the second one has been phase modulated at both the start and the end turning on at 45° and off 135° for each of the last two lobes (we call this a Twice-Phase Modulated waveform). The dark lines, 9606, represent the phase modulated applied voltage and dotted lines, 9605, represent the waveform from the fixed AC voltage accessory output. The advantage of Twice-Phase Modulated (TPM) waveforms is shown in FIG. 97, which shows the raw DC waveform that would typically be produced at the on-board motor power supply, such as VDC for the motor control supply shown in FIG. 65. Again the actual voltage is represented by the dark line waveform while the dotted lines represent what would be available if the fixed AC accessory voltage were not phase modulated. The horizontal dotted line represents a typical back EMF of a rotating motor in a locomotive that is moving at high speed. The amount of torque delivered to such a motor is proportional to its armature current, which is the applied voltage less the back EMF divided by the armature resistance. The voltage difference term is represented by the area above the back EMF horizontal line and enclosed by the top portion of each applied voltage waveform lobes, 9707, 9708, 9709, 9710. Although much of the TPM waveforms for the last two lobes, 9703 and 9704, have been reduced to zero for phase angles from 0° to 45° and from phase angles from 135° to 180°, this does not appreciably affect the actual current delivered to the motor. In other words, the areas, 9707 and 9708, above the back EMF line for lobes, 9701 and 9702, are nearly equal to the areas, 9709 and 9710, above the back EMF line for lobes 9703 and 9704. This means that the top speed of these locomotives is reduced very little by phase modulating the power waveform in this manner. The only reduction in motor current occurs during startup where the eliminated lower portions of the TPM waveforms will have an effect. Even so, with the phase angles used in this example, the reduction in start up motor current is only 35%. Since most model locomotives are overpowered and accelerate much too fast for realistic operation, any reasonable inertia setting will provide the same behavior with full sine waves or the phase modulated waves shown in this example. Although TPM lobes are applicable for conventional analog operation, its main advantage is command control where digital data is continually being transmitted.

Figure 98:
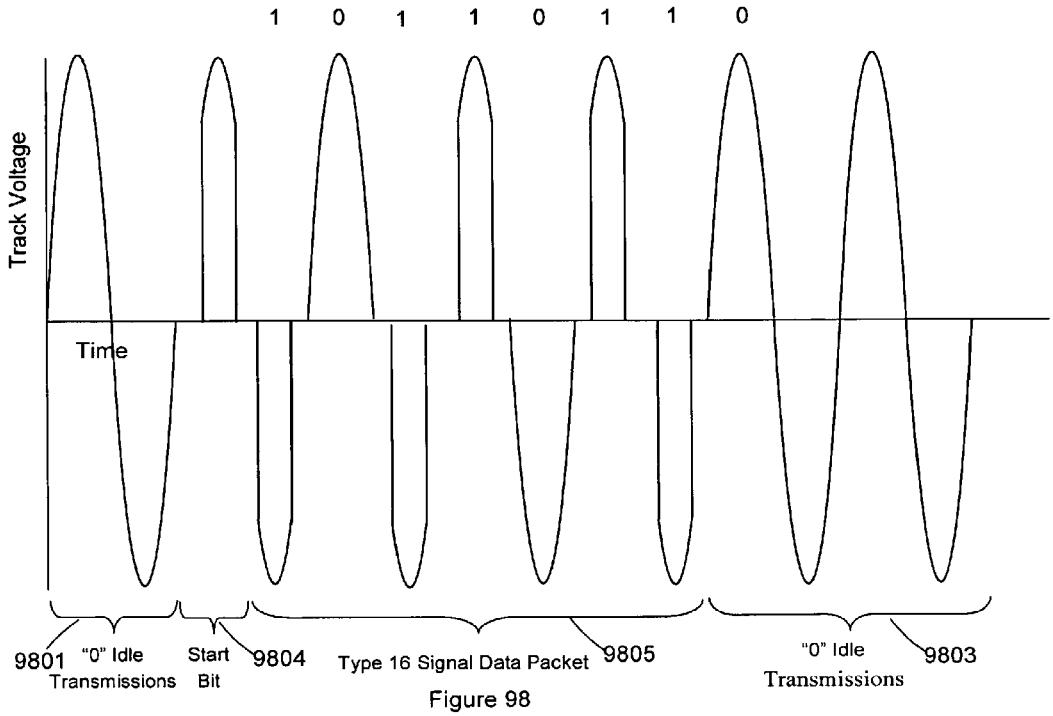
FIG. 98 Full sine wave throttle voltage interleaved by a Twice-Phase Modulated (TPM) waveform showing how TPM waveforms can be used to transmit data bits on each lobe. This is called Type 16 Signaling.

Type 16 Signaling: In command control, there is no need to switch between normal track power and AC remote control signaling. The relay, 10104, in FIG. 101 can remain in the fixed AC accessory voltage output connection and pass device, 10115, can be used for phase modulation of this voltage for digital transmission. The waveform in FIG. 98 is an example of transmitting digital information in such a command control environment using TPM waveforms. In this case, we use either a positive or negative lobes to transmit one bit each. We have arbitrarily assigned a logic "1" to TPM lobes and a logic "0" to full lobes. The normal track voltage when no command data is being transmitted is a series of "0" or full sine waves called "Idle Transmission", 9801. In this example, we use a start "1" bit, 9804, to indicate that a command is being sent followed by Type 16 signaling, 9805. In this case, we are transmitting the digital word, (1, 0, 1, 1, 0, 1, 1, 0). At the end of the command, we continue with Idle Transmission, 9803.

Figure 99:
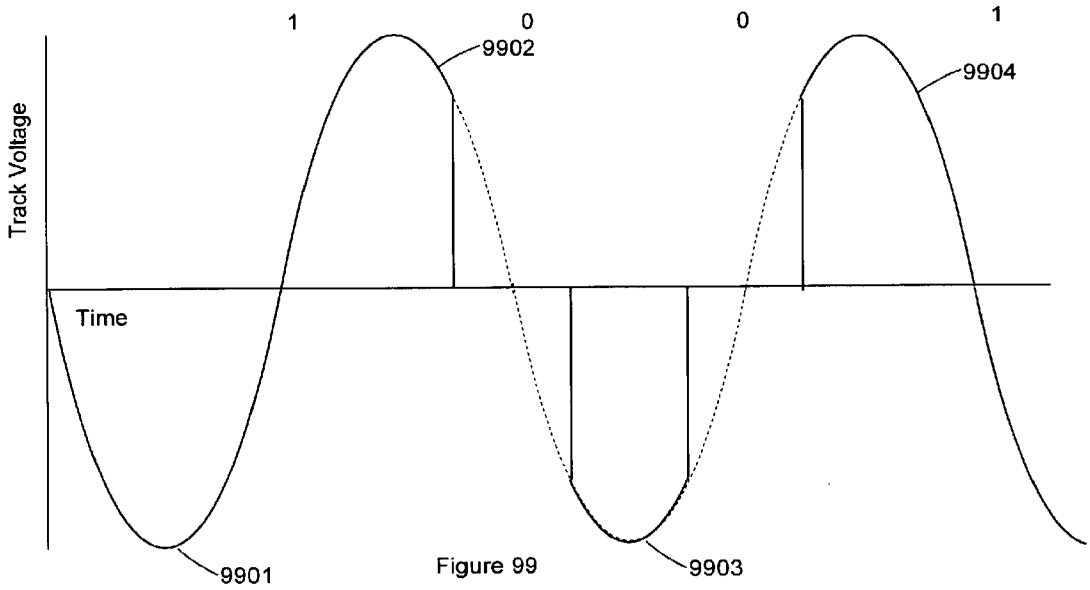
FIG. 99 Shows four different ways to phase modulate an AC lobe and illustrating how the off-time between lobes is readily detectable and an improvement over detecting the average voltage in each lobe.

Type 17 Signaling: While we have improved available power under command control using TPM lobes, we may have degraded waveform detection over using half phase modulated waves such as those shown in FIG. 92. If detection was simply the average voltage, the voltage measurement for a half phase shifted waveform is ½ a full lobe but the voltage of TPM lobe is only reduced by about ⅓. However, the amount of time that a half-phase modulated lobe or a TMP lobe is off (zero voltage) is the same at 50%. If we detected off-time rather than average voltage, we have the same detection reliability for both types of signals. However, instead of applying this concept to each lobe, it would be better to apply it to the off-time between two lobes. This is illustrated in FIG. 99. Here we have four different kinds of lobes, where any lobe can be phase modulated to turn on at 45°, or turn off 135°, or both turned on at 45° and off at 135°, or not phase modulated at all. We will call these four different lobes, Enable Phase Modulated (EPM), 9904, Disable Phase Modulated (DPM), 9902, Twice Phase Modulated (TPM), 9903, and Non-Phase Modulated (NPM), 9901.

Figure 100:
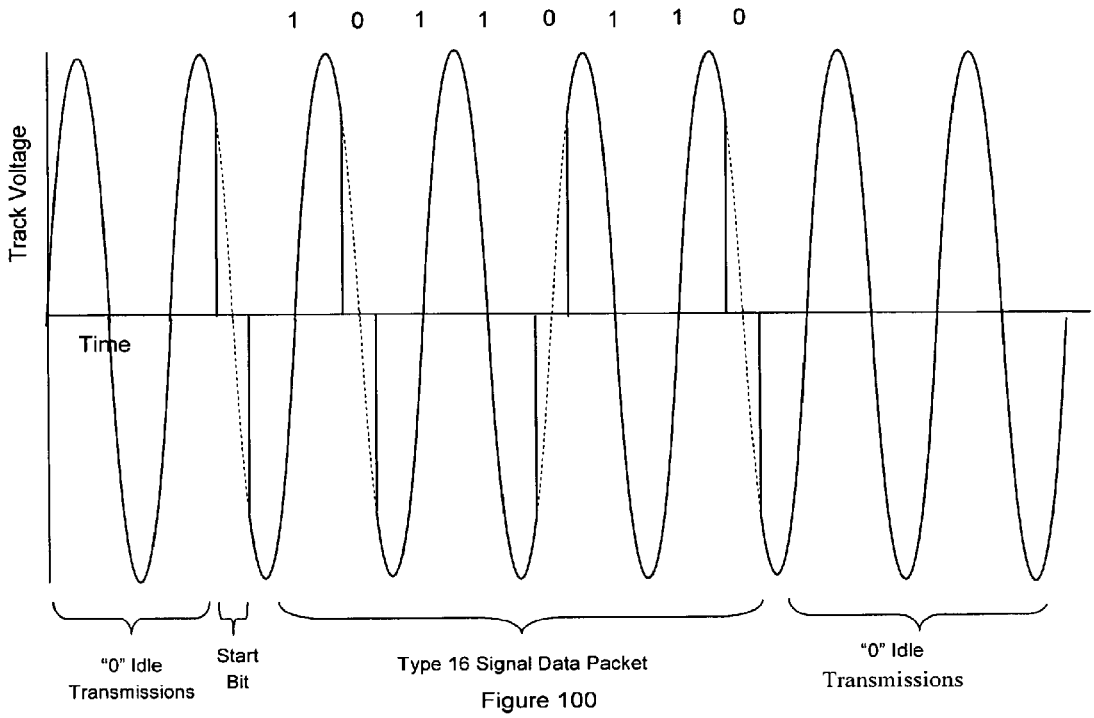
FIG. 100 Shows these four different phase modulated lobes of Type 17 Signaling used to transmit digital data on an AC waveform where the data is determined by the off-time between lobes.

These four types of lobes are shown in waveform diagram in FIG. 100. Here a digital zero is a long duration of no voltage during a zero crossing and a digital one is made up of a very short or non-existent period during a zero crossing. For the phase angles described above for TPM lobes, 60 hertz waveforms would produce a zero crossing time of 4.17 m-seconds for a logic "0" which should be easily detected compared to the zero or near zero value of a logic 2. This is called Type 17 signaling and can be used with either AC or DC powered trains and command control.

Type 18 Signaling: Since there four distinct lobe types, and if it were possible to detect each type, then each lobe could represent two bits such as indicated in the table below:

| Type of Lobe | Bit Value |
|---|---|
| NPM | 00 |
| EPM | 01 |
| DPM | 10 |
| TPM | 11 |

Figure 103:
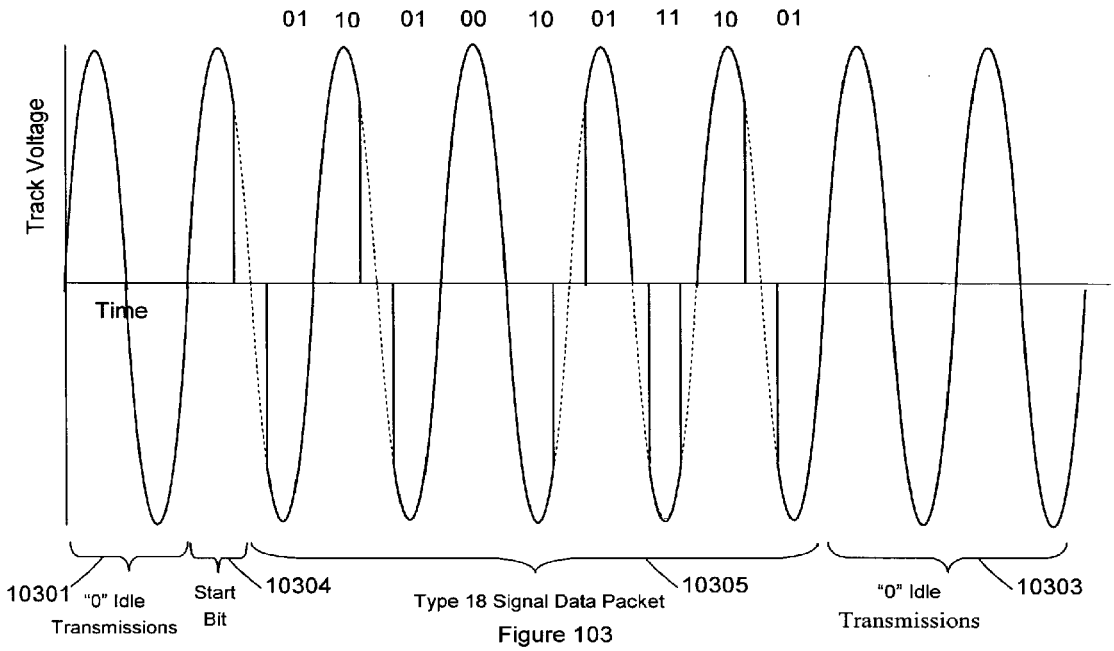
FIG. 103 Shows how detection of the four different phase modulated lobes of Type 17 Signaling can be used to double the data rate. This is called Type 18 Signaling.

An example of this type of transmission is shown in FIG. 103. In FIG. 103, normal "0" idle bits, 10301, are followed by start bit, 10304, represented by a DPM lobe, followed by a digital word, 10305, where each lobe represents two bits as shown above, followed by a return to "0" idle bits, 10303.

This has a data rate of 200/220 bits per second for 50/60 hertz sine waves.

Figure 104:
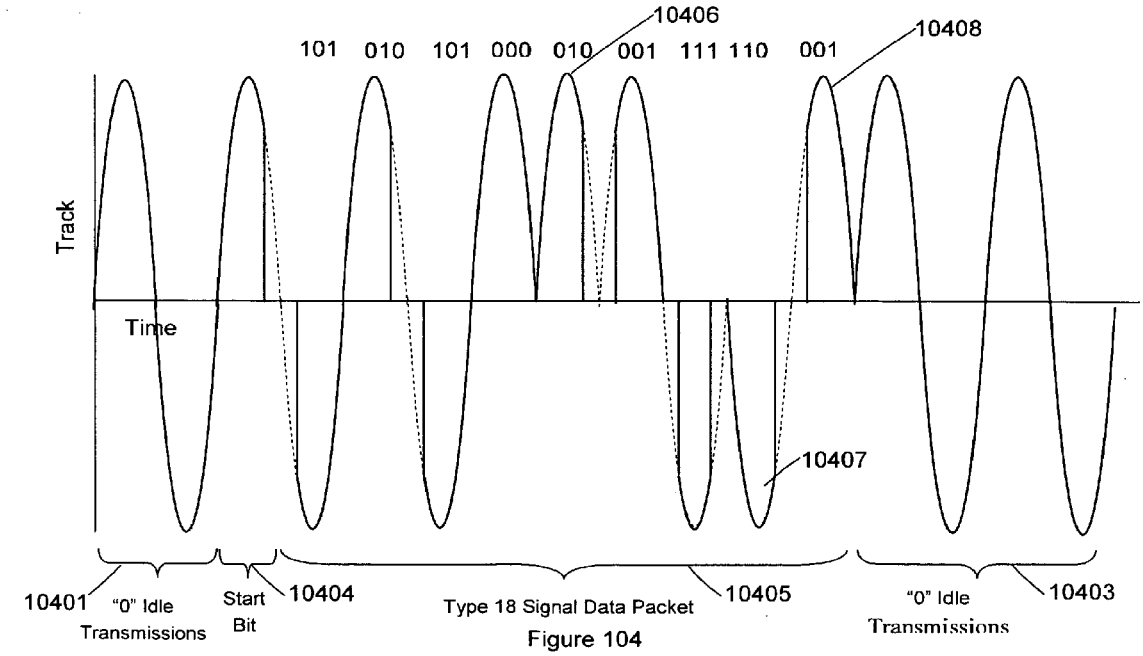
FIG. 104 Shows how combining Type 18 Signaling with Lobing technology can increase data rate by having each lobe represent a three bit word.

Type 19 Signaling; We can combine Type 18 signaling with lobing technology described in U.S. Pat. No. 5,773,939 to double the data rate. Each of the four types of lobes and their polarity can specify three bits each according to the example assignments in the table below:

| Type of Lobe | Bit Value |
|---|---|
| +NPM | 000 |
| +EPM | 001 |
| +DPM | 010 |
| +TPM | 011 |
| −NPM | 100 |
| −EPM | 101 |
| −DPM | 110 |
| −TPM | 111 |

Where a "+" indicates a positive lobe and a "−" indicates a negative lobe. In FIG. 104, normal "0" idle bits, 10401, are followed by start bit, 10404, represented by a +DPM lobe, followed by a digital word, 10405, where each lobe represents three bits as shown above, followed by a return to "0" idle bits, 10403. Lobes, 10406, 10407 and 10408, have been flipped from their normal AC polarities. This method has a data rate of 400/440 bits per second for 50/60 hertz AC waveforms.

Figure 102:
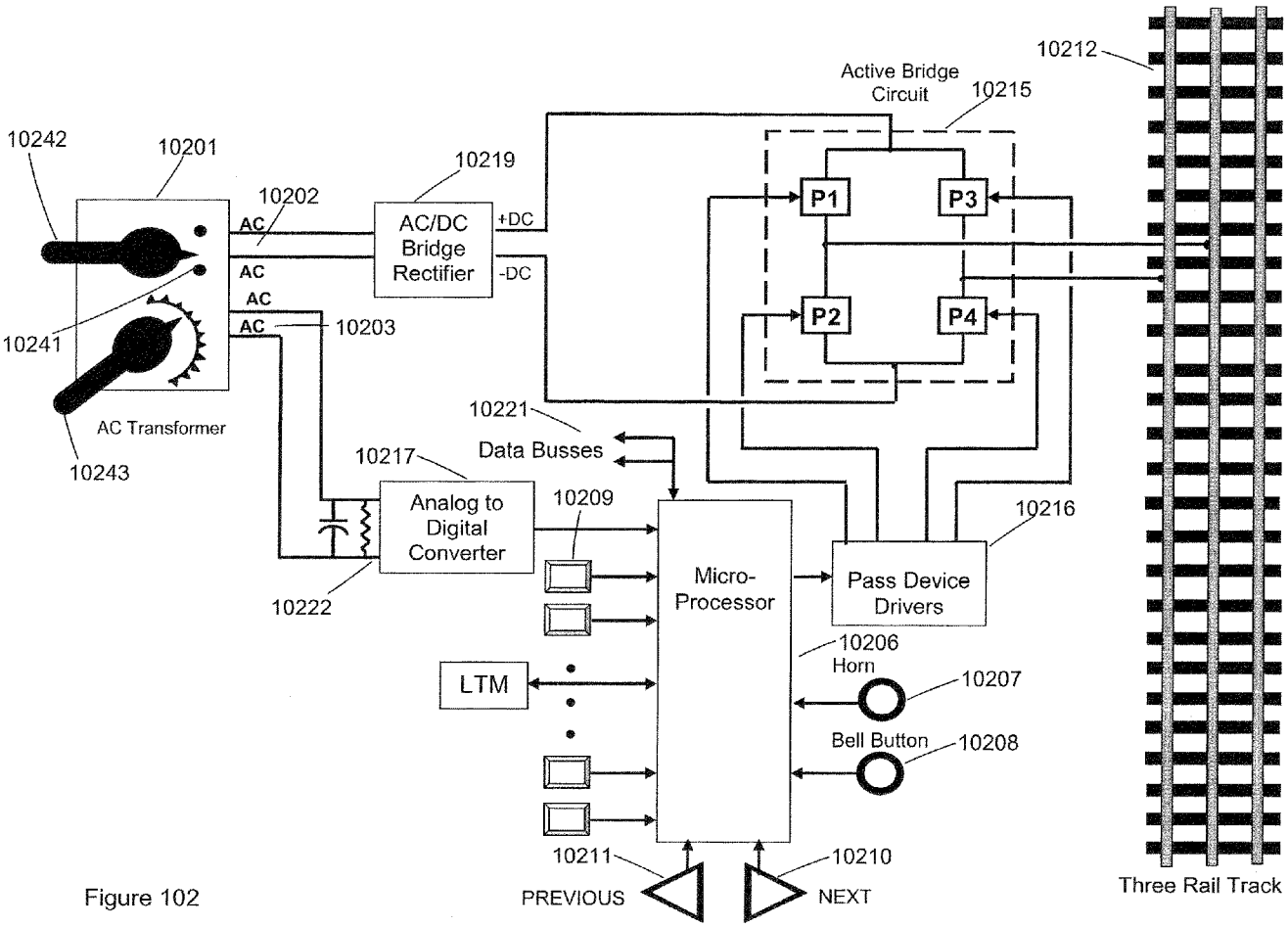
FIG. 102 An MBA design that can also flip AC lobes to improve data transmission rate and can be used with all described methods of AC and DC transmission.

The MBA shown in FIG. 102 provides all the advantages of the MBA described for FIG. 87 but is designed to flip lobes of pure sine waves supplied by the bridge rectifier, 10219, to the active bridge circuit 10215. This circuit is capable of generating all types of signaling described above including Type 16, 17, 18, and 19 signaling.

Figure 101:
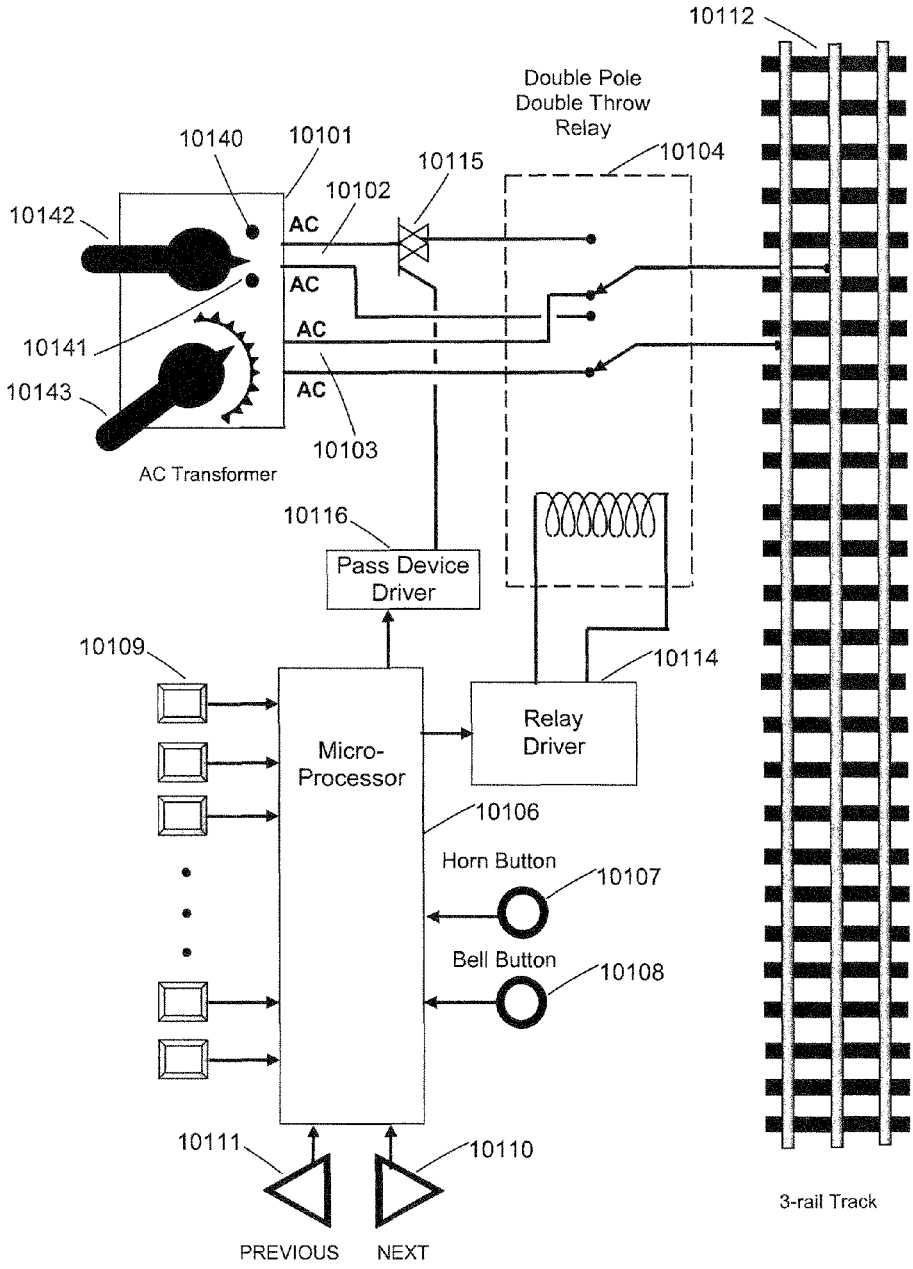
FIG. 101 An MBA design configured for use with AC transformers for track power using an in-line pass device to control the AC accessory power.

Another type of signaling that can be generated with an MBA like the one shown in FIG. 101 or FIG. 102 is to send out DC remote control signals. In FIG. 101, if the relay is connected to the output for the fixed AC accessory voltage, 10102, then pass device, 10115, can be used to provide phase modulated half-wave rectified DC from zero volts to about one-half the fixed AC voltage. In FIG. 102, active bridge, 10215, can provide any amount of DC from zero to full-wave rectified voltage equal to the fixed AC voltage. This DC signal can be used to operate horns and bells on standard Lionel-like locomotives. Since this DC voltage using the MBA in FIG. 101, cannot supply full voltage, locomotives may slow down when DC remote control signals are sent. However, the MBA in FIG. 102 can send out full DC equal to the applied throttle voltage, which can operate these locomotive's horns and bells without slowdown.

In addition, DC can be used to generate digital code by interleaving the AC throttle voltage with DC signals using any of the signal types described for DC powered trains where AC and DC are used together, such as those described in FIGS. 72, 73, 75, 83, 86, and 88. The main difference is that the starting track voltage, such as 7310, in FIG. 73 will be the AC track voltage instead of DC and the first bit or start bit will be DC rather than AC. However, the basic methods of alternating AC signals with DC signals would remain the primary method of digital encoding. Also phase modulation could be used to ensure that when DC was applied, it had a voltage appropriate to maintain locomotive speed.

The DC remote control signal can also be used to generate digital code using any of the polarity reversal techniques such as Type 1, Type 2, Improved Type 2, or Type 3, described for FIGS. 4, 9, 10,11 and 12 as well as any bi-directional techniques described for FIGS. 20, 21, 22, 33, and 34. Again, the main difference with AC powered trains is that the starting track voltage will be the AC track voltage instead of DC.

The terms and descriptions used herein are set forth by way of illustration only and are not meant as limitations. Those skilled in the art will recognize that many variations can be made to the details of the above-described embodiments without departing from the underlying principles of the invention. The scope of the invention should therefore be determined only by the following claims (and their equivalents) in which all terms are to be understood in their broadest reasonable sense. Note that elements recited in means-plus-function format are intended to be construed in accordance with 35 U.S.C. §112 ¶ 6.

The methods disclosed herein comprise one or more steps or actions for performing the described method. The method steps and/or actions may be interchanged with one another. In other words, unless a specific order of steps or actions is required for proper operation of the embodiment, the order, and/or use of specific steps, and/or actions may be modified without departing from the scope of the disclosure as claimed.

The embodiments disclosed may include various steps, which may be embodied in machine-executable instructions to be executed by a general-purpose or special-purpose computer (or other electronic device). Alternatively, the steps may be performed by hardware components that contain specific logic for performing the steps, or by any combination of hardware, software, and/or firmware.

Embodiments of the present disclosure may also be provided as a computer program product including a machine-readable medium having stored thereon instructions that may be used to program a computer (or other electronic device) to perform processes described herein. The machine-readable medium may include, but is not limited to, floppy diskettes, optical disks, CD-ROMs, DVD-ROMs, ROMs, RAMs, EPROMs, EEPROMs, magnetic or optical cards, propagation media or other type of media/machine-readable medium suitable for storing electronic instructions. For example, instructions for performing described processes may be transferred from a remote computer (e.g., a sever) to a requesting computer (e.g., a client) by way of data signals embodied in a carrier wave or other propagation medium via a communication link (e.g., wireless or wired network connections).

The invention claimed is:

1. A method for transmitting a digital command word to a remote object on a track in a model railroad layout, the method comprising:

coupling an AC power signal to the track for driving a motor disposed in the remote object;

temporarily de-coupling the AC power signal from the track;

temporarily coupling a fixed amplitude AC accessory voltage signal to the track;

encoding the digital command word by altering the AC accessory voltage signal, so that the encoded digital command word can be decoded by a remote object coupled to the track;

wherein altering the AC accessory voltage signal comprises altering at least a selected lobe of a cycle of the AC accessory voltage signal, by cutting the selected lobe at a selected phase angle, to encode a bit of the digital command word.

2. A method according to claim 1 wherein altering the AC accessory voltage signal comprises cutting a selected lobe of a cycle of the AC power signal at 90 degrees and at 270 degrees phase angles to produce symmetrical waveforms.

3. A method according to claim 1 wherein altering the AC accessory voltage signal includes cutting both a positive lobe and a contiguous negative lobe for encoding one bit of the digital command, so that the altered AC accessory voltage signal remains symmetric, thereby avoiding imposing a DC offset on the AC accessory voltage signal.

4. A method according to claim 1 wherein altering the AC accessory voltage signal includes forming a twice cut-waveform.

5. A method according to claim 1 and further comprising:

after transmitting the digital command word, de-coupling the AC accessory voltage signal from the track; and coupling the AC power signal to the track to restore normal track power.

6. The method according to claim 1 wherein the AC accessory voltage signal has an amplitude greater than the AC power signal so as to improve detection of the digital command word while maintaining power delivered to a motor in the remote object.

7. The method according to claim 1 wherein the AC accessory voltage signal has a nominal amplitude approximately equal to twice the AC power signal (throttle) voltage.

8. The method according to claim 1 and further comprising inserting a start indicator at the beginning of the transmitted digital command word.

9. The method according to claim 8 wherein the start indicator comprises a predetermined start bit.

10. The method according to claim 1 and wherein said altering the AC accessory voltage signal is implemented using a semiconductor pass device that can turn on or interrupt the AC accessory voltage signal at a selected phase angle.

11. The method according to claim 1 and wherein said altering the AC accessory voltage signal is implemented using an active bridge circuit that can be used to invert the polarity of the selected lobe.

* * * * *